US011395555B2

(12) United States Patent
Mullet et al.

(10) Patent No.: US 11,395,555 B2
(45) Date of Patent: Jul. 26, 2022

(54) VALANCE SYSTEM FOR WINDOW COVERINGS

(71) Applicant: CURRENT PRODUCTS CORP, Pensacola, FL (US)

(72) Inventors: Willis Jay Mullet, Gulf Breeze, FL (US); Daniel T. Matthews, Pensacola, FL (US); Richard Scott Hand, Pace, FL (US); Harry Edward Asbury, Holt, FL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 740 days.

(21) Appl. No.: 16/251,987

(22) Filed: Jan. 18, 2019

(65) Prior Publication Data

US 2019/0150650 A1 May 23, 2019

Related U.S. Application Data

(63) Continuation-in-part of application No. 15/413,973, filed on Jan. 24, 2017, now Pat. No. 10,694,880.

(60) Provisional application No. 62/286,689, filed on Jan. 25, 2016.

(51) Int. Cl.
*A47H 2/00* (2006.01)
*A47H 3/02* (2006.01)

(52) U.S. Cl.
CPC ..... *A47H 2/00* (2013.01); *A47H 3/02* (2013.01)

(58) Field of Classification Search
CPC ... A47H 2/00; A47H 3/02; A47H 1/04; A47H 1/144; A47H 1/14; A47H 2001/047; E06B 9/17; E06B 9/17007; E06B 9/17015; E06B 9/17023; E06B 9/323
See application file for complete search history.

(56) References Cited

U.S. PATENT DOCUMENTS 239,049 A * 3/1881 Jones ..... E06B 7/20 49/303
1,199,673 A * 9/1916 Donovan ..... E06B 9/54 160/21
1,818,776 A * 8/1931 Wintrob ..... A47H 5/032 160/19
1,897,029 A * 2/1933 Bell ..... E04F 10/0637 160/70

(Continued)

FOREIGN PATENT DOCUMENTS

CA 3004437 A1 * 11/2018 ..... E06B 9/323
DE 102013101588 A1 * 8/2014 ..... A47H 1/104

*Primary Examiner* — Johnnie A. Shablack
(74) *Attorney, Agent, or Firm* — Christopher A. Proskey; BrownWinick Law Firm

(57) ABSTRACT

A valance system for a window covering that can be folded and placed within the same shipping box as a wall bracket, top bracket and track sections. The valance extends a length between opposing ends and includes a clip feature that extends out from its rearward side. The clip feature is generally C-shaped or U-shaped when viewed from the side and includes a plurality of friction members in its exterior surface. The valance is covered with a covering material. An end cap having a hinge area that facilitates bending of the end cap is connected to the ends of the valance by connection of a tongue of the end cap to a slot of the valance. The clip feature is sized and shaped to frictionally fit within and be installed within a socket of a top bracket without any tools.

20 Claims, 101 Drawing Sheets

(56) References Cited

U.S. PATENT DOCUMENTS 2,254,019 A * 8/1941 Powell ..... A47H 1/124 248/227.4
2,277,240 A * 3/1942 Lowry ..... E04F 10/0685 160/38
2,329,546 A * 9/1943 Lee ..... A47H 2/00 160/19
2,531,822 A * 11/1950 Moeller ..... A47H 2/00 160/335
2,594,656 A * 4/1952 Junkunc ..... A47H 1/142 160/38
2,637,380 A * 5/1953 Hyde ..... A47H 2/00 160/38
2,653,656 A * 9/1953 Kuebler ..... A47H 2/00 160/19
2,689,704 A * 9/1954 Rosenbaum ..... E06B 9/323 248/262
2,862,549 A * 12/1958 Robbins ..... A47H 2/00 160/38
3,574,887 A * 4/1971 Schindlauer ..... A47H 2/00 16/95 D
3,927,437 A * 12/1975 Ford ..... A47H 1/144 16/94 R
4,003,162 A * 1/1977 Britt ..... E06B 1/70 49/468
4,079,770 A * 3/1978 Woodie ..... A47H 2/02 160/19
4,254,814 A * 3/1981 Vecchiarelli ..... E06B 9/323 160/19
4,282,919 A * 8/1981 Teno ..... E06B 9/17015 160/23.1
4,399,856 A * 8/1983 Anderson ..... A47H 1/104 160/39
4,590,642 A * 5/1986 Hesener ..... E04F 10/0674 16/241
4,824,062 A * 4/1989 Wagner ..... A47H 1/122 16/94 R
4,865,105 A * 9/1989 Peters ..... A47H 2/00 160/38
5,012,850 A * 5/1991 Schrader ..... A47H 2/00 160/178.1 R
5,042,548 A * 8/1991 Attal ..... E06B 9/00 160/38
5,054,535 A * 10/1991 Rozon ..... E06B 9/36 160/38
5,112,157 A * 5/1992 Haarer ..... A47H 1/02 211/105.1
5,219,013 A * 6/1993 Rozon ..... A47H 15/02 160/38
5,232,039 A * 8/1993 Shapiro ..... A47H 2/00 160/330
5,515,901 A * 5/1996 Hall ..... E05D 15/264 160/206
5,636,674 A * 6/1997 Benthin ..... A47H 2/00 160/38
5,890,527 A * 4/1999 Smiley ..... A47H 2/02 160/39
5,944,084 A * 8/1999 Cadorette ..... A47H 2/00 160/38
5,967,213 A * 10/1999 Smiley ..... A47H 2/02 160/378
6,111,694 A * 8/2000 Shopp ..... G03B 21/58 160/23.1
6,659,154 B2 * 12/2003 Bergeron ..... A47H 2/00 160/178.1 V
6,672,359 B2 * 1/2004 Morris ..... A47H 2/00 160/19
7,730,923 B2 * 6/2010 Zhang ..... E06B 9/323 160/38
10,694,880 B2 * 6/2020 Mullet ..... A47H 1/144
2002/0014315 A1 * 2/2002 Toffey ..... E04F 10/0618 160/45
2003/0010174 A1 * 1/2003 Biro ..... A47H 2/00 83/581
2003/0029822 A1 * 2/2003 Fitzsimmons ..... A47H 1/144 211/105.1
2013/0098561 A1 * 4/2013 Mullet ..... E06B 9/42 160/29
2015/0247362 A1 * 9/2015 Kirby ..... E06B 9/42 160/310
2018/0283093 A1 * 10/2018 Tseng ..... E06B 9/323
2021/0047884 A1 * 2/2021 Kirby ..... E06B 9/322

* cited by examiner

152

BACK

400

BOTTOM

SIDE

VALANCE SYSTEM FOR WINDOW COVERINGS

CROSS-REFERENCE TO RELATED APPLICATION

This application is a continuation-in-part to and claims priority to United States Patent and Trademark Office Utility patent application Ser. No. 15/413,973 filed on Jan. 24, 2017 and published as U.S. Pat. Pub. No. 2017/0208980 which itself claims priority from United States Patent and Trademark Office Provisional Application No. 62/286,689 filed Jan. 25, 2016.

FIELD OF THE INVENTION

This invention relates to window coverings. More specifically, this invention relates to a valance system for window coverings.

BACKGROUND OF THE INVENTION

Window coverings are frequently used to provide privacy and to limit the amount of light that is permitted to pass through a window and into a room. There are numerous types of window coverings known in the art. One form of window coverings, which are of particular interest to this application, are known as drapes (or drapery), curtains, vertical blinds, drapery tracks, or the like which hang from a track system or other structure positioned above a window. For purposes of simplicity, these window covering systems will be referred to draperies, drapery systems, or window coverings; however no limitation is to be implied and instead the teachings herein are applicable to any form of a window covering.

One problem with drapery systems is that the track system and bracketry that is used to hang and operate the shade material tends to have an unappealing appearance. As such, in many applications, users cover or hide the drapery track and bracketry behind a fascia or valance.

However, due to there being countless forms and designs of drapery systems, there is no standard or convenient method of installing a valance. As such, in many cases, users tend to custom fabricate their own fascia or valance out of plywood or other readily available materials. While effective, this process is extremely time consuming, labor intensive and many times it leads to a finished product that is less than optimal. In addition, custom fabricating a valance often produces a finished product that uses more materials than is necessary, is heavier than is necessary, is more complicated and difficult to install than is necessary, and can provide a substantial safety hazard if installed improperly. In addition, removing and replacing these custom fabricated valances tends to suffer from the same disadvantages.

Another problem related to current valance systems is that they often are misaligned and they are substantially impacted by the way in which they are installed. In addition, current valance systems are not able to be adjusted to correct any misalignment causing the resulting installation to be less than desirable.

For the reasons stated above, and for other reasons stated below which will become apparent to those skilled in the art upon reading and understanding the specification, there is a need in the art for an improved valance system for window coverings.

Thus, it is a primary object of the invention to provide a valance system for window coverings that improves upon the state of the art.

Another object of the invention is to provide an improved valance system for window coverings that has a pleasing aesthetic appearance.

Yet another object of the invention is to provide an improved valance system for window coverings that is easy to install.

Another object of the invention is to provide an improved valance system for window coverings that is easy to remove.

Yet another object of the invention is to provide an improved valance system for window coverings that is easy to cover.

Another object of the invention is to provide an improved valance system for window coverings that is easy to ship.

Yet another object of the invention is to provide an improved valance system for window coverings that can be folded for shipping.

Another object of the invention is to provide an improved valance system for window coverings that can be shipped in the same shipping box as a broken down track system.

Yet another object of the invention is to provide an improved valance system for window coverings that does not require a shipping box that is longer than a broken down track system.

Another object of the invention is to provide an improved valance system for window coverings that can be installed quickly.

Yet another object of the invention is to provide an improved valance system for window coverings that can be replaced quickly.

Another object of the invention is to provide an improved valance system for window coverings that is easy to cover with material.

Yet another object of the invention is to provide an improved valance system for window coverings that is formed of a minimum number of parts.

Another object of the invention is to provide an improved valance system for window coverings that is relatively inexpensive.

Yet another object of the invention is to provide an improved valance system for window coverings that has a long useful life.

Another object of the invention is to provide an improved valance system for window coverings that is easily customized.

Yet another object of the invention is to provide an improved valance system for window coverings that can be easily cut to size.

Another object of the invention is to provide an improved valance system for window coverings that can be used in most applications.

Yet another object of the invention is to provide an improved valance system for window coverings that is standardized.

Another object of the invention is to provide an improved valance system for window coverings that allows for the customized end caps.

Yet another object of the invention is to provide an improved valance system for window coverings that uses a minimum amount of material.

Another object of the invention is to provide an improved valance system for window coverings that is lightweight.

Yet another object of the invention is to provide an improved valance system for window coverings that is durable.

Another object of the invention is to provide an improved valance system for window coverings that has a long useful life.

Yet another object of the invention is to provide an improved valance system for window coverings that can be easily extended.

Yet another object of the invention is to provide an improved valance system for window coverings that utilizes an end cap that can be configured in a number of ways.

Yet another object of the invention is to provide an improved valance system for window coverings that is adjustable.

Yet another object of the invention is to provide an improved valance system for window coverings that can correct alignment of the valance.

Yet another object of the invention is to provide an improved valance system for window coverings that reduces or eliminates the effect of installation variance on alignment of the valance.

These and other objects, features, or advantages of the invention will become apparent from the specification and claims.

SUMMARY OF THE INVENTION

An adjustable valance system for a window covering that can be folded and placed within the same shipping box as a wall bracket, top bracket and track sections. The valance extends a length between opposing ends and includes a clip feature that extends out from its rearward side. The clip feature is generally C-shaped or U-shaped when viewed from the side and includes a plurality of friction members in its exterior surface. The clip feature is removed in one or more sections to facilitate bending of the valance. The valance is covered with a covering material which is stapled to the valance in staple sections. An end cap having a hinge area that facilitates bending of the end cap is connected to the ends of the valance by connection of a tongue of the end cap to a slot of the valance. The clip feature is sized and shaped to frictionally fit within and be installed within a socket of a top bracket without any tools. This arrangement provides an inexpensive, standardized, quick and easy method of installing a valance on a window covering.

DETAILED DESCRIPTION

Figure 1:
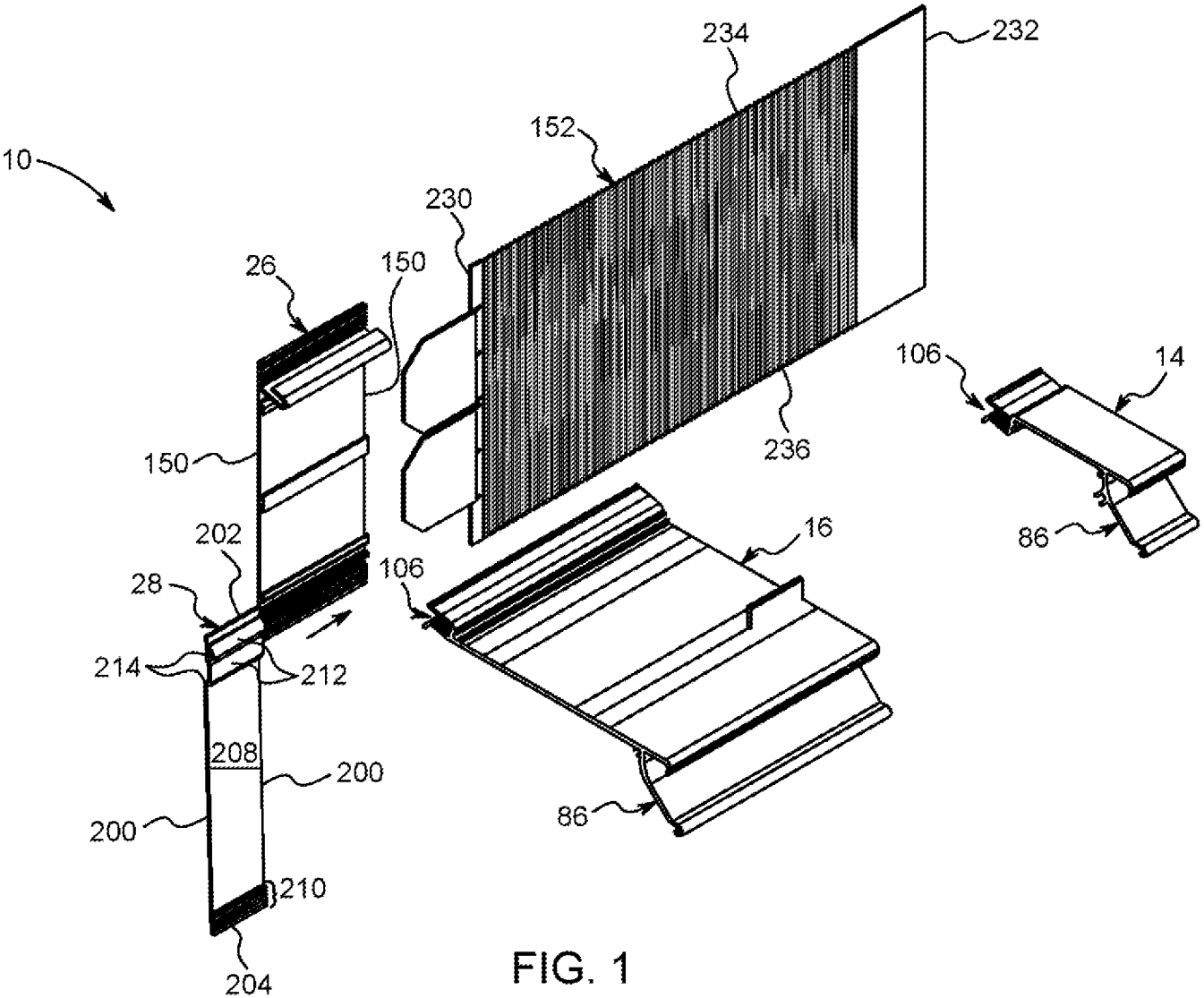
FIG. 1 is an exploded perspective view of a valance system, the view showing a the back side of a valance, a valance extension, and an end cap that is connectable to the valance, the view also showing a single track top bracket and a double track top bracket.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented and/or the orientation of the parts/components with respect to one another. It should be understood, however, that the terms are used only for purposes of description, and are not intended to be used as limitations. Accordingly, orientation of an object or a combination of objects may change without departing from the scope of the invention.

While the figures show the invention used in association with a window covering that is a drapery track system and/or a dual drapery track system, the invention is not so limited. A drapery track system is simply used as an example, and the features or advantages of the arrangement can be applied to any form of a window covering, and for that matter any mechanical and/or electromechanical device or system.

System:

With reference to the figures, a valance system 10 (system 10) is presented. Valance system 10 is formed of any suitable size, shape and design. In the arrangement shown, as one example, valance system 10 includes a wall bracket 12, a single track top bracket 14, a dual track top bracket 16, a first track 18, a second track 20, first shade material 22, second shade material 24, a valance 26, a valance extension 28, among other components, parts and pieces as is shown and/or described herein.

Wall Bracket:

Wall bracket 12 is formed of any suitable size shape and design and serves to connect valance system 10 to a wall or other structure. In one arrangement, as is shown, wall bracket 12 is formed of an extrusion that extends a length between opposing ends 30 and has a generally constant shape along its length.

As one example, wall bracket 12 includes a main body 32 that is generally rectangular in shape. Main body 32 extends horizontally between a generally flat rear wall 34 positioned in approximate parallel spaced alignment to a generally flat front wall 36. Main body 32 extends vertically between a generally flat upper wall 38, that extends in approximate perpendicular alignment to the rear wall 34 and front wall 36, and a lower end 40.

A lower arm 42 is connected to lower end 40 of main body 32 and extends outward and downward from main body 32 at an angle. The downward and outward end of lower arm 42 includes a rounded nose 44 and a lip 46 that terminates in a lower end 48. In the arrangement shown, lip 46 extends downward and rearward at an angle from rounded nose 44.

An upper arm 50 is connected to main body 32. In one arrangement, upper arm 50 connects to forward wall 36 between upper wall 38 and lower end 40 and extends forward a distance in approximate perpendicular alignment to the plane of rear wall 34 and forward wall 36. A flange 52 is connected to the outward end of upper arm 50 and extends upwardly a distance therefrom. Flange 52 extends upward in approximate perpendicular alignment to the upper arm 50.

The upper end of flange 52 includes a first rounded nose 54 and a second rounded nose 56. First rounded nose 54 and second rounded nose 56 are positioned in approximate horizontal opposing alignment to one another with first rounded nose 54 pointing rearward toward main body 32 and second rounded nose 56 pointing forward away from main body 32. An upper wall 58 connects the upper end of first rounded nose 54 and second rounded nose 56. Upper wall 58 has a generally flat and planar surface that extends in approximate perpendicular alignment to the rear wall 34 and forward wall 36 of main body 32. In the arrangement shown, while first rounded nose 54 is generally configured to be solid, the second rounded nose 56 includes a hollow interior 60 that is generally cylindrical or partially cylindrical in shape. This hollow interior 58 serves as a screw boss or opening that threadably receives a fastener such as a screw or bolt.

Main body 32 also includes a plurality of openings 62 therein that allow for the passage of fasteners there through that facilitates connection of the wall bracket 12 to a wall or structure.

Top Bracket:

Top brackets 14, 16 are formed of any suitable size shape and design and serve to connect to wall bracket 12 and support one or more tracks 18, 20. In one arrangement, as is shown, there are two top brackets 14, 16 presented. Single track top bracket 14 is configured to support a first track 18, and a dual track top bracket 16 is configured to support a first track 18 and a second track 20. In the arrangement shown, the single track top bracket 14 and the dual track top bracket 16 are generally similar with one difference being that the upper wall 70 of the dual track top bracket 16 being longer in length than the upper wall 70 of the single track top bracket 14. As such, other than the configuration of the upper wall 70, reference will be made to the components of the top brackets 14, 16 simultaneously.

As one example, top brackets 14, 16 include an upper wall 70 that is generally rectangular in shape and extends vertically between an upper surface 72 that is generally planar in shape and a lower surface 74 that is also generally planar in shape, with the upper surface 72 and the lower surface 74 positioned in approximate perpendicular alignment to one another. Upper wall 70 extends a distance between rearward end 76 and forward end 78.

Rearward end 76 of upper wall 70 includes a hook feature 80 that extends downward from upper wall 70 in curved fashion and includes a socket 82 that has a curved surface that is sized and shaped to matingly engage and receive the rearward facing first rounded nose 54 of wall bracket 12 when top bracket 14, 16 is hung on wall bracket 12. A flat surface 84 is positioned forward of hook feature 80 that is configured to flushly engage the flat upper wall 58 of wall bracket 12 when top bracket 14, 16 is hung on wall bracket 12.

A support arm 86 is positioned forward a distance from rearward end 76, hook feature 80 and flat surface 84. Support arm 86 includes a first section 88 that extends downward from the lower surface 74 of upper wall 70 a distance in approximately perpendicular alignment. Support arm 86 includes a second section 90 that connects to first section 88 at corner section 92. Second section 90 angles rearward as it extends downward. Second section 90 terminates at a lower end 94. Lower end 94 terminates in a rounded nose 96 that faces rearward and includes a hollow interior 98 that is generally cylindrical or partially cylindrical in shape. This hollow interior 98 serves as a screw boss or opening that is sized and shaped to threadably receive a fastener such as a screw or bolt, as is further described herein.

Top bracket 14, 16 also includes a screw boss 100 positioned at the intersection of support arm 86 and upper wall 70. In the arrangement shown, screw boss 100 is positioned on the forward side of support arm 86 and includes a pair of lips 102 that define a hollow interior 104 that is sized and shaped to threadably receive a fastener such as a screw or bolt, as is further described herein.

The forward end 78 of upper wall 70 includes a socket 106. Socket 106 is formed of any suitable size, shape and design and is configured to receive and hold a clip feature 108 of valance 26. In one arrangement, as is shown, socket 106 is formed a lower wall 110 and an upper wall 112 that are connected to one another by a center wall 114 and form a hollow receiving space 116 there between. Lower wall 110 and upper wall 112 extend in approximate parallel spaced alignment to one another, with center wall 114 connecting to the rearward ends of lower wall 110 and upper wall 112 in approximate perpendicular alignment thereto. In this way, the connection of lower wall 110, upper wall 112 and center wall 114 form a generally rectangular or C-shaped receiving space 116.

While lower wall 110 and upper wall 112 extend in an approximate flat and planar manner, when viewed from the side, the planes of lower wall 110 and upper wall 112 are positioned at an angle, and not in planar alignment, to the plane formed by upper wall 70 of top bracket 14, 16. That is, the receiving space 116 angles slightly downward as it extends rearward. Or, said another way, the open end of receiving space 116 faces slightly upward. This slight downward angle helps to hold clip feature 108 within receiving space 116 and prevent unintentional dislodgement.

In the arrangement shown, the upper surface of lower wall 110 includes one or more friction members 118 that serve to impart friction onto clip feature 108 when it is within receiving space 116 thereby helping to hold clip feature 108 within receiving space 116. In the arrangement shown, friction members 118 are a plurality of protrusions or bumps, however any other form of a friction imparting device is hereby contemplated for use such as adhesive, glue, sand paper, tack, or the like.

In the arrangement shown, the forward end of lower wall 110 includes a flange 120 that extends slightly outward as it extends downward. Flange 120 provides increased surface area to the end of lower wall 110 which provides support to the inward surface of valance 26 below clip feature 108 as well as provides a larger positive stop for full insertion of valance 26.

Top bracket 14, 16 also includes a screw boss 122 positioned at the intersection of upper wall 70 and socket 106. In the arrangement shown, screw boss 122 is positioned on the rearward side of center wall 114 of socket 106 and on upper side of upper wall 70 and includes a pair of lips 124 that define a hollow interior 126 that is sized and shaped to threadably receive a fastener such as a screw or bolt, as is further described herein.

Tracks:

First track 18 and second track 20 are formed of any suitable size, shape and design and serve to hold first shade material 22 and second shade material 24, respectively. In one arrangement, as is shown, tracks 18, 20 are generally square or rectangular in shape, when viewed from the side and extend a length between opposing ends 130. In the arrangement shown, tracks 18, 20 include an upper wall 132, a lower wall 134 and opposing sidewalls 136 that define a hollow interior 138. Upper wall 132 includes a slot 140 therein that is sized and shaped to receive a connecting member 142 therein that serves to connect track 18, 20 to upper wall 70 of top bracket 14, 16. Lower wall 134 also includes a slot 143 therein that allows passage of carriers 144 there through that connect shade material 22, 24 to tracks 18, 20. That is, hollow interior 138 receives carriers 144 therein that slidably move between ends 130 and connect to shade material 22, 24 thereby opening and closing shade material 22, 24.

Valance:

Valance 26 is formed of any suitable size, shape and design and serves to connect to top bracket 14, 16 and hang downward therefrom a distance to provide a visual cover for components of the system 10, such as the tracks 18, 20. Valance 26 serves as a support to or backing for material which is connected to the valance 26 that provides an improved aesthetic purpose, as is further described herein. In one arrangement, valance 26 is formed of an extrusion that is generally constant in size, shape and design from end.

In the arrangement shown, valance 26 extends a lateral length between opposing ends 150 that connect to end caps 152, as is further described herein. In one arrangement, valance 26 is formed of an extrusion that is generally constant in size, shape, and design from end 150 to end 150. Valance 26 extends vertically between an upper end 154 and a lower end 156, which extends in approximate parallel spaced relation to one another. Valance 26 includes a forward face 158, which is generally flat and planar and a rearward face 160 that is also generally flat and planar and includes a plurality of features as is described further herein. Forward face 158 and rearward face 160 extend in approximate parallel spaced alignment.

The rearward side of valance 26 includes an upper staple area 162, which is positioned at or near the upper end 154, and a lower staple area 164, which is positioned at or near the lower end 156. In one arrangement, as is shown, staple areas 162, 164 are formed of a thicker section of material than the other portions of valance 26, or a thicker band of material. This area or band of increased thickness serves to provide an area that receives fabric staples 166 therein that secure covering material 168 to the valance 26 as is further described herein. In the arrangement shown, staple areas 162, 164 include a plurality of protrusions that extend rearward and outward from the rearward face 160 a distance, however, it is also contemplated that staple areas 162, 164 are a solid piece or strip of material that is connected to or formed as part of valance 26, without a plurality of protrusions.

The rearward side of valance 26 also includes clip feature 108. Clip feature 108 is formed of any suitable size, shape and design and serves to frictionally connect valance 26 to socket 106 of top bracket 14, 16. In the arrangement shown, as one example, clip feature 108 is positioned at or near the upper end 154 of valance 26 and extends outward and slightly downward therefrom. In the arrangement shown, clip feature 108 includes an arm 170 that extends outward from the rearward face 160 of valance 26 a distance. The outward end of arm 170 connects to a rounded nose 172 that connects to flange 174. Arm 170 and flange 174 extend in approximate parallel spaced relation to one another and thereby form a slot 176 there between. The lower side of arm 170 includes a plurality of friction members 178 that serve to impart friction onto the socket 106 of top bracket 14, 16 when clip feature 108 is within receiving space 116 thereby helping to hold clip feature 108 within receiving space 116. In the arrangement shown, friction members 178 are a plurality of protrusions or bumps, however any other form of a friction imparting device is hereby contemplated for use such as adhesive, glue, sand paper, tack, or the like. In one arrangement, as is shown, the friction members 178 of clip feature 108 correspond in size and shape with the friction members 118 of socket 106 such that the two sets of friction members 178 and 118 frictionally and fittingly engage one another thereby providing increased hold between clip feature 108 and top bracket 14, 16.

In one arrangement, as one example, the friction members 118 of socket 106 are formed of rounded protrusions that are spaced apart from one another and friction members 118 of clip member 108 are formed of rounded protrusions that are spaced apart from one another. The spacing of the friction members 118 of socket 106 is complimentary or corresponds to the spacing of the friction members 178 of clip feature 108 such that when the clip feature 108 is fully inserted within the socket 106 the friction members 178 of clip feature 108 are pushed over and past the friction members 118 of socket 106. Once inserted, the friction members 178 of clip feature 108 are in engagement with the friction members 118 of socket 106 thereby preventing unintentional escape of the clip feature 108 from socket 106.

The rearward side of valance 26 includes an upper arm 180, a lower arm 182 and a center arm 184. The upper arm 180, lower arm 182 and center arm 184 extend outward from rearward face 160 a distance and include a flange that extend in approximate parallel spaced relation to the rearward face 160 of valance 26 a distance thereby defining a slot 186 therein. Slots 186 are sized and shaped to slidably receive tongues 188 connected to end cap 152, as is further described herein.

The rearward side of valance 26 also includes an alignment feature 190. Alignment feature 190 is formed of any suitable size, shape, and design and serves to connect and align valance extension 28 to valance 26. In the arrangement shown, alignment feature 190 is positioned at or near the lower end 156 of valance 26. More specifically, in the arrangement shown, alignment feature 190 is positioned just above the lower staple area 164. Alignment feature includes a bulbous nose 192 connected to a narrower stem 194 that extends nose 192 outward from the rearward surface of valance 26 a distance.

The lower end 156 of valance 26 also includes a second alignment feature 196. In the arrangement shown, second alignment feature 196 is a downward facing recess, curve, or cup. The combination of alignment feature 190 and second alignment feature 196 provide slidable connection points for valance extension 28, as is further described herein.

Valance Extension:

Valance extension 28 is formed of any suitable size, shape, and design and serves to quickly and easily connect to the lower end 156 of valance 26 and extends the vertical height of the overall valance. In one arrangement, as is shown, like valance 26, valance extension 28 extends a lateral length between opposing ends 200 that connect to end caps 152, as is further described herein. In one arrangement, like valance 26, valance extension 28 is formed of an extrusion that is generally constant in size, shape, and design from end 200 to end 200. Valance extension 28 extends vertically between an upper end 202 and a lower end 204, which extends in approximate parallel spaced relation to one another. Valance extension 28 includes a forward face 206, which is generally flat and planar and a rearward face 208 that is also generally flat and planar and includes a plurality of features as is described further herein. Forward face 206 and rearward face 208 extend in approximate parallel spaced alignment.

The rearward side of valance extension 28 includes a staple area 210, which is positioned at or near the lower end 204. In one arrangement, as is shown, staple area 210 is formed of a thicker section of material than the other portions of valance extension 28, or a thicker band of material. This area or band of increased thickness serves to provide an area that receives fabric staples 166 therein that secure covering material 168 to the valance extension 28 as is further described herein. In the arrangement shown, staple area 210 includes a plurality of protrusions that extend rearward and outward from the rearward face 208 a distance, however, it is also contemplated that staple area 210 is a solid piece or strip of material that is connected to or formed as part of valance extension 28, without a plurality of protrusions.

The upper end 202 of valance extension 28 also includes a socket 212 positioned at or near its upper end 202. Socket 212 is sized and shaped to receive alignment feature 190 of valance 26 therein. In one arrangement, as is shown, socket 212 includes a slot 214 that includes a pair of opposing arms 216 that extend inward at an angle. Socket 212 is sized and shaped to allow stem 194 to pass through slot 214 while socket 212 receives nose 192 within close tolerances while arms 216 hold the nose 192 therein.

A second alignment feature 218 is positioned below the socket 212 and is sized and shaped to connect to the second alignment feature 196 of valance 26 in mating engagement. In the arrangement wherein the second alignment feature 196 of valance 26 is a rounded socket, the second alignment feature 218 in valance extension 28 is a rounded protrusion that connects together in mating engagement.

In the arrangement shown, valance extension 28 also includes relief 220. Relief 220 provides room to receive the lower staple area 164 of valance 26 within the valance extension 28. The lower end of relief 220 connects to or provides support for second alignment feature 218.

Figure 2:
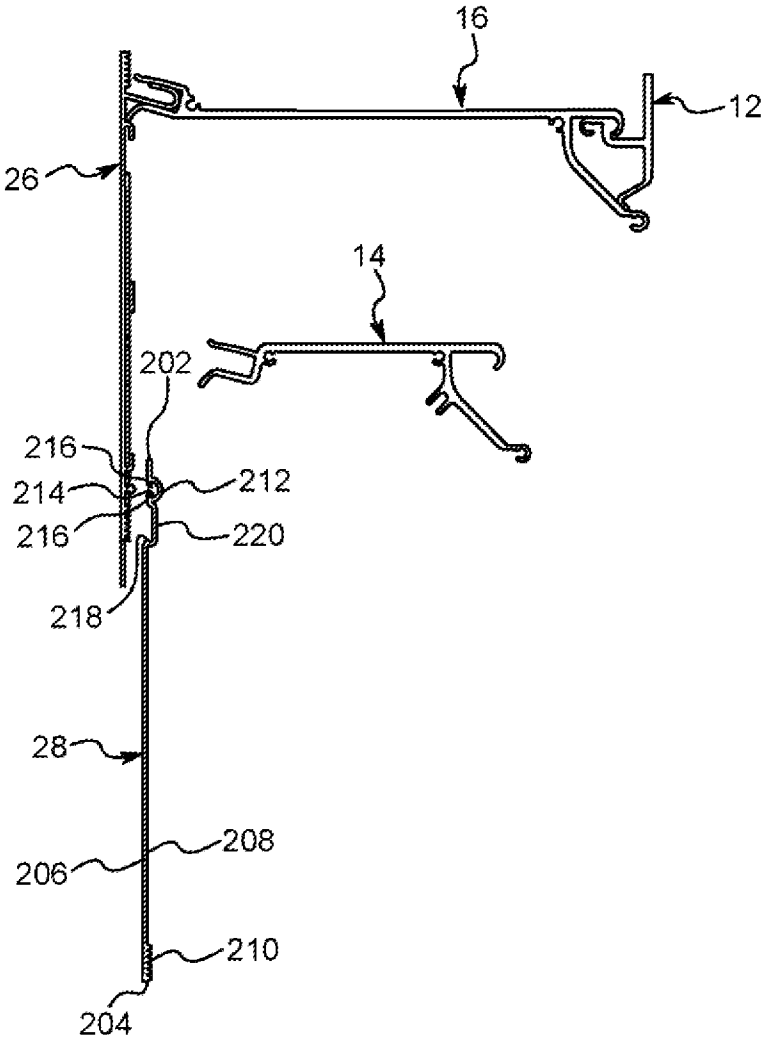
FIG. 2 is a side elevation view of the valance system of FIG. 1, the view showing the wall bracket, a dual track top bracket connected to the wall bracket, a valance connected to a socket in the outward end of the dual track top bracket, a valance extension positioned adjacent the lower end of the valance, and a single track top bracket.
Figure 4:
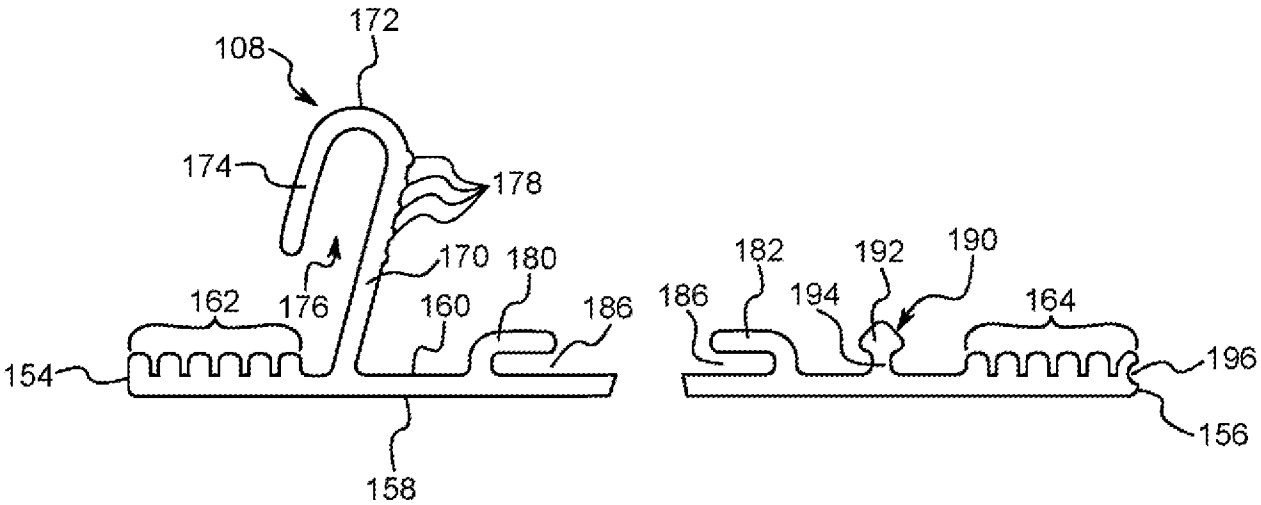
FIG. 4 is a close up side elevation view of the ends of a valance.
Figure 3:
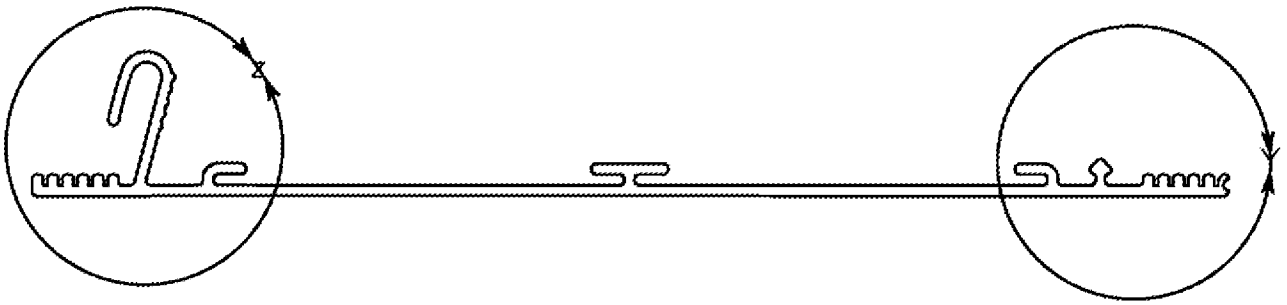
FIG. 3 is a side elevation view of a valance.
Figure 5:
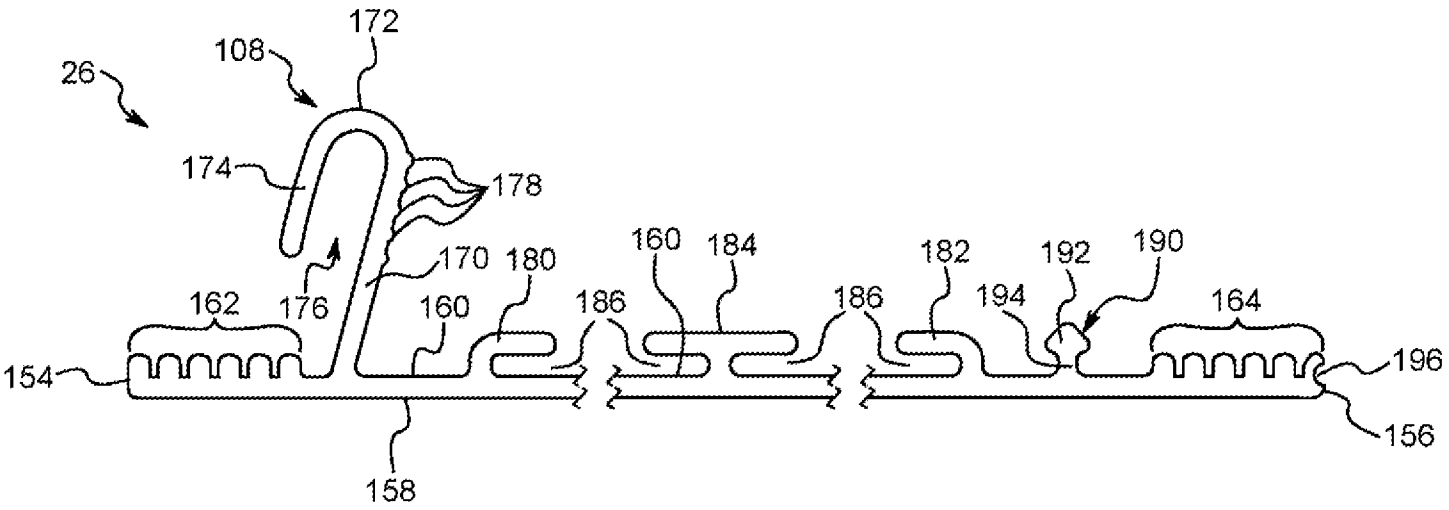
FIG. 5 a close up side elevation view of a valance showing the ends and middle of the valance.
Figure 6:
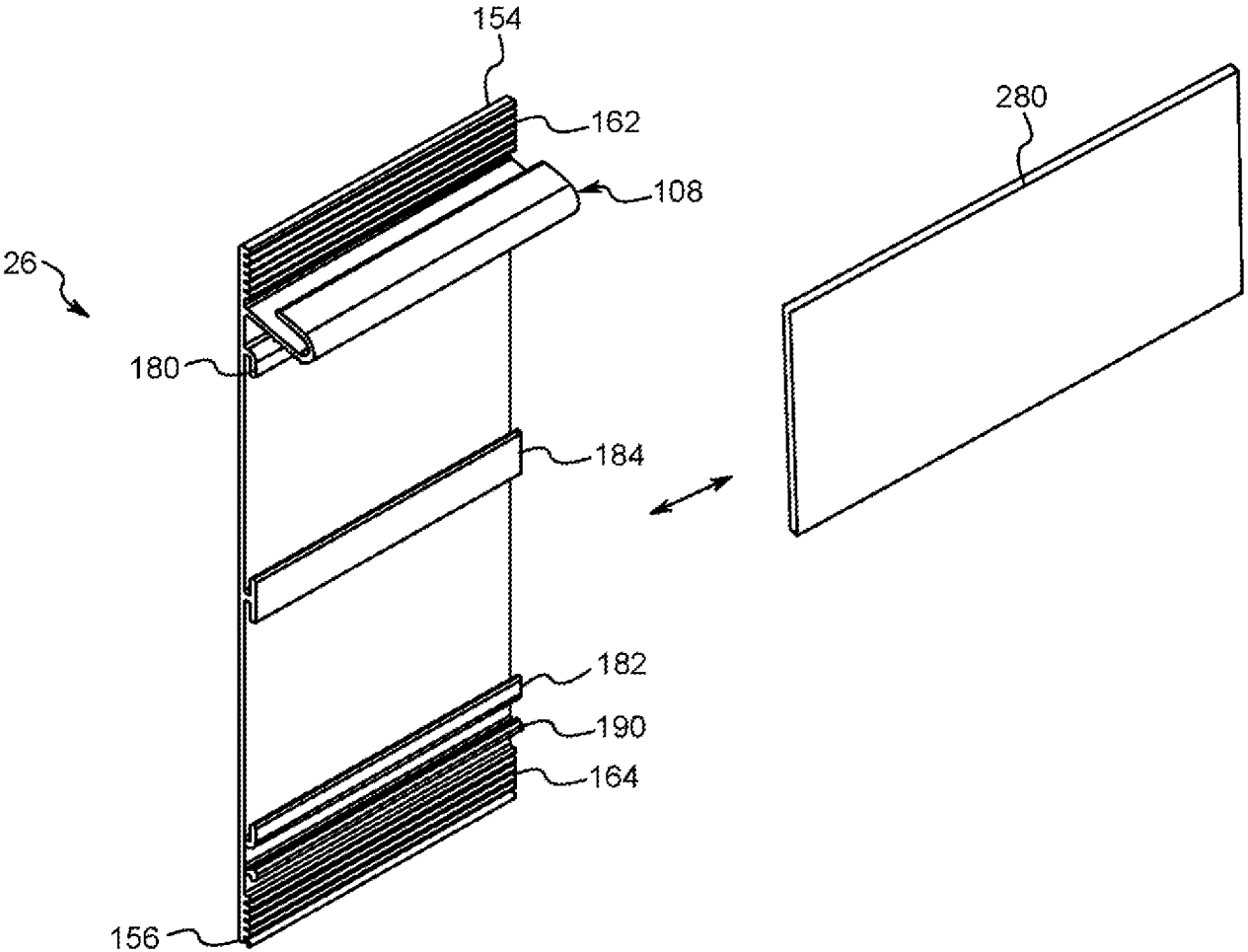
FIG. 6 is a perspective view of the rear side of a valance.
Figure 7:
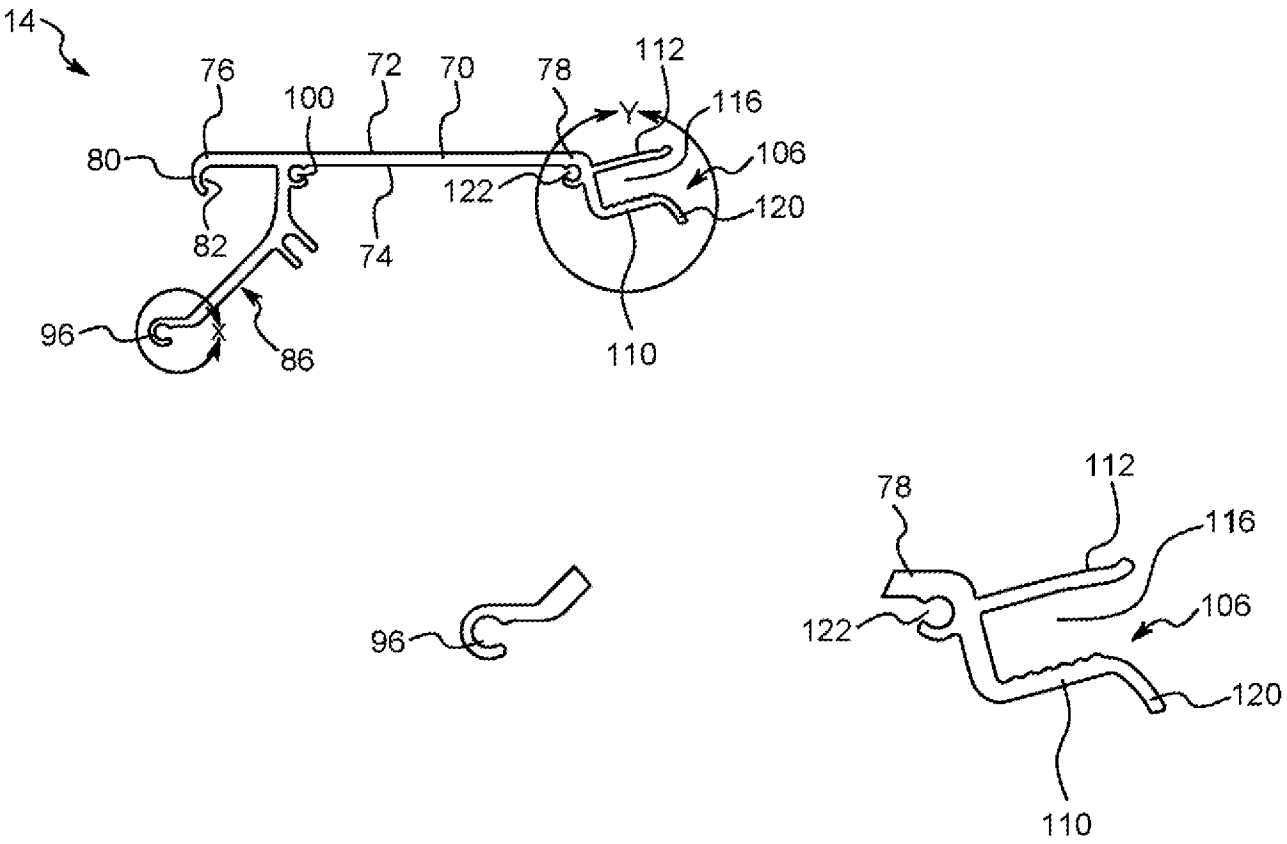
FIG. 7 is a side elevation view of a single track top bracket.
Figure 8:
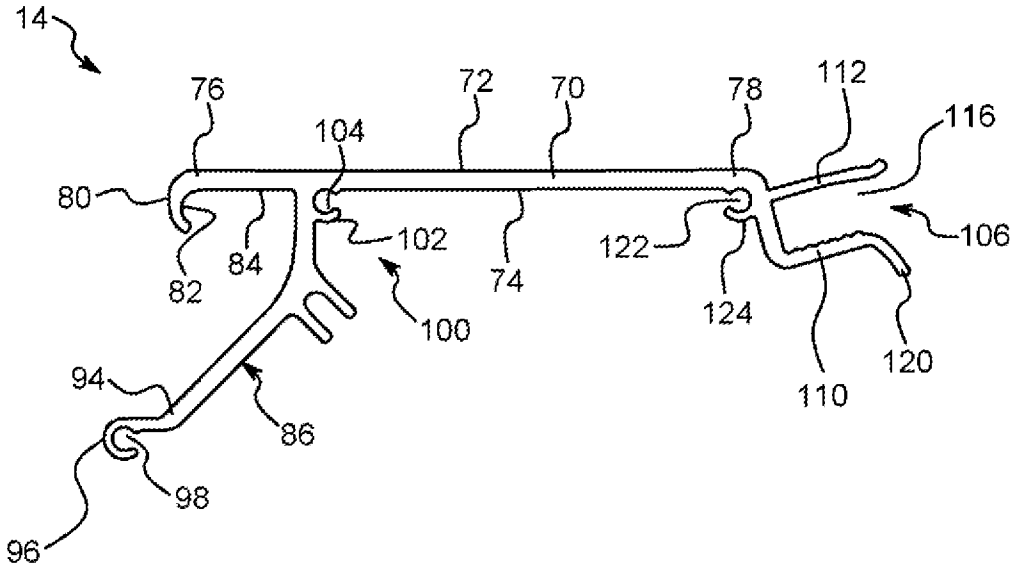
FIG. 8 is a side elevation view of a single track top bracket.
Figure 9:
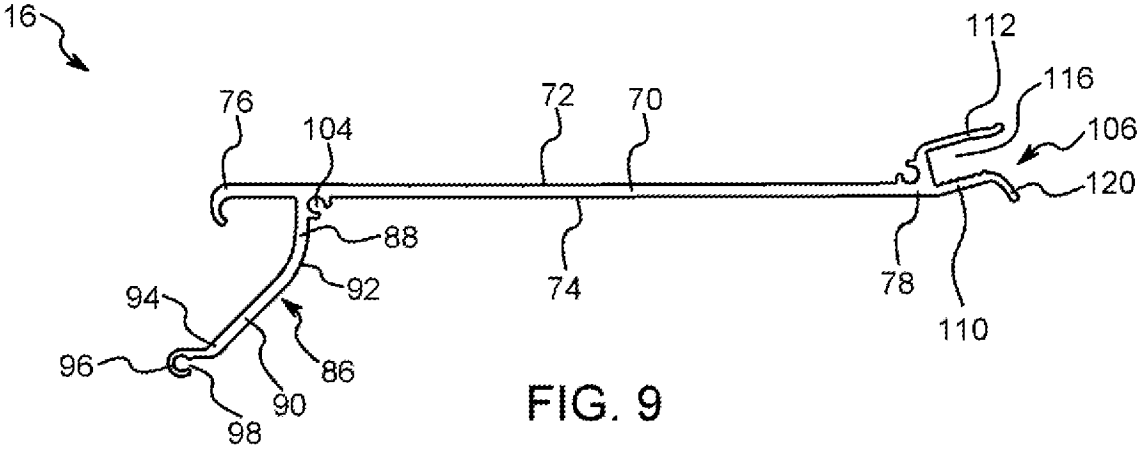
FIG. 9 is a side elevation view of a dual track top bracket.
Figure 10:
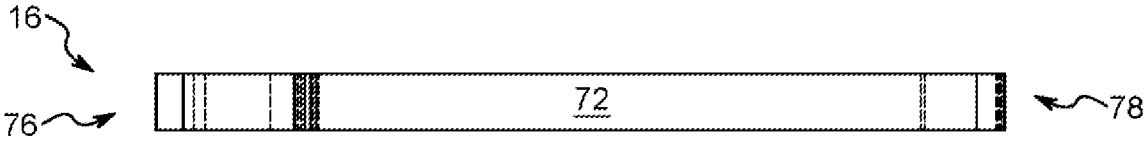
FIG. 10 is a bottom elevation view of a dual track top bracket.
Figure 11:
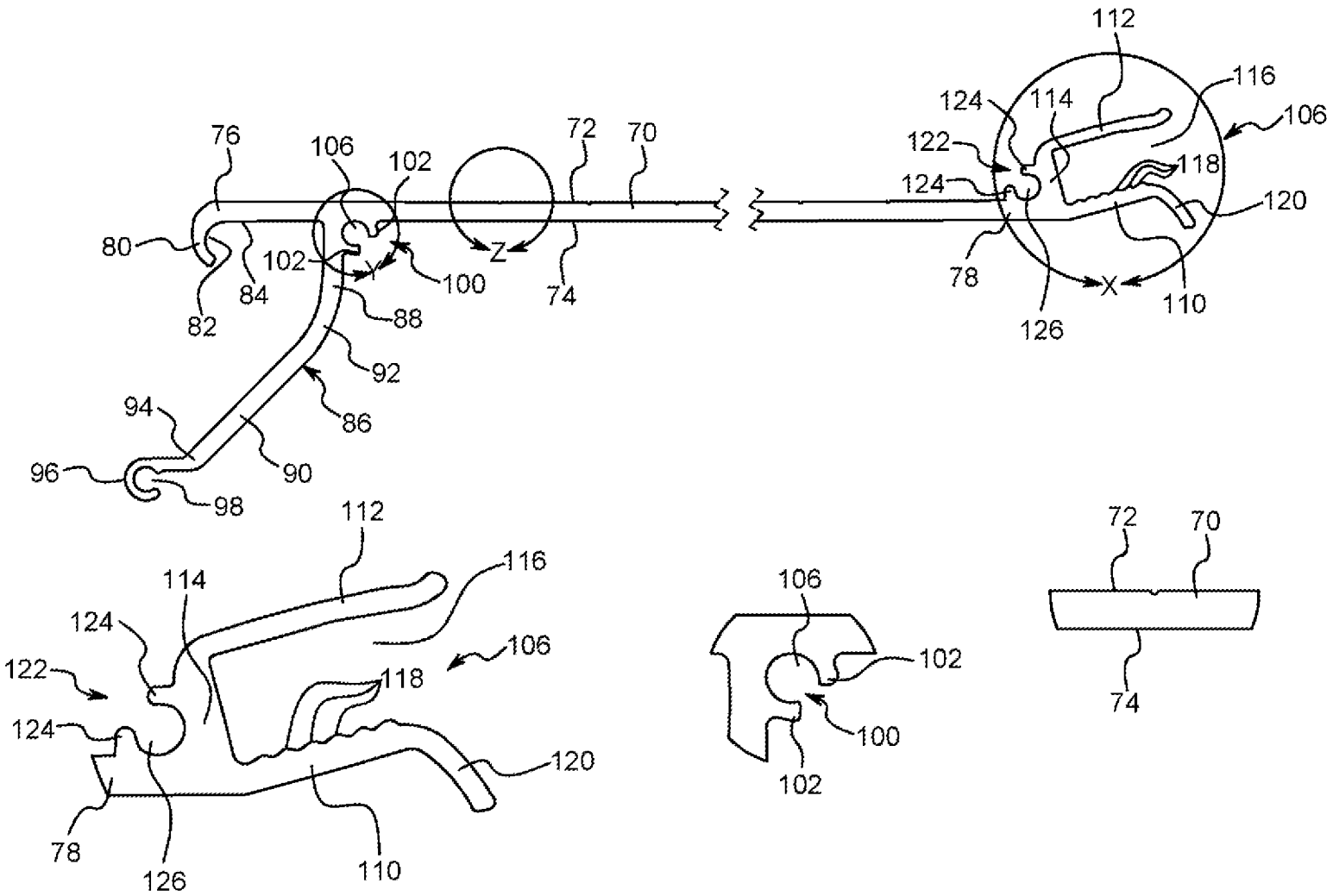
FIG. 11 is a side elevation view of a top bracket.
Figure 12:
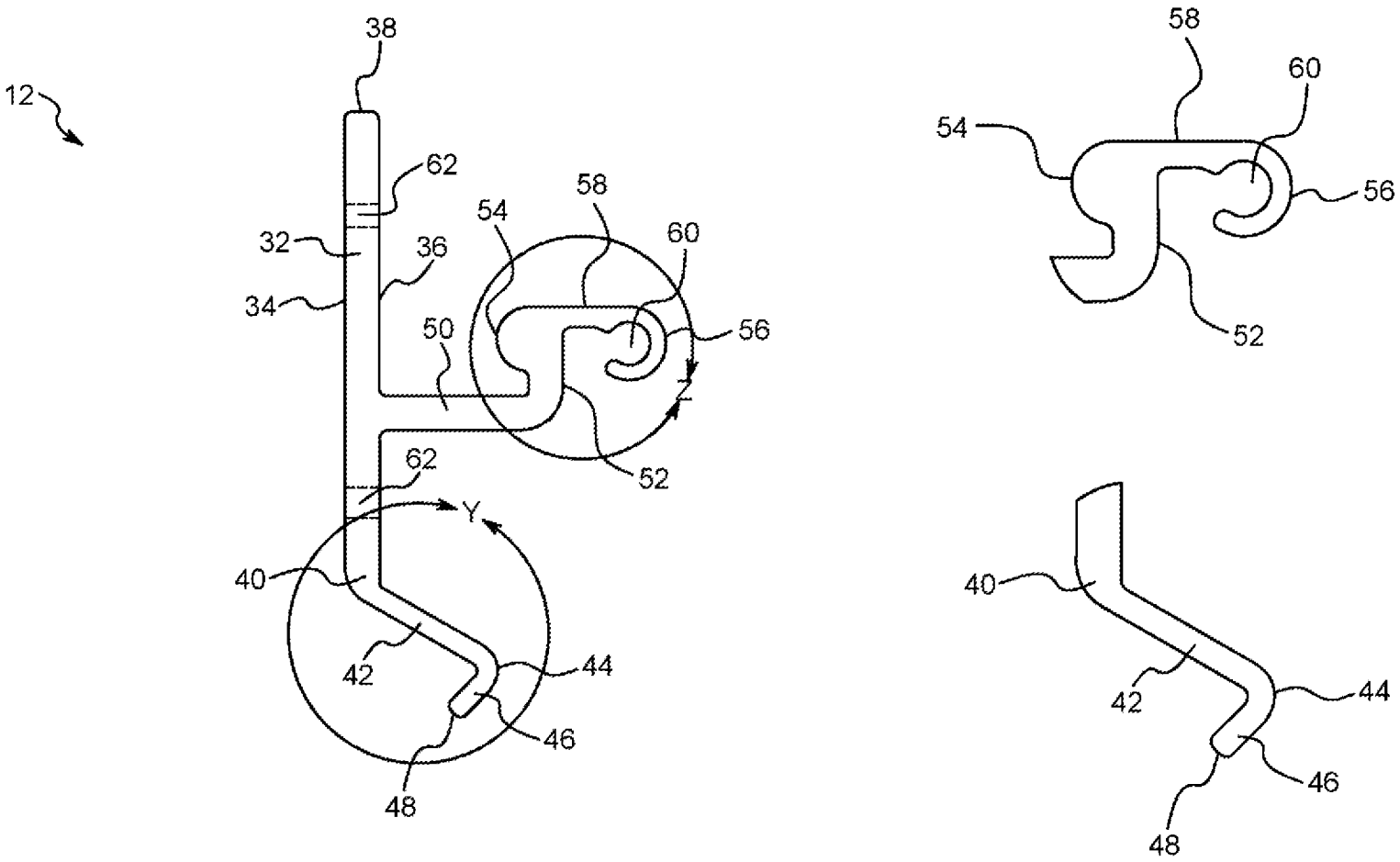
FIG. 12 is a side elevation view of a wall bracket.
Figure 13A:
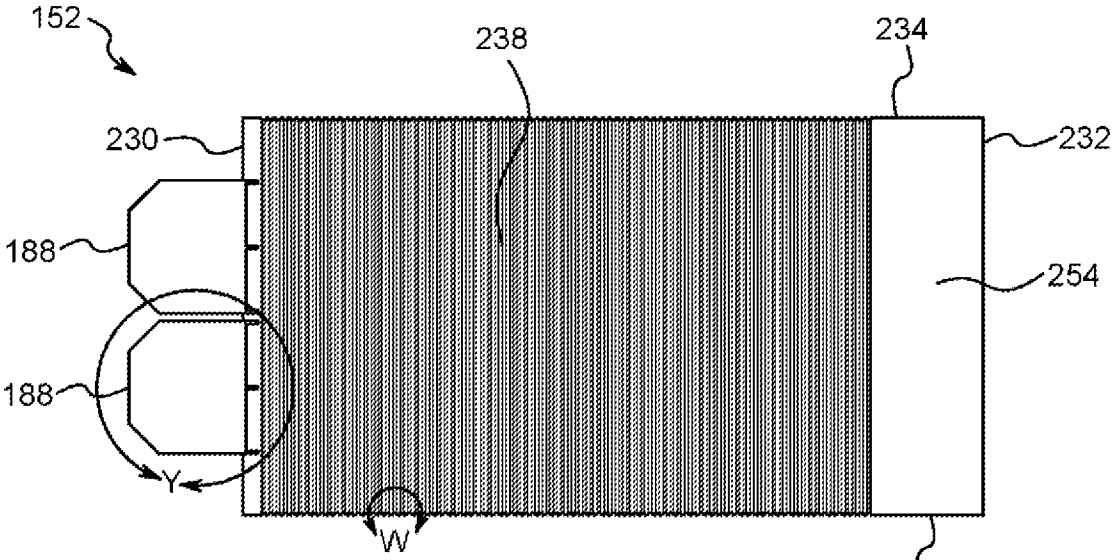
FIG. 13A is a rear elevation view of a left end cap.
Figure 13B:
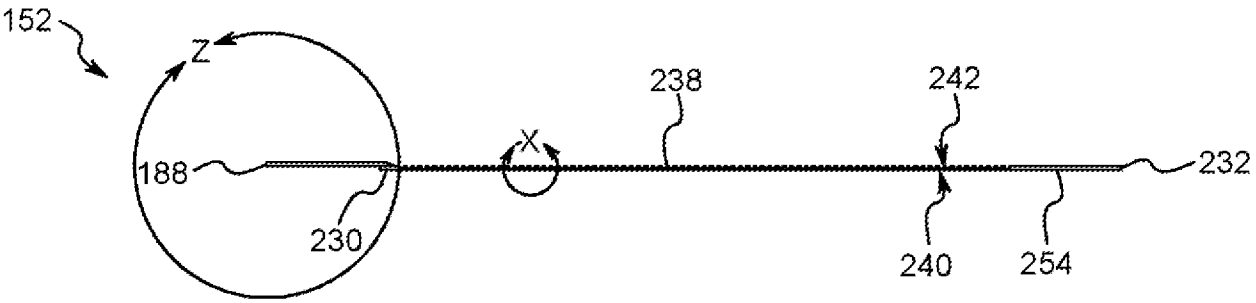
FIG. 13B is a side elevation view of a left end cap.
Figure 14B:
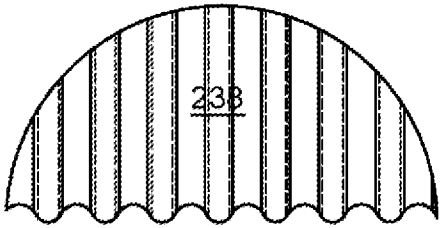
FIG. 14B is a close up rear elevation view of the living hinge area of an end cap.
Figure 14D:
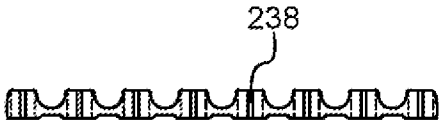
FIG. 14D is a close up side elevation view of the living hinge area of an end cap.
Figure 14A:
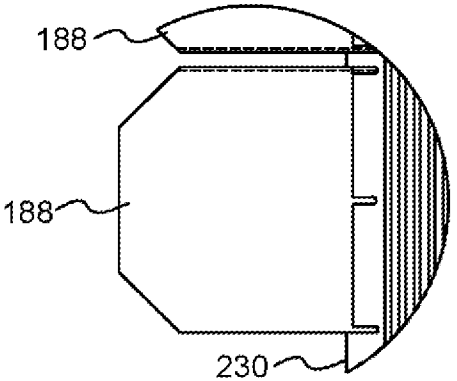
FIG. 14A is a close up rear elevation view of a tongue of an end cap.
Figure 14C:
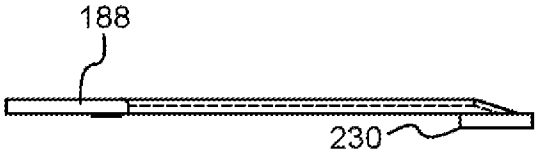
FIG. 14C is a close up side elevation view of a tongue of an end cap.
Figure 15C:
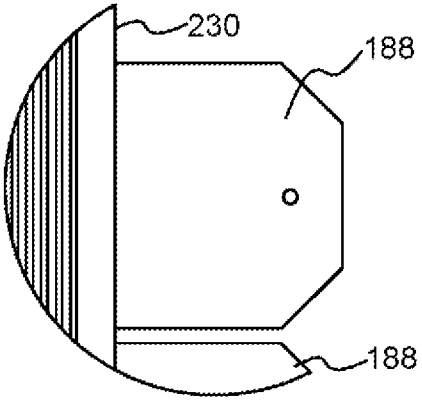
FIG. 15C is a close up rear elevation view of a tongue of a right end cap.
Figure 15B:
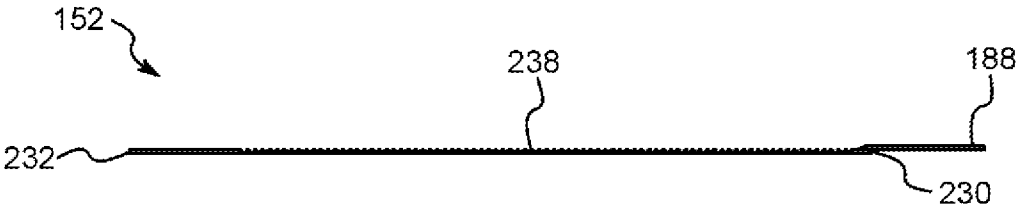
FIG. 15B is a side elevation view of a right end cap.
Figure 15A:
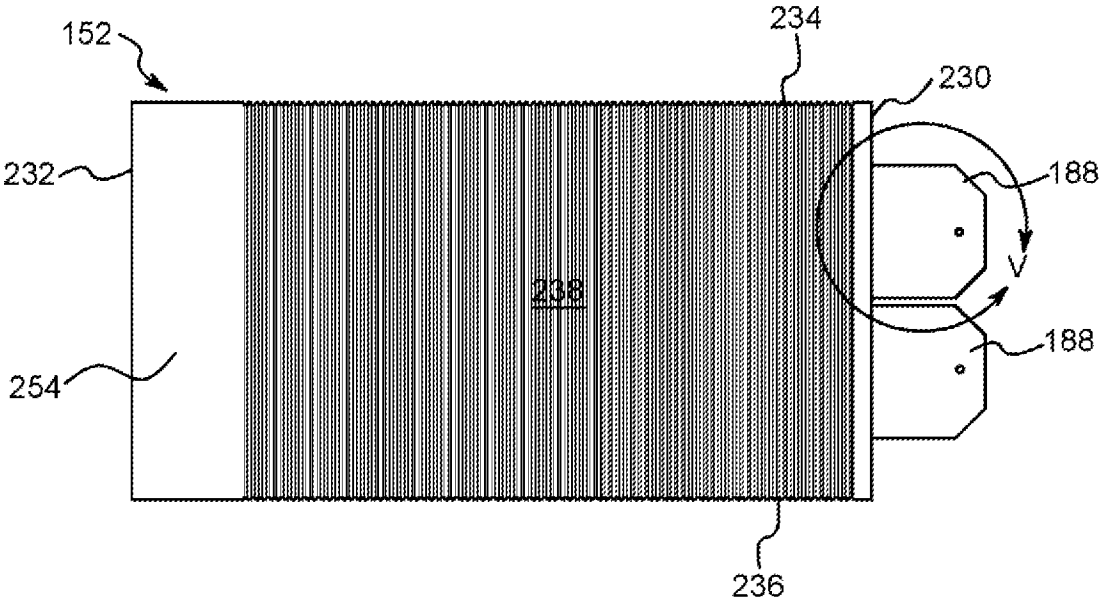
FIG. 15A is a rear elevation view of a right end cap.
Figure 16:
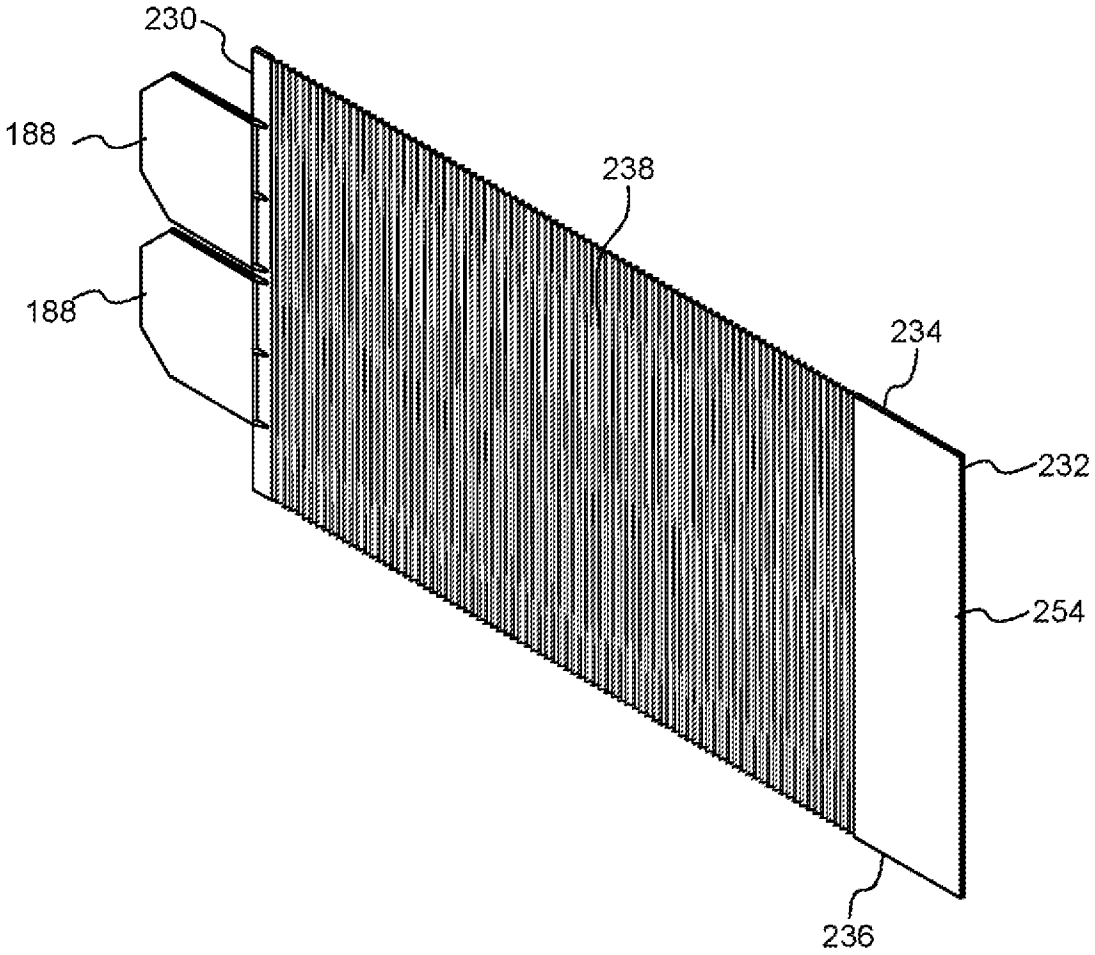
FIG. 16 is a rear perspective view of a left end cap.

Utilizing the combination alignment feature 190 and second alignment feature 196 of valance 26 and socket 212 and second alignment feature 218 of valance extension 28, valance 26 and valance extension 28 connect together and are held together. Valance extension 28 can slide onto valance 26 by aligning the socket 212 with the alignment feature 190 and the of valance 26 while simultaneously aligning the second alignment feature 218 with the second alignment feature 196 of valance 26 and sliding the valance extension 28 over and onto the valance (as is shown in FIG. 1, where sliding occurs along the direction of the arrow shown). Alternatively, valance extension 28 can snap onto valance 26 by aligning the socket 212 with the alignment feature 190 and the of valance 26 while simultaneously aligning the second alignment feature 218 with the second alignment feature 196 of valance 26 and pressing the valance extension 28 onto the valance 26 (as is shown in FIG. 2, where snapping occurs along the direction of the arrow shown).

End Cap:

End cap 152 is formed of any suitable size, shape and design and serves to quickly and easily connect to the ends 150, 200 valance 26 and/or valance extension 28 and provides the ability to curve from the general flat forward face 158, 206 around the end of system 10 eventually connecting to the wall or structure. In this way, end cap 152 covers and closes the ends 150, 200 of system 10.

In one arrangement, as is shown, like valance 26 and valance extension 28, end cap 152 extends a lateral length between inward end 230 and outward end 232. Inward end 230 is configured to connect to the end 150, 200 of valance 26 and/or valance extension 28. Outward end 232 is configured to connect to the wall or structure that supports valance system 10. End cap 152 extends vertically between an upper end 234 and a lower end 236, which extends in approximate parallel spaced relation to one another.

End cap 152 includes a hinge area 238. Hinge area 238 is an area or section of end cap 152 that serves to allow end cap 152 to curve from the generally flat forward face 158, 206 of valance 26, valance extension 28 to meet the wall or structure that supports system 10. In one arrangement, as is shown, hinge area 238 includes a plurality of recesses or grooves that extend from the upper end 234 to the lower end 236. In one arrangement, the grooves or recesses of hinge area 238 are placed in both the forward face 240 of end cap 152 and the rearward face 242 of end cap 252. In an alternative arrangement, the forward face 240 is flat, so as to provide better aesthetics, and only the rearward face 242 includes the recesses or grooves. In yet another alternative arrangement, the rearward face 242 is flat and only the forward face 240 includes the recesses or grooves.

In one arrangement, the presence of the recesses or grooves of hinge area 238 allows the end cap 152 to be bent to any desired angle or shape. That is, end cap 152 can be bent into a sharp corner, a smooth curve, any angle or any other desired configuration.

Hinge area 238 balances the ability to easily bend the end cap 152 to any desired configuration, while also providing enough rigidity to support and hold the selected configuration.

The inward end 230 of end cap 152 includes at least one tongue 188. Tongues 188 extend outward from inward end 230 a distance and are sized and shaped to fit within slots 186 valance 26. In the arrangement shown, tongues 188 are generally flat, elongated and square or rectangular in shape with the outward most corners chamfered or angled-off to aid with insertion of tongues 188 into slots 186. In the arrangement shown, two tongues 188 are used which are separated by a space that is sized and shaped to receive center arm 184, however any other number of tongues 188 are hereby contemplated for use.

To install the end cap 152 onto the valance 26, 28, the tongues 188 are aligned with slots 186 and the end cap 152 is slid inward until the inward end 230 is in flat and flush alignment and engagement with the outward end 150 of valance 26. In this position, the friction between tongues 188 and valance 26 holds end cap 152 in place. An adhesive, staples, tape or any other binding agent can also be used to help ensure the two components remain together after installation.

Once the end cap 152 is installed onto valance 28, the end cap 152 is bent to the desired configuration.

For applications that include valance extension 28, the height of end cap 152 matches the height of the combined valance 26 and valance extension 28. In this arrangement, end cap 152 may include a second set of tongues 188, and the valance extension 26 includes a set of slots 186 that connect to one another.

End caps 152 may also include staple areas along the rearward side of end caps along the upper end 234, lower end 236 and/or the outward end 232 to provide an area to receive fabric staples 166.

Covering Material:

End caps 152 are installed on valance 26 or valance 26 and valance extension 28 by inserting tongues 188 within slots 186. Once end caps 152 are installed, the combined valance (which will be referred to simply as "valance 26" for purposes of simplicity) is covered with covering material 168. Covering material 168 is any material that covers valance 26. In one arrangement, covering material 168 is the same material as the first shade material 22 or second shade material 24, so that the covered valance 26 matches the drapery. In another arrangement, covering material 168 is a different material, so that the covered valance 26 does not match the drapery.

To install the covering material 168, the covering material 168 is cut to shape and is placed over the forward face 158, 206, 240 of the valance 26. The upper end of the covering material 168 is stapled to upper staple area 162, and the lower end of the covering material is stapled to the lower staple area 164 or 210. The fabric staples 166 go into the staple areas but do not protrude through the forward face 158, 206, 240 of the valance 26 due to the increased thickness of the staple areas.

While stapling the covering material 168 is sufficient to hold covering material 168 onto valance 26, to improve this connection, adhesive and/or double sided tape may be used on the forward face 158, 206, 240 and/or any other component of valance 26.

This arrangement provides a quick, easy, simple and fool proof way of installing covering material 168 onto valance 26.

In one arrangement, the covering material is added at the factory and the valance 26 and/or the end caps 152 are shipped with the covering material 168 thereon. This eliminates the need for the user to add the covering material 168 in the field.

System Assembly:

Once the valance 26 is assembled with end caps 152 and potentially valance extension 28, the system is assembled and installed.

Wall bracket 12 is installed onto the wall or structure to which system is to be attached by inserting fasteners, such as screws or bolts, through the wall bracket 12 and into the wall.

The appropriate top bracket 14, 16 is selected. In applications utilizing only a single track 18, single track top bracket 14 is selected. In applications utilizing a pair of tracks, dual track top bracket 16 is selected. Once the top bracket 14, 16 is selected, track(s) 18, 20 are installed by first aligning the track(s) 18, 20 with the top bracket 14, 16 and connecting a turn buckle 250 or fastening device to the track(s) 18, 20. In one arrangement, wherein turn buckle 250 is utilized, the flange of turn buckle 250 is inserted within the slot 140 in the upper wall 132 of the track(s) 18, 20 and is rotated thereby affixing the track(s) 18, 20 to top bracket 14, 16.

Once the track(s) 18, 20 are installed on top bracket 14, 16, top bracket 14, 16 is installed onto wall bracket 12. To do so, top bracket 14, 16 is raised above wall bracket 12 and aligned with the wall bracket 12 such that the hook feature 80 of top bracket 14, 16 reaches behind the first rounded nose 54 of wall bracket 12. To do this, the forward end of top bracket 14, 16 is raised above the rearward end of top bracket 14, 16 at an angle. Once in this position, the weight of the top bracket 14, 16 can rest on the wall bracket 12, which eases installation, and the forward end of top bracket 14, 16 is lowered as the hook feature 80 rotates over the first rounded nose 54 of wall bracket 12. This rotation continues until the flat surface 84 of top bracket 14, 16 engages the upper wall 58 of wall bracket 12, at which point the top bracket 14, 16 is fully lowered onto the wall bracket 12.

In this position, the inward surface of the lower end 94 of support arm 86 of top bracket 14, 16 engages the outward surface of lip 46 of wall bracket 12. Next, anchor plates 252 are installed onto wall bracket 14 and top bracket 14, 16 thereby connecting the two components together and preventing unintentional removal of the top bracket 14, 16 from the wall bracket 12. Anchor plates 252 are installed by passing a fastener, such as a screw or bolt or the like through anchor plate 252 and into the hollow opening 60 (or screw boss) of wall plate 12 and the hollow interiors 98 and 104 (also each a screw boss) of top bracket 14, 16. Once anchor plate 252 is screwed or bolted to both the top bracket 14, 16 and wall bracket 12, the two components are affixed to one another and cannot be separated unintentionally without removal of the anchor plates 252.

Once the top bracket 14, 16 is installed onto the wall bracket 12 and locked there on by anchor plates 252, shade material 22, 24 is installed onto tracks 18, 20 by carriers 144 held within tracks 18, 20.

Once the shade material 22, 24 is installed, the assembled valance 26 (which may include valance extension 28 as well as end caps 152) which is covered by covering material 168 is installed onto top bracket 14, 16. This is accomplished by aligning the clip feature 108 of valance 26 with the socket 106 of top bracket 14, 16. Once aligned, the clip feature 108 is forced within the socket 106. The partially flexible, but resilient, clip feature 108 flexes to accommodate the size of the generally rigid socket 106. That is, the rounded nose 172 tends to flex or bend allowing the flange 174 and arm 170 to fit within the socket 106. As the clip feature 108 is inserted within socket 106, the friction members 178 of clip feature 106 engage and pass over the friction member 118 of socket 106. As these friction members 118, 178 engage one another additional force must be applied to insert and/or remove the clip feature 108 from socket 106, which helps to prevent unintentional removal of valance 26 from top bracket 14, 16.

When fully installed, the rounded nose 172 of clip feature 106 engages or is adjacent the center wall 114 of socket 106, the flange 174 is in engagement with the upper wall 112 of socket 106, and the arm 170 is in engagement with the lower wall 110 with the friction members 118, 178 in engagement with one another.

In this way, assembled valance 26 is quickly and easily installed onto top bracket 14, 16.

To remove valance 26, the opposite process is performed. That is, instead of applying an inward force to valance 26 when installing valance 26, an outward force is applied to valance 26, thereby pulling clip feature 108 out of socket 106.

In this way, valance 26 can be quickly, easily and safely installed and removed from top bracket 14, 16 without any tools or sophisticated processes. In addition, by providing the socket 106 that extends the length of the top bracket 14, 16 and by providing the clip feature 108 that extends the length of the valance 26, this allows for connection between the valance 26 and the top bracket 14, 16 along their entire lengths, except for the small areas wherein the clip feature 108 was removed for the purposes of bending. This extensive area of connection ensures that the valance 26 is straight and has a pleasing aesthetic appearance, while still being inexpensive, standardized, quick and easy to install, among other advantages.

Shipping:

One problem related to using valances in association with window shading systems is that the valance is highly visible and therefore cannot include seams or other obstructions or deviations. Other components of the window shading system, such as tracks 18, 20, wall bracket 12, top bracket 14, 16 often are shipped in pieces which are then assembled into longer components at the sight of installation. Seams between these parts are acceptable because they are largely hidden from view by the valance. However, such is not the case with the valance 26.

To provide the best possible appearance, it is desirable to provide a single continuous valance 26 that is uninterrupted by seams. However, due to many applications being well over ten or twenty feet in length, shipping a rigid continuous piece that extends the entire length of the application would be complicated and expensive. In addition, getting a rigid continuous piece in place in many applications would be impossible because it would not fit in elevators, up stairwells or around corners or the like. As such, to reduce shipping costs, allow for packaging within the same packaging as the broken down brackets 12, 14, 16 and tracks 18, 20, while still providing a continuous, uninterrupted valance 26 it is desirable to bend the valance 26 to fit within the shipping container.

To accomplish this, valance 26 is formed of a rigid yet partially flexible and bendable material. To further facilitate bending, in one arrangement, the clip feature 108 is removed from the areas where the bend is to occur. As one example, with reference to FIGS. 19 and 21, the clip feature 108 has been cut away at the center of valance 26, thereby allowing for folding of the valance 26 where the clip feature 108 has been removed.

Figure 19:
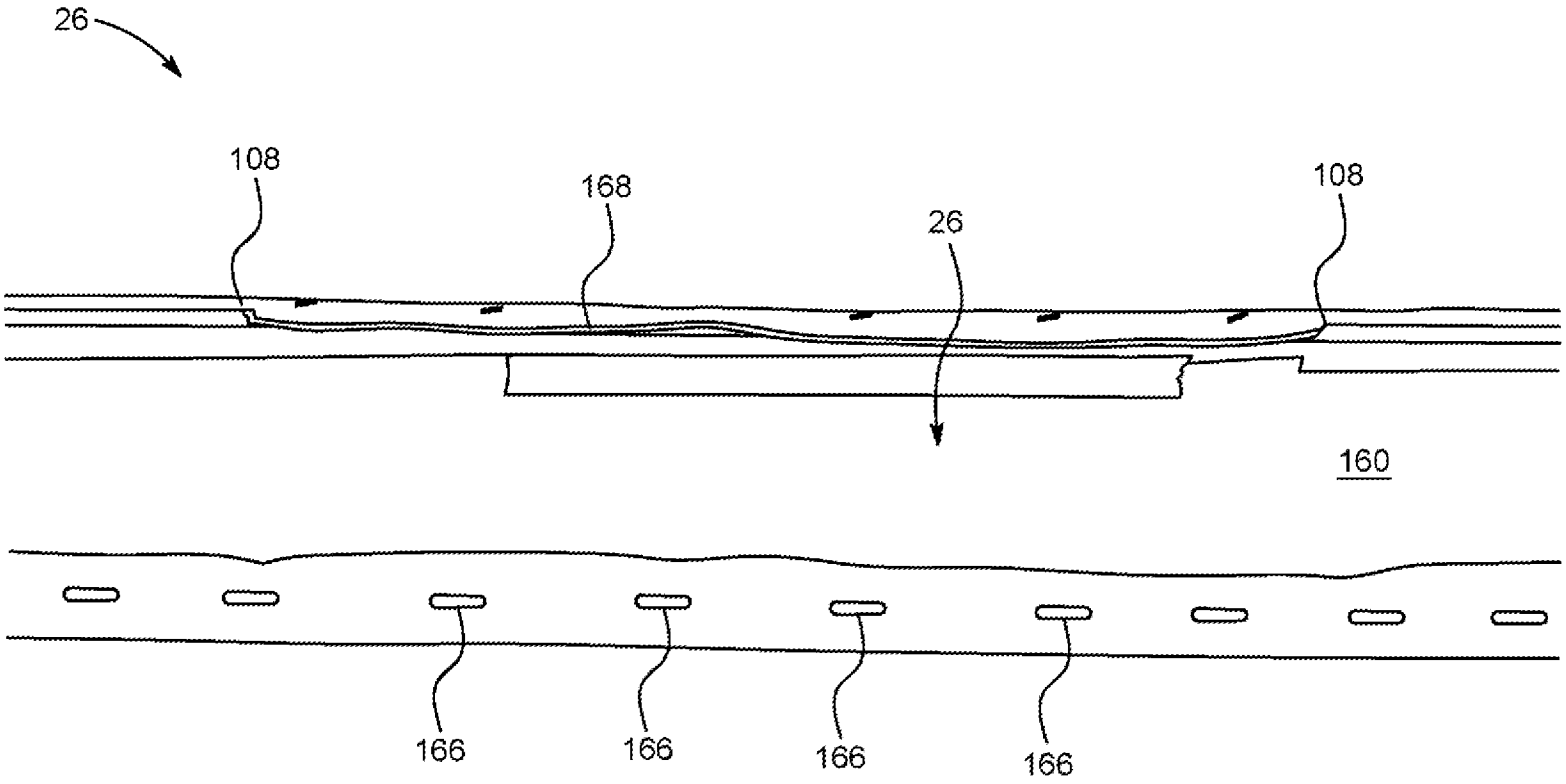
FIG. 19 is a perspective view of the back surface of a valance, the view showing covering material stapled to the valance, the view showing the clip feature, with the clip feature removed adjacent the center of the valance so as to allow the valance to be bent or folded to fit into the shipping container.
Figure 20:
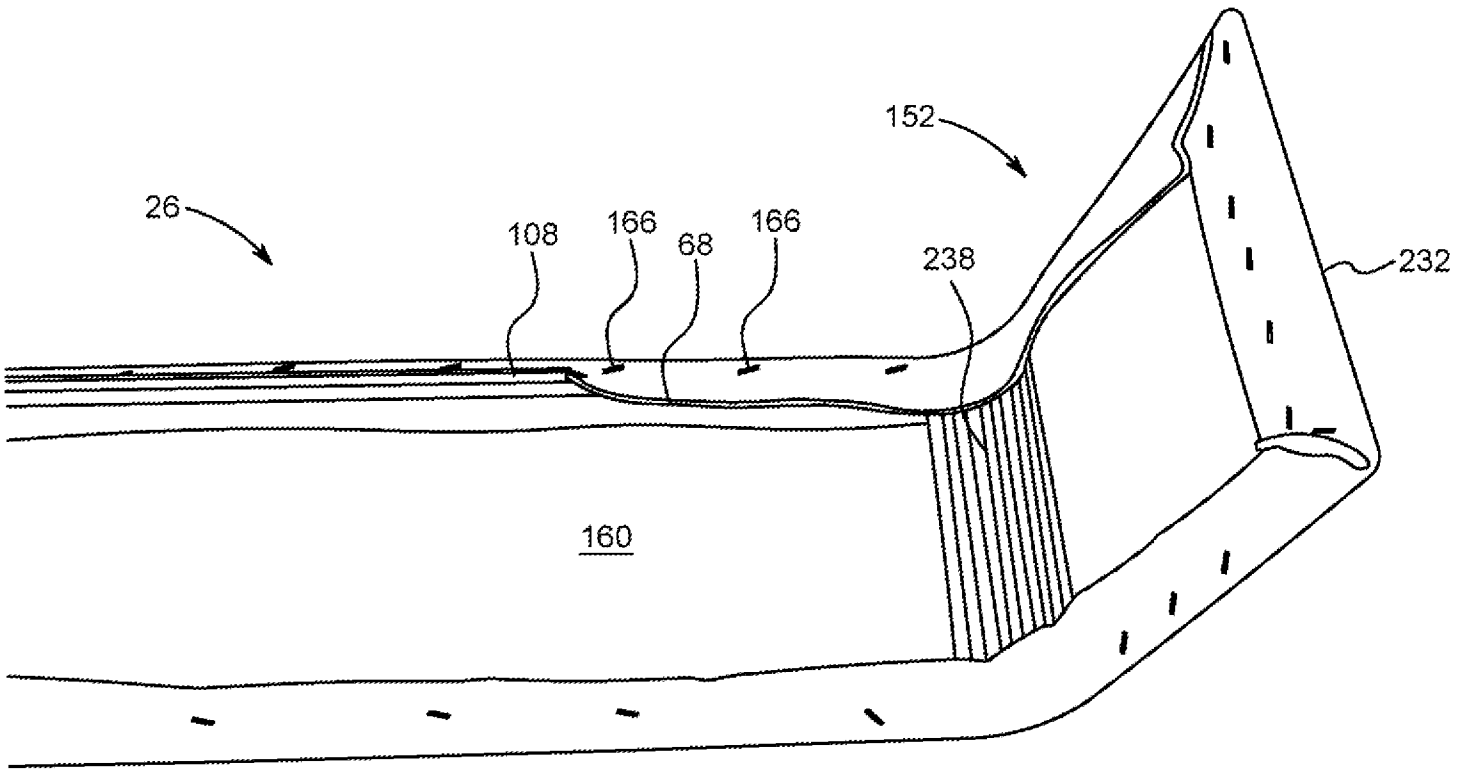
FIG. 20 is a perspective view of the back surface of a valance, the view showing covering material stapled to the valance, the view showing the clip feature, the view showing the end cap bent around a living hinge area.
Figure 21:
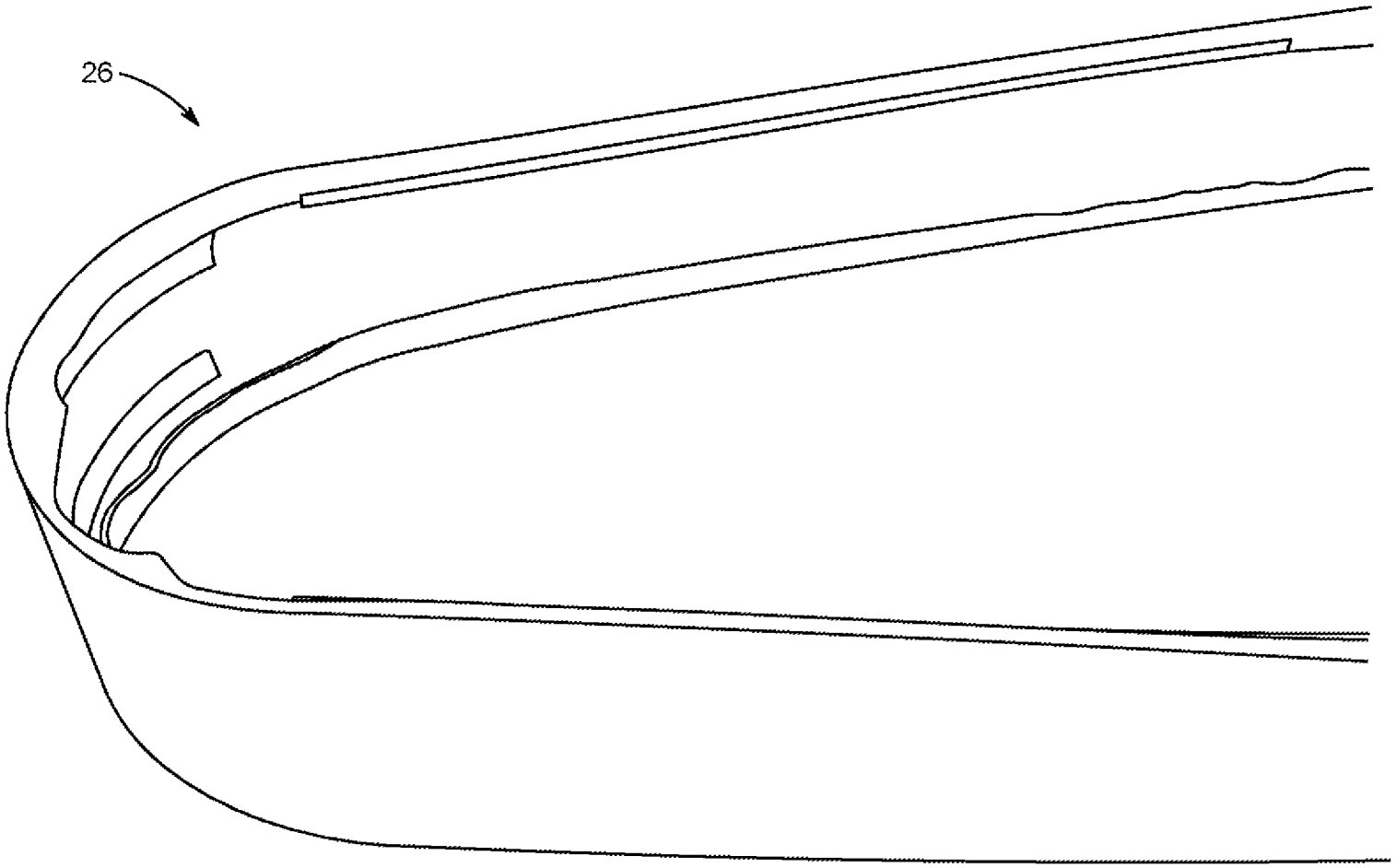
FIG. 21 is a perspective view of a valance, the view showing covering material stapled to the valance, the view showing the clip feature, with the clip feature removed adjacent the center of the valance, the view showing the valance bent or folded to fit into the shipping container.
Figure 22:
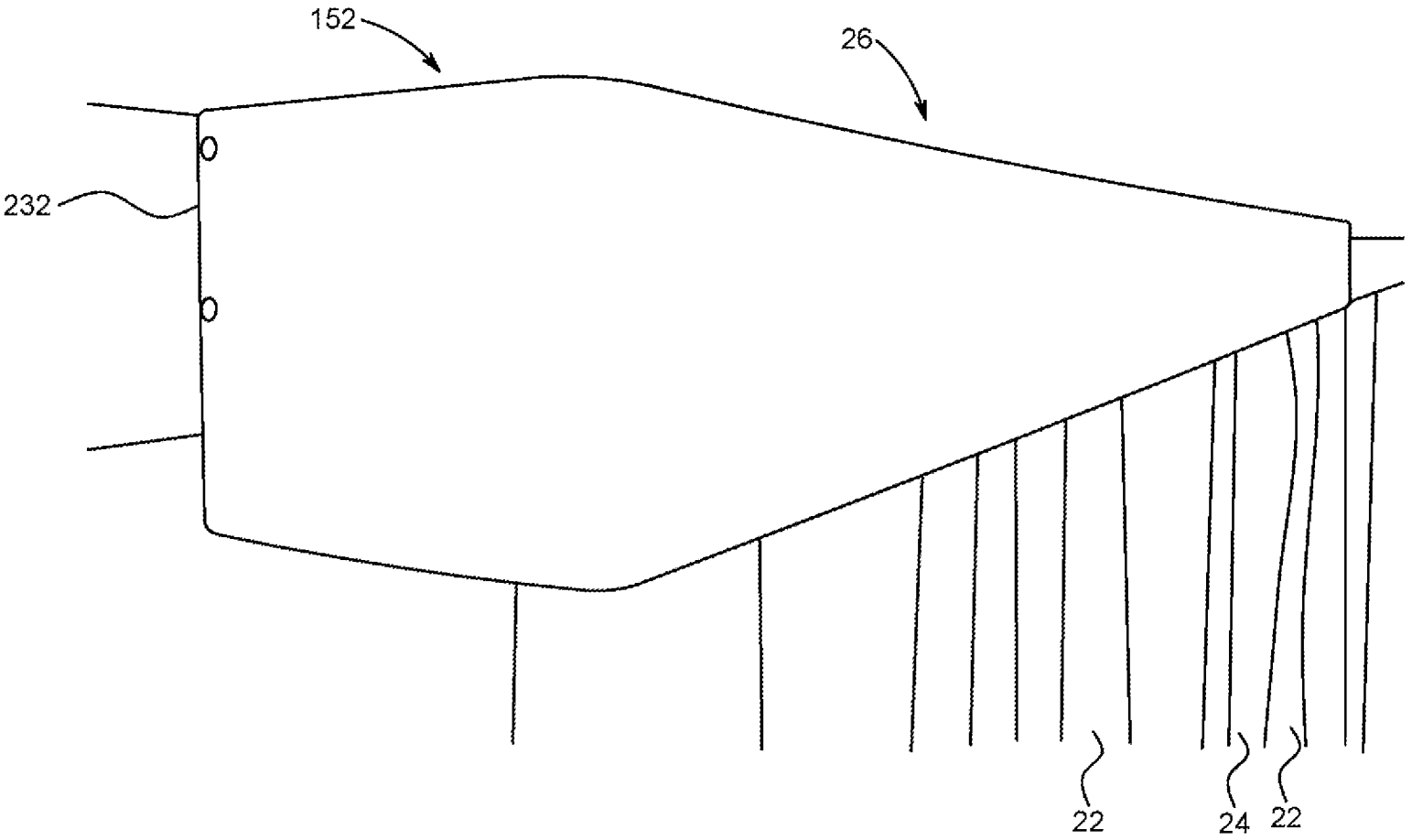
FIG. 22 is a perspective view of the end of a valance system, the view showing the valance covered by covering material, the view showing the end cap bent at the end of the valance, the view showing shade material hanging down from the track.
Figure 23:
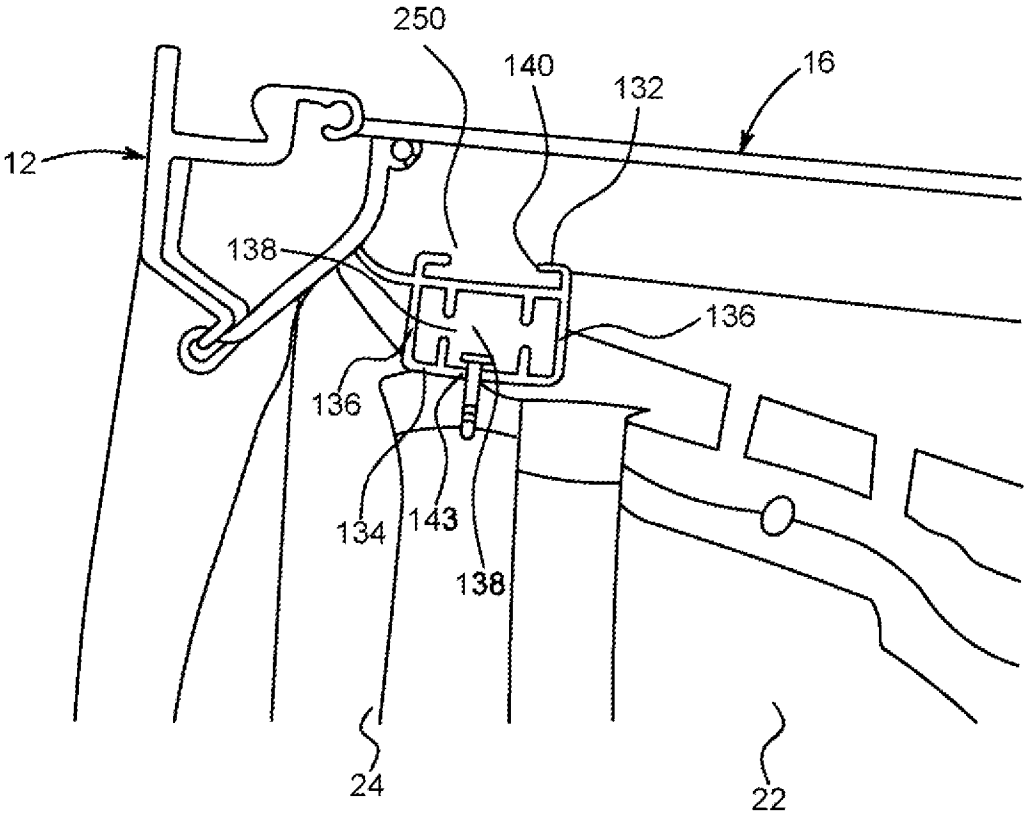
FIG. 23 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers.
Figure 24:
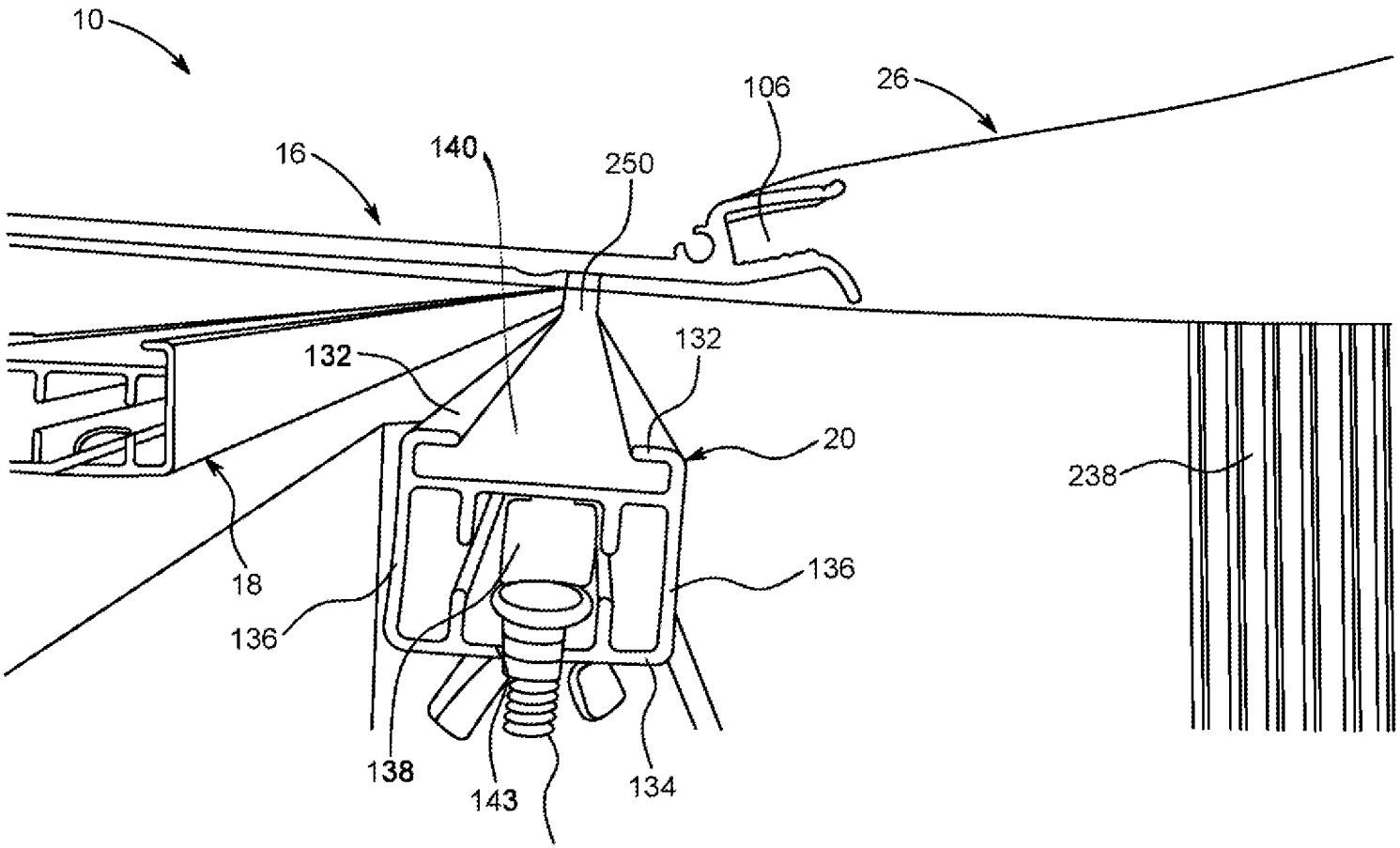
FIG. 24 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers; the view showing a valance connected to a socket positioned in the end of the top bracket opposite the wall bracket, the view showing the clip feature positioned within the socket.
Figure 25:
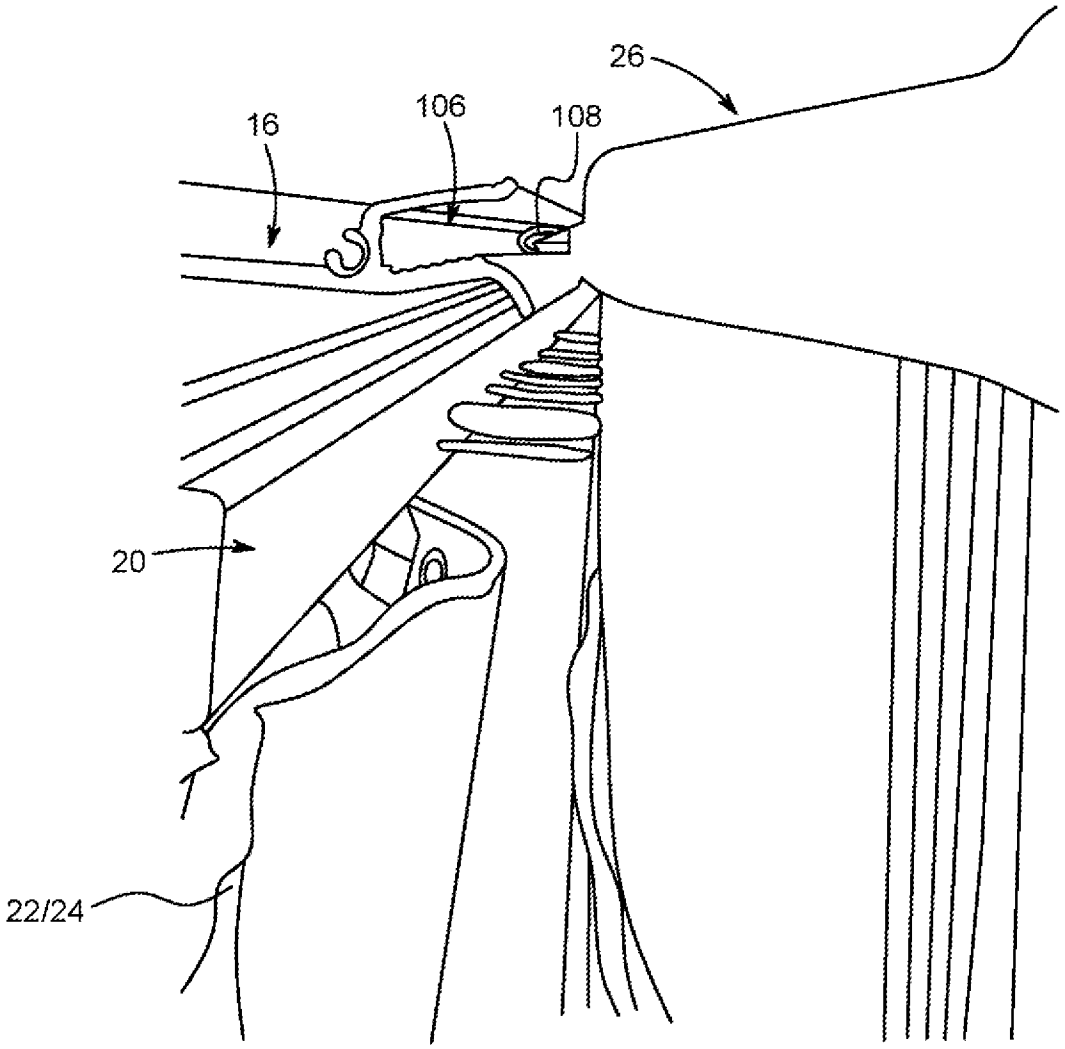
FIG. 25 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers; the view showing a valance connected to a socket positioned in the end of the top bracket opposite the wall bracket, the view showing the clip feature positioned within the socket.
Figure 26:
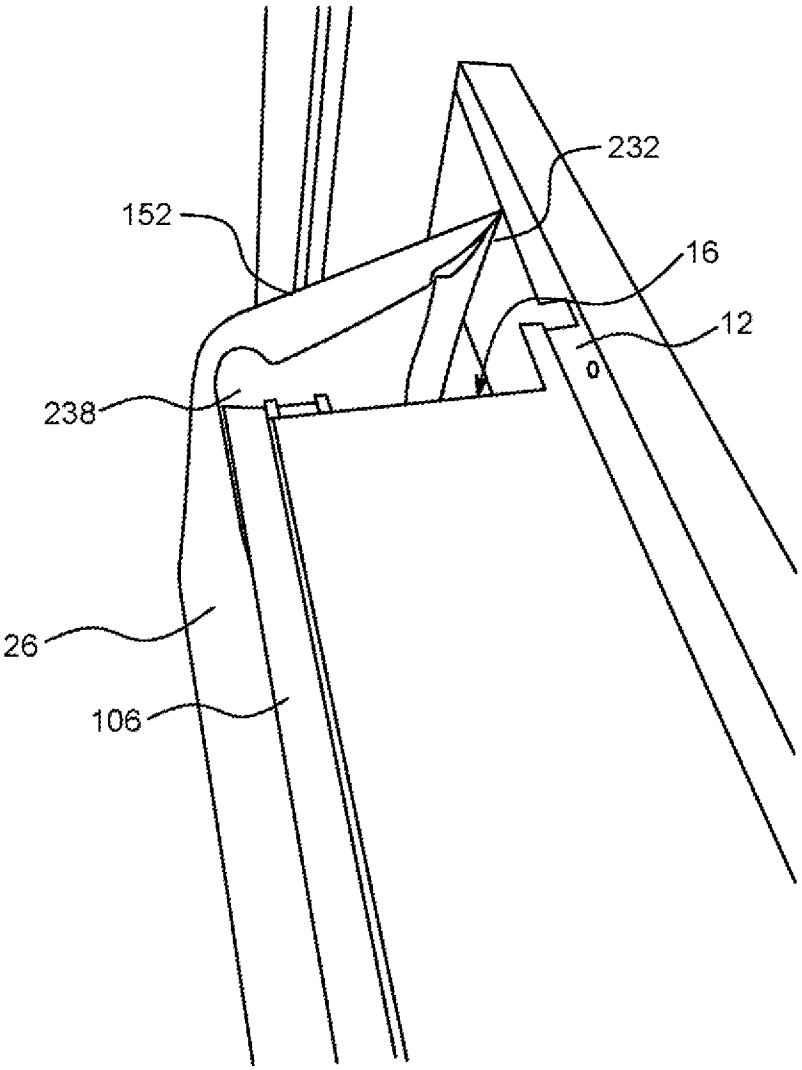
FIG. 26 is a top perspective view of the end of a valance system, the view showing the valance covered by covering material, the view showing the end cap bent at the end of the valance, the view showing shade material hanging down from the track.
Figure 27:
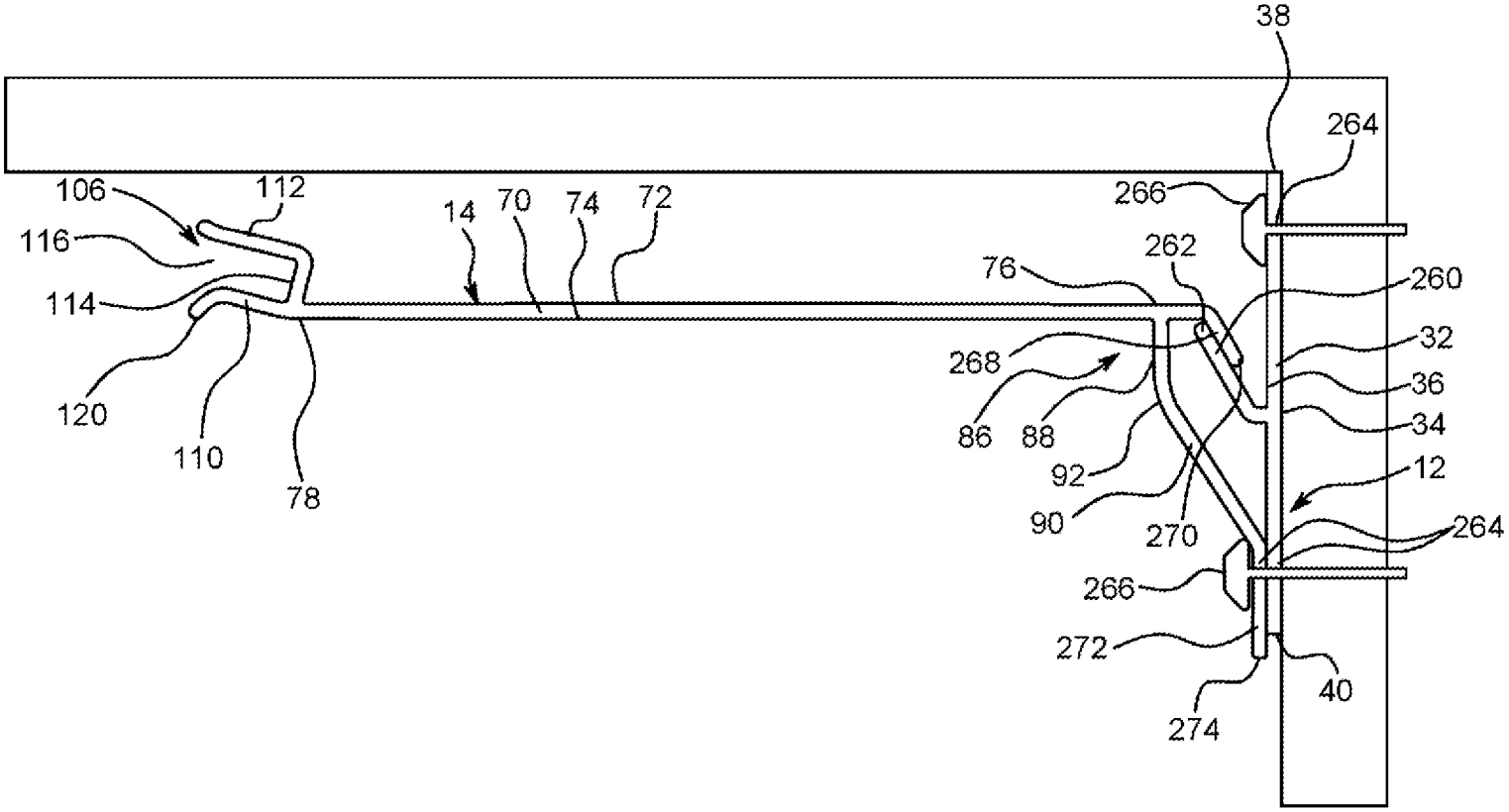
FIG. 27 is a side elevation view of an alternative design for wall bracket and top bracket, the view showing the wall bracket installed into the wall and in engagement with the ceiling and the top bracket positioned on the wall bracket.
Figure 28:
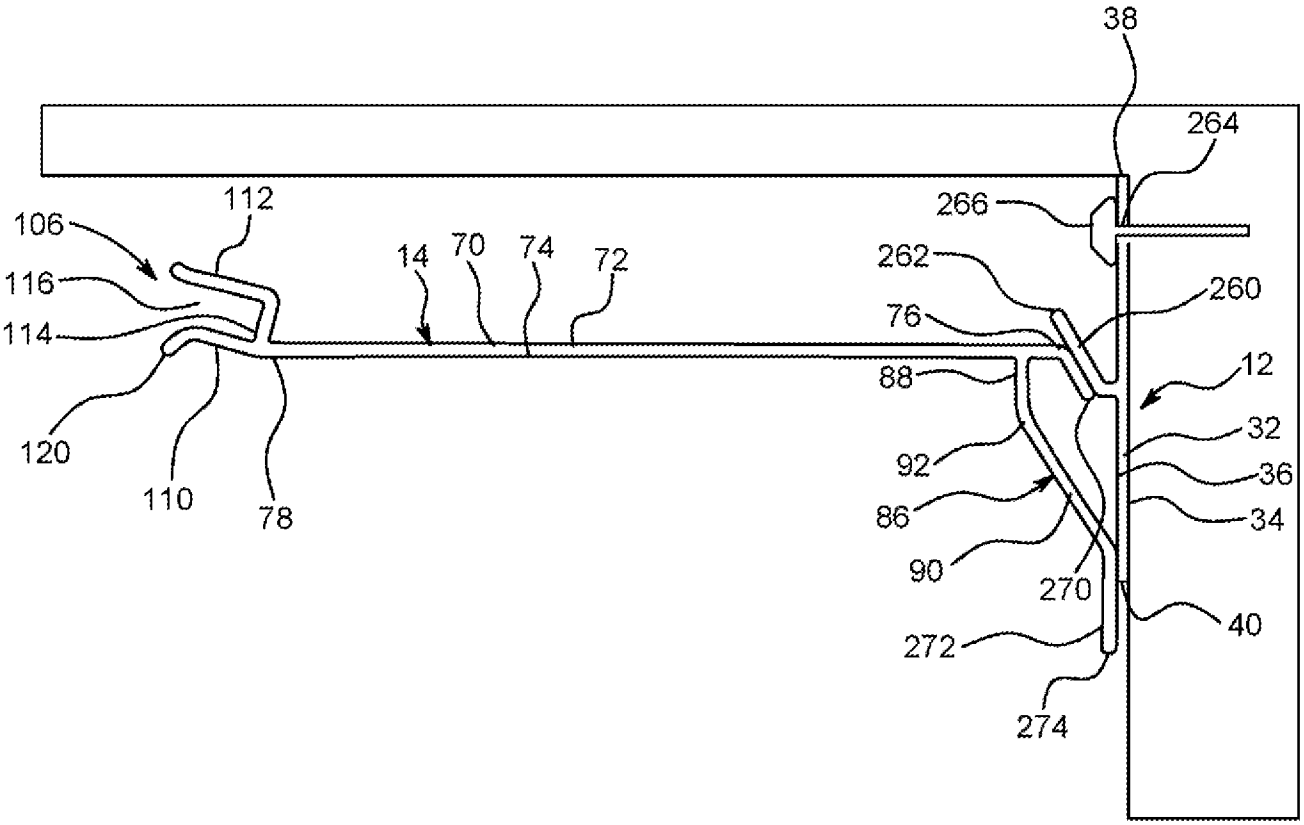
FIG. 28 is a side elevation view of an alternative design for wall bracket and top bracket, the view showing the top bracket being installed onto the wall bracket with the first arm of the top bracket in engagement with and sliding upward upon the first arm of the wall bracket.
Figure 29:
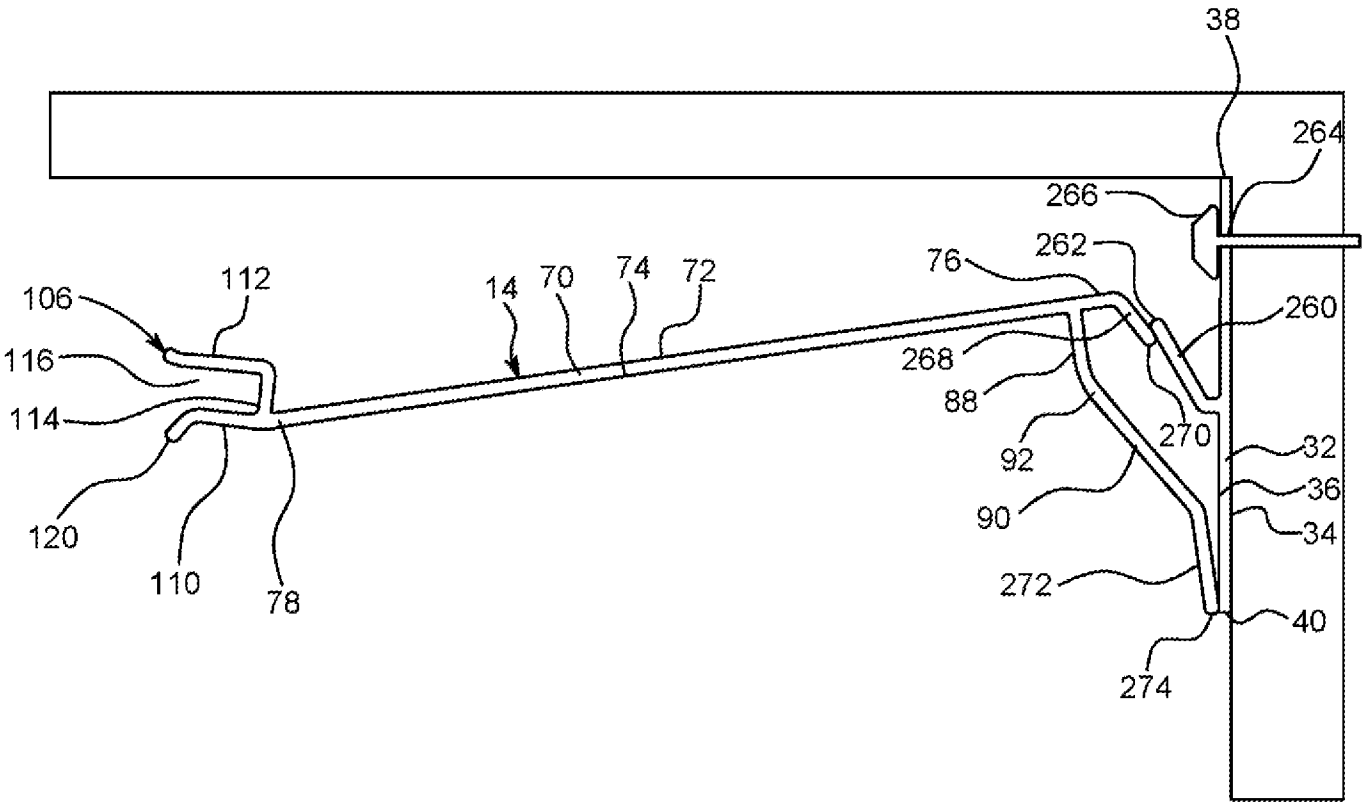
FIG. 29 is a side elevation view of an alternative design for wall bracket and top bracket, the view showing the top bracket being installed onto the wall bracket with the first arm of the top bracket in engagement with and just about to pass over the upper end of the first arm of the wall bracket, the view showing the forward end of the top bracket tipped downward.
Figure 30:
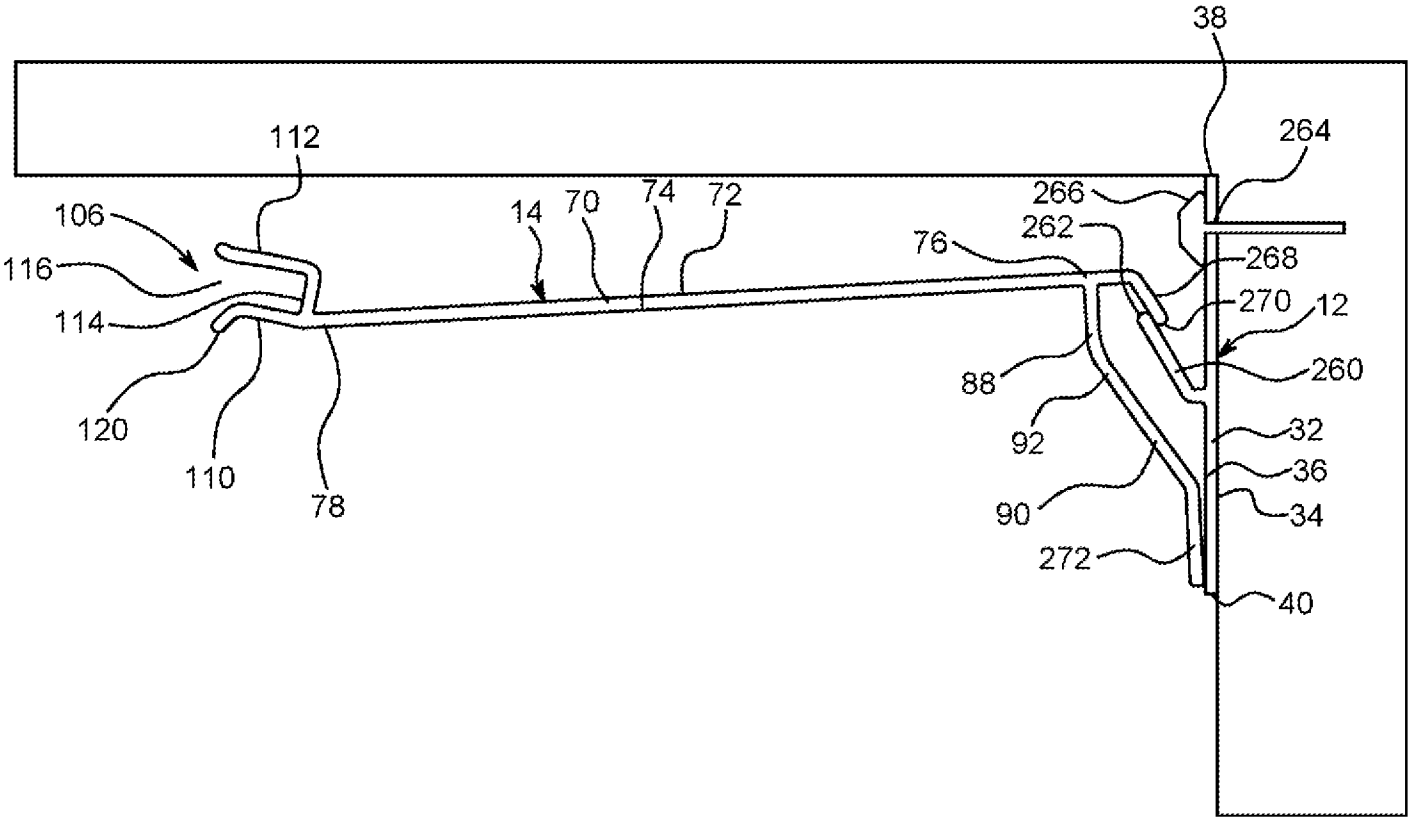
FIG. 30 is a side elevation view of an alternative design for wall bracket and top bracket, the view showing the top bracket being installed onto the wall bracket with the first arm of the top bracket in engagement with and just passed over the upper end of the first arm of the wall bracket, the view showing the forward end of the top bracket tipped downward and the top bracket about to slide downward onto the wall bracket.
Figure 31:
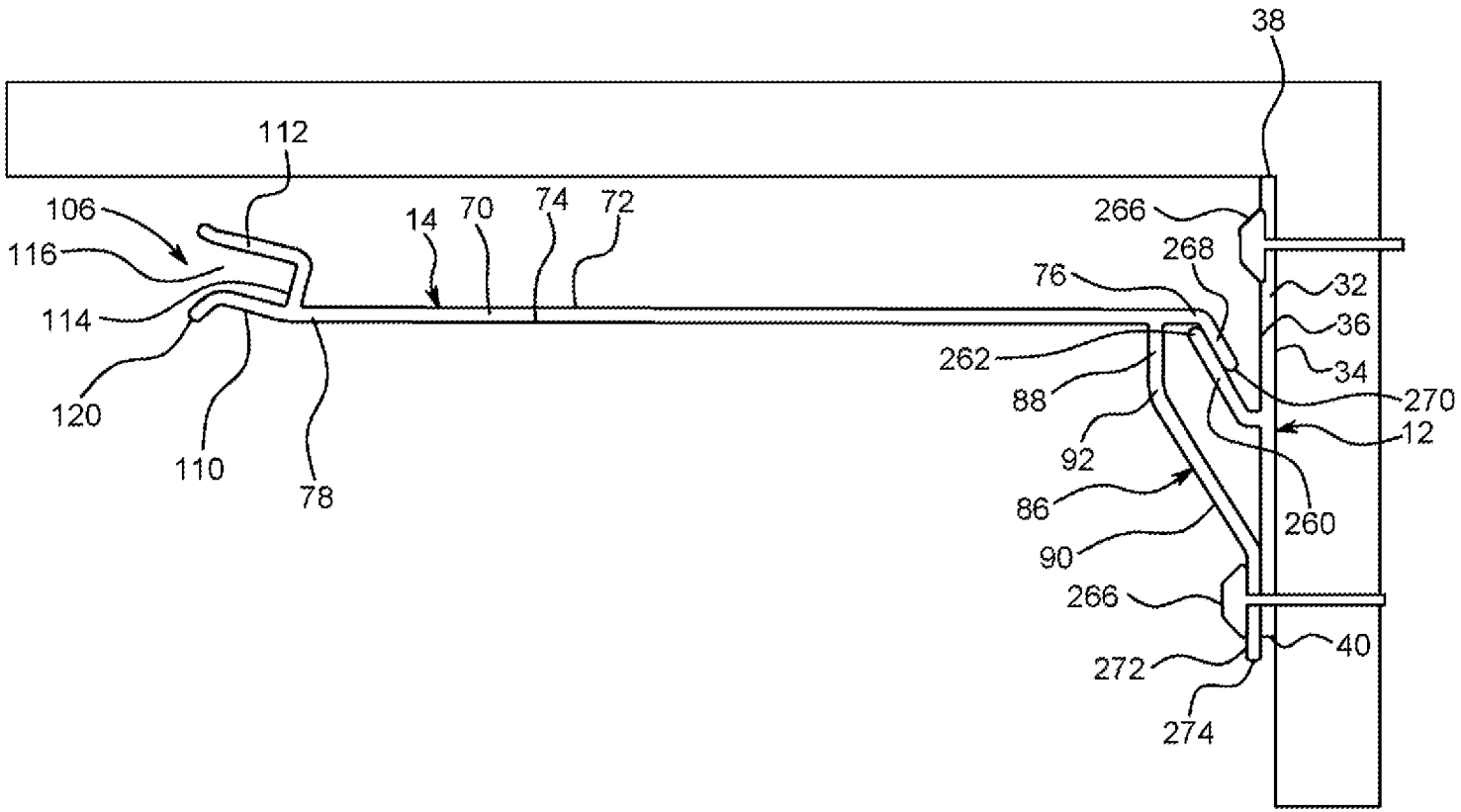
FIG. 31 is a side elevation view of an alternative design for wall bracket and top bracket, the view showing the top bracket installed onto the wall bracket with the first arm of the top bracket in engagement with and over the first arm of the wall bracket, the view showing the support foot of the top bracket fastened to the wall through the lower end of the wall bracket.
Figure 32:
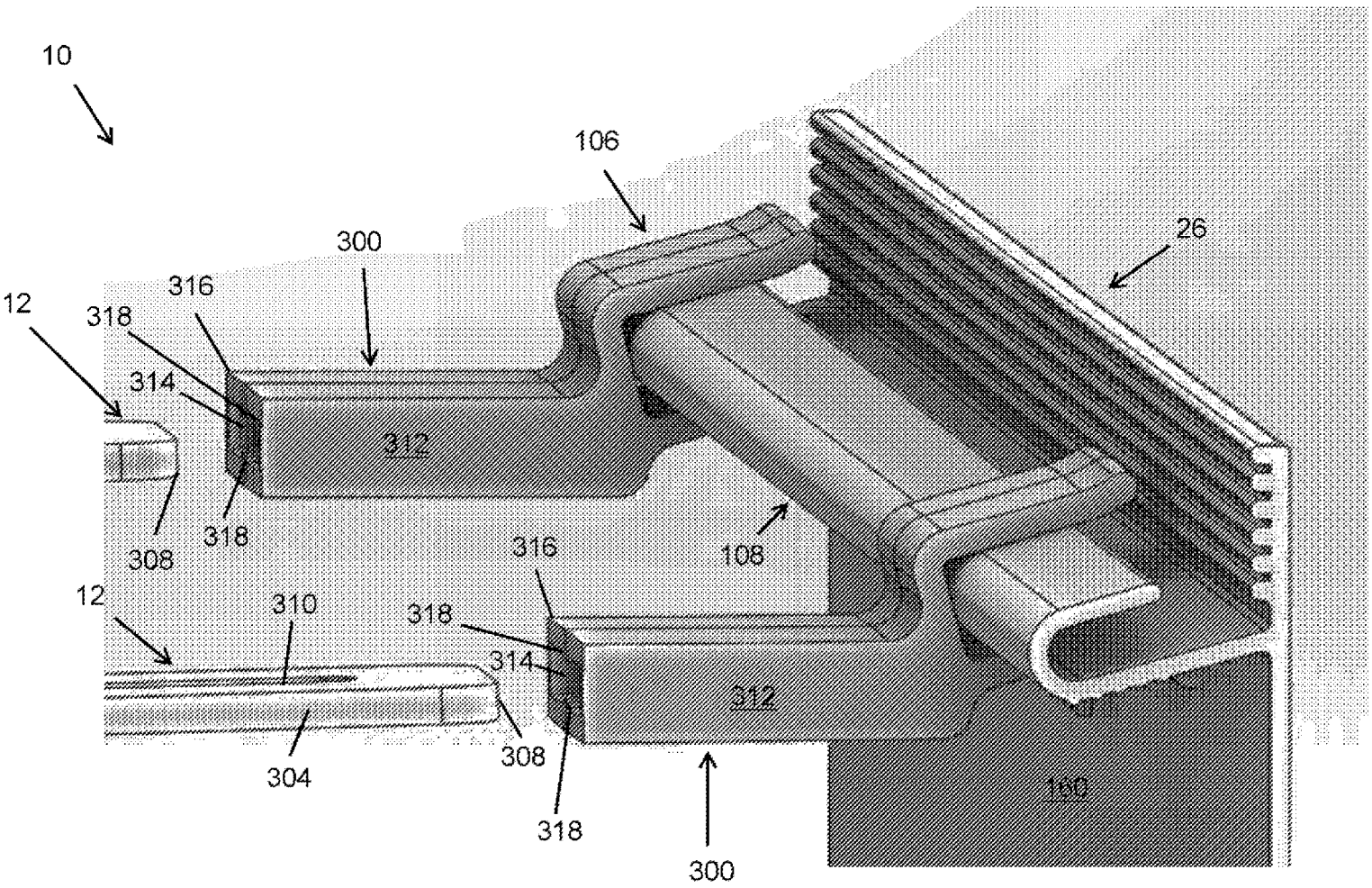
FIG. 32 is a perspective view of the valance system, the view showing the wall brackets and the clips unattached, the view showing the sockets and the clip feature attached.
Figure 33:
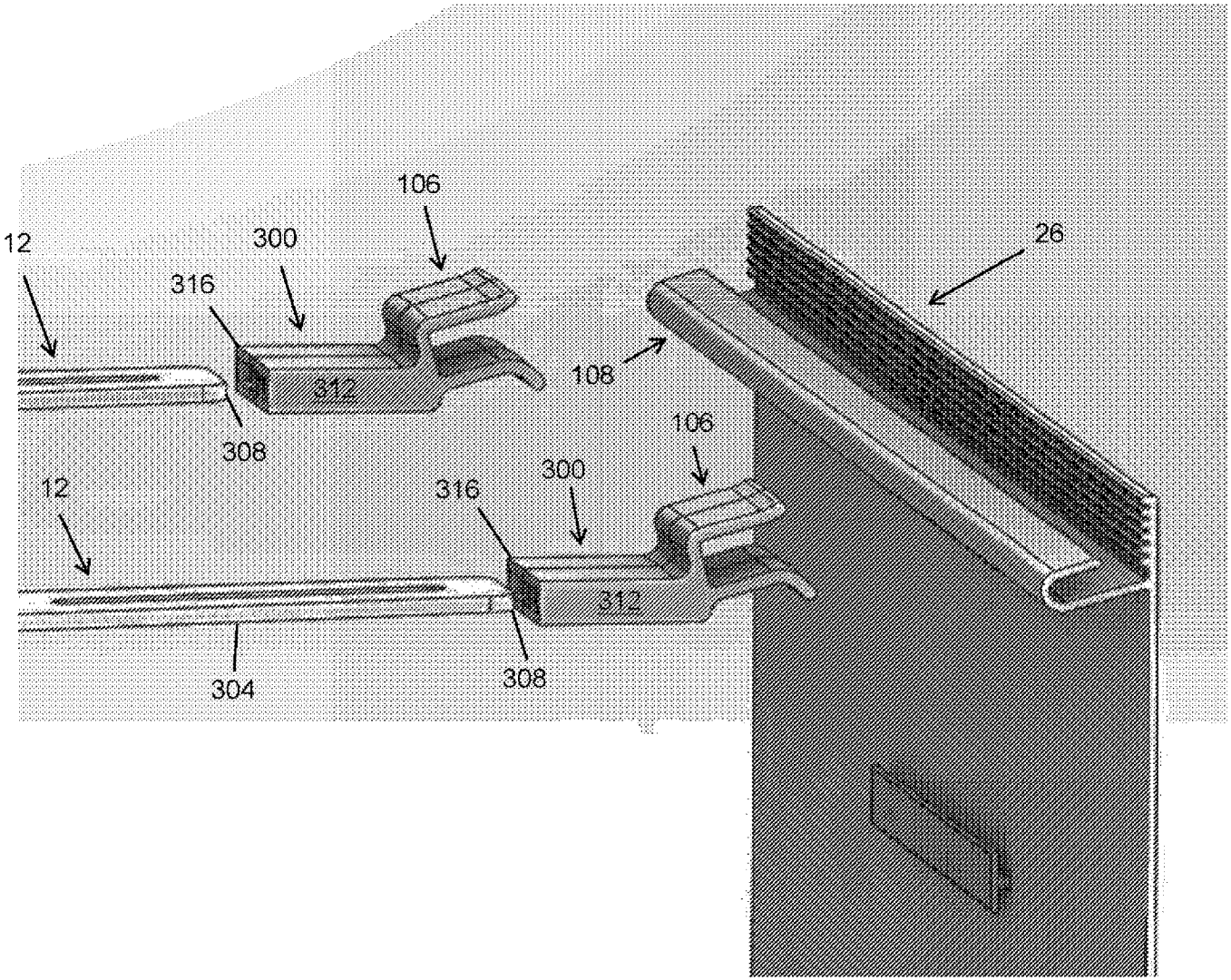
FIG. 33 is a perspective view of the valance system, the view showing the wall brackets and the clips unattached, the view showing the sockets and the clip feature unattached.
Figure 34:
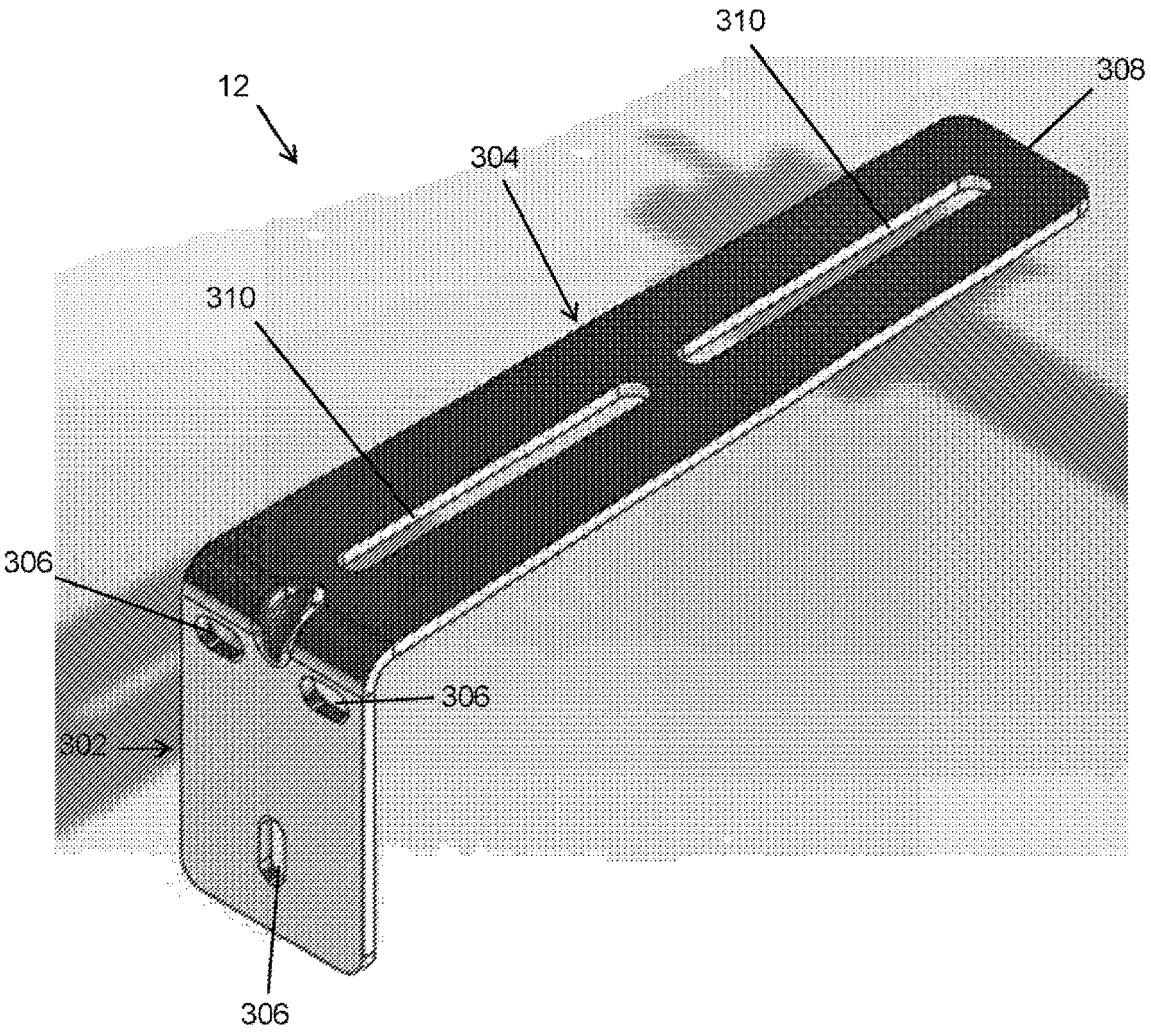
FIG. 34 is a perspective view of a wall bracket.
Figure 35:
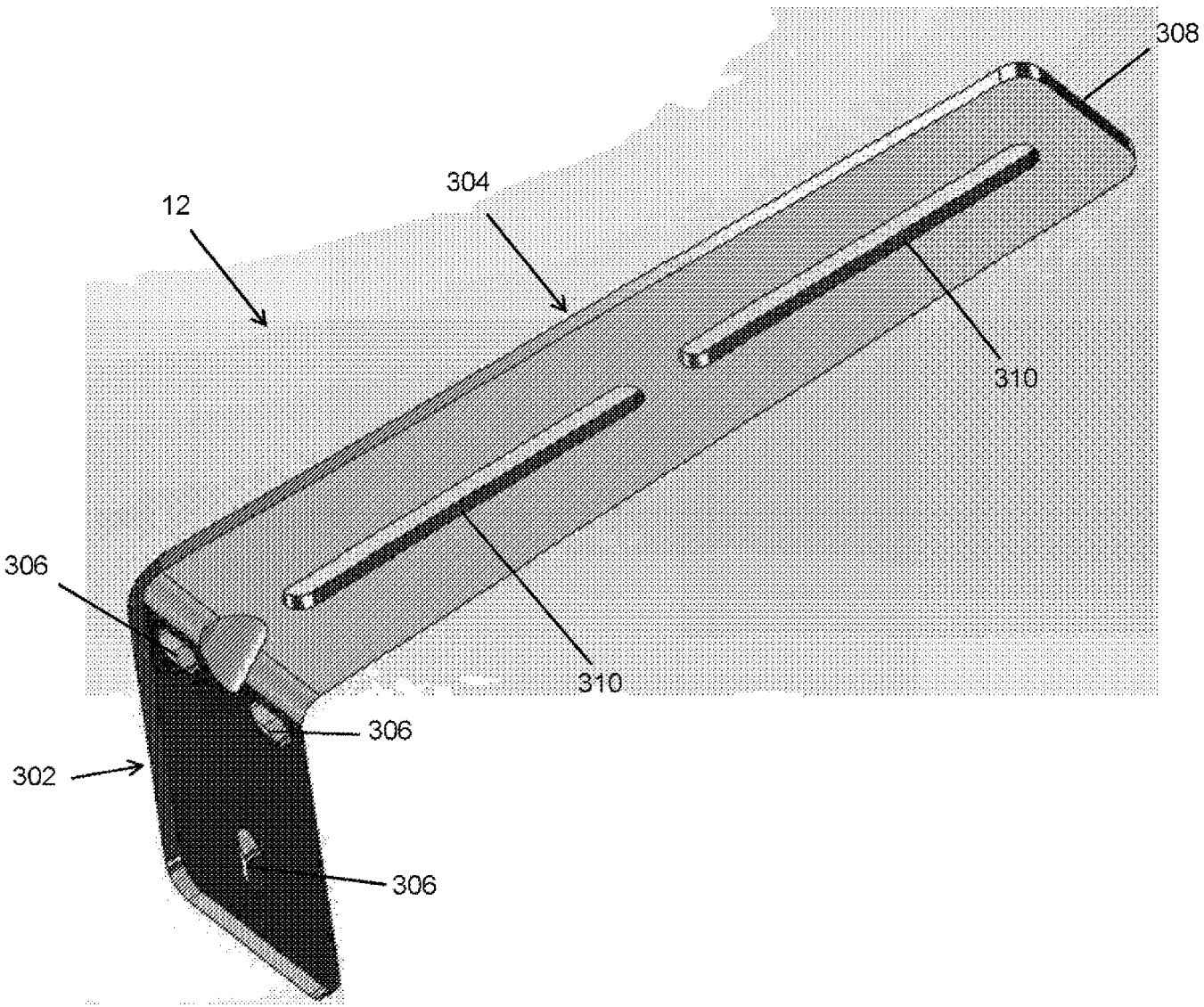
FIG. 35 is a rear elevation view of a wall bracket.
Figure 36:
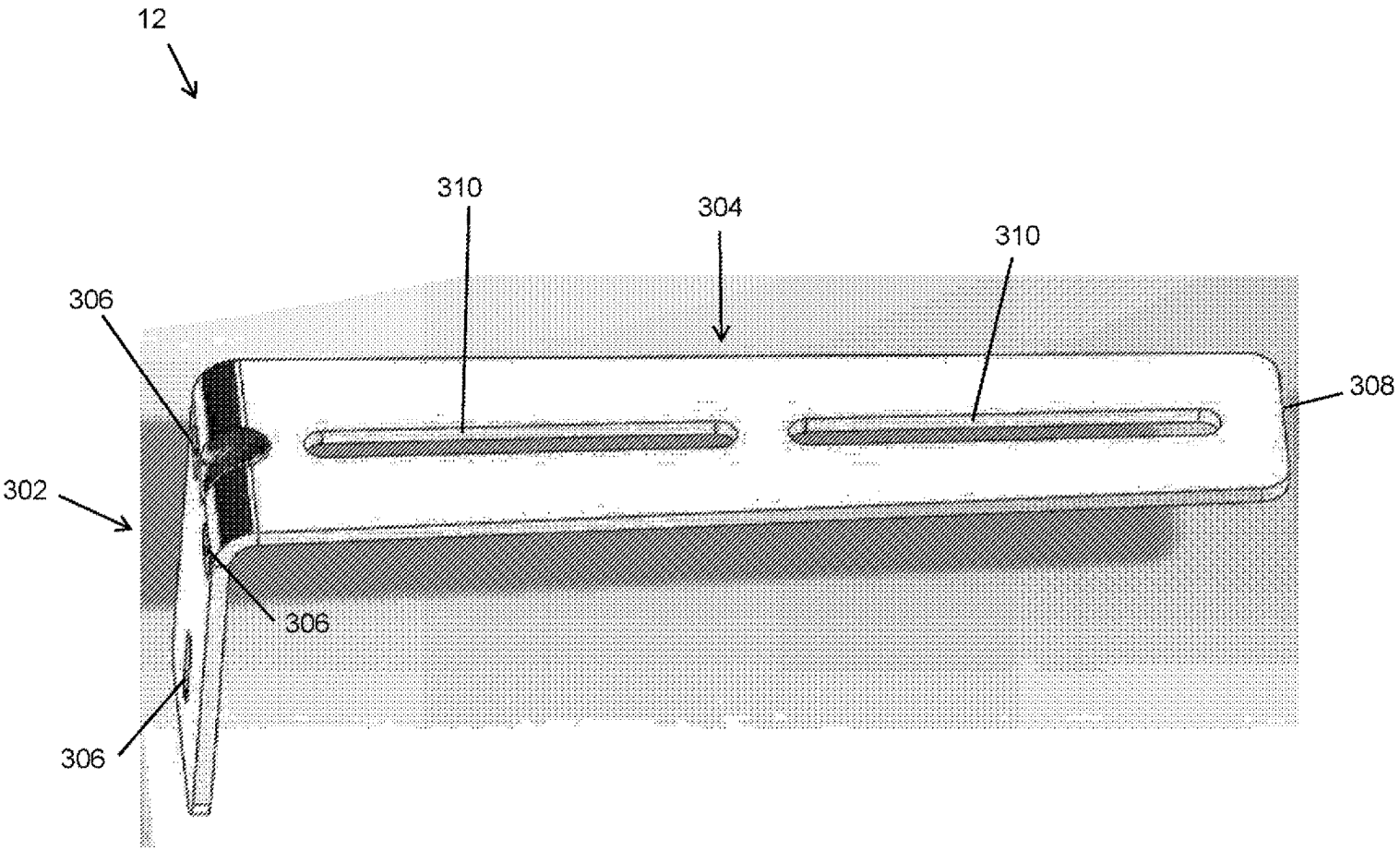
FIG. 36 is a top perspective view of a wall bracket.
Figure 37:
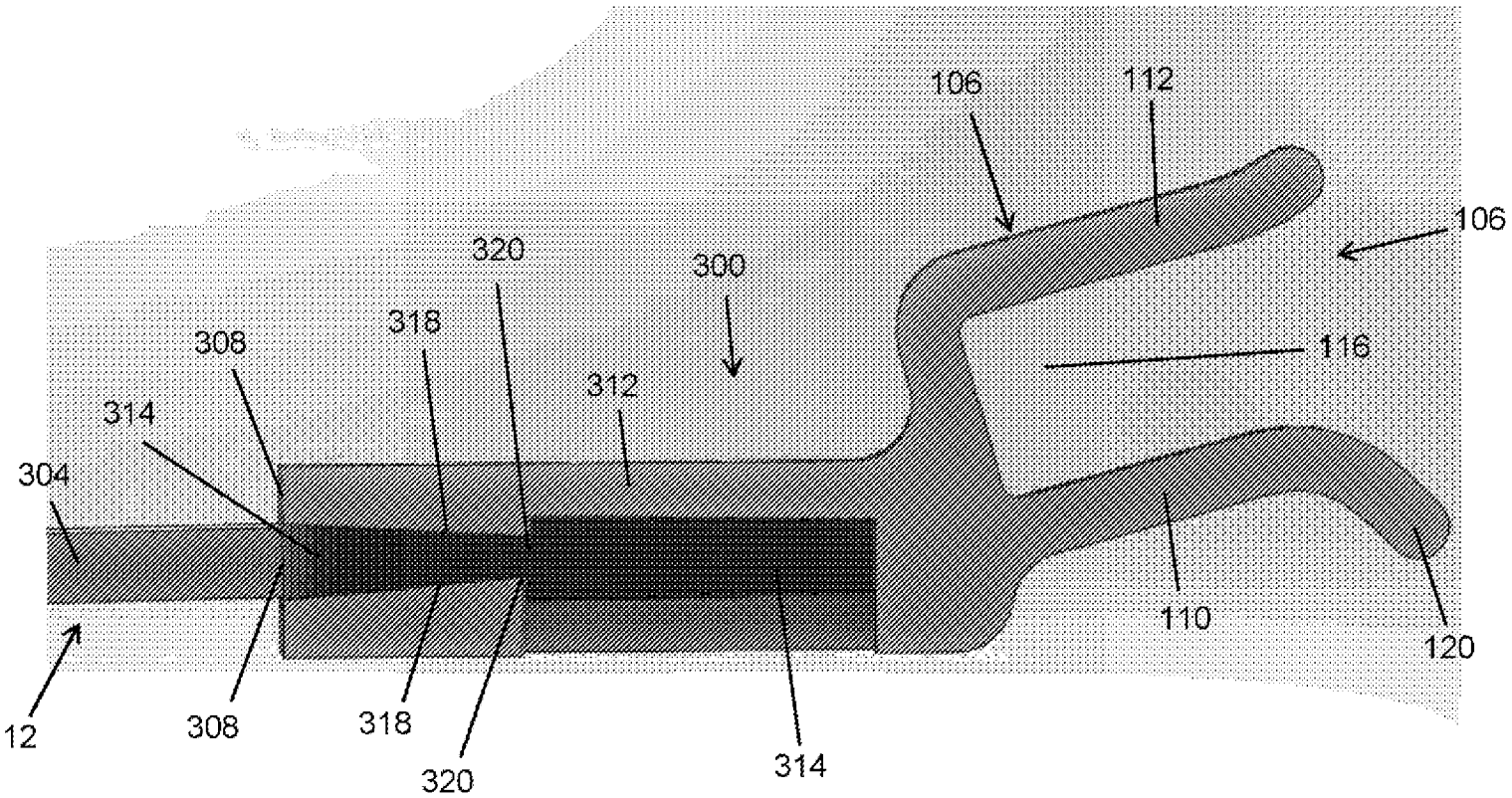
FIG. 37 is a side elevation view of a wall bracket connected to a clip.
Figure 38:
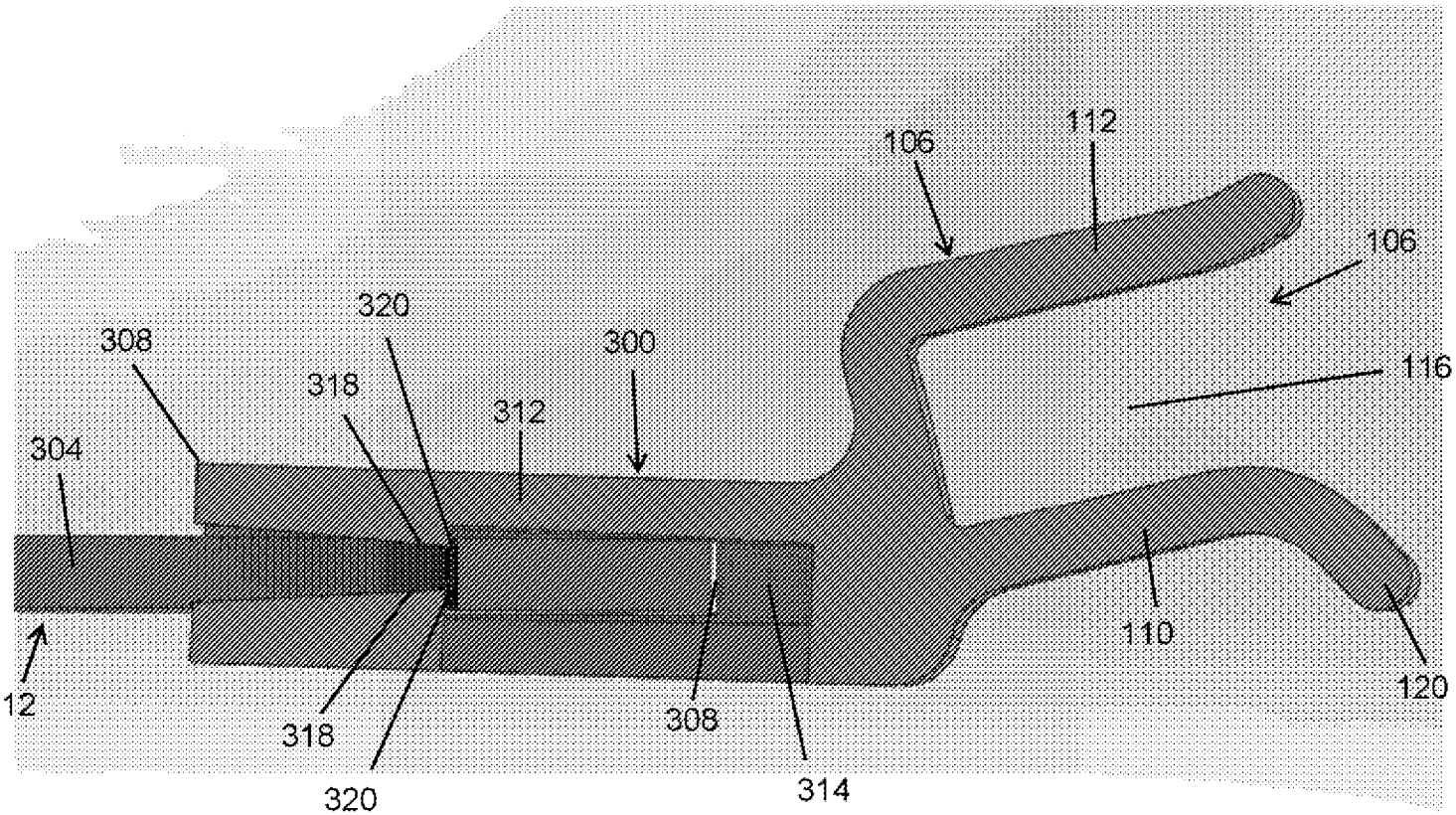
FIG. 38 is a side elevation view of a wall bracket connected to a clip.
Figure 39:
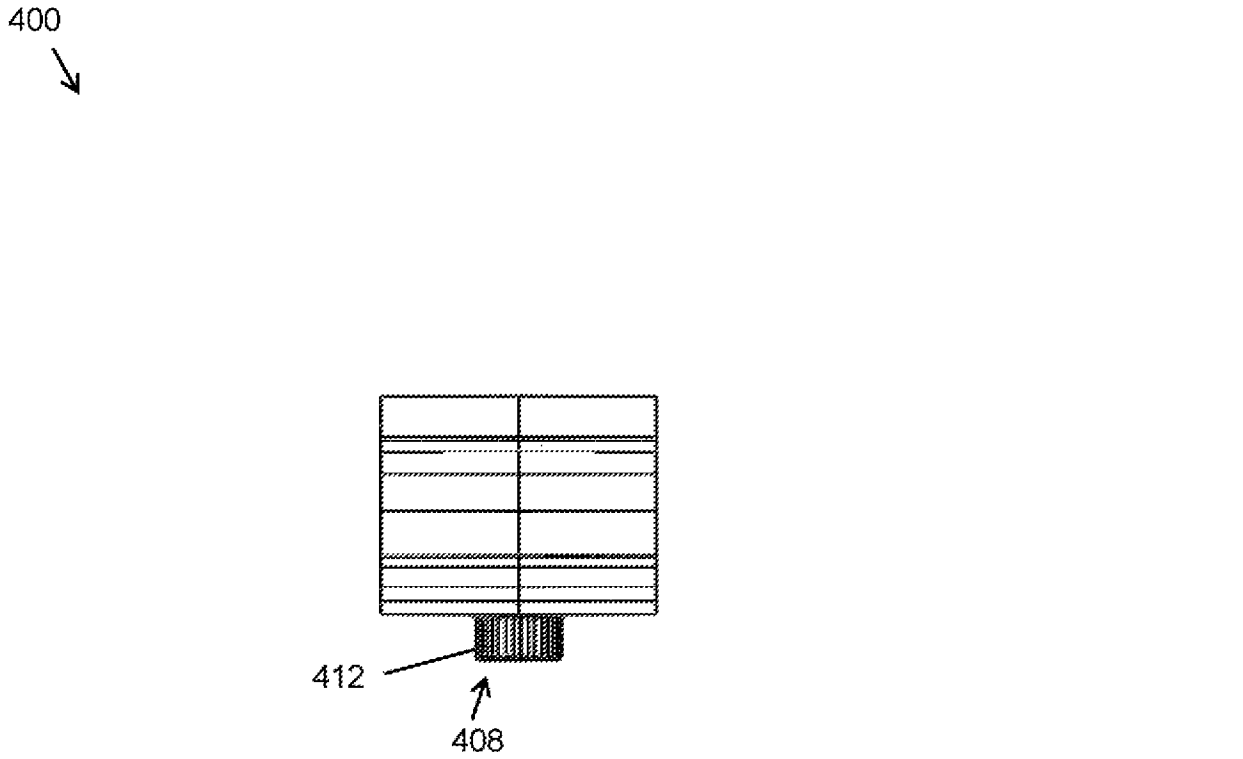
FIG. 39 is a front elevation view of an adjustable valance clip.
Figure 40:
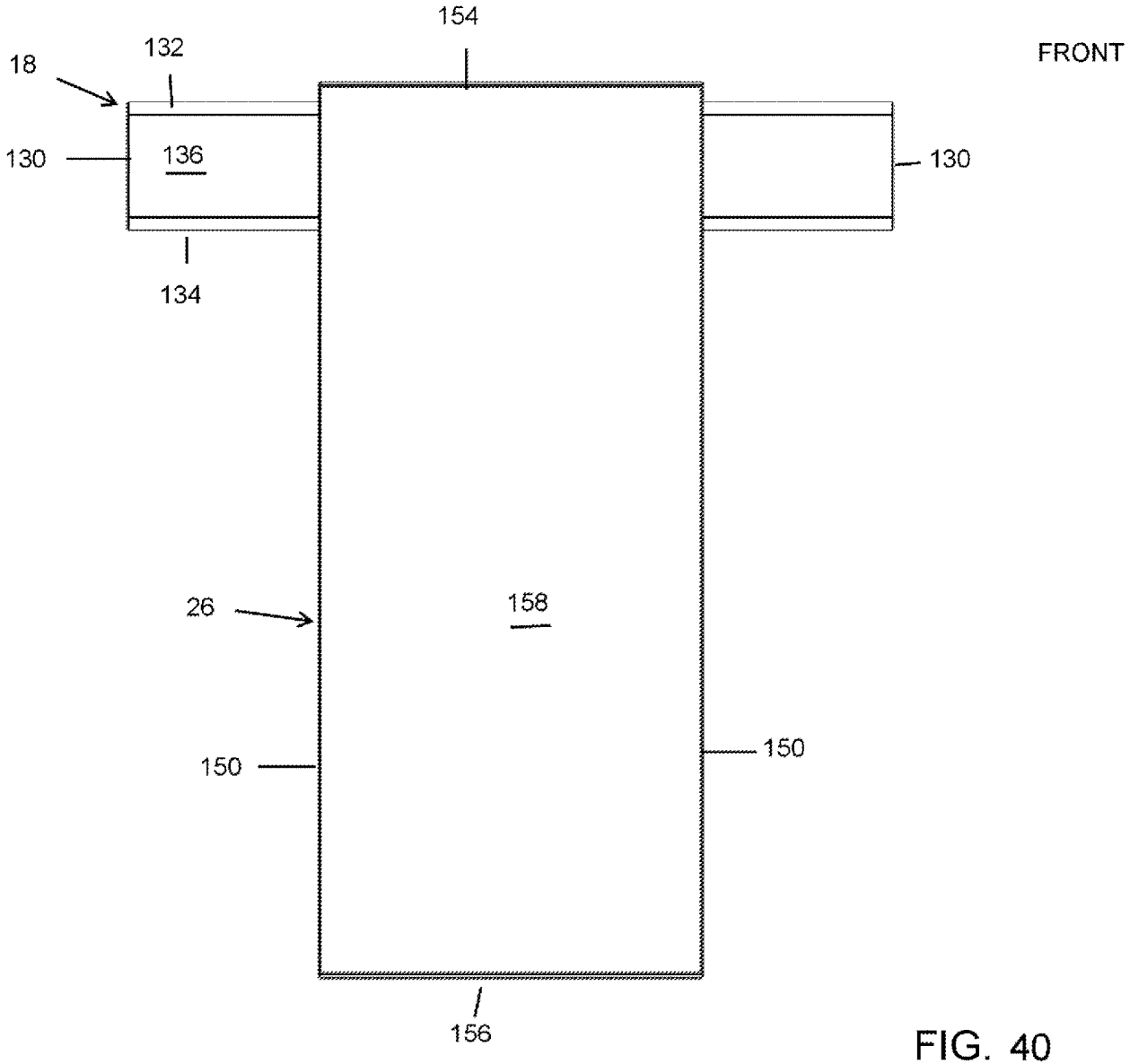
FIG. 40 is a front elevation view of an adjustable valance clip used to install a valance on a track.
Figure 41:
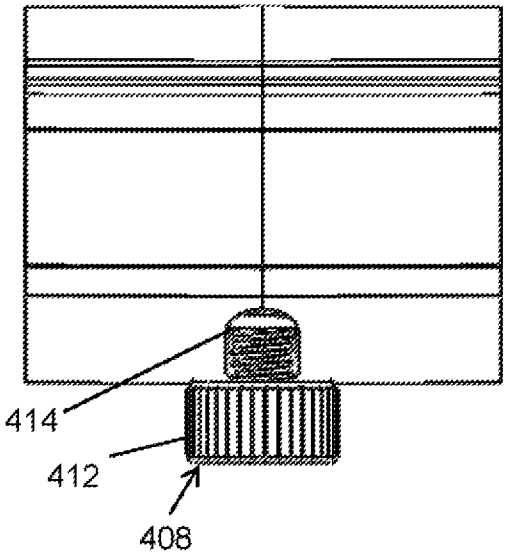
FIG. 41 is a rear elevation view of an adjustable valance clip.
Figure 42:
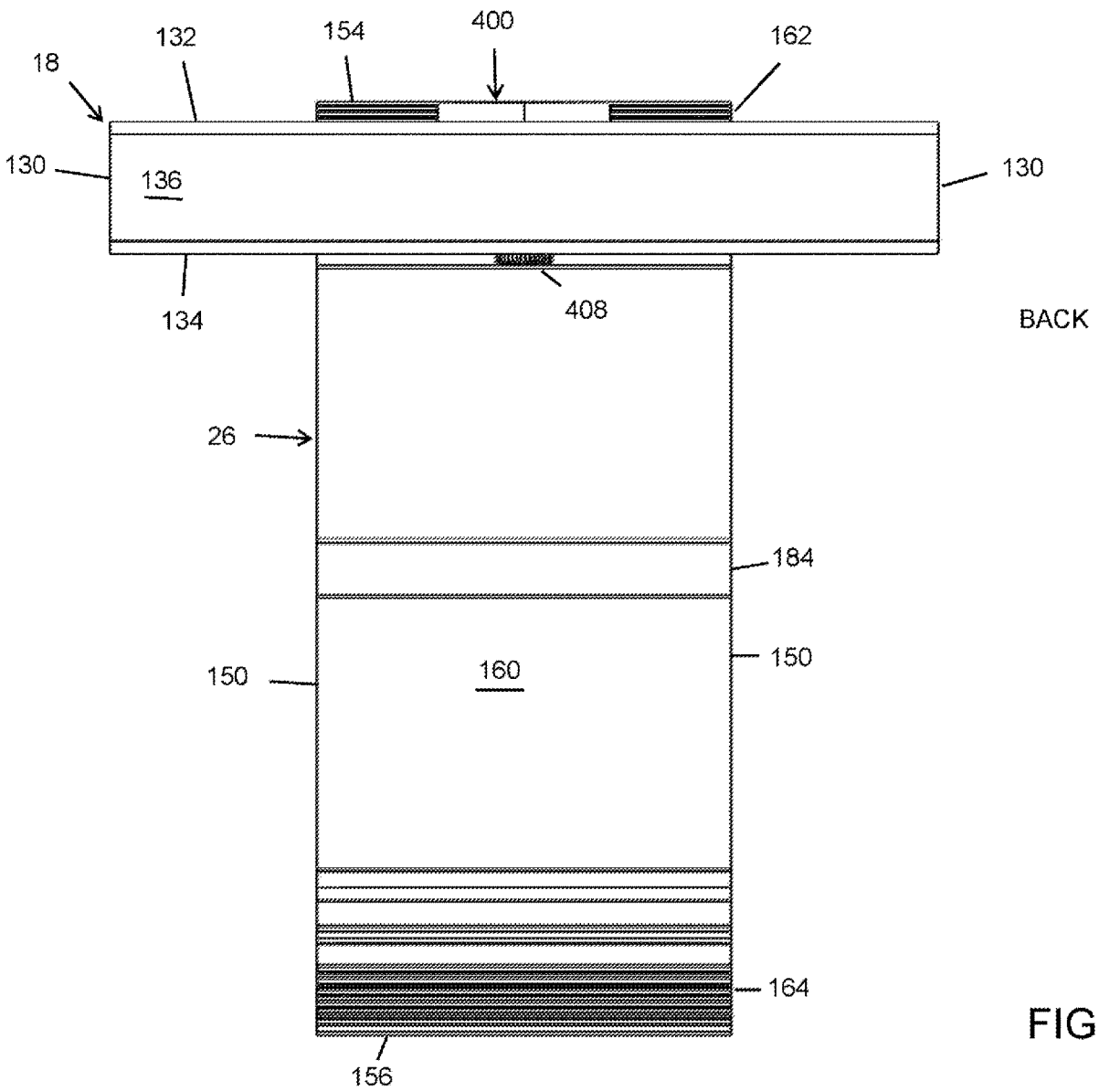
FIG. 42 is a rear elevation view of an adjustable valance clip used to install a valance on a track.
Figure 43:
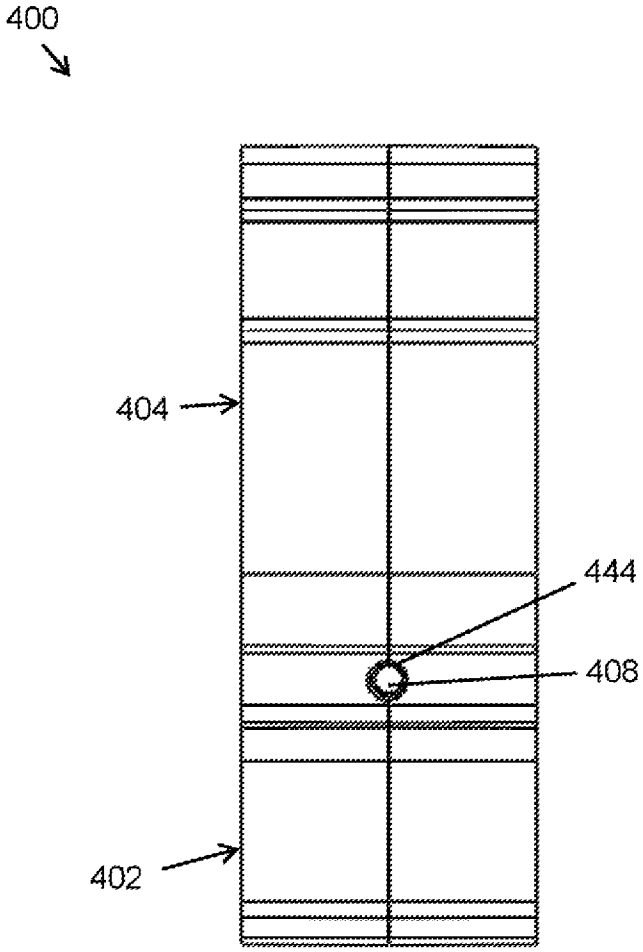
FIG. 43 is a top elevation view of an adjustable valance clip.
Figure 44:
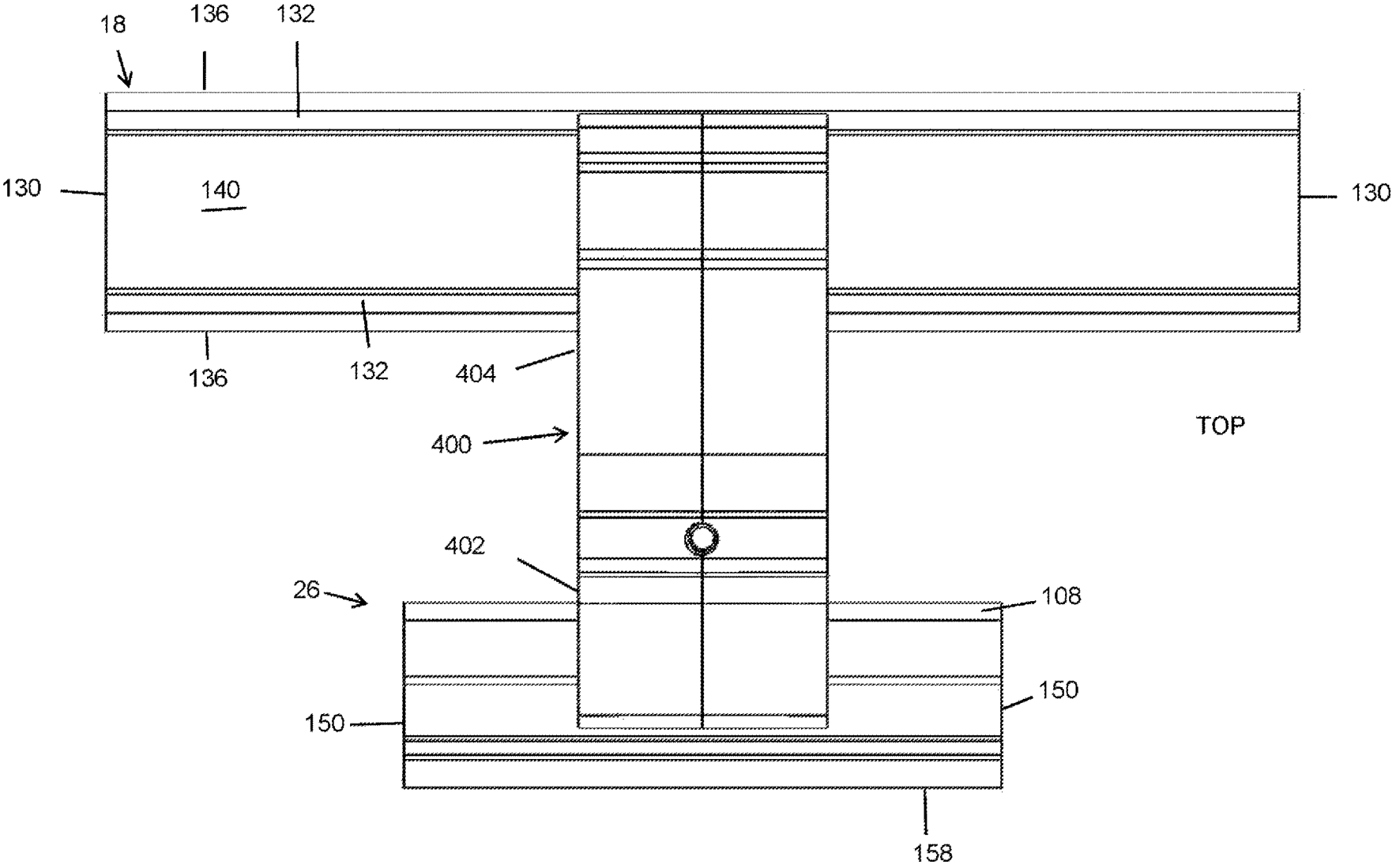
FIG. 44 is a top elevation view of an adjustable valance clip used to install a valance on a track.
Figure 45:
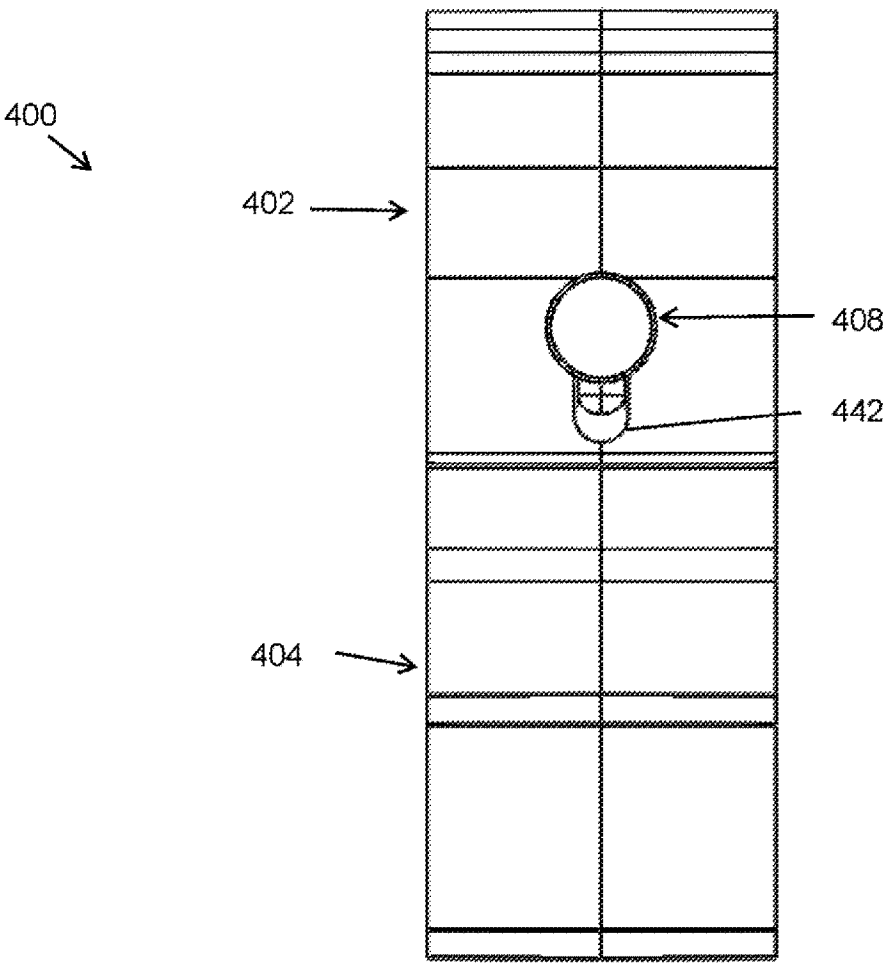
FIG. 45 is a bottom elevation view of an adjustable valance clip.
Figure 46:
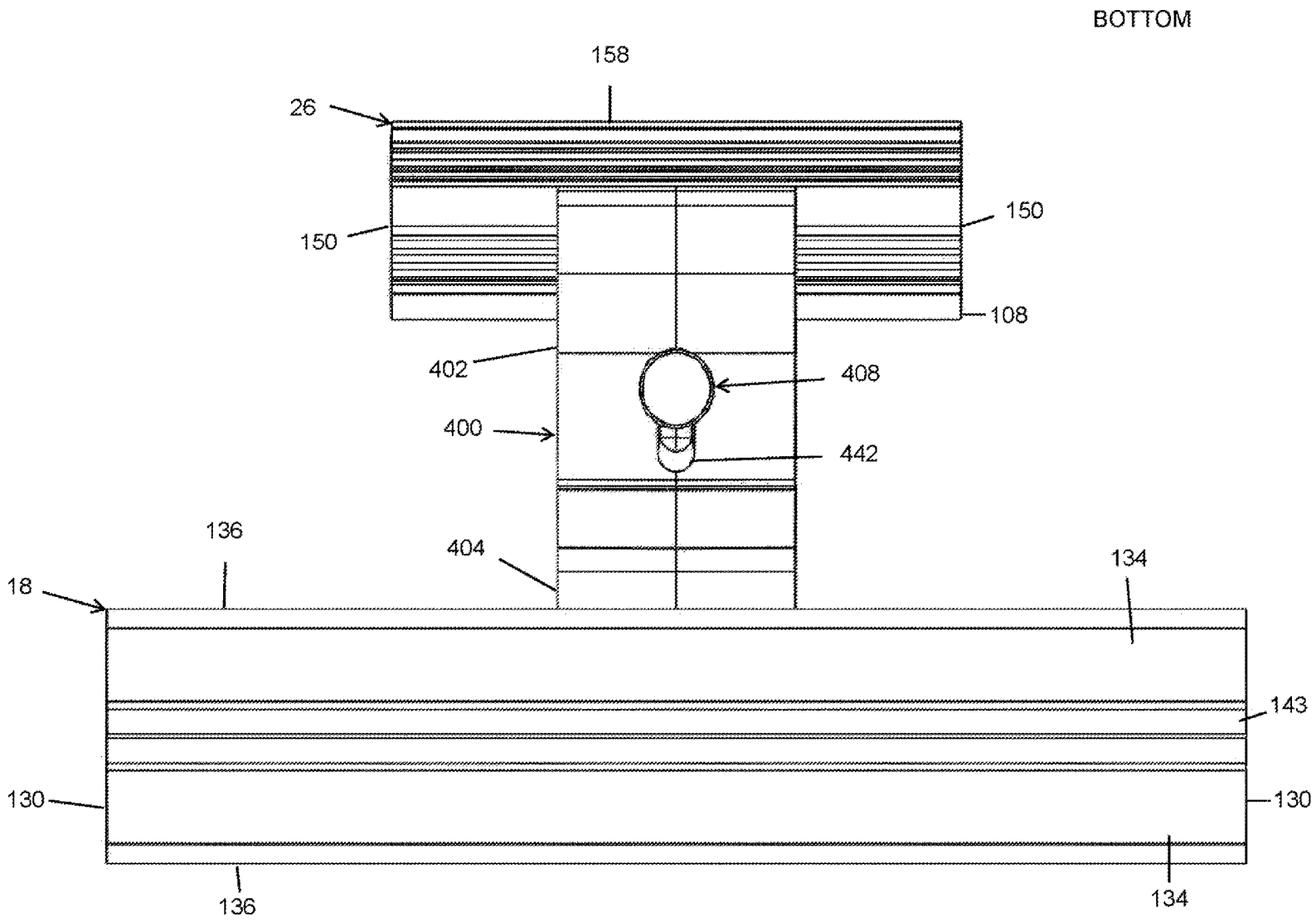
FIG. 46 is a bottom elevation view of an adjustable valance clip used to install a valance on a track.
Figure 47:
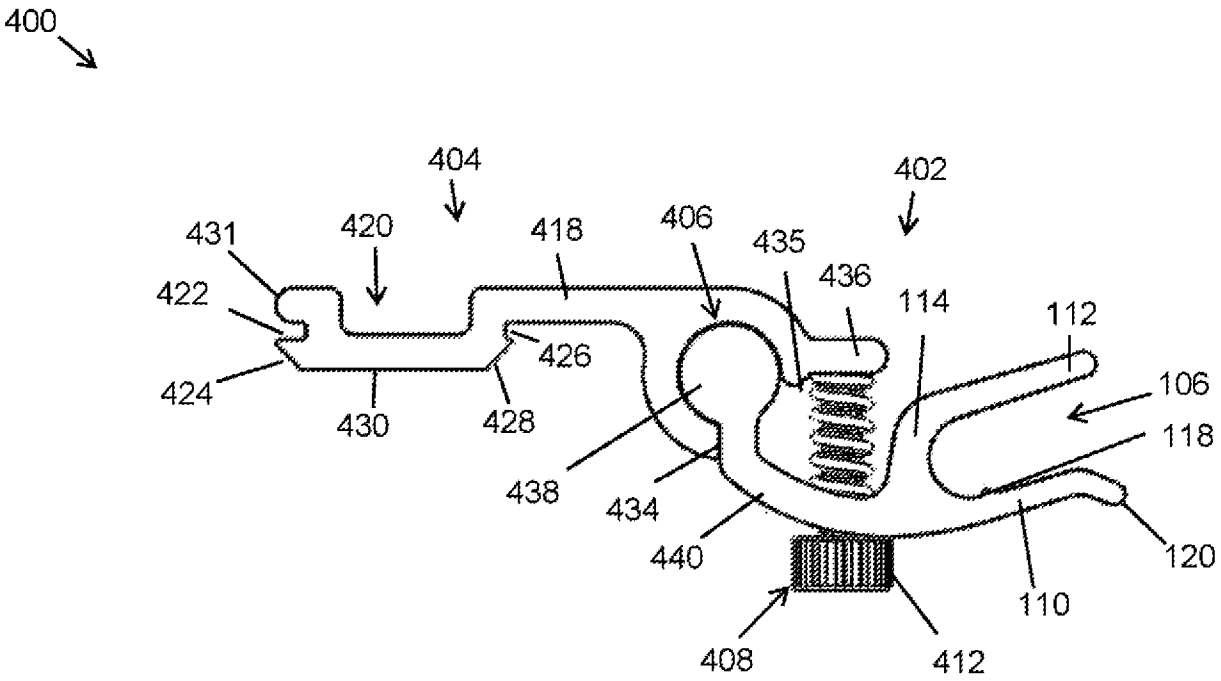
FIG. 47 is a side elevation view of an adjustable valance clip.
Figure 48:
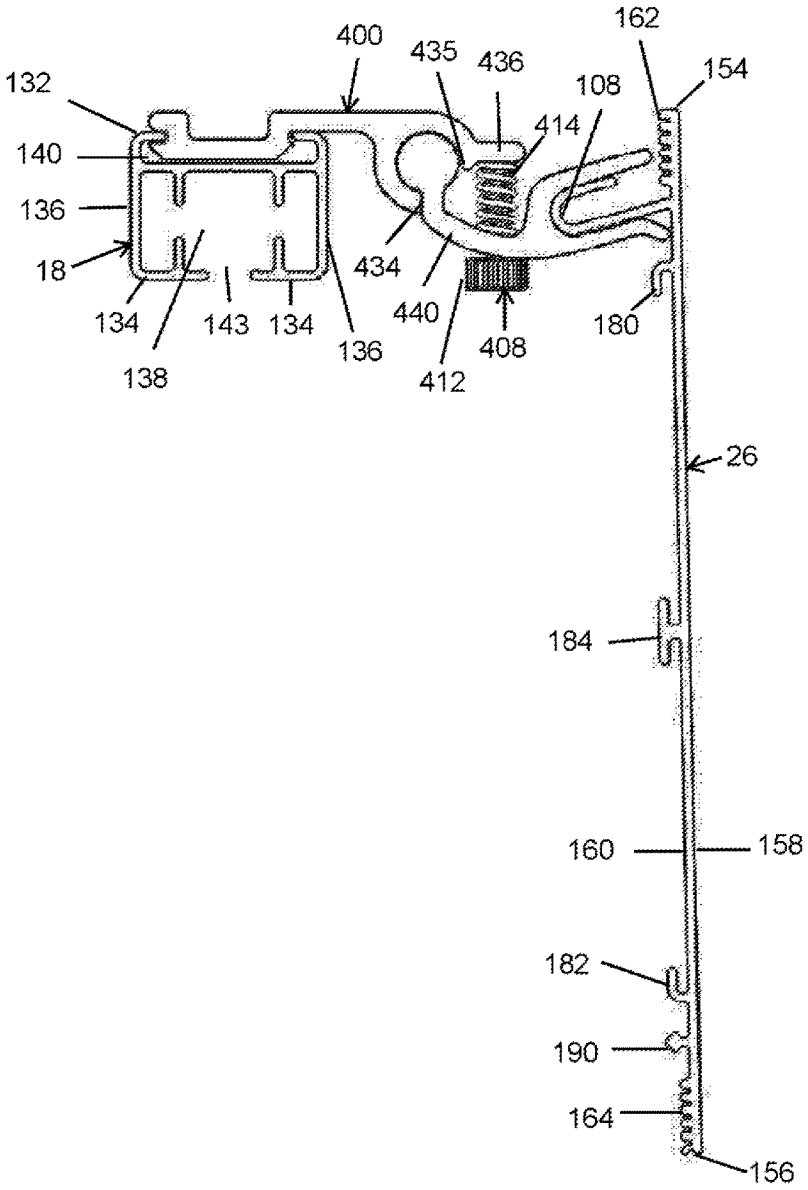
FIG. 48 is a side elevation view of an adjustable valance clip used to install a valance on a track.
Figure 49:
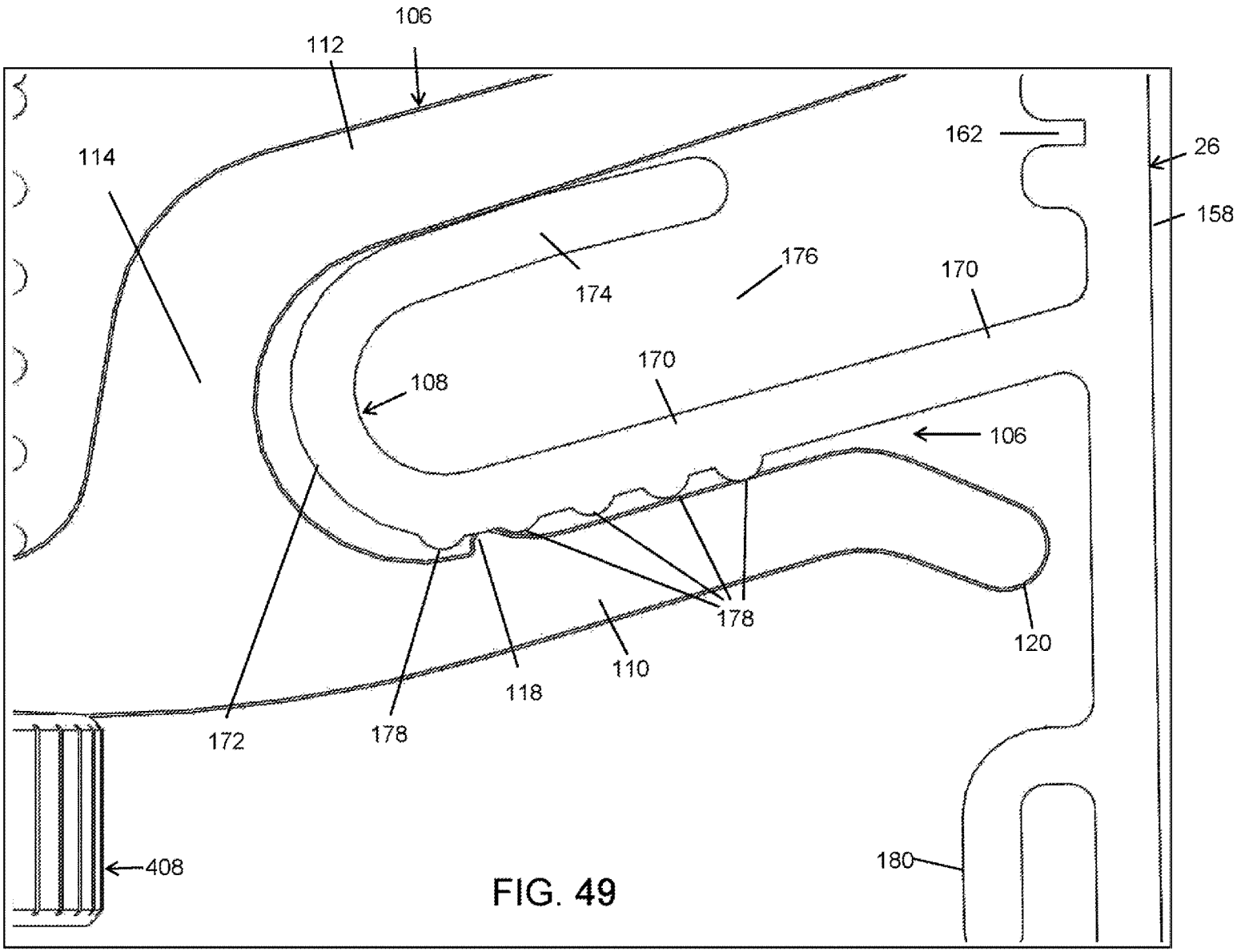
FIG. 49 is a close-up view of the side elevation view of an adjustable valance clip used to install a valance on a track of FIG. 48.
Figure 50:
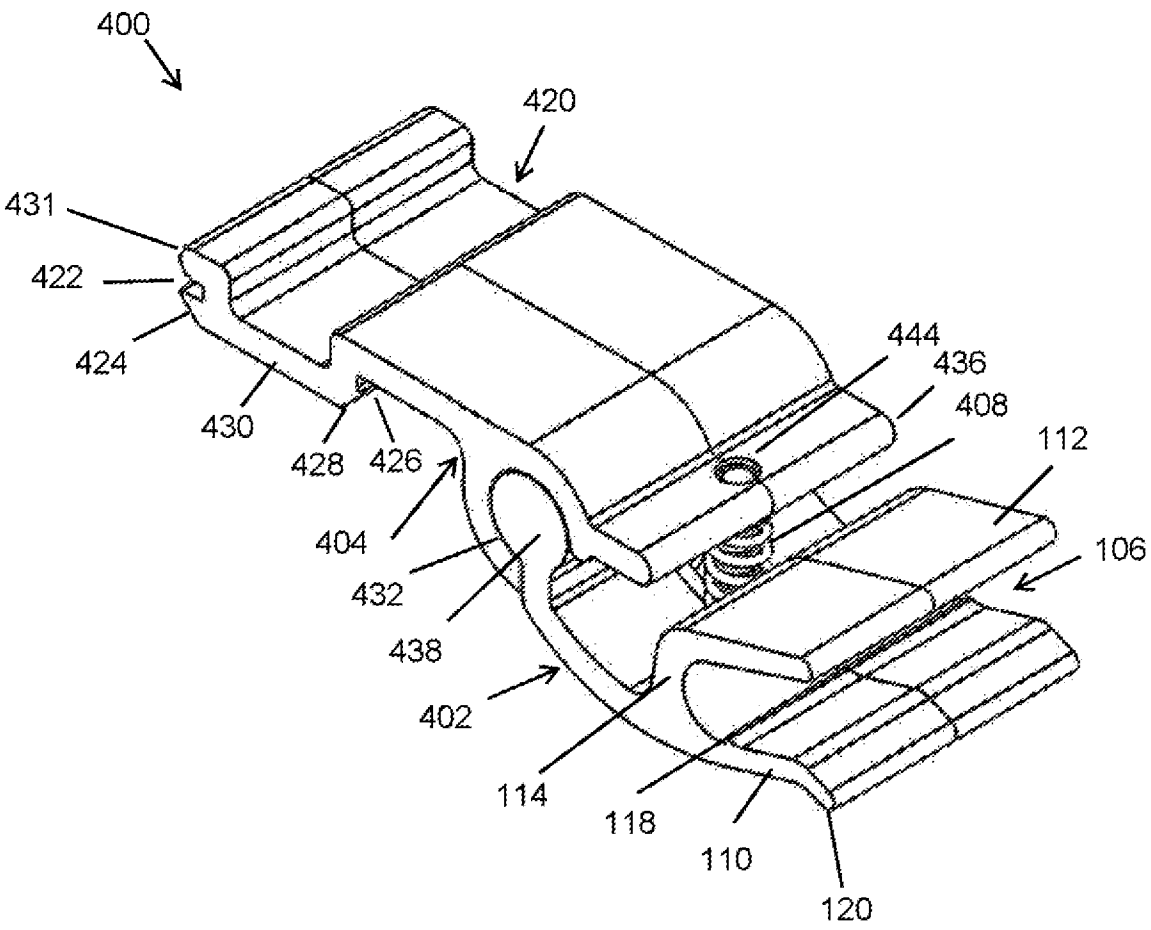
FIG. 50 is a top perspective view of an adjustable valance clip.
Figure 51:
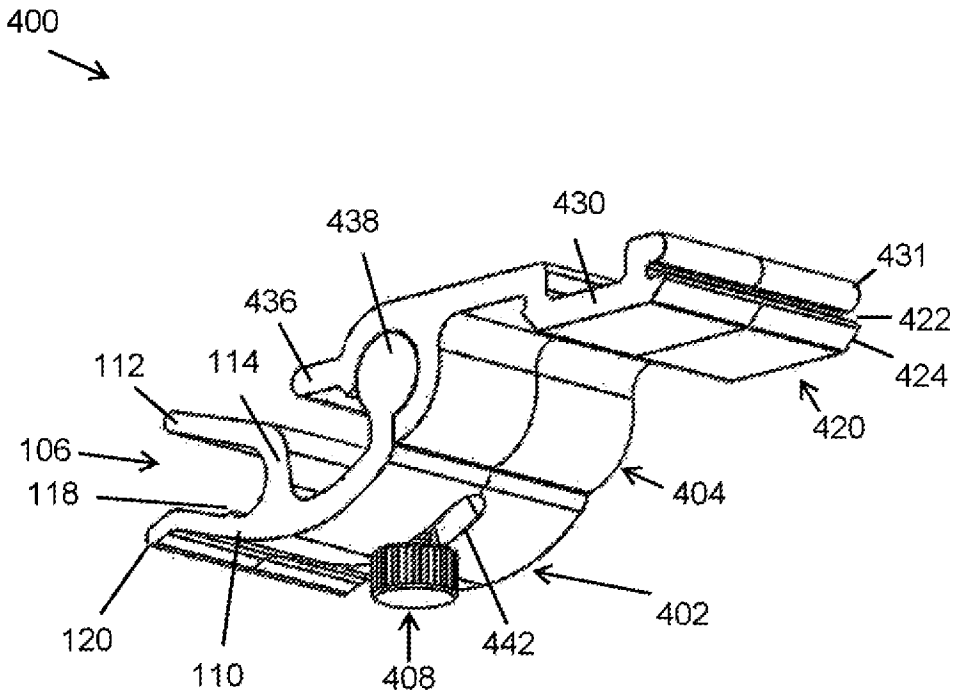
FIG. 51 is a bottom perspective view of an adjustable valance clip.
Figure 52:
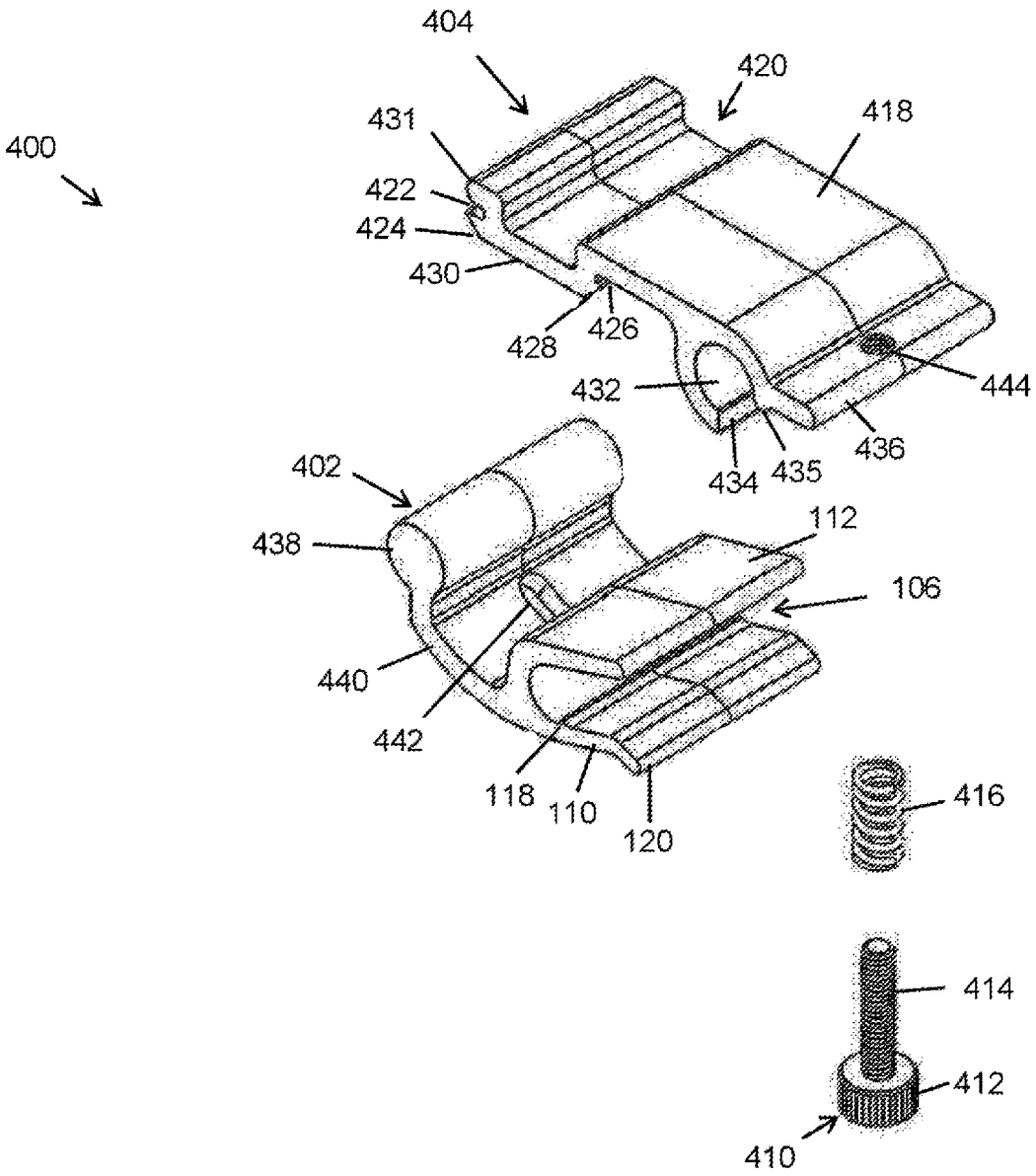
FIG. 52 is an exploded perspective view of an adjustable valance clip.
Figure 53:
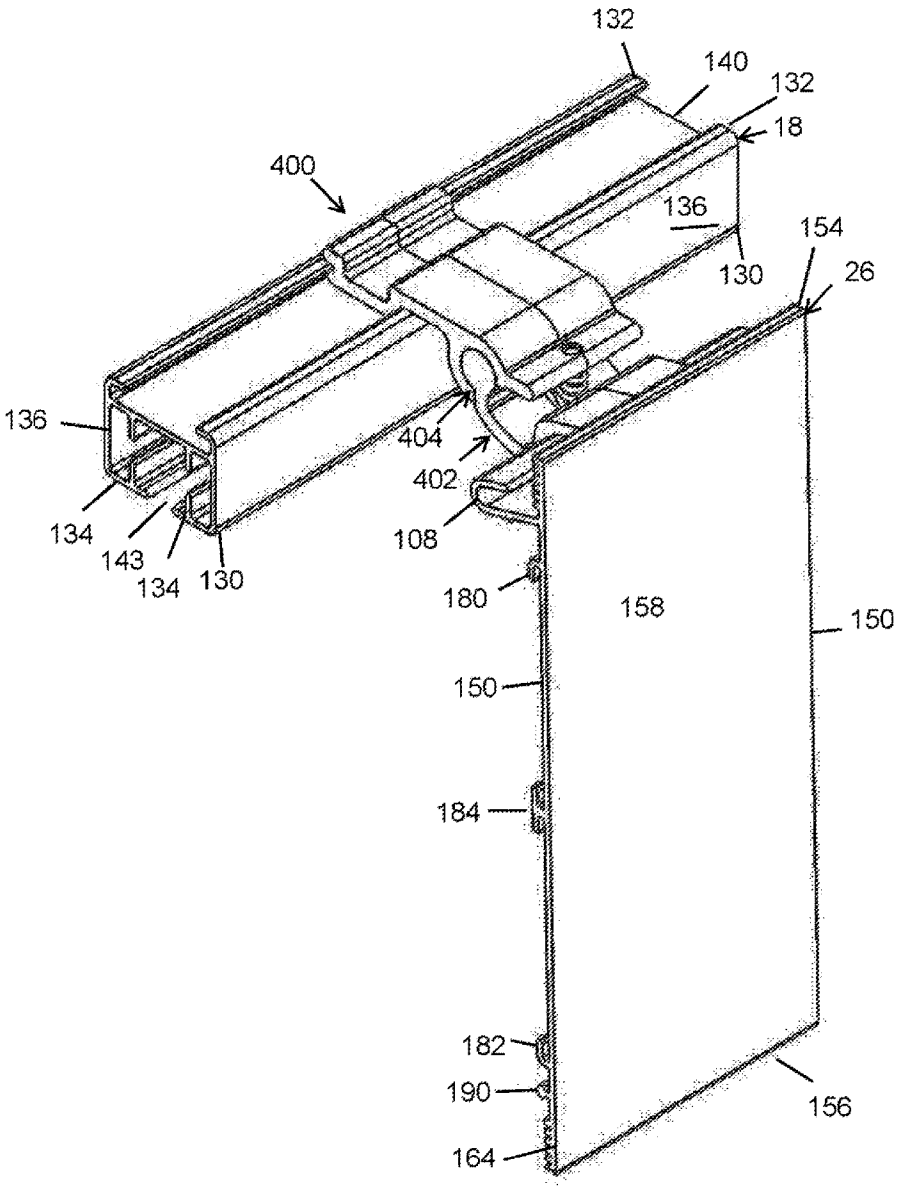
FIG. 53 is a top perspective view of an adjustable valance clip used to install a valance on a track.
Figure 54:
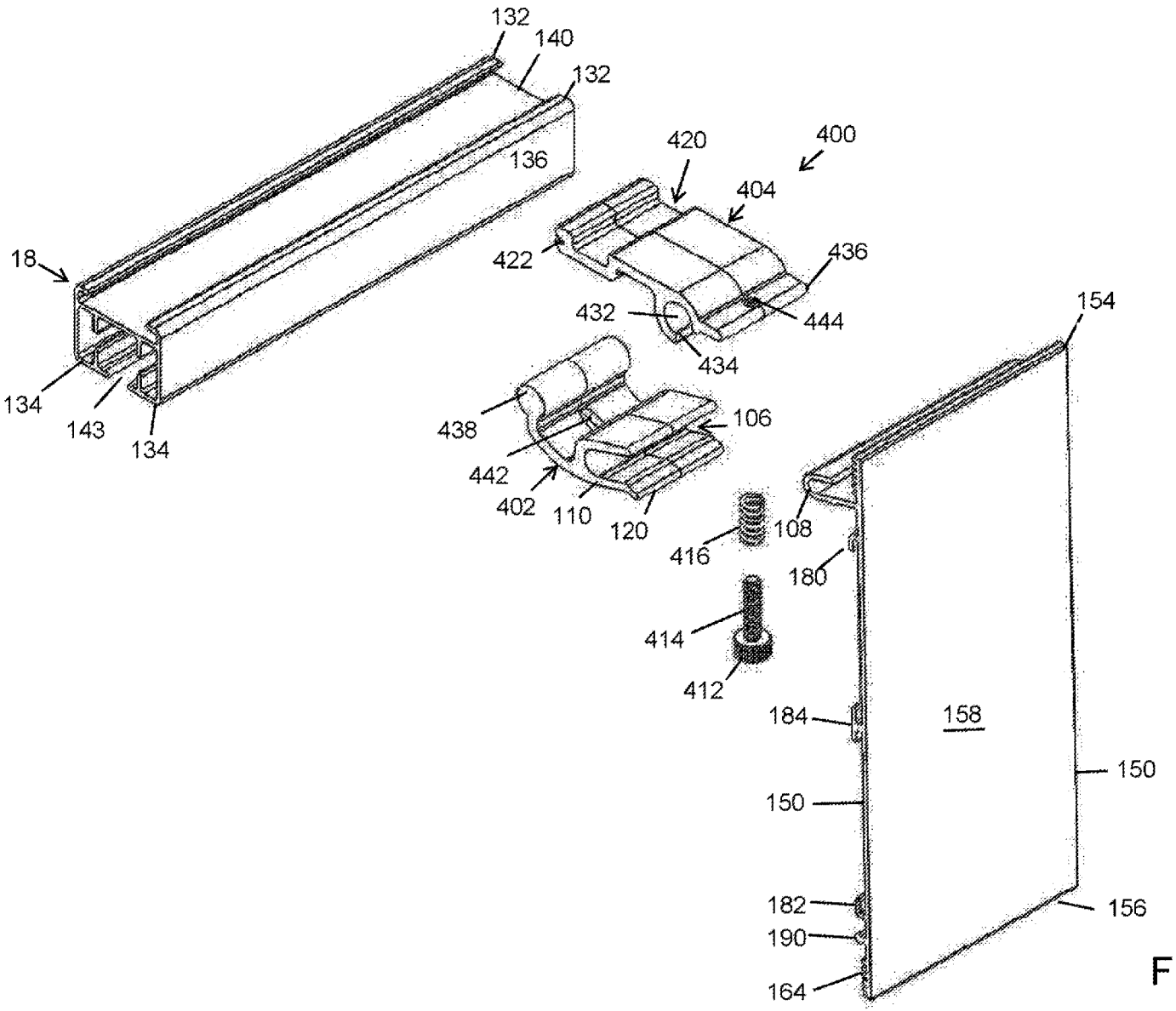
FIG. 54 is an exploded top perspective view of an adjustable valance clip used to install a valance on a track.
Figure 55:
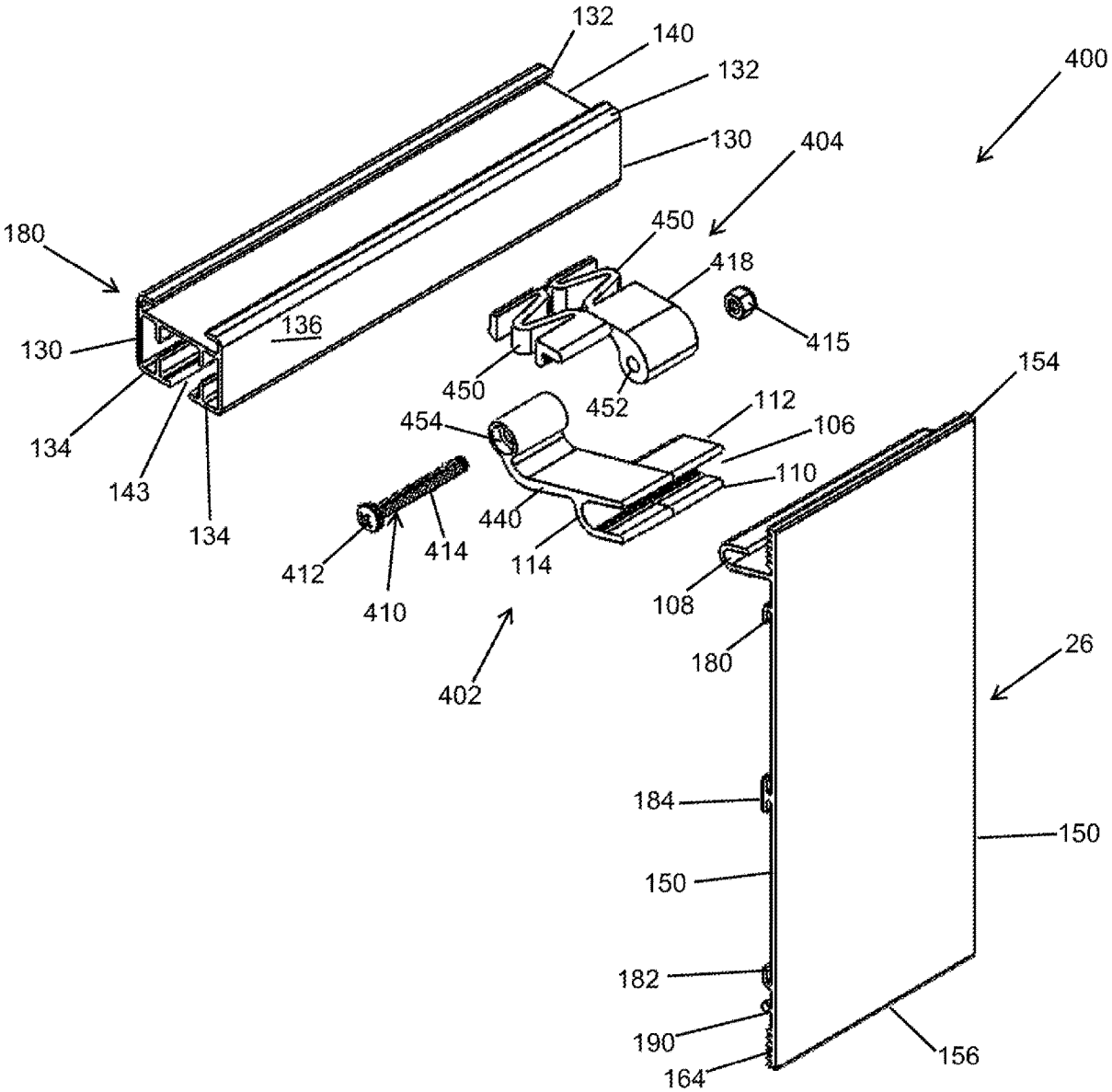
FIG. 55 is a front exploded top perspective view of an alternative arrangement of an adjustable valance clip used to install a valance on a track having a laterally extending screw that extends through the forward end of the rear section and extends through the rear end of the forward section thereby forming an adjustable joint.
Figure 56:
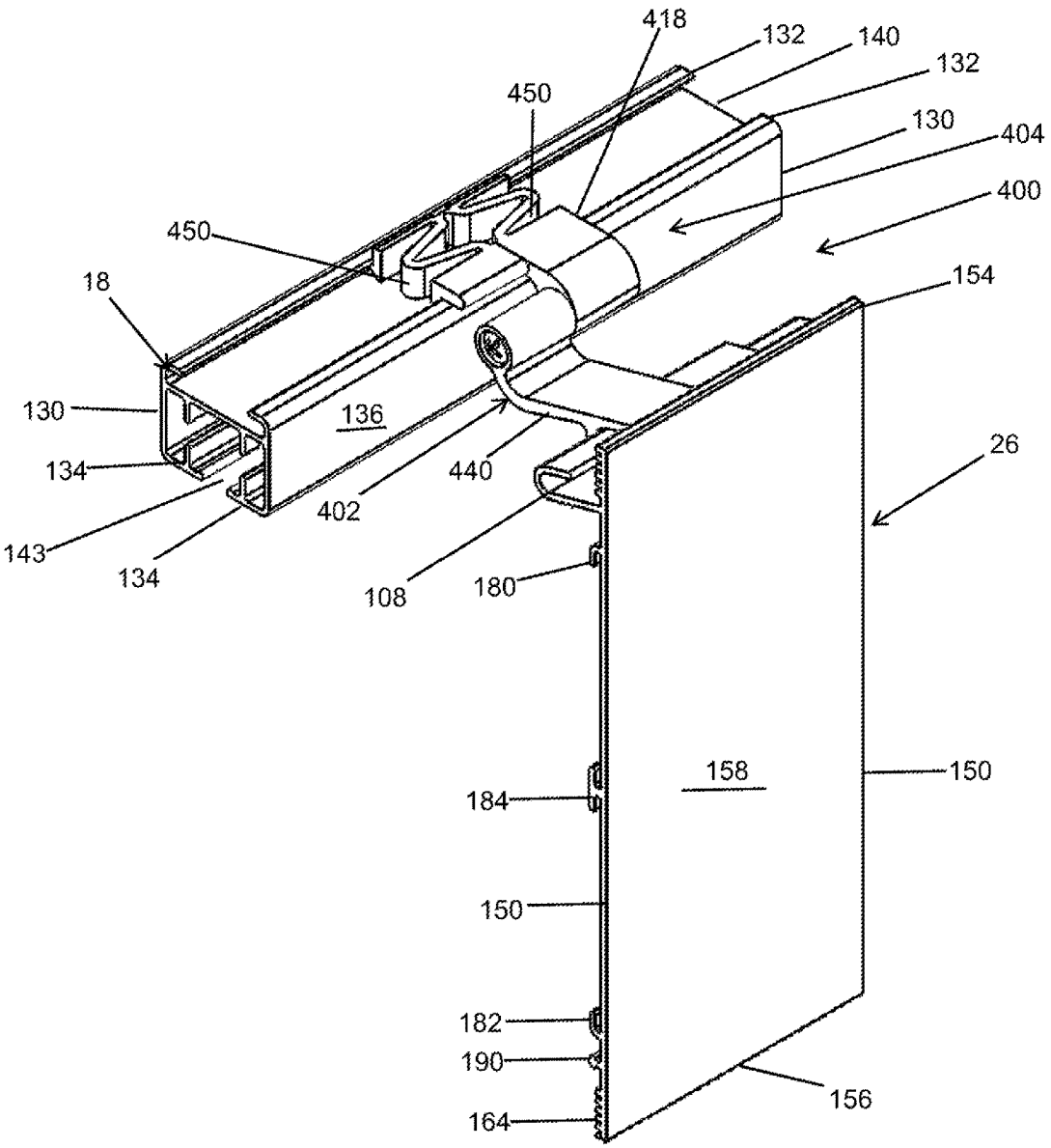
FIG. 56 is a front perspective assembled view of the alternative arrangement of an adjustable valance clip shown in FIG. 54.
Figure 57:
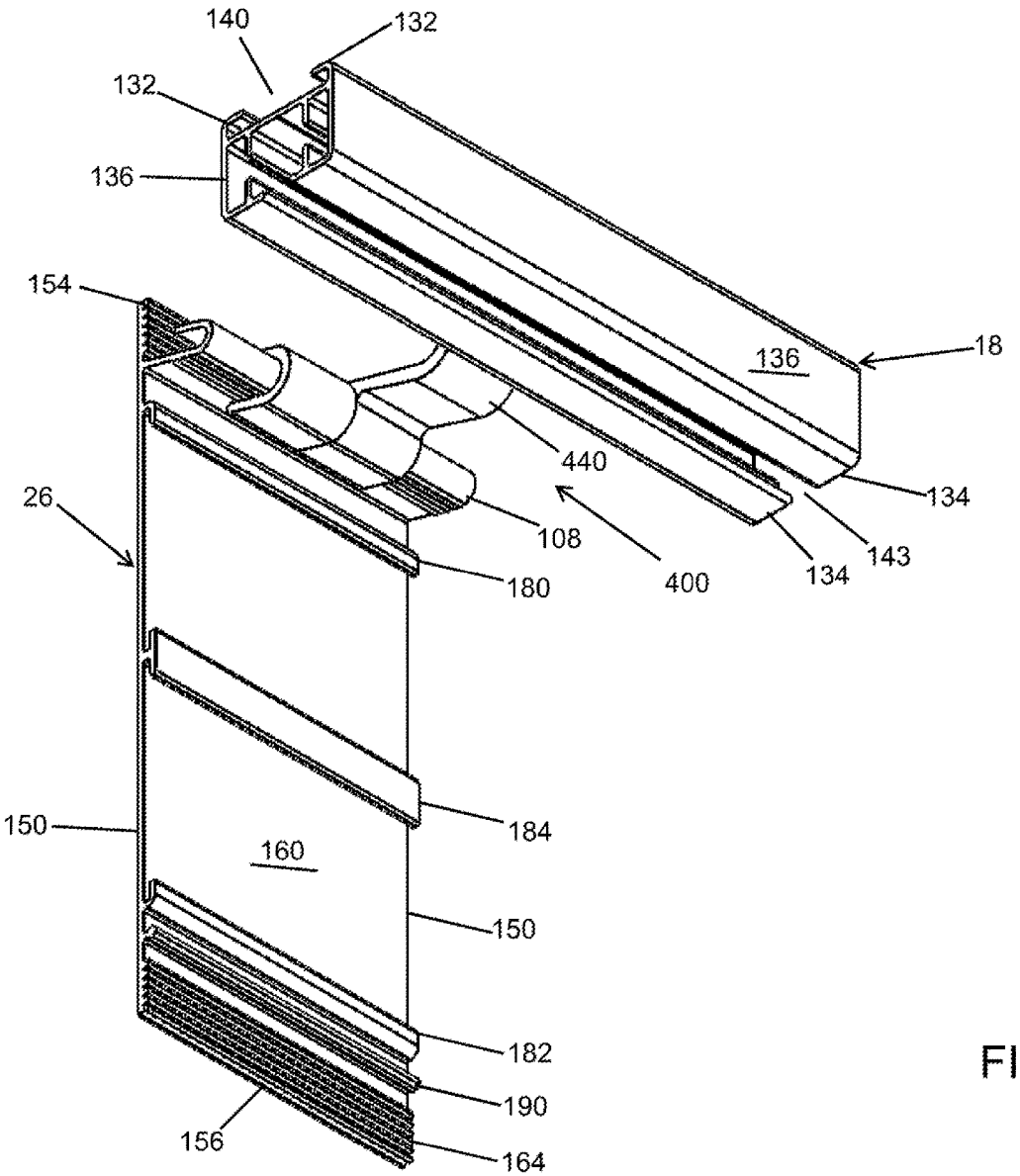
FIG. 57 is a rear perspective assembled view of the alternative arrangement of an adjustable valance clip shown in FIG. 54.
Figure 58:
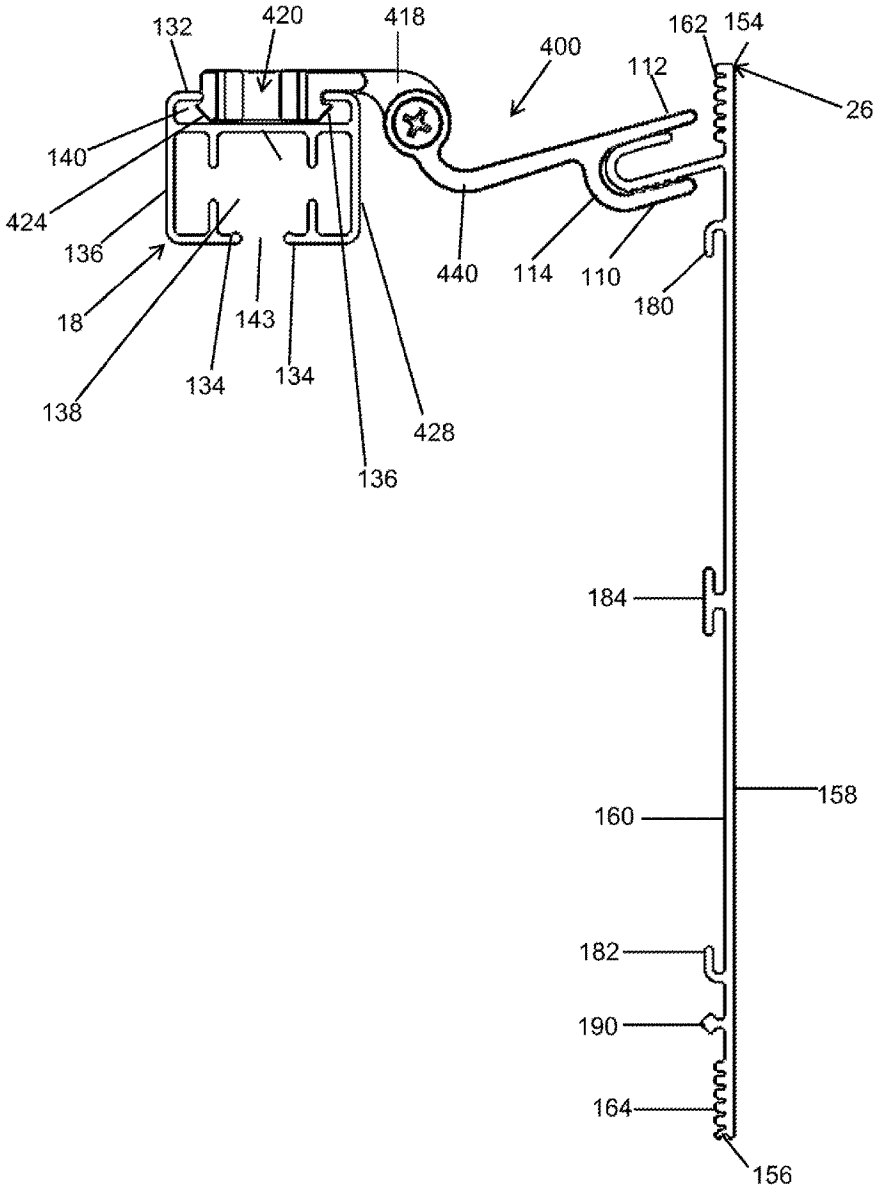
FIG. 58 is a side elevation assembled view of the alternative arrangement of an adjustable valance clip shown in FIG. 54.
Figure 59:
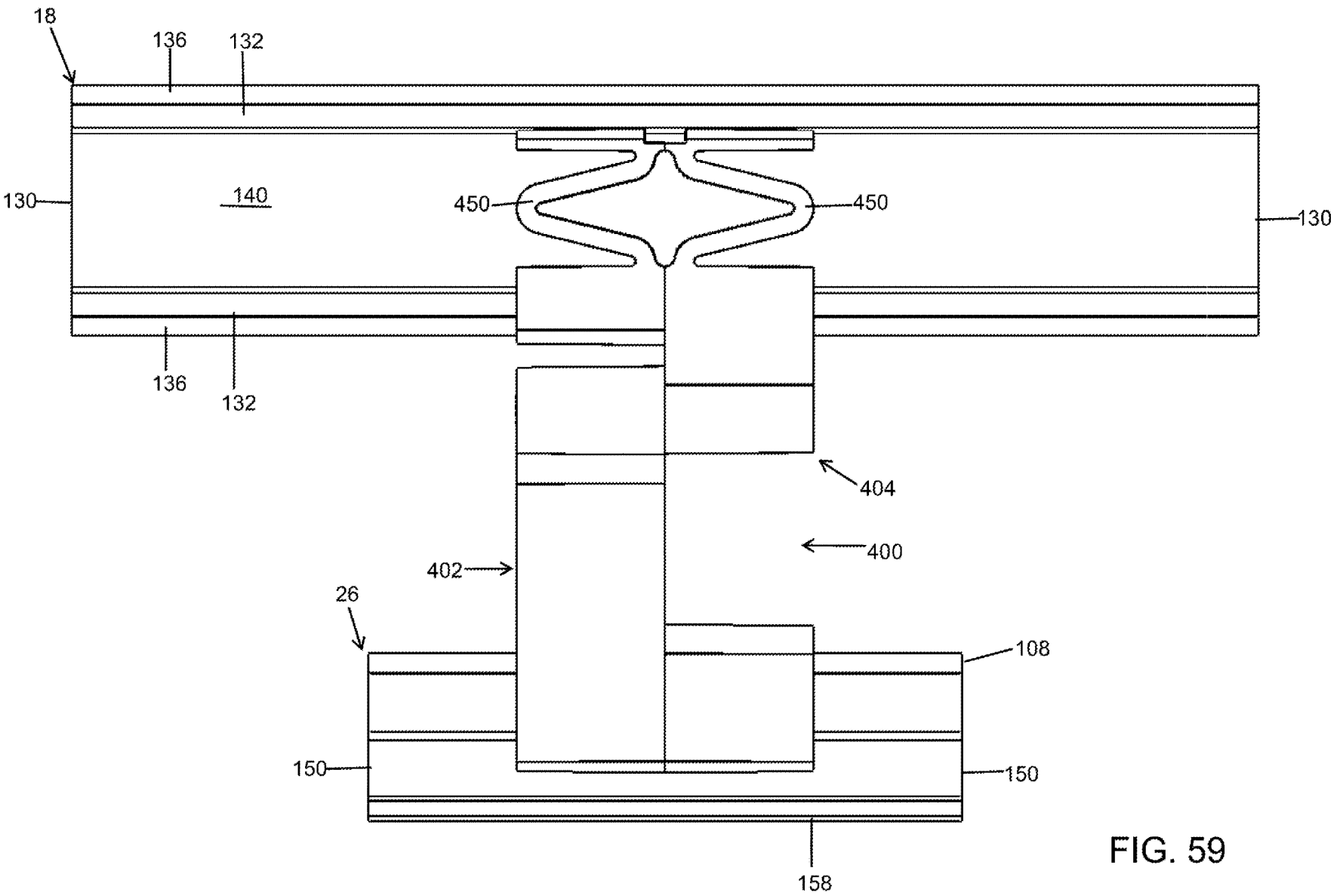
FIG. 59 is a top elevation assembled view of the alternative arrangement of an adjustable valance clip shown in FIG. 54; in particular the view showing the shape of the spring members that connect the forward and rearward portions of the rear section that affix to the track.
Figure 60:
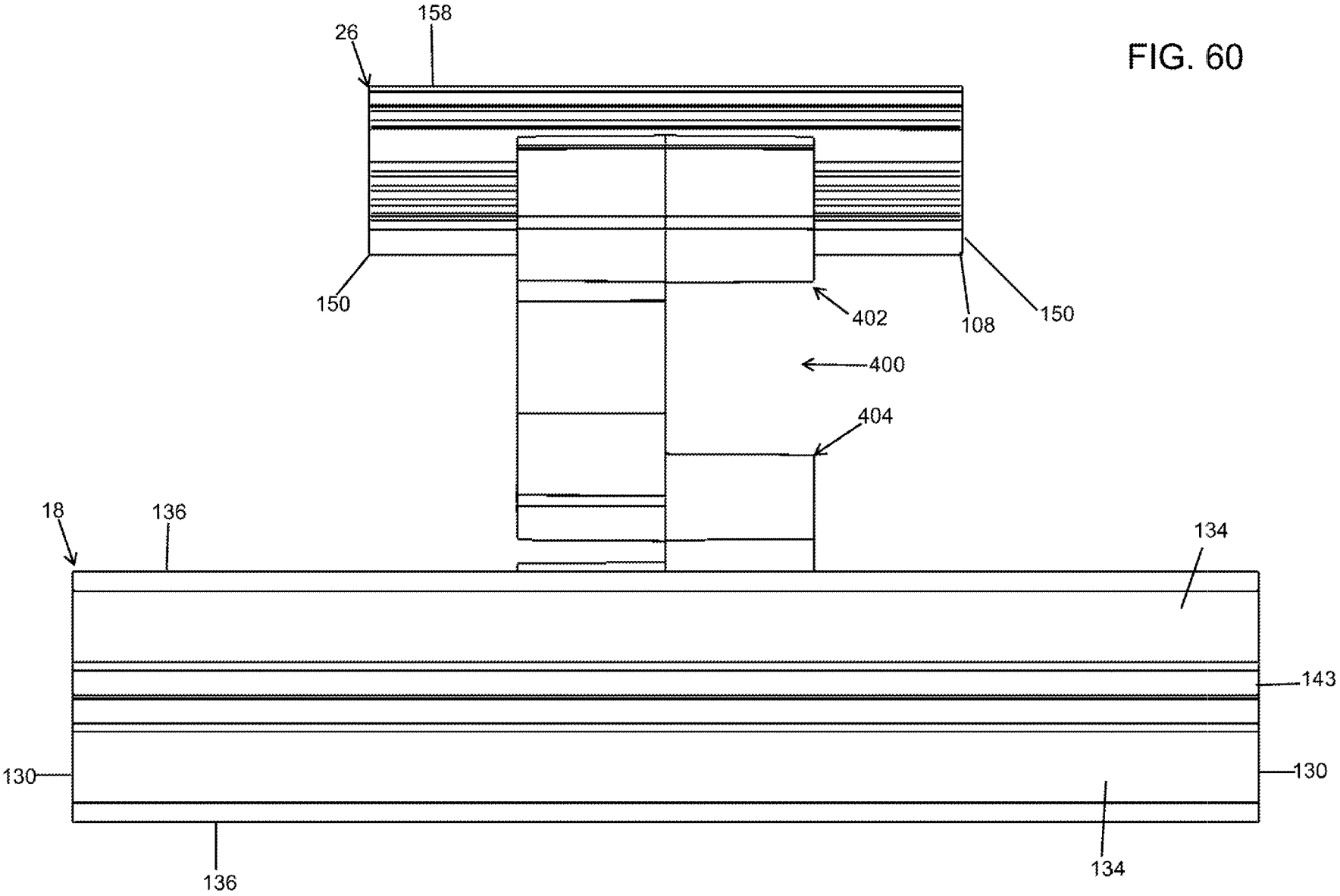
FIG. 60 is a top elevation assembled view of the alternative arrangement of an adjustable valance clip shown in FIG. 54.
Figure 61:
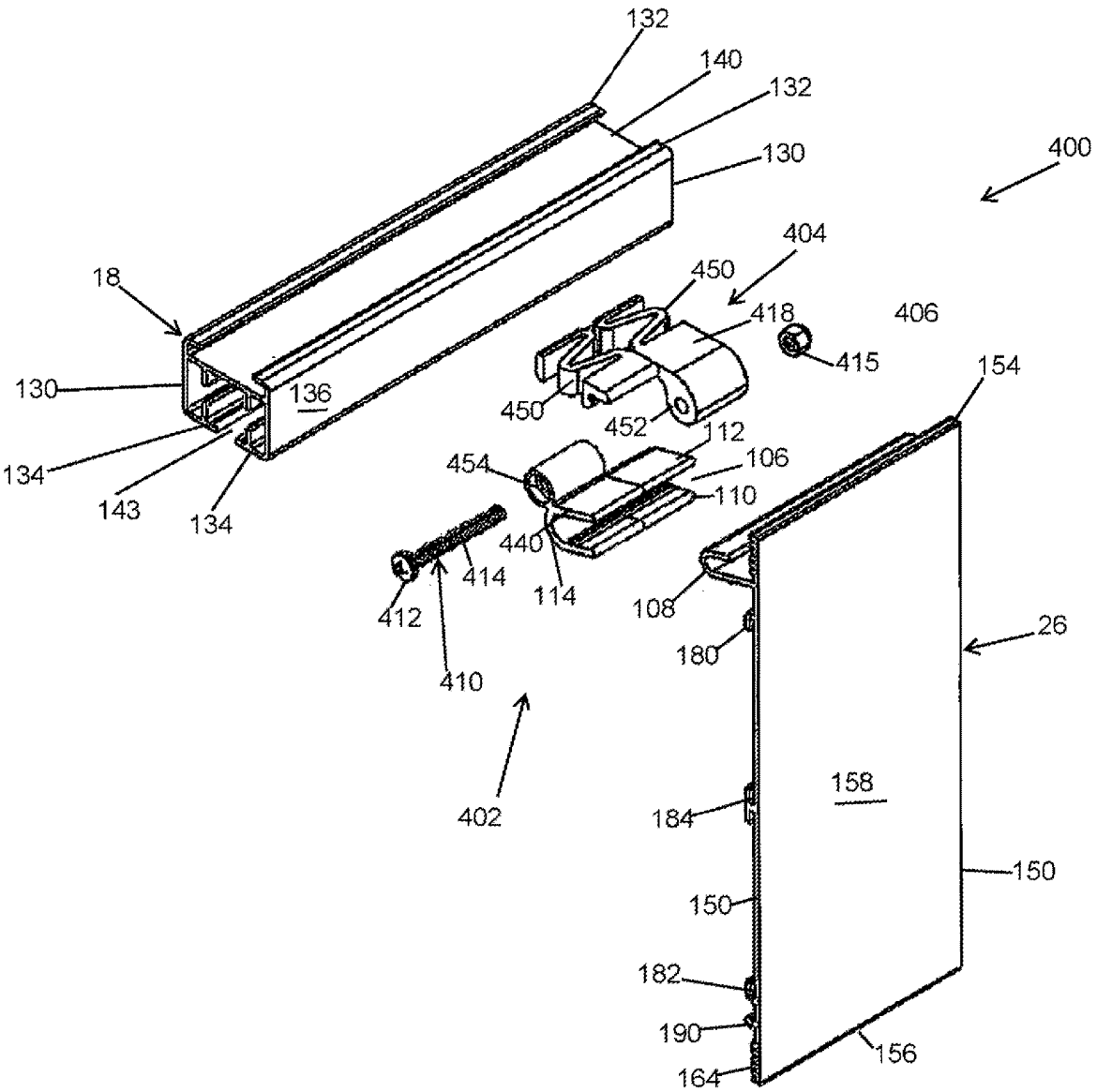
FIG. 61 is a front exploded top perspective view of an alternative arrangement of an adjustable valance clip used to install a valance on a track having a laterally extending screw that extends through the forward end of the rear section and extends through the rear end of the forward section thereby forming an adjustable joint, this arrangement having a shorter forward section as compared to the arrangement shown in FIGS. 55-60.
Figure 62:
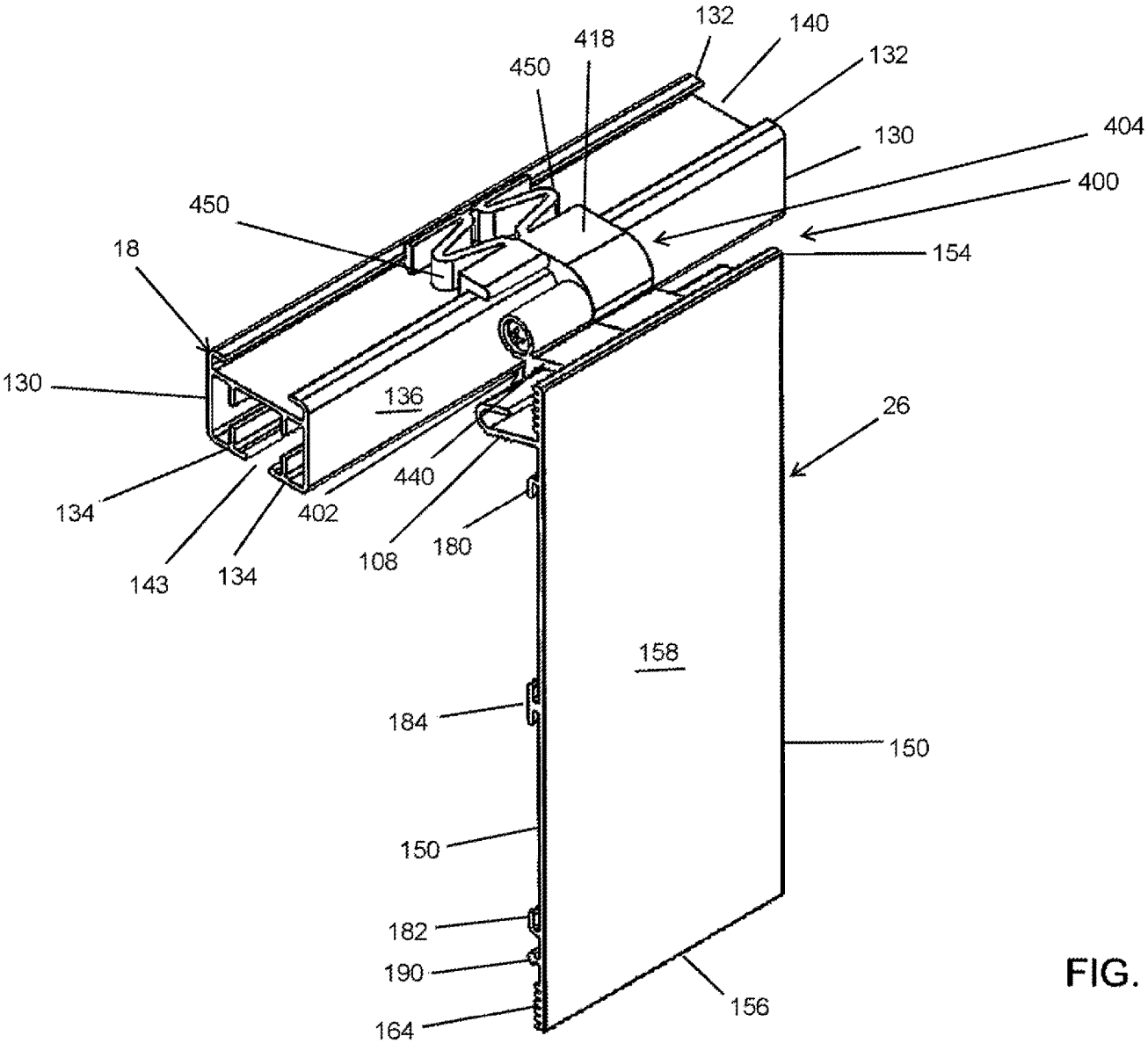
FIG. 62 is a front perspective assembled view of the alternative arrangement of an adjustable valance clip shown in FIG. 61.
Figure 63:
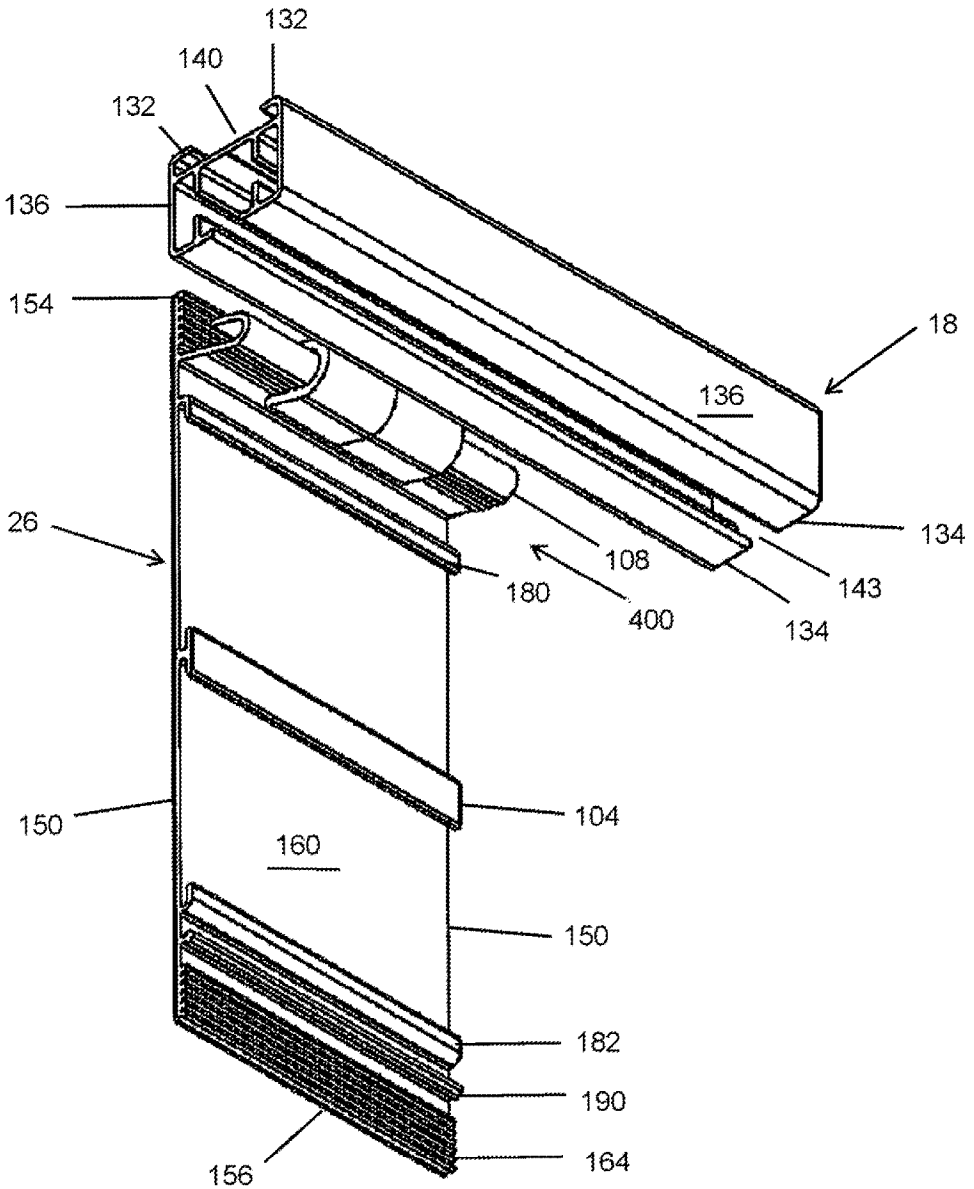
FIG. 63 is a rear perspective assembled view of the alternative arrangement of an adjustable valance clip shown in FIG. 61.
Figure 64:
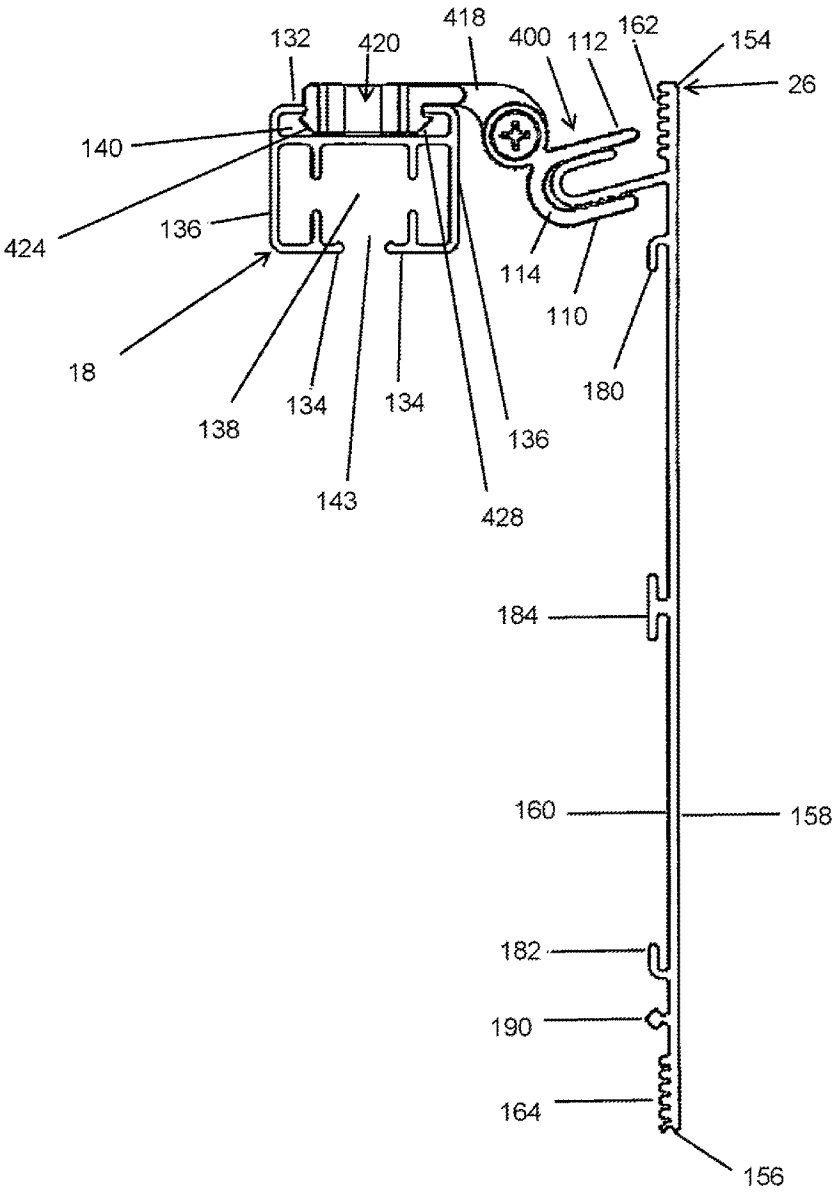
FIG. 64 is a side elevation assembled view of the alternative arrangement of an adjustable valance clip shown in FIG. 61.
Figure 65:
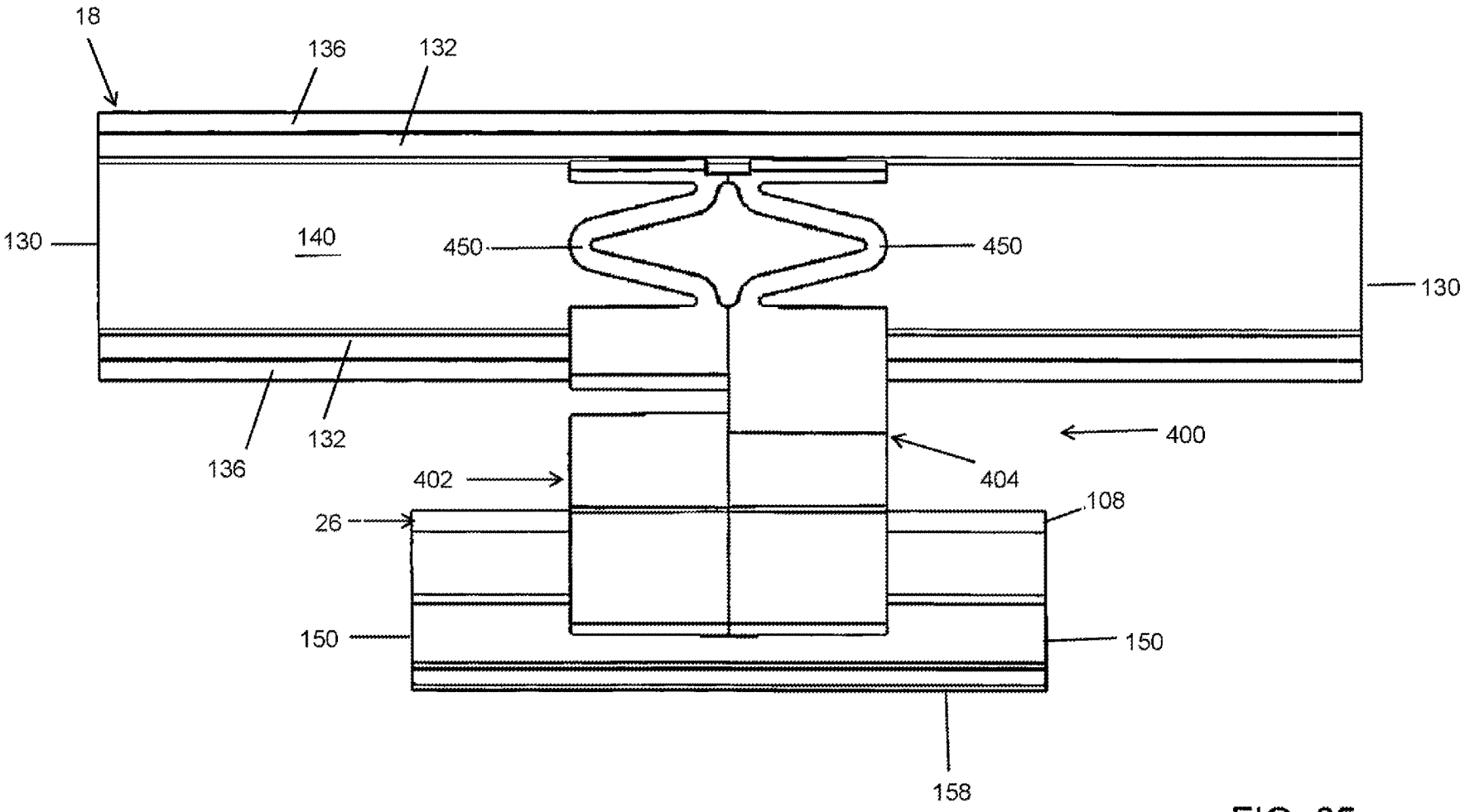
FIG. 65 is a top elevation assembled view of the alternative arrangement of an adjustable valance clip shown in FIG. 61; in particular the view showing the shape of the spring members that connect the forward and rearward portions of the rear section that affix to the track.
Figure 66:
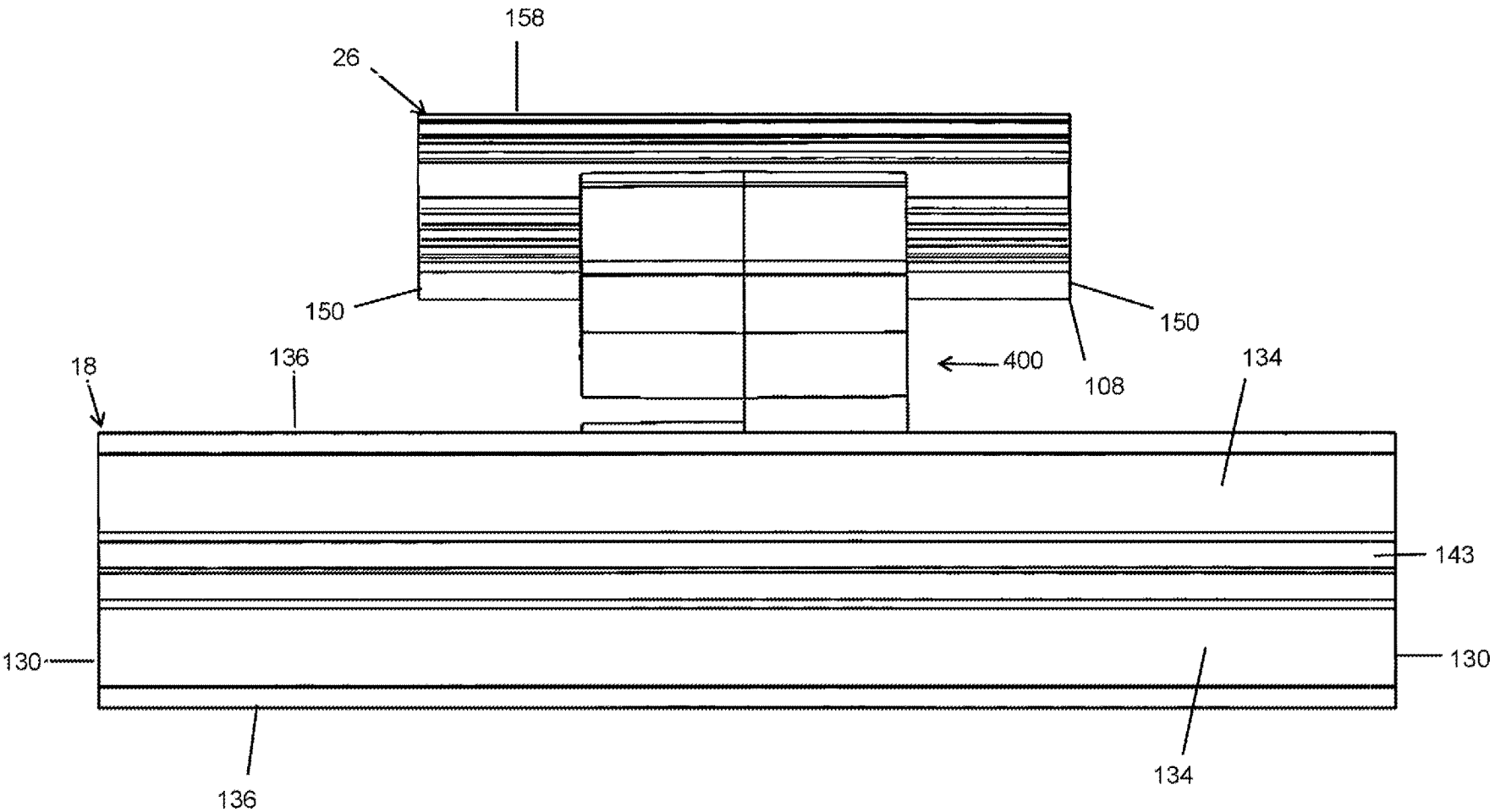
FIG. 66 is a top elevation assembled view of the alternative arrangement of an adjustable valance clip shown in FIG. 61.
Figure 67:
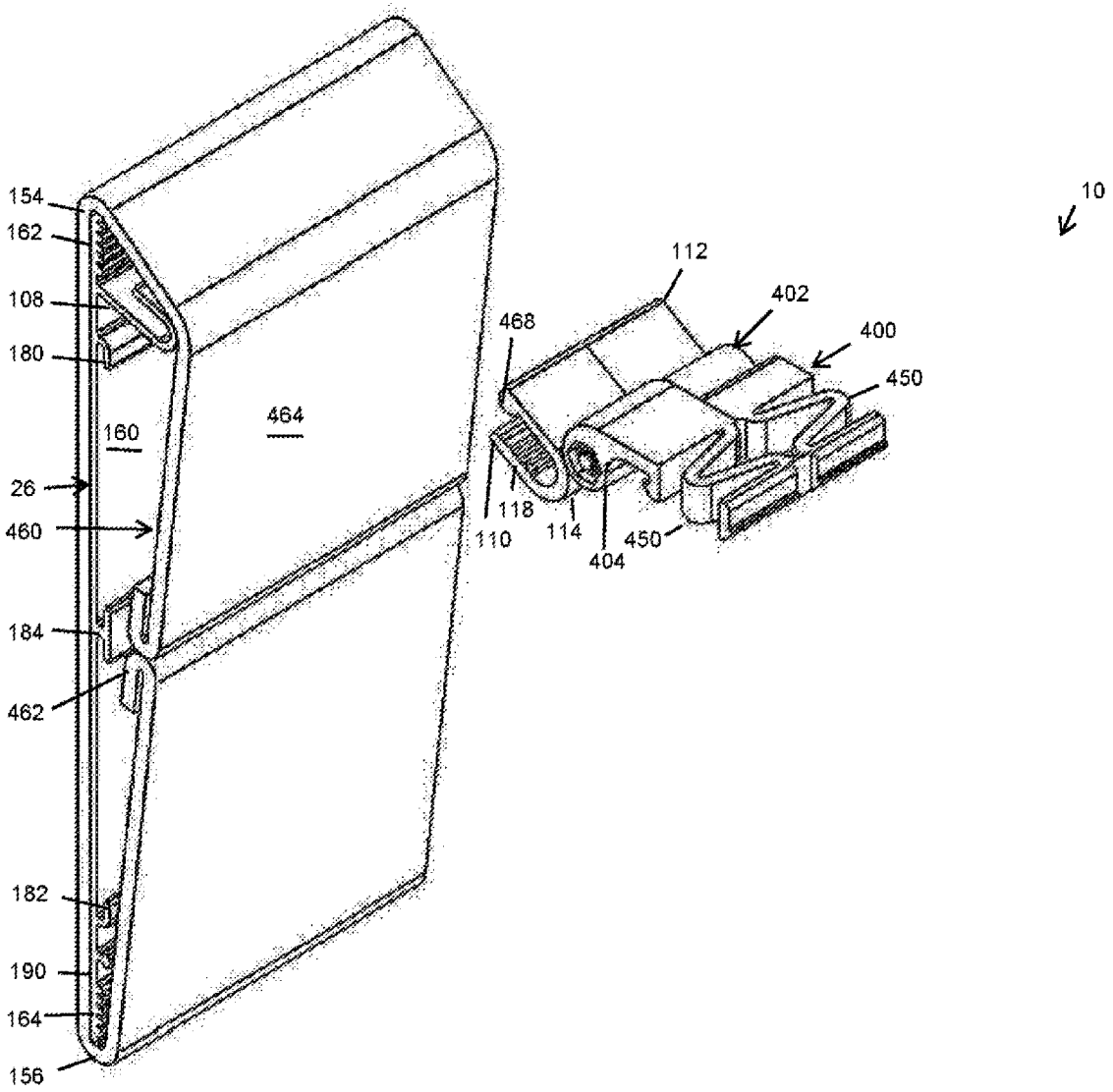
FIG. 67 is a rear perspective exploded view of an alternative arrangement of the valance showing a sock positioned over the valance and an adjustable valance clip exploded away from the valance.
Figure 68:
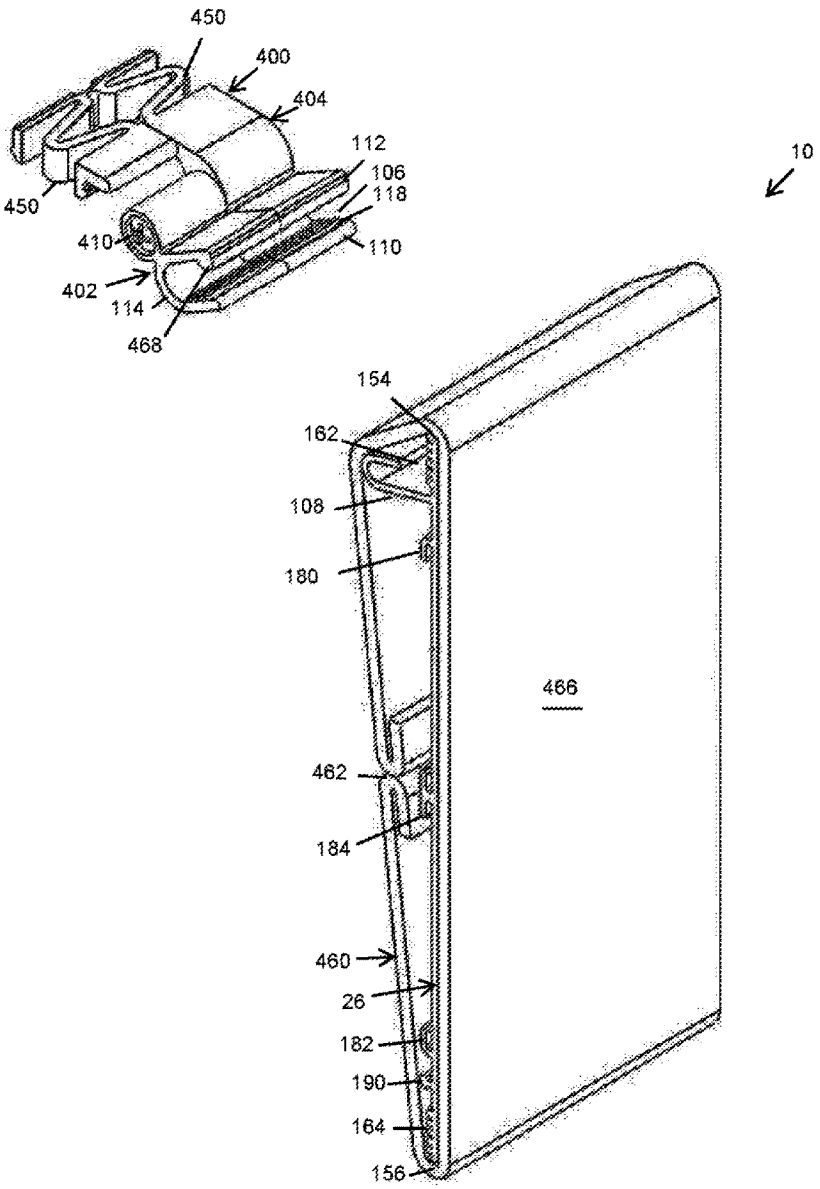
FIG. 68 is a front perspective exploded view of an alternative arrangement of the valance showing a sock positioned over the valance and an adjustable valance clip exploded away from the valance.

While the clip feature 108 has been removed in one continuous extended centrally located position in FIGS. 19 and 21, it is hereby contemplated that a plurality of smaller sections of clip feature 108 may be removed where the bend is desired. This arrangement allows for bending of the valance 26 while also allowing for a portion of the area of valance 26 that was bent to be held within socket 106 upon installation. This arrangement helps to prevent or smooth out any bulges or memory within the valance 26 upon installation.

Stiffener:

When valance 26 is bent to fit within the shipping box, valance 26 has a tendency to have some memory, or to retain some bend within the valance 26 even after installation. To help correct or eliminate this bend, a stiffener 280 is added. Stiffener 280 is any object or device that can be added to valance 26 that helps to return the bent portion of valance 26 to a generally flat arrangement.

In one arrangement, stiffener 280 is a generally elongated piece of metal, wood, plastic, composite or other generally stiff and rigid material. In one arrangement, as is shown, stiffener 280 is generally rectangular in shape and is sized and shaped to fit within and slide within the slots formed by center arm 184 and upper arm 180 and/or center arm 184 and lower arm 182.

Once the stiffener 280 is inserted between the center arm 184 and upper arm 180 or center arm 184 and lower arm 182, the stiffener is slid into the position where the deflection or bend is present. As the stiffener 280 is flat and straight, once slid into position, stiffener 280 has a tendency to take out any or most unintended deflection or bend in the valance 26.

In an alternative arrangement, stiffener 280 is installed by any other manner or means onto the valance 26 such as gluing, welding, adhering, stapling, taping, or the like.

Figure 17:
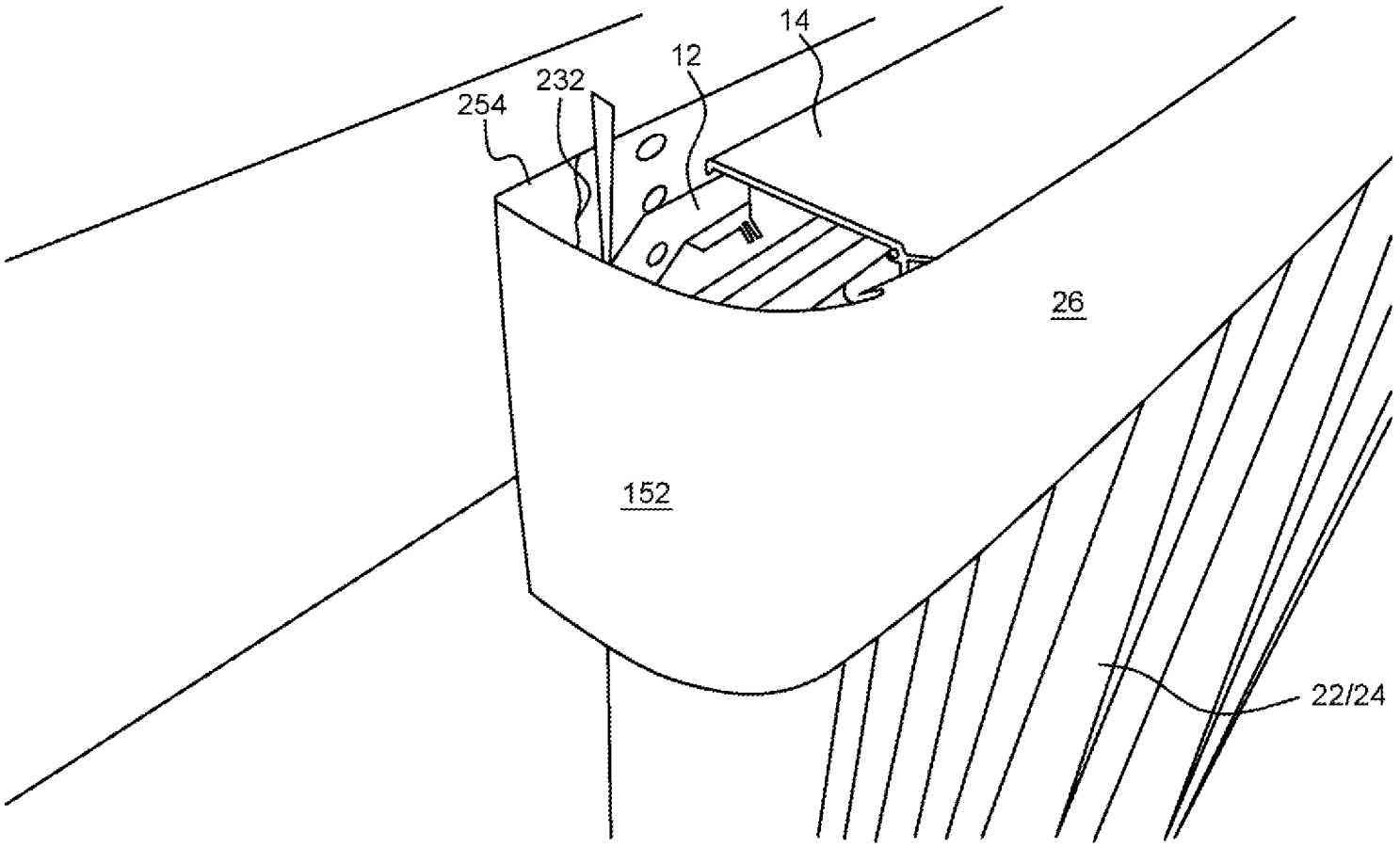
FIG. 17 is a perspective view of an assembled valance system; the view showing a wall bracket attached to a wall, a single track top plate, a track connected to the top plate, and a valance connected to the top plate.
Figure 18:
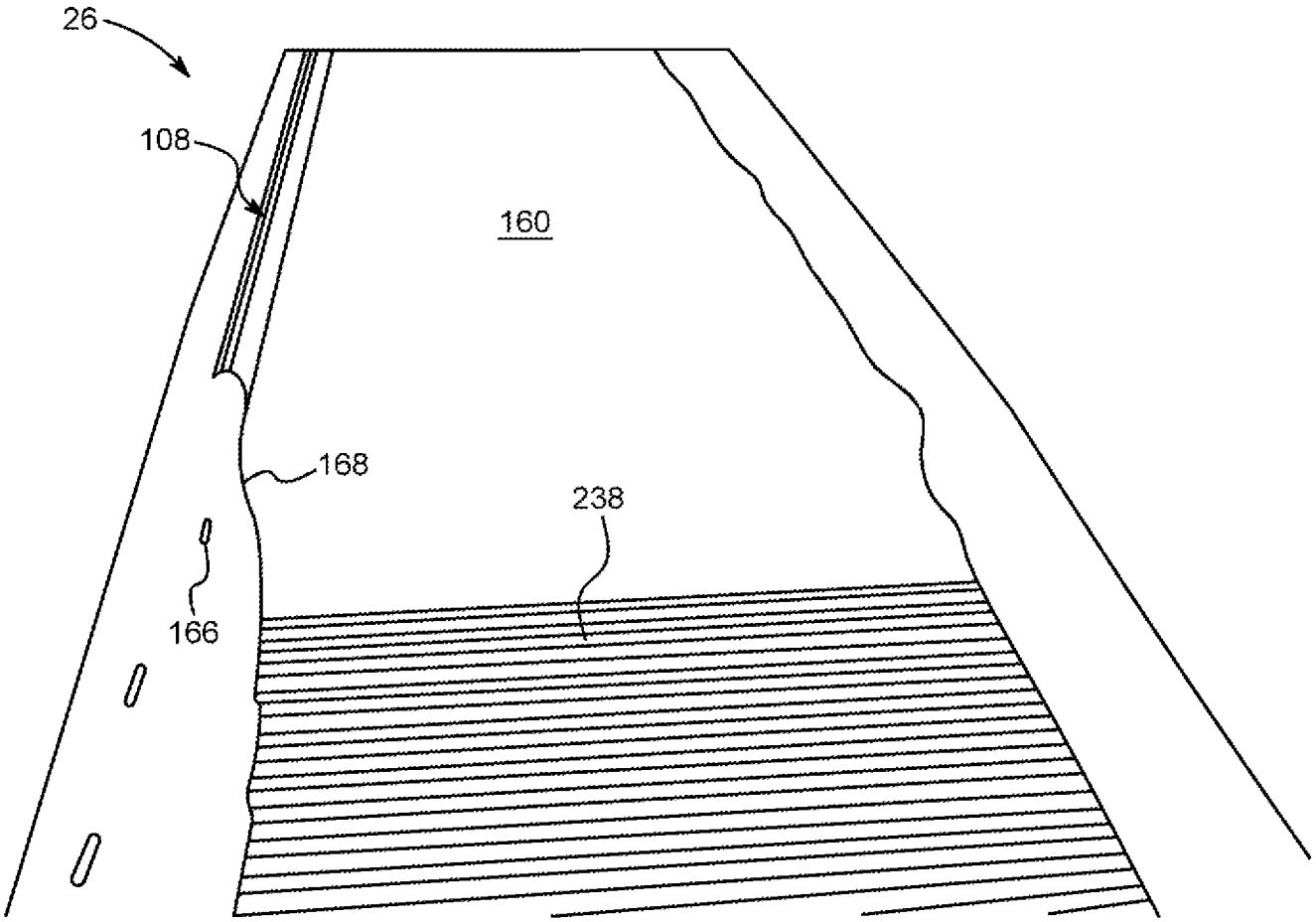
FIG. 18 is an end perspective view of the back surface of a valance, the view showing covering material stapled to the valance, the view showing the clip feature, the view showing the living hinge area of the end cap.

End Cap Configurations:

As stated herein, end caps 152 can be curved by living hinges in hinge area 238 into any desired configuration desired by the user. These configurations include a sharp 90 degree corner, a smooth curve, an angled curve or any other configuration. In one arrangement, with reference to FIG. 17, the excess portion 254 of end cap 162, which is not consumed by the curve, is itself bent to travel along the wall and can be affixed thereto, thereby holding the outward ends 232 of end cap 152 to the wall or structure.

Alternative Arrangement of Wall Bracket and Top Bracket:

With reference to FIGS. 27-31, an alternative arrangement of the wall bracket 12 and the top bracket 14 is presented. This arrangement is particularly well suited for situations where it is desired to place the top bracket 14 close to the ceiling, or as close to the ceiling as possible.

In the arrangement shown, wall bracket 12 includes a main body 32 that is generally rectangular in shape. Main body 32 extends horizontally between a generally flat rear wall 34 positioned in approximate parallel spaced alignment to a generally flat front wall 36. Main body 32 extends vertically between a generally flat upper wall 38, that extends in approximate perpendicular alignment to the rear wall 34 and front wall 36, and a lower end 40.

A first arm 260 is main body 32 and extends outward and upward at an angle from main body 32. First arm 260 terminates in an upper end 262 that is positioned a distance forward of forward wall 36.

In this arrangement, main body 32 includes a plurality of openings 264 that are sized and shaped to receive fasteners 266 therein that serve to connect wall bracket 12 to the wall or other structure.

In the arrangement shown, top bracket 14 (which can either be a single top bracket or a double top bracket and for simplicity's sake will be referred to as "top bracket 14" in this example). Top bracket 14 includes an upper wall 70 that is generally rectangular in shape and extends vertically between an upper surface 72 that is generally planar in shape and a lower surface 74 that is also generally planar in shape, with the upper surface 72 and the lower surface 74 positioned in approximate perpendicular alignment to one another. Upper wall 70 extends a distance between rearward end 76 and forward end 78.

Rearward end 76 of upper wall 70 includes a first arm 268 that extends downward and rearward at an angle from the rearward end 76 of upper wall 70. First arm 268 extends downward and rearward at an angle before terminating at lower end 270. First arm 268 extends at approximately the same angle as the first arm 260 of wall bracket 12, such that the two components are positioned in generally flat and flush mating engagement with one another when the top bracket 14 is placed on the wall bracket 12.

The forward end 78 of upper wall 70 includes the features described herein with respect to the socket 106 and related components.

The rearward end 76 of top bracket 14 includes a support arm 86. Support arm 86 is positioned forward a distance from rearward end 76. Support arm 86 includes a first section 88 that extends downward from the lower surface 74 of upper wall 70 a distance in approximately perpendicular alignment thereto. Support arm 86 includes a second section 90 that connects to first section 88 at corner section 92. Second section 90 angles rearward as it extends downward. Second section 90 connects to a support foot 272 that extends in approximate parallel spaced alignment to the forward wall 36 of wall bracket 12 when first arm 268 of top bracket 14 is in flat and flush engagement with the first arm 260 of wall bracket 12. Support foot 272 extends vertically a distance before terminating in a lower end 274. Like wall bracket 12, support foot 272 includes one or more openings 264 that receive fasteners 266 there through, as well as through main body 32 of wall bracket 12, thereby connecting the top bracket 14 and wall bracket 12 together while connecting both components 12, 14 to the wall or other structure.

Using this arrangement, the wall bracket 12 is mounted to the wall or other structure by placing the rear wall 34 of main body 32 of wall bracket 12 against the wall. The wall bracket 12 is slid along the wall until the upper wall 38 of the main body 32 engages the ceiling. That is, the wall bracket 12 is sized and shaped to eliminate measuring by indexing off of the intersection between the wall and the ceiling. When the upper wall 38 is engaged with the ceiling and the rear wall 34 is engaged with the wall, one or more fasteners are inserted through the openings 264 in the upper portion of main body 32, above the first arm 260.

Once the wall bracket 12 is installed, the top bracket 14 is installed onto the wall bracket 12. To do this, the rearward end 76 of top bracket 14 is placed along the wall and slid upward until the first arm 268 of top bracket 14 engages the first arm 260 of wall bracket 12. Due to the downward and rearward angle of the first arm 268 of top bracket 14 and the outward and upward angle of the first arm 260 of wall bracket 12, the first arm 268 of top bracket 14 has a tendency to be guided or slide upward along the first arm 260 of wall bracket 12. This continues until the lower end 270 of the first arm 268 of top bracket 14 passes above the upper end 262 of first arm 260 of wall bracket 12. Once this occurs, the first arm 268 of top bracket 14 is moved behind the first arm 260 of the wall bracket 12 and then the top bracket 14 is lowered into place. As the top bracket 14 slides upward on the wall bracket 12, the forward angle of the first arm 260 of the wall bracket 12 has a tendency to cause the forward end 78 of top bracket 12 to angle downward. This downward angling of top bracket 14 provides needed clearance between the forward end 78 of top bracket 14 and the ceiling during the installation process.

Once lowered into place the forward and lower surface of first arm 268 of top bracket 14 is in generally flat and flush engagement with the rearward and upper surface of first arm 260 of wall bracket 12. In addition, once lowered into place, the rearward surface of support foot 272 of top bracket 14 is in generally flat and flush engagement with the forward surface 36 of the lower end of main body 32. Once in this position, one or more fasteners are passed through openings 264 of both the support foot 272 and the main body 32 thereby connecting and holding the top bracket 14 onto the wall bracket 12 and preventing unintentional disengagement of the two components.

In this arrangement, the upper end of socket 106 is positioned at the appropriate spacing from the ceiling without any measuring. Once the wall bracket 12 and the top bracket 14 are installed, as is described herein, the valance 26 is installed, as is described herein.

Adjustable Valance Clip:

With reference to FIGS. 39-54 an adjustable valance clip 400 is presented for use with the system 10 or any architectural covering. Adjustable valance clip 400 is formed of any suitable size, shape and design and is configured to facilitate connection of valance 26 to track 18, clip 300 or any other component of the system 10 while also facilitating angular adjustment of valance 26.

To provide an aesthetically pleasing installation it is important to ensure that the valance 26 is installed in a properly aligned manner for the particular application. In some arrangements, when a valance 26 is installed next to another valance 26, it is desirable to have adjacent valances 26 perfectly align with one another. In addition, it is often desirable to have the forward face 158 of valance 26 extend in a generally vertical manner.

However, drapery tracks 18, 20 are often installed adjacent a ceiling or high up on a wall which makes it difficult to make a precise, level and consistent installation. Making matters worse, slight angular variations in the installation are magnified by projecting the valance 26 forward from the window or wall by the length of the top bracket 14, 16 and/or clip 300 which has a tendency to increase the noticeability of any variation offsets in the installation. For these reasons, an adjustable valance clip 400 that quickly and easily allows for and facilitates angular adjustment of valance 26 is needed.

In the arrangement shown, as one example, adjustable valance clip 400 is formed of a forward section 402 and a rear section 404 that are connected to one another by a joint 406 as well as an adjustment member 408, which in the arrangement shown includes a screw 410 having a head 412 and a threaded shaft 414 and an associated biasing member 412 which in the arrangement shown is a spring that wraps around the screw 410.

In the arrangement shown, as one example, rear section 404 is configured to connect adjustable valance clip 400 to other components of the system 10 such as first track 18, second track 20, wall bracket 12, single track top bracket 14, dual track top bracket 16, or any other component of system 10. In the arrangement shown, as one example, rear section 404 includes an arm 418. When viewed from the side, arm 418 is generally flat and planar in shape and extends a width from opposing sides that extend in approximate parallel spaced relation to one another and extends a height between an opposing upper surface and lower surface.

The rearward side of arm 418 includes a connection section 420. Connection section 420 is formed of any suitable size, shape and design and is configured to facilitate connection of adjustable valance clip 400 to other components of the system 10. In the arrangement shown, as one example, connection section 400 is configured to frictionally engage and lock to the slot 140 in the upper wall 132 of track 18. In this arrangement, to facilitate installation into and connection onto the slot 140 in the upper wall 132 of track 18, connection section 420 includes a rear notch 422 positioned at its rearward end. Rear notch 422 is configured to engage and receive the forward facing end of the rearward section of the upper wall 132 that forms slot 140. A rear angled wall 424 is positioned just below rear notch 422. Rear angled wall 424 extends from the rearward most edge of rear notch 422 and extends forward as it extends downward thereby providing an angled surface that helps facilitate installation of the adjustable valance clip 400 into slot 140.

Connection section 420 also includes a forward notch 426 positioned at its forward end. Forward notch 426 is configured to engage and receive the rearward facing end of the forward section of the upper wall 132 that forms slot 140. A forward angled wall 428 is positioned just below forward notch 426. Forward angled wall 428 extends from the forward most edge of forward notch 426 and extends rearward as it extends downward thereby providing an angled surface that helps facilitate installation of the adjustable valance clip 400 into slot 140.

In the arrangement shown, as one example, the lower end of rear angled wall 424 and the lower end of forward angled wall 428 are connected together by wall 430. In the arrangement shown, as one example, wall 430, when viewed from the side has a generally flat bottom surface that extends in approximate parallel space relation to a generally flat upper surface.

In the arrangement shown, adjustable valance clip 400 is installed in the slot 140 in the upper wall 132 of track 18 by first angling the adjustable valance clip 400 such that the rearward end of adjustable valance clip 400 is lower than the upper end of adjustable valance clip 400. In this orientation, the rear notch 422 is placed over the forward facing end of the rearward section of the upper wall 132. In seeking the installation of the forward facing end of the rearward section of the upper wall 132 into rear notch 422, the rear angled wall 424 helps to guide the forward facing end of the rearward section of the upper wall 132, as does the enlarged rounded nose 431 that is positioned just above the rear notch 422. In this way, the configuration of rear notch 422, rear angled wall 424 and rounded nose 432 helps ease installation.

Once the forward facing end of the rearward section of the upper wall 132 is inserted within the rear notch 422, the forward end of adjustable valance clip 400 is rotated downward. In doing so, the forward angled wall 428 frictionally engages the rearward facing end of the forward section of the upper wall 132 that forms slot 140. Once this engagement occurs, the angle of forward angled wall 428 helps to guide the rearward facing end of the forward section of the upper wall 132 that forms slot 140 into forward notch 426. Once the upper end of forward angled wall 428 passes the lower end of rearward facing end of the forward section of the upper wall 132 that forms slot 140, the rearward facing end of the forward section of the upper wall 132 that forms slot 140 falls or snaps or is retained within the forward notch 426 thereby locking the adjustable valance clip 400 to track 18. In this locked position, the lower surface of wall 430 is in approximate flat and flush parallel planar engagement with the upper surface of the wall that forms the lower end of slot 140 in track 18. It is also notable that the depth of the rear notch 422 is substantially deeper than the depth of the forward notch 426 so as to facilitate removal of the adjustable valance clip 400 from track 18.

That is, to remove adjustable valance clip 400 from track 18, sufficient pressure is applied pushing upward on the forward end of adjustable valance clip 400. Once enough pressure is applied, the track 18 and/or adjustable valance clip will elastically deform enough to allow the rearward facing end of the forward section of the upper wall 132 that forms slot 140 to escape out of the forward notch 426, at which point, adjustable valance clip 400 may be removed from track 18.

The forward end of rear section 404 connects to the rearward end of forward section 402 at joint 406. Joint 406 is formed of any suitable size, shape and design and is configured connect forward section 402 and rear section 404 while facilitating angular adjustment of the forward section 402 relative to the rear section 404. In the arrangement shown, as one example, rear section 404 includes a socket 432 at its forward end, which when viewed from the side is a generally cylindrical opening that extends from side-to-side across the length of adjustable valance clip 400, however any other configuration of a joint is hereby contemplated for use. In this arrangement, the lower end of the generally cylindrical opening of socket 432 terminates in a lower stop surface 434, which in the arrangement shown when viewed from the side is a generally vertically extending wall that serves as a rear-most rotational point for forward section 402 relative to rear section 404. Also, in the arrangement shown, the upper end of the generally cylindrical opening of socket 432 includes an upper stop surface 435 as well as a stop flange 436. In the arrangement shown, when viewed from the side upper stop surface 435 is a rounded protrusion that extends downward from the upper forward side of the opening of socket 432. The upper stop surface 435 serves as the forward-most rotational point for forward section 402 relative to rear section 404. In the arrangement shown when viewed from the side, stop flange 436 is a generally flat and straight forward projection of rear section 404 which is positioned above the opening into the socket 432 that includes a generally flat bottom surface that extends in approximate horizontal alignment when adjustable valance clip 400 is installed on track 18. The lower surface of stop flange 436 receives the upper end of adjustment member 408.

In the arrangement shown, as one example, the rear end of forward section 402 connects to the socket 432 by way of axle 438. Axle 438 is formed of any suitable size, shape and design and is configured to connect to and be received within socket 432 of rear section 404 while facilitating angular motion of the forward section 402 relative to the rear section 404. Axle 438 forms a pivot point between the forward section 402 relative the rear section 404. In the arrangement shown, as one example, when viewed from the side, axle 438 is a generally cylindrical member that extends from side-to-side across the forward section 402 of adjustable valance clip 400. This configuration allows the axle 438 of forward section 402 to be slid into the socket 432 of rear section 404 from a side. This configuration, wherein the socket 432 of rear section 404 and the axle 438 of the forward section 420 extending the entire side-to-side width of the adjustable valance clip 400 maximizes the surface area of engagement between forward section 402 and rear section 404 thereby providing a strong, stable and durable joint 406 that can be precisely adjusted.

An arm 440 is connected to axle 438 that connects axle 438 to other components of forward section 402. In the arrangement shown, as one example, arm 440 extends vertically downward from axle 438 when forward section 402 is in a fully lowered position. In this fully lowered position, the rear face of arm 440 engages the forward face of lower stop surface 434. This engagement prevents the lower or rearward rotation of forward section 402 on rear section 404. When forward section 402 is fully rotated forward or upward, the forward face of arm 44 engages the upper stop surface 435. This engagement prevents the upper or forward rotation of forward section 402 on rear section 404.

Arm 440 includes a slot 442 therein that allows passage of the threaded shaft 414 of screw 410 of biasing member 416 there through. This slot 442 allows for rotational movement of the forward section 402 on the rear section 404 while the vertical orientation of the screw 410 remains stationary. The upper end of the threaded shaft 414 of screw 410 of biasing member 416 is received in threaded opening 444 in stop flange 436. In this way, when threaded shaft 414 passes through the slot 442 of arm 440 of forward section 402 and threads into the threaded opening 444 of stop flange 436 this facilitates an adjustable connection between forward section 402 and rear section 404. In this arrangement, the upper surface of the head 412 of screw 410 is in engagement with the lower surface of arm 440. As screw 410 is increasingly tightened, the engagement between the upper surface of head 412 and lower surface of arm 440 causes forward section 402 to rotate upward with respect to rear section 404, thereby angularly adjusting the forward section 402 upward relative to the rear section 404 and track 18 or other components of the system 10. As screw 410 is increasingly loosened, the engagement between the upper surface of head 412 and lower surface of arm 440 causes forward section 402 to rotate downward with respect to rear section 404, thereby angularly adjusting the forward section 402 downward relative to the rear section 404 and track 18 or other components of the system 10.

In the arrangement shown, as one example, a biasing member 416 is placed around the shaft 414 of screw 410 between the upper surface of arm 440 and the lower surface of stop flange 436. In the arrangement shown, as one example, biasing member 416 is a spring. The placement of the biasing member 416 between the forward section 402 and the rear section 404 ensures that the forward section 402 is urged to its lowest most position allowed by screw 410 thereby ensuring consistency of operation.

The forward end of arm 440 of forward section 402 includes a socket 106 similar if not identical to that described herein and as such reference is made to that portion of the disclosure. The socket 106 of the forward section 402 of the adjustable valance clip 400 is configured to receive the clip feature 108 of a valance 26 in the manner described herein and as such reference is made to that portion of the disclosure. One difference is that in one arrangement of socket 106 of forward section 402 includes only a single friction member 118 which is positioned in the upper surface of lower wall 110 near the rear portion of the socket 106.

In an alternative arrangement, valance clip 400 is non-adjustable, meaning that there is no built-in mechanism that facilitates angular adjustment. That is, in one arrangement, valance clip 400 is formed of a single solid and monolithic member that is non-adjustable in nature. This reduces cost and complexity of the arrangement.

In Operation:

Adjustable valance clip 400 is installed onto the upper slot 140 of track 18 by first aligning the rear notch 422 with the forward facing end of the rearward section of upper wall 132 of track 18. Once the forward facing end of the rearward section of upper wall 132 of track 18 is held within notch 422 of the rear section 404 of adjustable valance clip 400, the forward end of the adjustable valance clip 400 is rotated downward. As the forward end of the adjustable valance clip 400 is rotated downward, the forward angled wall 428 engages the rearward facing end of the forward section of upper wall 132. Once this engagement occurs between the forward angled wall 428 and the rearward facing end of the forward section of upper wall 132 sufficient force is applied to cause the adjustable valance clip 400 and/or track 18 to elastically deform to allow the adjustable valance clip 400 connect to the track 18. As the forward end of adjustable valance clip 400 is moved further downward, the forward angled wall 428 slides on the rearward facing end of the forward section of upper wall 132 until the forward upper end of the forward angled wall 428 passes the rearward facing end of the forward section of upper wall 132 at which point the rearward facing end of the forward section of upper wall 132 snaps into forward notch 426 of the rear section 404 thereby locking the adjustable valance clip 400 onto the track 18.

To remove adjustable valance clip 400 from track 18, the opposite process is performed where the forward end of the adjustable valance clip 400 is raised with sufficient force thereby causing the adjustable valance clip 400 to separate from the track 18.

Once adjustable valance clip 400 is installed on track 18, the valance 26 is installed in socket 106 of the forward end of forward section 402. In doing so, the clip feature 108 is forced into the socket 106 of forward section 402. In one arrangement, where only a single friction member 118 is placed within socket 106, clip feature 108 is fully installed when an audible click is heard when the friction member 118 passes the rear-most positioned friction member 178 of clip feature 108. In the arrangement shown, as one example, only a single friction member 118 is present within socket 106 as having multiple friction members 118 that each engage a friction member 178 of clip feature 108 provides too strong of a connection making it too difficult for removal of the clip feature 108 from the socket 106. In an alternative arrangement, socket 106 includes multiple friction members 118 that either each engage a friction member 178, or each of them allow a friction member 178 to pass there by. In this way, valance 26 is quickly and easily installed onto adjustable valance clip 400 without the use of any tools.

Once installed, the angle of the valance 26 is adjusted by simply rotating the adjustment member thereby raising or lowering the angle of the valance 26. This can be easily done when the valance 26 is in place within the socket 106 of adjustable valance clip 400 without any tools simply by rotating the head 412 of adjustment member 408 either clockwise or counterclockwise.

The valance 26 can easily be removed by simply peeling one end of the clip feature 108 from the socket 106 from one end. Peeling the valance 26 out of the socket 106 has been tested to be easier and more effective than laterally pulling the valance 26 out of the socket 106. Also, it has been tested that pulling the valance 26 down or up, or twisting the valance 26 down or up (e.g. clockwise or counterclockwise) does not pull the clip feature 108 out of the socket 106 due in part to the movement in these manners causes increased engagement between the friction member 178 of the clip feature 108 with the friction member 118 of the adjustable valance clip 400. In this way a strong, durable, yet easily selectively removable connection is formed between valance 26 and adjustable valance clip 400.

Alternative Arrangement:

In an alternative arrangement, the rear section 404 connects to any other object in any other manner. As one example, the connection section 420 of rear section 404 is connected to the end of wall bracket 12, such as that shown in FIGS. 32-38 in the manner shown in these figures, as an example, using opening 314 to fit over the end 308 of wall bracket 12. Alternatively, rear section 404 is contemplated to connect to any other component in any other manner thereby expanding the uses of the adjustable valance clip 400.

Alternative Embodiment of Adjustable Valance Clip

With reference to FIGS. 55-60 an alternative embodiment of an adjustable valance clip 400 is presented for use with the system 10 or any other architectural covering. This alternative embodiment of an adjustable valance clip 400 shown in FIGS. 55-60 differs from the embodiment of an adjustable valance clip 400 shown in FIGS. 39-54 in that the screw 410 of adjustment member 408 extends laterally (or, said another way, horizontally, or side-to-side, or in axial alignment with the axis of rotation of the joint 406 between forward section 402 and rear section 404), whereas, the screw 410 of adjustment member 408 of the adjustable valance clip 400 presented in FIGS. 39-54 extends vertically (or, said another way, up-and-down, or in perpendicular alignment to the axis of rotation of the joint 406 between forward section 402 and rear section 404).

In the arrangement shown, as one example, adjustable valance clip 400 is formed of a forward section 402 and a rear section 404 that are connected to one another by a joint 406, having as an adjustment member 408, which in the arrangement shown includes a screw 410 having a head 412 and a threaded shaft 414 that connects to a nut 415. In the arrangement shown, as one example, joint 406 includes an axis of rotation upon which forward section 402 and rear section 404 angularly adjust with respect to one another.

In the arrangement shown, as one example, rear section 404 is configured to connect adjustable valance clip 400 to other components of the system 10 such as first track 18, second track 20, wall bracket 12, single track top bracket 14, dual track top bracket 16, or any other component of system 10. In the arrangement shown, as one example, rear section 404 includes an arm 418. When viewed from the side, arm 418 is generally flat and planar in shape and extends a width from opposing sides that extend in approximate parallel spaced relation to one another and extends a height between an opposing upper surface and lower surface.

The rearward side of arm 418 includes a connection section 420. Connection section 420 is formed of any suitable size, shape and design and is configured to facilitate connection of adjustable valance clip 400 to other components of the system 10. In the arrangement shown, as one example, connection section 400 is configured to frictionally engage and lock to the slot 140 in the upper wall 132 of track 18. In this arrangement, to facilitate installation into and connection onto the slot 140 in the upper wall 132 of track 18, connection section 420 includes a rear notch 422 positioned at its rearward end. Rear notch 422 is configured to engage and receive the forward facing end of the rearward section of the upper wall 132 that forms slot 140. A rear angled wall 424 is positioned just below rear notch 422. Rear angled wall 424 extends from the rearward most edge of rear notch 422 and extends forward as it extends downward thereby providing an angled surface that helps facilitate installation of the adjustable valance clip 400 into slot 140.

Connection section 420 also includes a forward notch 426 positioned at its forward end. Forward notch 426 is configured to engage and receive the rearward facing end of the forward section of the upper wall 132 that forms slot 140. A forward angled wall 428 is positioned just below forward notch 426. Forward angled wall 428 extends from the forward most edge of forward notch 426 and extends rearward as it extends downward thereby providing an angled surface that helps facilitate installation of the adjustable valance clip 400 into slot 140.

In the arrangement shown, as one example, a spring member 450 is positioned between the portion of rear section 404 that includes rear angled wall 424 and rear notch 422 on one side and the forward angled wall 428 and forward notch 426 on the other side. Spring member 450 is formed of any suitable size, shape and design, and is configured to facilitate give and compression of rear section 404 between rear angled wall 424 and rear notch 422 on one side and the forward angled wall 428 and forward notch 426 on the other side. It has been tested that the dimensional tolerances of track 18 vary greatly and vary substantially from manufacturer-to-manufacture. Further dimensional tolerance variations can be caused by the surface treatment of the track 18 such as being anodized, painted, plated, powder coated, or the like. As such, spring member 450 is configured to provide substantial flexibility to rear section 404 so that rear section 404 can securely and in a repeatable manner connect to tracks 18 that have wide dimensional variations. Placement of spring member 450 between the portion of rear section 404 that includes rear angled wall 424 and rear notch 422 on one side and the forward angled wall 428 and forward notch 426 on the other side allows rear section 404 to securely snap onto and lock onto track 18 regardless of the surface treatment (anodizing, paint, plating, powder coating) and wide dimensional variations.

Spring member 450 may be formed of any suitable size, shape, design or configuration that facilitates flexing or give between the portions of rear section 404 that includes rear angled wall 424 and rear notch 422 on one side and the forward angled wall 428 and forward notch 426 on the other side. In the arrangement shown, as one example, spring member 450 is formed of an extension of rear section 404 that extends in a curved, sinusoidal, or S-shaped manner between the portion of rear section 404 that includes rear angled wall 424 and rear notch 422 on one side and the forward angled wall 428 and forward notch 426 on the other side. In this way, when the portion of rear section 404 that includes rear angled wall 424 and rear notch 422 is pushed toward the portion of rear section 404 that includes forward angled wall 428 and forward notch 426, the spring member 450 compresses thereby allowing the portion of rear section 404 that includes rear angled wall 424 and rear notch 422 to move toward the portion of rear section 404 that includes forward angled wall 428 and forward notch 426 thereby accommodating attachment of the rear section 404 to track 18 regardless of wide dimensional tolerances.

In the arrangement shown, as one example, when viewed from the side the lower edge of spring member 450 between rear angled wall 424 and forward angled wall 428 forms a wall 430 that forms a generally flat bottom surface that extends in approximate parallel space relation to a generally flat upper surface. This is despite the arcuate curvature of the spring member 450, which is visible when viewing rear section 404 from above or below.

In the arrangement shown, adjustable valance clip 400 is installed in the slot 140 in the upper wall 132 of track 18 by first angling the adjustable valance clip 400 such that the rearward end of adjustable valance clip 400 is lower than the upper end of adjustable valance clip 400. In this orientation, the rear notch 422 is placed over the forward facing end of the rearward section of the upper wall 132. In seeking the installation of the forward facing end of the rearward section of the upper wall 132 into rear notch 422, the rear angled wall 424 helps to guide the forward facing end of the rearward section of the upper wall 132. In this way, the configuration of rear notch 422 and rear angled wall 424 helps ease installation.

Once the forward facing end of the rearward section of the upper wall 132 is inserted within the rear notch 422, the forward end of adjustable valance clip 400 is rotated downward. In doing so, the forward angled wall 428 frictionally engages the rearward facing end of the forward section of the upper wall 132 that forms slot 140. Once this engagement occurs, the angle of forward angled wall 428 helps to guide the rearward facing end of the forward section of the upper wall 132 that forms slot 140 into forward notch 426. As the forward end of rear section 404 is forced downward, as the forward angled wall 428 engages the upper side of the rearward facing end of the forward section of the upper wall 132 the spring member 450 compresses. This compression allows the forward angled wall 428 to move toward the rear angled wall 424. Once the upper end of forward angled wall 428 passes the lower end of rearward facing end of the forward section of the upper wall 132 that forms slot 140, the rearward facing end of the forward section of the upper wall 132 that forms slot 140 falls or snaps or is retained within the forward notch 426 thereby locking the adjustable valance clip 400 to track 18. In doing so, the spring bias of spring member 450 again moves the forward angled wall 428 away from rear angled wall 424 until the forward notch 426 and rear notch 422 lock onto track 18. In this locked position, the lower surface of wall 430 is in approximate flat and flush parallel planar engagement with the upper surface of the wall that forms the lower end of slot 140 in track 18.

That is, to remove adjustable valance clip 400 from track 18, sufficient pressure is applied pushing upward on the forward end of adjustable valance clip 400. Once enough pressure is applied, the track 18 and/or adjustable valance clip 400 will elastically deform, and or spring member 450 will elastically deform, enough to allow the rearward facing end of the forward section of the upper wall 132 that forms slot 140 to escape out of the forward notch 426, at which point, adjustable valance clip 400 may be removed from track 18.

The forward end of rear section 404 connects to the rearward end of forward section 402 at joint 406. Joint 406 is formed of any suitable size, shape and design and is configured connect forward section 402 and rear section 404 while facilitating angular adjustment of the forward section 402 relative to the rear section 404.

In the arrangement shown, as one example, rear section 404 includes a hole 452 at its forward end, which when viewed from the side is a generally cylindrical opening that extends from side-to-side across the length of the forward end of rear section 404. Hole 452 is configured to receive the threaded shaft 414 of screw 410 therein.

In the arrangement shown, as one example, the forward end of rear section 404 that includes hole 452 therein is only approximately half as wide as the rear end of rear section 404 that connects to track 18. Having a wider rear end of rear section 404 provides adjustable valance clip 400 having a stronger connection to track 18. Having a narrower forward end of rear section 404 facilitates connection of the forward section 402 to rear section 404.

In the arrangement shown, as one example, the rear end of forward section 402 connects to the forward end of rear section 404 at joint 406. In the arrangement shown, as one example, forward section 402 includes a hole 454 at its rear end, which when viewed from the side is a generally cylindrical opening that extends from side-to-side across the length of the rear end of forward section 402. Hole 454 is configured to receive the threaded shaft 414 of screw 410 therein. In the arrangement shown, the outward end of hole 454 includes a larger recess that is configured to fit the head 412 of screw 410 therein.

In the arrangement shown, as one example, the rear end of forward section 402 that includes hole 454 therein is only approximately half as wide as the forward end of forward section 402 that connects to the valance 26. Having a wider forward end of forward section 402 provides adjustable valance clip 400 having a stronger connection to valance 26. Having a narrower rear end of forward section 402 facilitates connection of the forward section 402 to rear section 404.

In the arrangement shown, as one example, the rear end of forward section 402 connects to the forward end of rear section 404 by aligning the hole 452 in the forward end of rear section 404 with the hole 454 in the rear end of forward section 402 and thereafter inserting the screw 410 through hole 452 and hole 454. Once screw 410 is inserted through hole 452 and hole 454, nut 415 is placed on the end of the threaded shaft 414 of screw 410 and the head 412 of screw 410 is tightened. In one arrangement, nut 415 is held in place within a wider section hole 452 on its side opposite the side forward section 402 is connected, such that when head 412 is rotated, the nut 415 is held in place thereby easing installation. As the screw 410 is tightened, the rear end of forward section 402 is pulled in tight engagement with the forward end of rear section 404.

Screw 410 of adjustment member 408 is tightened until the desired amount of resistance is formed within joint 406. Screw 410 may be tightened to lock the relative position of the forward section 402 and the rear section 404. Screw 410 may be tightened to hold the relative position of the forward section 402 and the rear section 404 while allowing for manual adjustment of the relative position of the forward section 402 and the rear section 404. Screw 410 may be loosened to allow free movement of the relative position of the forward section 402 and the rear section 404.

Notably, the arrangement can be made in an opposite manner wherein rear section 404 is positioned on an opposite side of forward section 402.

An arm 440 is connected to and extends forward from the rear portion of forward section 402 that includes hole 454 and receives screw 410 therein. In the arrangement shown, as one example, arm 440 initially extends forward and downward and curves before extending in a generally planar manner. The forward end of arm 440 of forward section 402 includes a socket 106 similar if not identical to that described herein and as such reference is made to that portion of the disclosure. The socket 106 of the forward section 402 of the adjustable valance clip 400 is configured to receive the clip feature 108 of a valance 26 in the manner described herein and as such reference is made to that portion of the disclosure.

In Operation:

Adjustable valance clip 400 is installed onto the upper slot 140 of track 18 by first aligning the rear notch 422 with the forward facing end of the rearward section of upper wall 132 of track 18. Once the forward facing end of the rearward section of upper wall 132 of track 18 is held within notch 422 of the rear section 404 of adjustable valance clip 400, the forward end of the adjustable valance clip 400 is rotated downward. As the forward end of the adjustable valance clip 400 is rotated downward, the forward angled wall 428 engages the rearward facing end of the forward section of upper wall 132. Once this engagement occurs between the forward angled wall 428 and the rearward facing end of the forward section of upper wall 132 sufficient force is applied to cause the adjustable valance clip 400 and/or track 18 to elastically deform to allow the adjustable valance clip 400 connect to the track 18. In doing so, spring member 450 compresses inward, allowing the forward angled wall 428 to move toward the rear angled wall 424. As the forward end of adjustable valance clip 400 is moved further downward, the forward angled wall 428 slides on the rearward facing end of the forward section of upper wall 132 until the forward upper end of the forward angled wall 428 passes the rearward facing end of the forward section of upper wall 132 at which point the rearward facing end of the forward section of upper wall 132 engages or moves or snaps or locks into forward notch 426 of the rear section 404 thereby locking the adjustable valance clip 400 onto the track 18.

To remove adjustable valance clip 400 from track 18, the opposite process is performed where the forward end of the adjustable valance clip 400 is raised with sufficient force thereby causing the adjustable valance clip 400 to separate from the track 18. Alternatively, or in addition, to ease removal of valance clip 400 from track 18 with the presence of spring member 450, in one arrangement the user may grasp the upper ends of rear section 404 and compress them together thereby reducing the distance between the forward angled wall 428 to move toward the rear angled wall 424 thereby allowing the rearward facing end of the forward section of upper wall 132 to move out of the forward notch 426 of the rear section 404 and/or allowing the forward facing end of the rear section of upper wall 132 to move out of the rear notch 422 of the rear section 404 thereby allowing the adjustable valance clip 400 to be removed from track the track 18 in a fast and easy manner.

Once adjustable valance clip 400 is installed on track 18, the valance 26 is installed in socket 106 of the forward end of forward section 402. In doing so, the clip feature 108 is forced into the socket 106 of forward section 402.

Once installed, the angle of the valance 26 is adjusted using the screw 410 of adjustment member 408 to facilitate angular adjustment of forward section 402 relative to rear section 404. Screw 410 of adjustment member 408 is tightened until the desired amount of resistance is formed within joint 406. Screw 410 may be tightened to lock the relative position of the forward section 402 and the rear section 404. Screw 410 may be tightened to hold the relative position of the forward section 402 and the rear section 404 while allowing for manual adjustment of the relative position of the forward section 402 and the rear section 404. Screw 410 may be loosened to allow free movement of the relative position of the forward section 402 and the rear section 404. When screw 410 is loose, or tightened just enough to allow movement while holding the relative position of forward section 402 and the rear section 404, the user simply adjusts the angle of forward section 402 relative to the rear section 404. As the user adjusts the angle of forward section 402 relative to the rear section 404, forward section 402 and rear section 404 rotate upon the axis of rotation formed by the shaft 414 of screw 410. Once the desired angular position of forward section 402 and rear section 404 is achieved, screw 410 is tightened thereby locking the relative angular position of forward section 402 and rear section 404.

As screw 410 is tightened, the threads of threaded shaft 414 mesh with the threads of nut 415 thereby pulling nut 415 toward head 412. As screw 410 is tightened, this pulls the forward portion of rear section 404 into tight and locking frictional engagement with the rear portion of forward section 402. In doing so, the friction between the engaging surfaces of rear section 404 and forward section 402 holds the relative position of joint 406.

Adjustable valance clip 400 may be of any length. That is, adjustable valance clip 400 may extend the valance 26 any desired distance away from track 18. As an example, in the arrangement shown in FIGS. 55-60 a longer forward section 402 is presented with an elongated arm 440 as compared to the arrangement presented in FIGS. 61-66 which has a shorter forward section 402 is presented with a shortened arm 440.

In the arrangement shown, as one example, in FIGS. 55-66, screw 410 includes a head 412 that requires the use of a Philips head screw driver. In another arrangement, head 412 of screw 410 is enlarged, such as that shown in FIGS. 39-54, so as to facilitate hand tightening and loosening without the use of any tools.

Sock, End Cap and Clip Arrangement:

In an alternative arrangement, with reference to FIGS. 67-79 an alternative arrangement of valance system 10 is presented that includes a sock 460 that is used to cover valance 26 and end cap 152. Sock 460 is formed of any suitable size, shape and design and is configured to cover valance 26 and end cap 152 and improve its aesthetic appearance as well as cover any seams in the valance 26 and/or end 152. In the arrangement shown, as one example sock 460 is formed of a single piece of material that is folded over and is connected to itself along a seam line 462. In this way, sock 460 forms a single continuous member having a hollow interior at extends a length between opposing ends. In the arrangement shown, the size, shape and configuration of sock 460 remains similar if not identical from end to opposing end.

The hollow interior of sock 460 receives valance 26 and end cap 152 therein within close and tight tolerances. In this way, sock 460 is configured to cover the entirety of valance 26 and end cap 152. In the arrangement shown, as one example, when valance 26 is positioned within the hollow interior of sock 460 the upper end 154 of valance 26 engages the upper interior end of the hollow interior of sock 460, the lower end 156 of valance 26 engages the lower interior end of the hollow interior of sock 460, and the rearward end of clip feature 108 of valance 26 engages the interior surface of the hollow interior of sock 460. In one arrangement, end cap 152 fits within the hollow interior of sock 460 in a similar fashion. In this way, when valance 26 and end cap 152 are positioned within the hollow interior of sock 460, sock 460 fits around valance 26 and end cap 152 in a tight-fitting fashion. In one arrangement, sock 460 is configured such that valance 26 and end cap 152 are easily inserted within the hollow interior of sock 460 while sock 460 stretches slightly or is under tension when positioned around valance 26 and end cap 152.

This arrangement allows for quick, easy and tool-free covering of valance 26 and end cap 126. When sock 460 covers valance 26 and end cap 152, seam line 462 is positioned to the rearward side of valance 26 and end cap 152 so as to conceal the seam line 462 from sight. As such, the side of sock 460 that includes seam line 462 is the rearward side 464 of sock 460 and the seam-free side of sock 460 is the forward side 466 of sock 460. Installing sock 460 in this manner over valance 26 and end cap 152 provides a seamless covering over valance 26 and end cap 152 that provides an improved aesthetic appearance that is quick and easy to install, as well as quick and easy to remove and replace.

Sock 460 may be formed of any type of fabric and may be formed of any color and/or pattern. In one arrangement, sock 460 is formed of a single layer of material. In another arrangement, to provide additional give and additional concealment of seams or features in valance 26 and/or end cap 152, the sock 460 is formed of an outer fabric layer with a backing layer. In one arrangement, the outer layer of sock 460 provides the desired aesthetic appearance, such as the desired color and/or pattern. In one arrangement, the inner layer of sock 460 provides additional give, compression and concealment to the outer layer. In one arrangement, the inner layer is formed of a layer of foam, felt or any other material or combination thereof that provides give, can compress and/or can help facilitate concealment of features in valance 26 and/or end cap 152. In one arrangement, the inner layer and outer layer of sock 460 are formed together, are adhered together, or are connected to one another by any other manner, method or means. In this arrangement, inner layer and outer layer of sock 460 are installed at the same time over valance 26 and end cap 152. In an alternative arrangement, inner layer and outer layer of sock 460 are not connected to one another and in this arrangement, the inner layer is installed first over valance 26 and end cap 152 followed by the installation of the outer layer of sock 460 over the inner layer, valance 26 and end cap 152. This arrangement allows for removal and replacement of the outer layer of sock 460 without removing the inner layer, which can provide some time savings.

Figure 69:
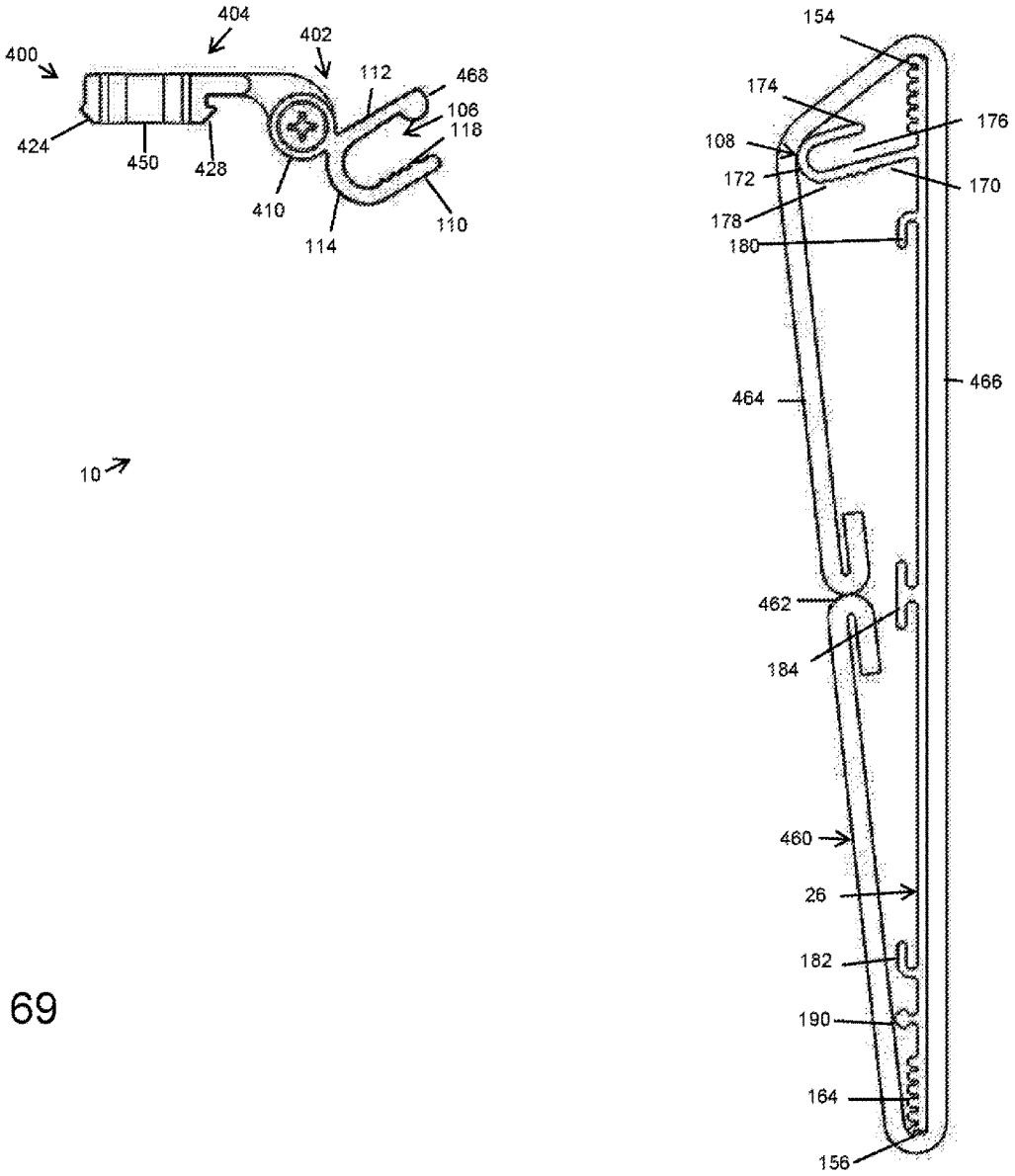
FIG. 69 is a side elevation exploded view of an alternative arrangement of the valance showing a sock positioned over the valance and an adjustable valance clip exploded away from the valance.

With reference to the side view of FIG. 69, when sock 460 is placed around valance 26, sock 460 is taught or tight-fitting around valance 26. That is, the interior surface of the hollow interior of sock 460 extends in a fat and flush engagement against the forward face 158 of valance 26, the upper interior edge of sock 460 wraps around the upper end 154 of valance 26, the lower interior edge of sock 460 wraps around the lower end 156 of valance 26, and the rearward interior side of sock 460 wraps around the interior edge, and/or rounded nose 172, of clip feature 108. In this way, sock 460 is relatively tight-fitting around valance 26 and/or end cap 152. In this position, with sock 460 wrapped around valance 26 and end cap 152, valance 26, with the installed sock 460, is installed into socket 106 of bracket 14, 16, clip 300 and/or adjustable valance clip 400.

Figure 70:
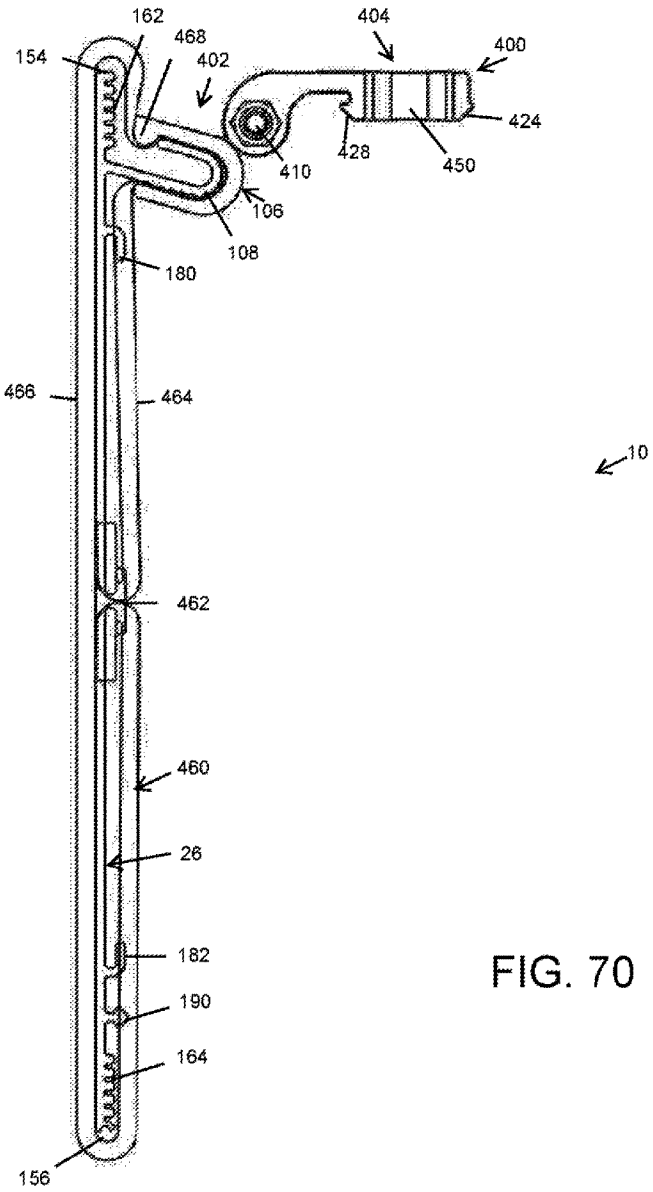
FIG. 70 is a side elevation assembled view of an alternative arrangement of the valance showing a sock positioned over the valance and an adjustable valance clip installed over the clip feature of the valance, the view showing the sock pulled tight over the valance, the view showing a feature on the outward upper end of the socket locked over the upper rearward end of the clip feature.
Figure 71:
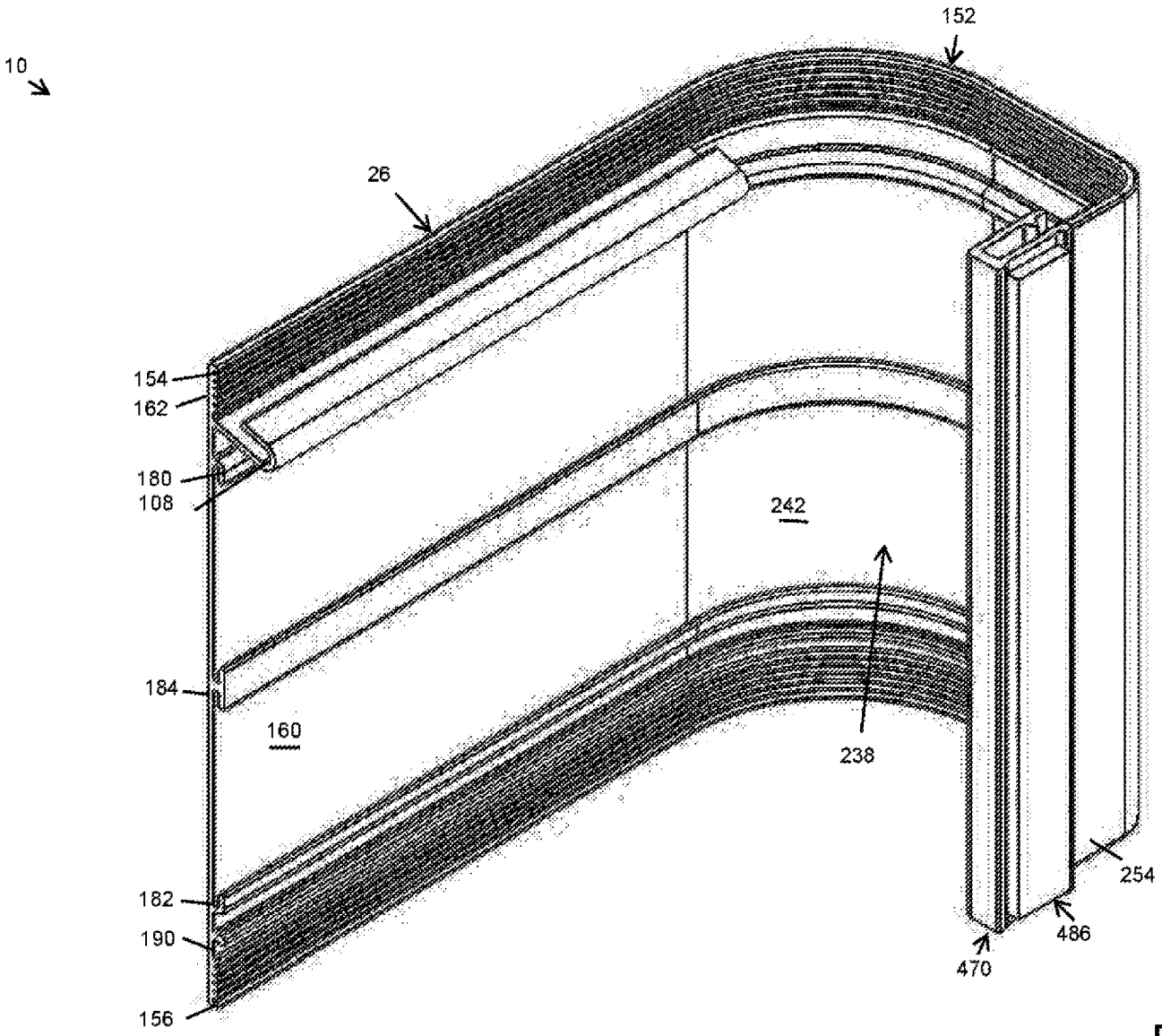
FIG. 71 is a rear perspective view of an alternative arrangement of the valance showing an end cap connected to the end of the valance, the view showing the end cap bent in a smooth fashion, the view showing an end clip slid over the end of the end cap, the view showing a connection member connected to the recess in the rearward side of the end clip.
Figure 72:
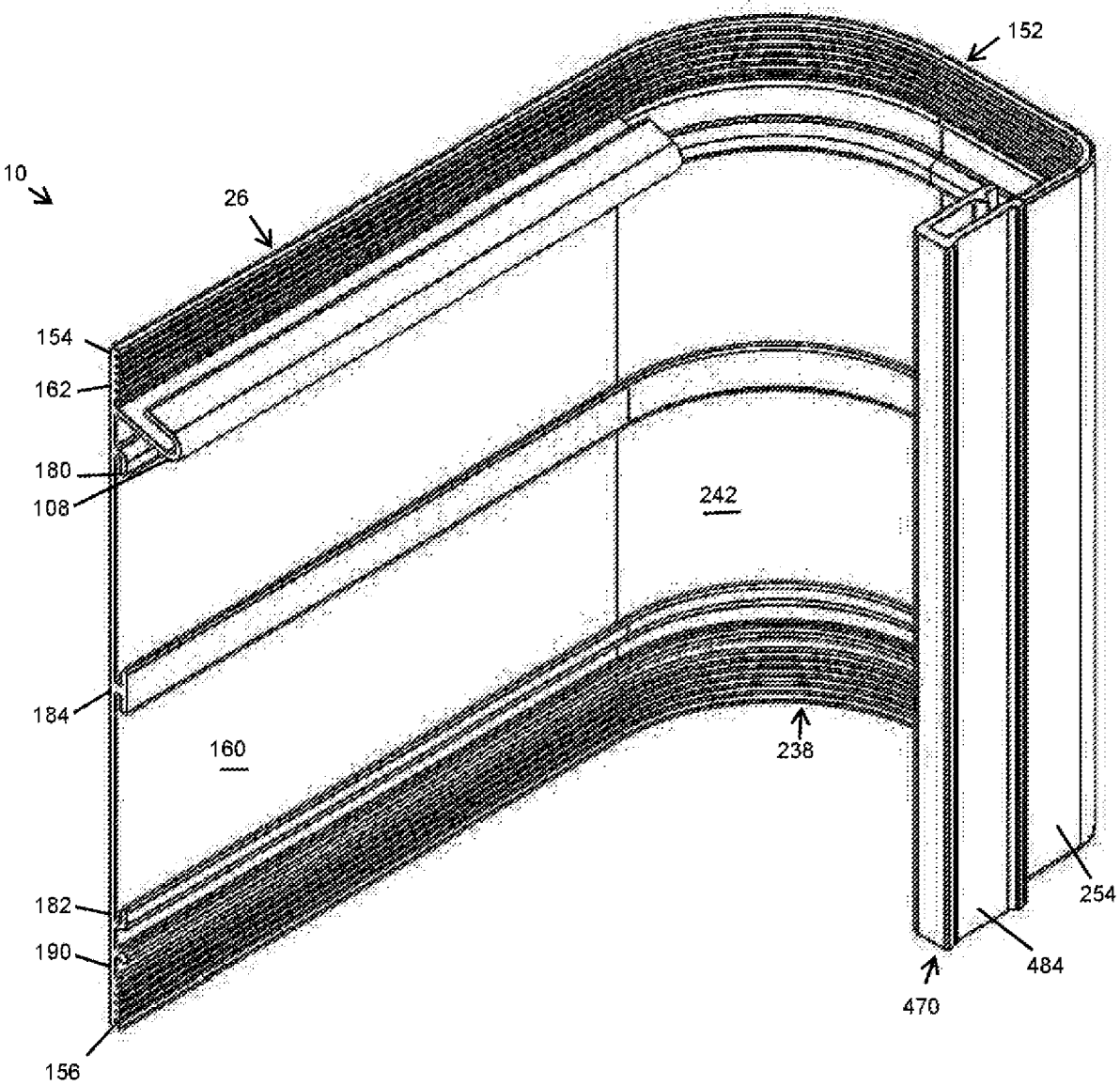
FIG. 72 is a rear perspective view of an alternative arrangement of the valance showing an end cap connected to the end of the valance, the view showing the end cap bent in a smooth fashion, the view showing an end clip slid over the end of the end cap, the view showing the connection member removed from the view of FIG. 71.
Figure 73:
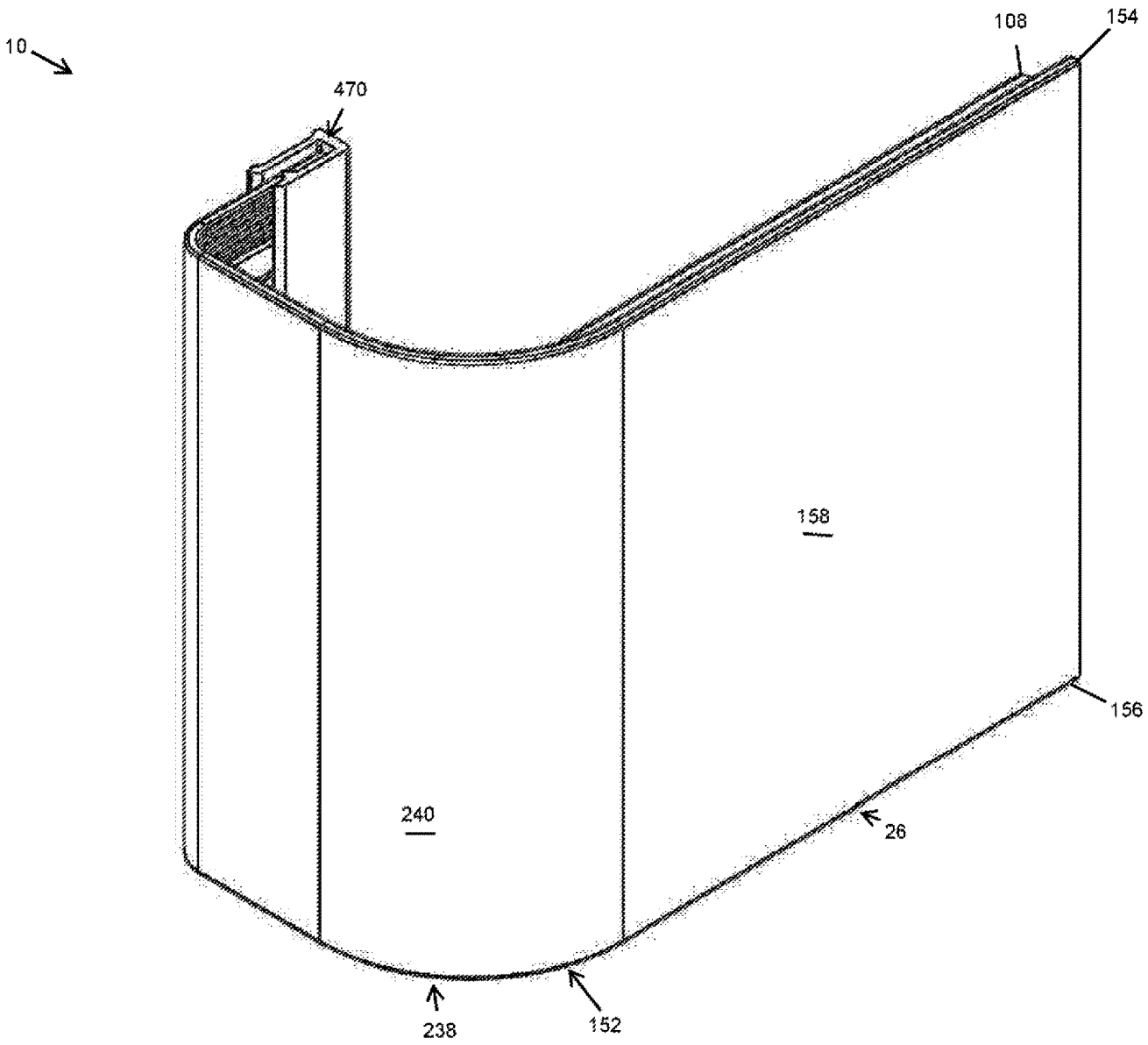
FIG. 73 is a front perspective view of an alternative arrangement of the valance showing an end cap connected to the end of the valance, the view showing the end cap bent in a smooth fashion, the view showing an end clip slid over the end of the end cap, the view showing the connection member removed from the view of FIG. 71.
Figure 74:
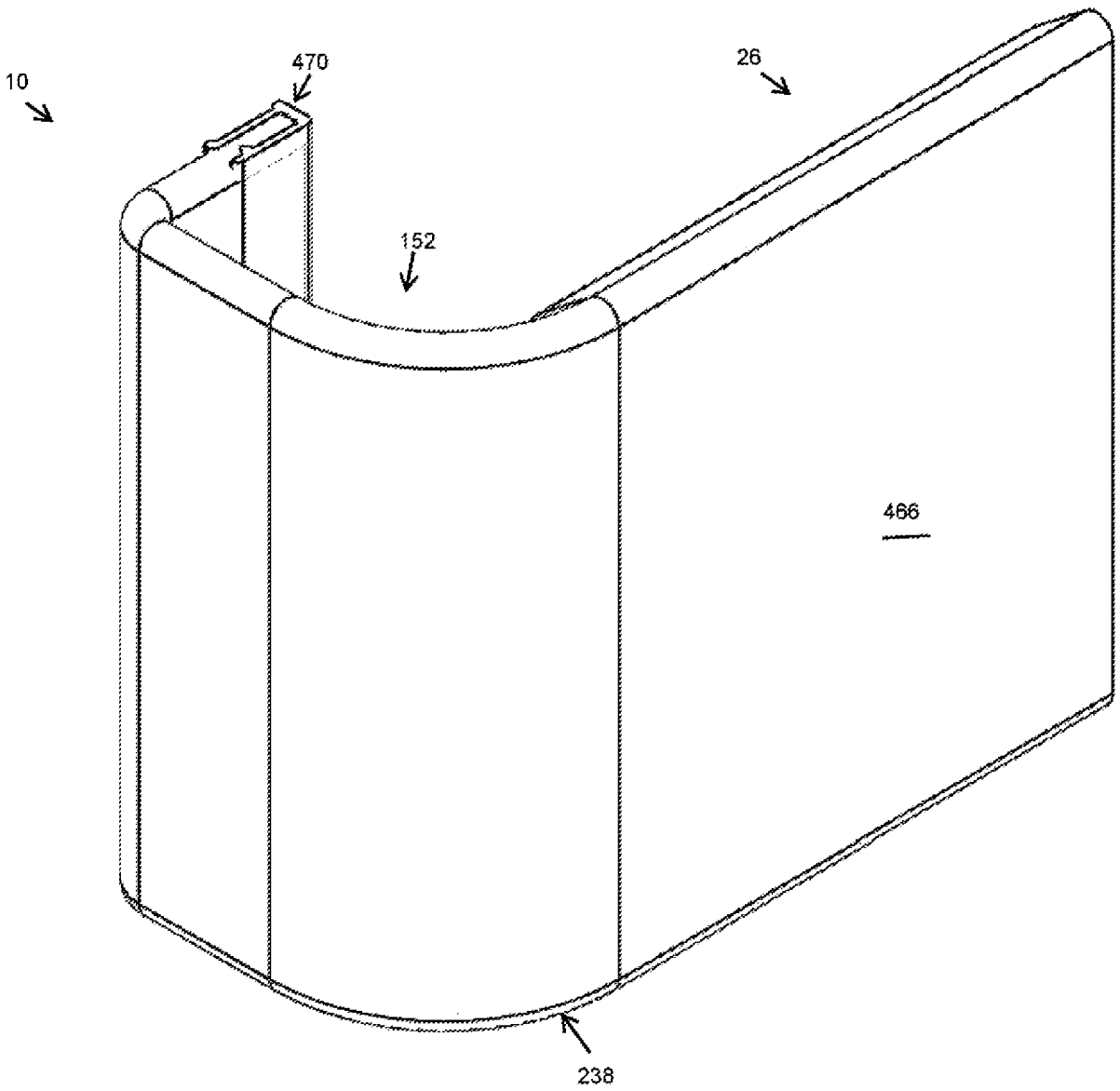
FIG. 74 is a front perspective view of an alternative arrangement of the valance showing an end cap connected to the end of the valance, the view showing the end cap bent in a smooth fashion, the view showing a sock installed over the valance and the end cap, the view showing an end clip slid over the end of the sock and the end cap, the view showing the connection member removed from the view of FIG. 71.
Figure 75:
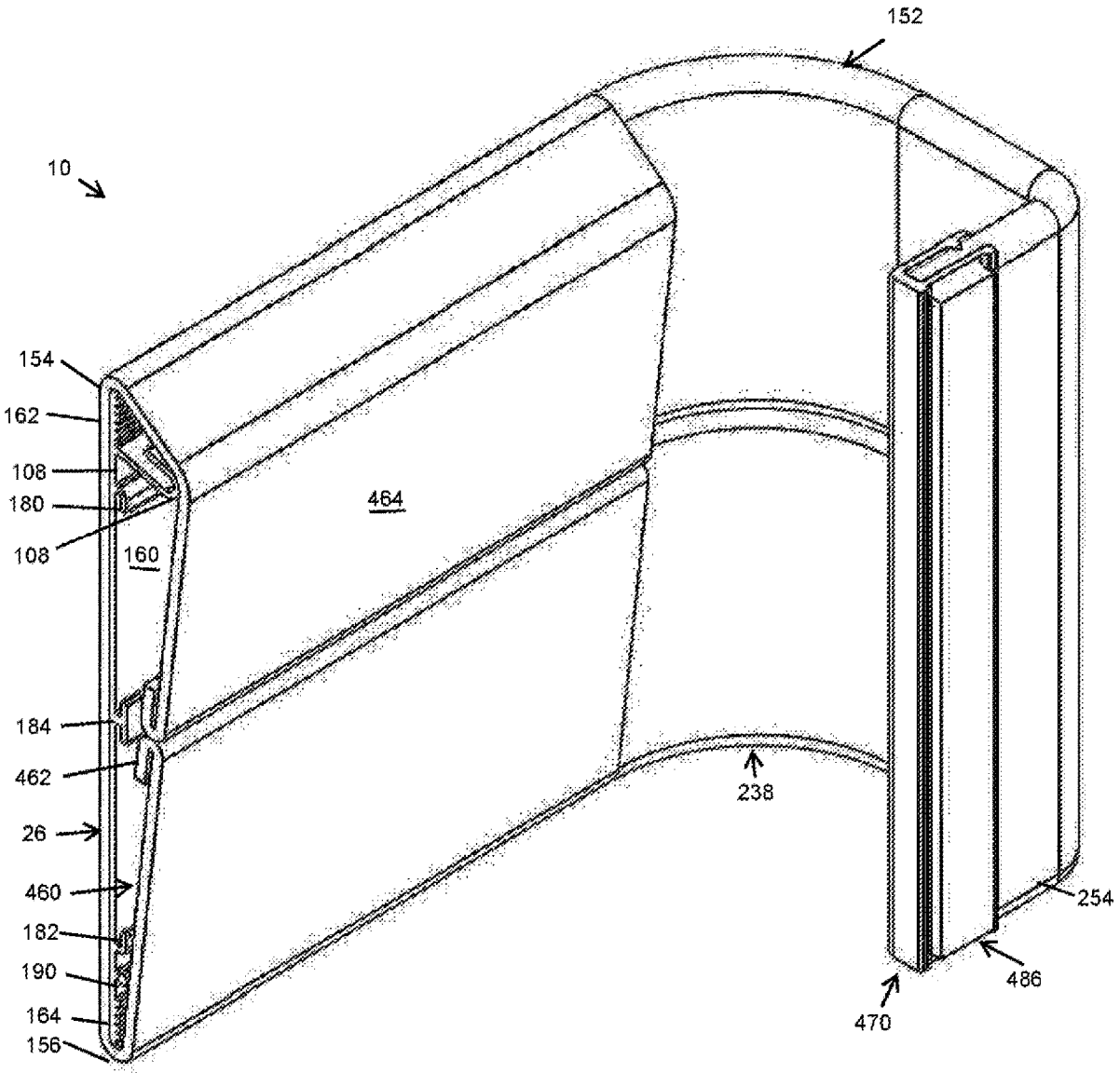
FIG. 75 is a rear perspective view of an alternative arrangement of the valance showing an end cap connected to the end of the valance, the view showing the end cap bent in a smooth fashion, the view showing a sock installed over the valance and the end cap, the view showing an end clip slid over the end of the sock and the end cap, the view showing the connection member removed from the view of FIG. 71.
Figure 76:
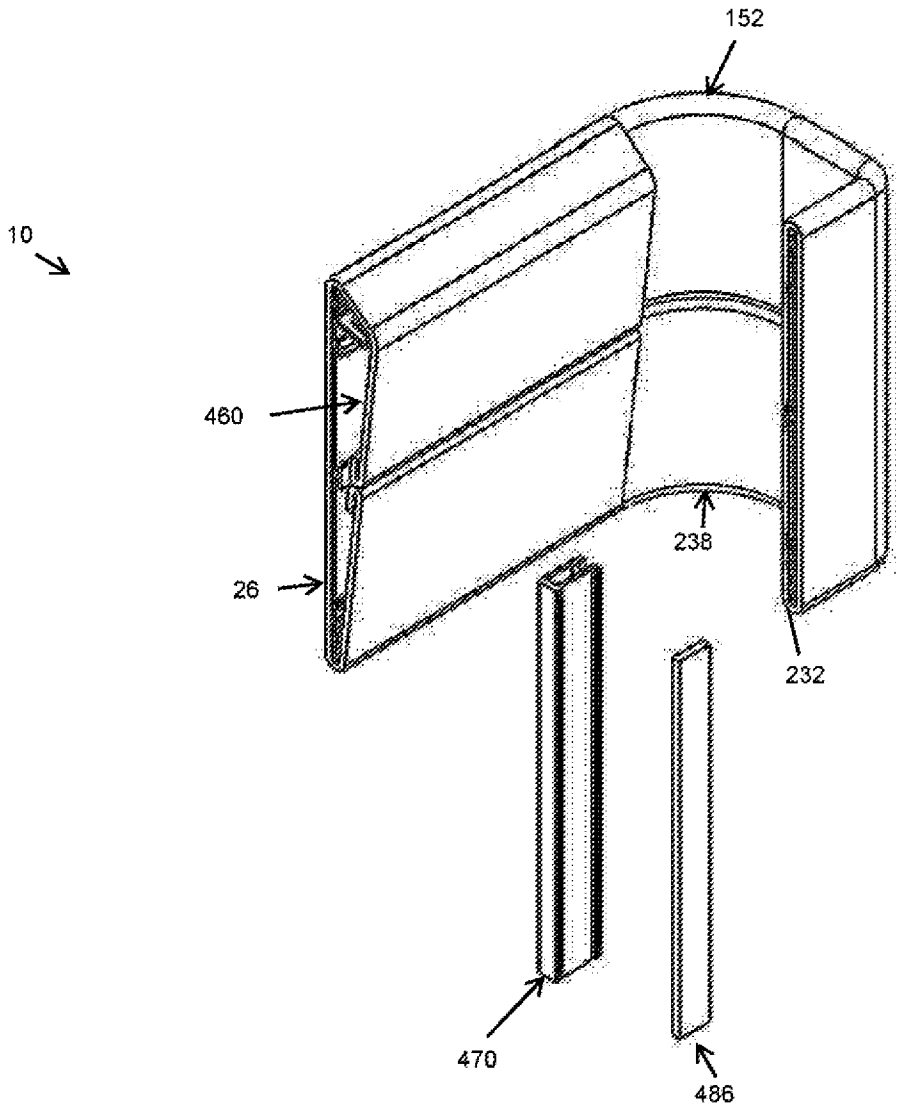
FIG. 76 is a rear perspective exploded view of an alternative arrangement of the valance showing an end cap connected to the end of the valance, the view showing the end cap bent in a smooth fashion, the view showing a sock installed over the valance and the end cap, the view showing an end clip exploded away from the valance and sock, the view showing the connection member exploded from the recess in the rear side of the end clip.
Figure 77:
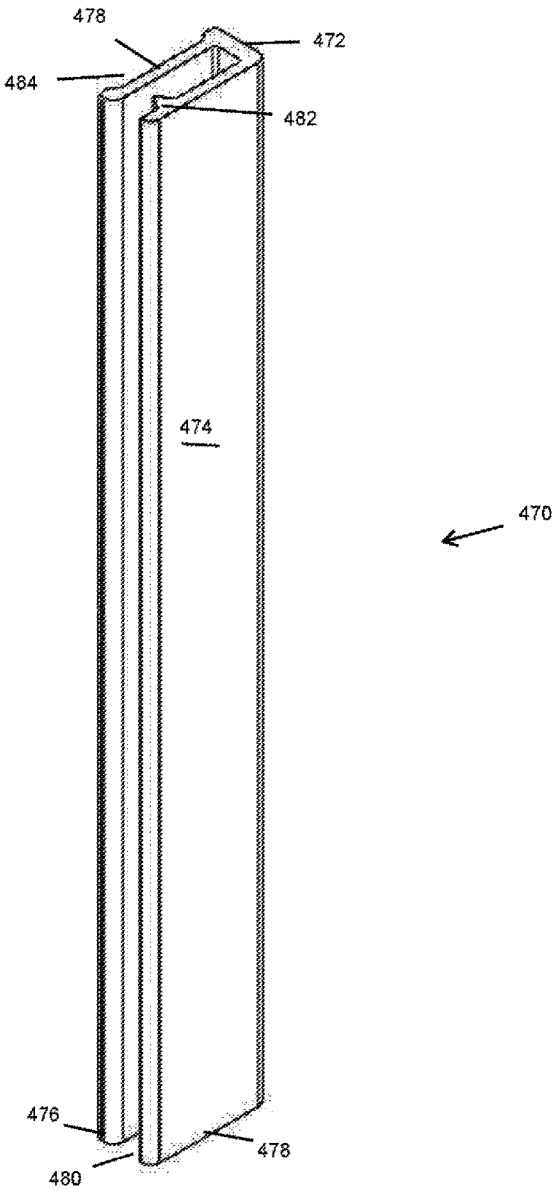
FIG. 77 is a front perspective view of an end clip.
Figure 78:
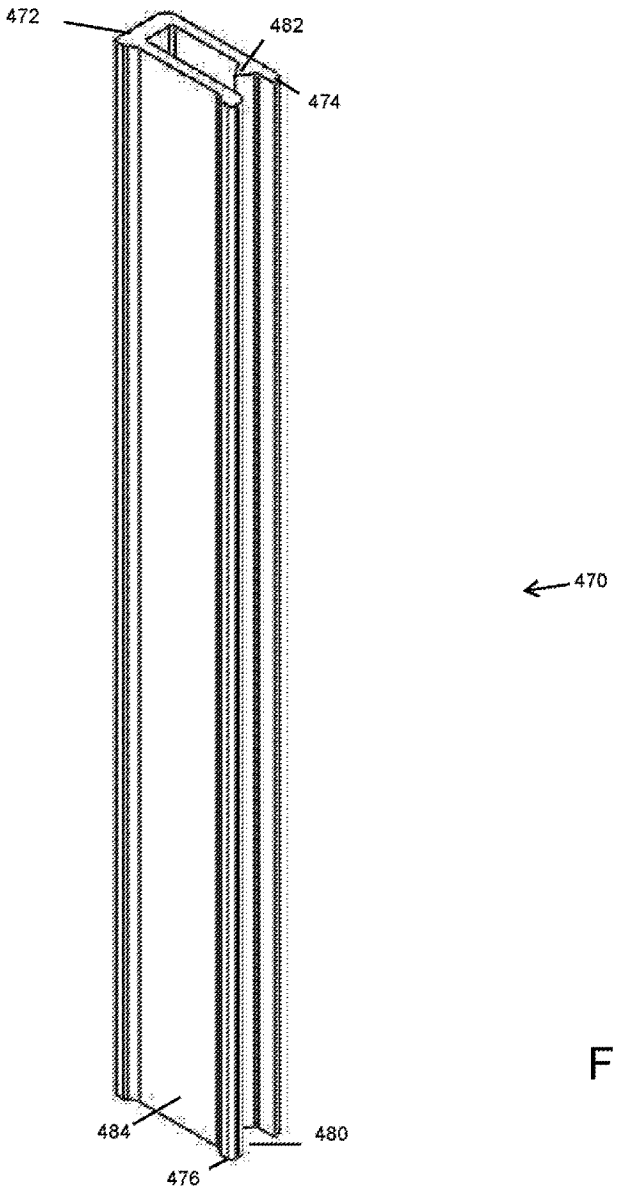
FIG. 78 is a rear perspective view of an end clip.
Figure 79:
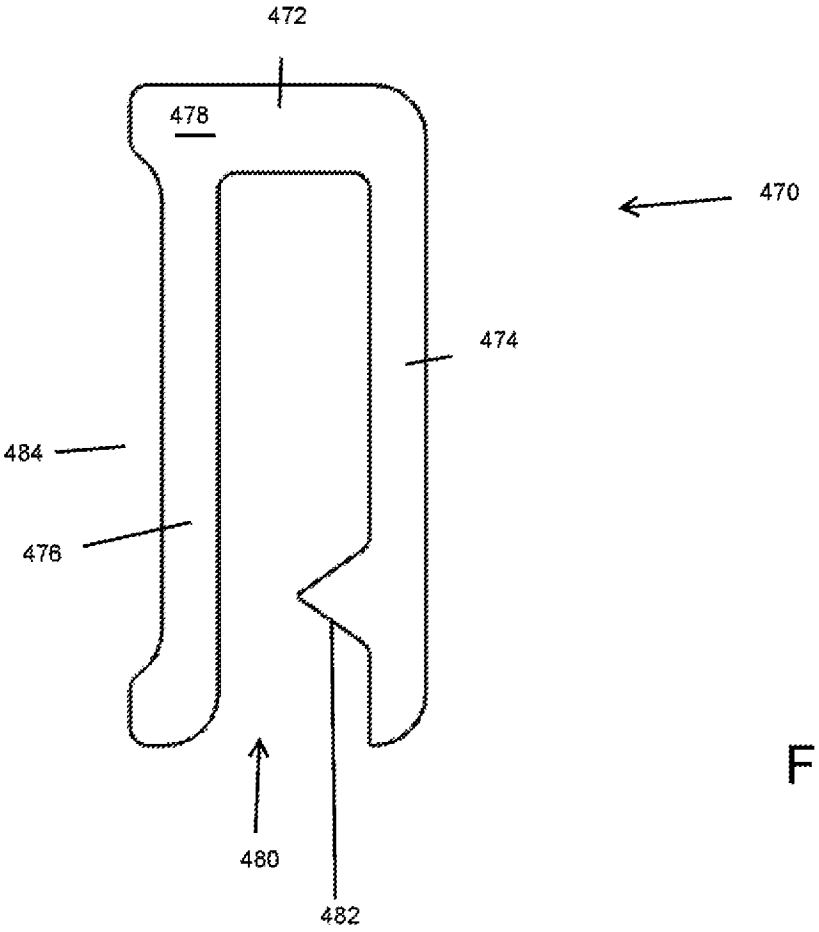
FIG. 79 is an end elevation view of an end clip.
Figure 80:
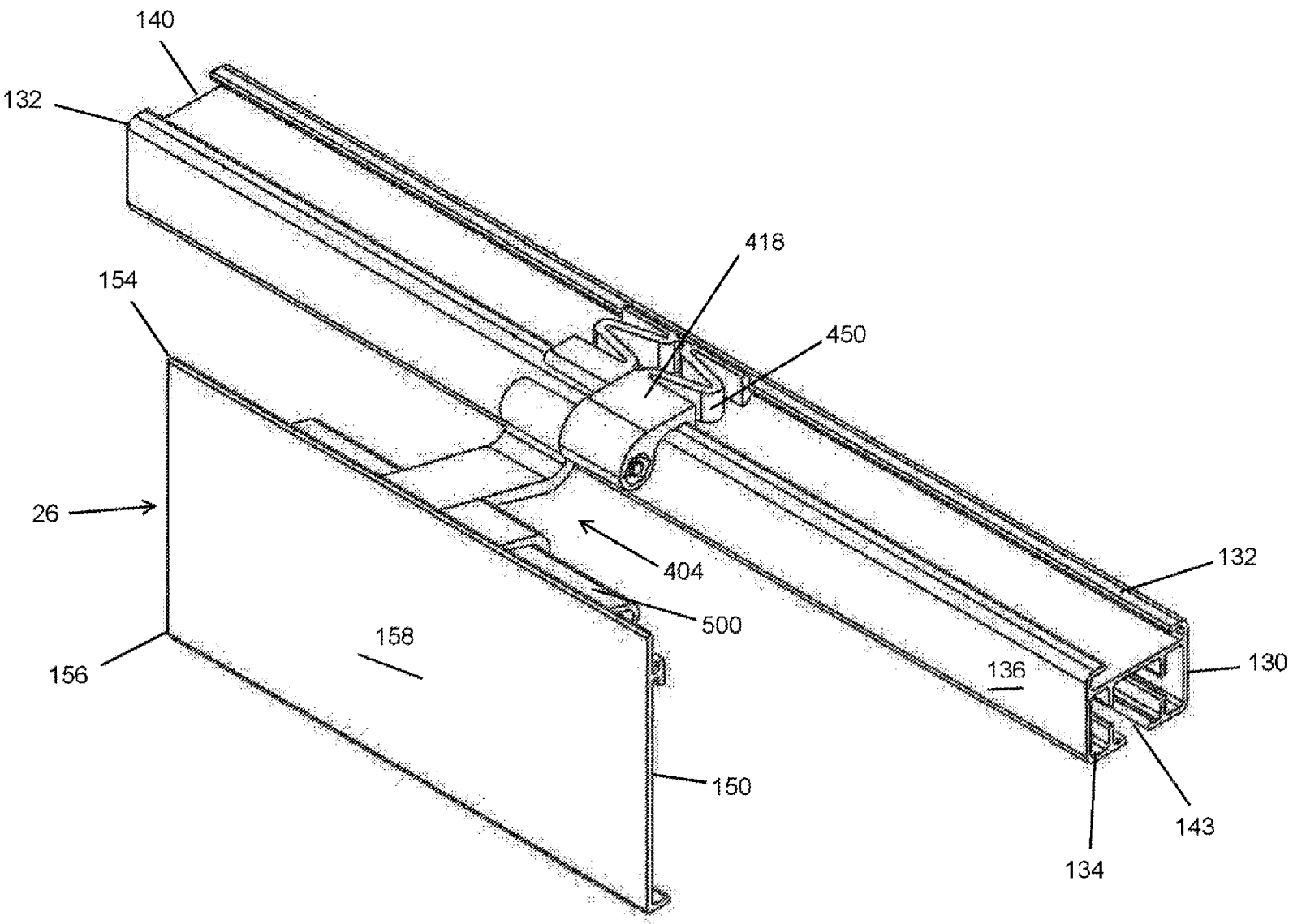
FIG. 80 is a perspective view from the front-top side of a valance having a removable clip feature added to a feature in the rearward side of the valance, the view showing the removable clip feature connected to an adjustable valance clip which is connected to a drapery track.
Figure 81:
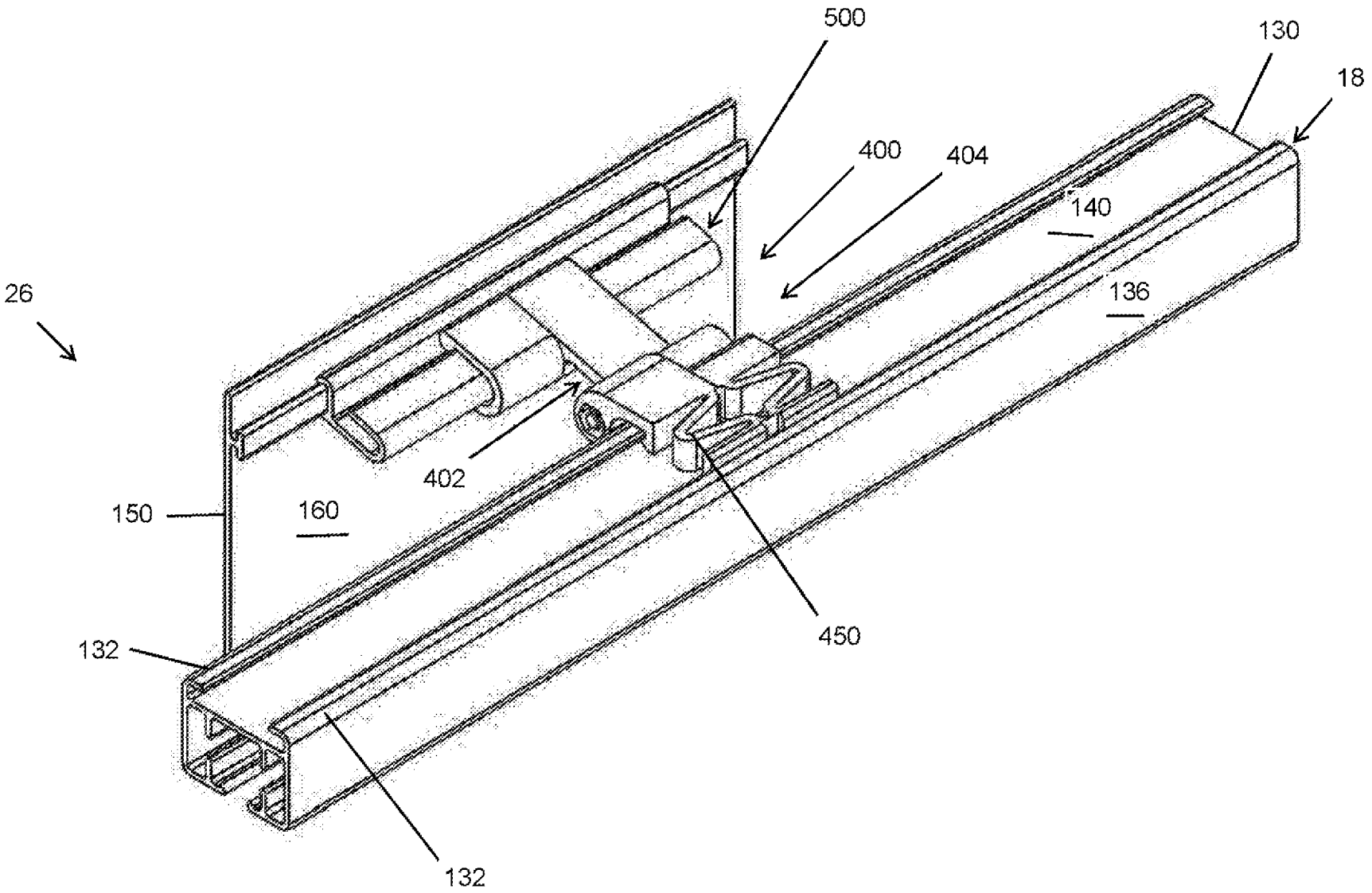
FIG. 81 is a perspective view of FIG. 80 from the rear-top side.
Figure 82:
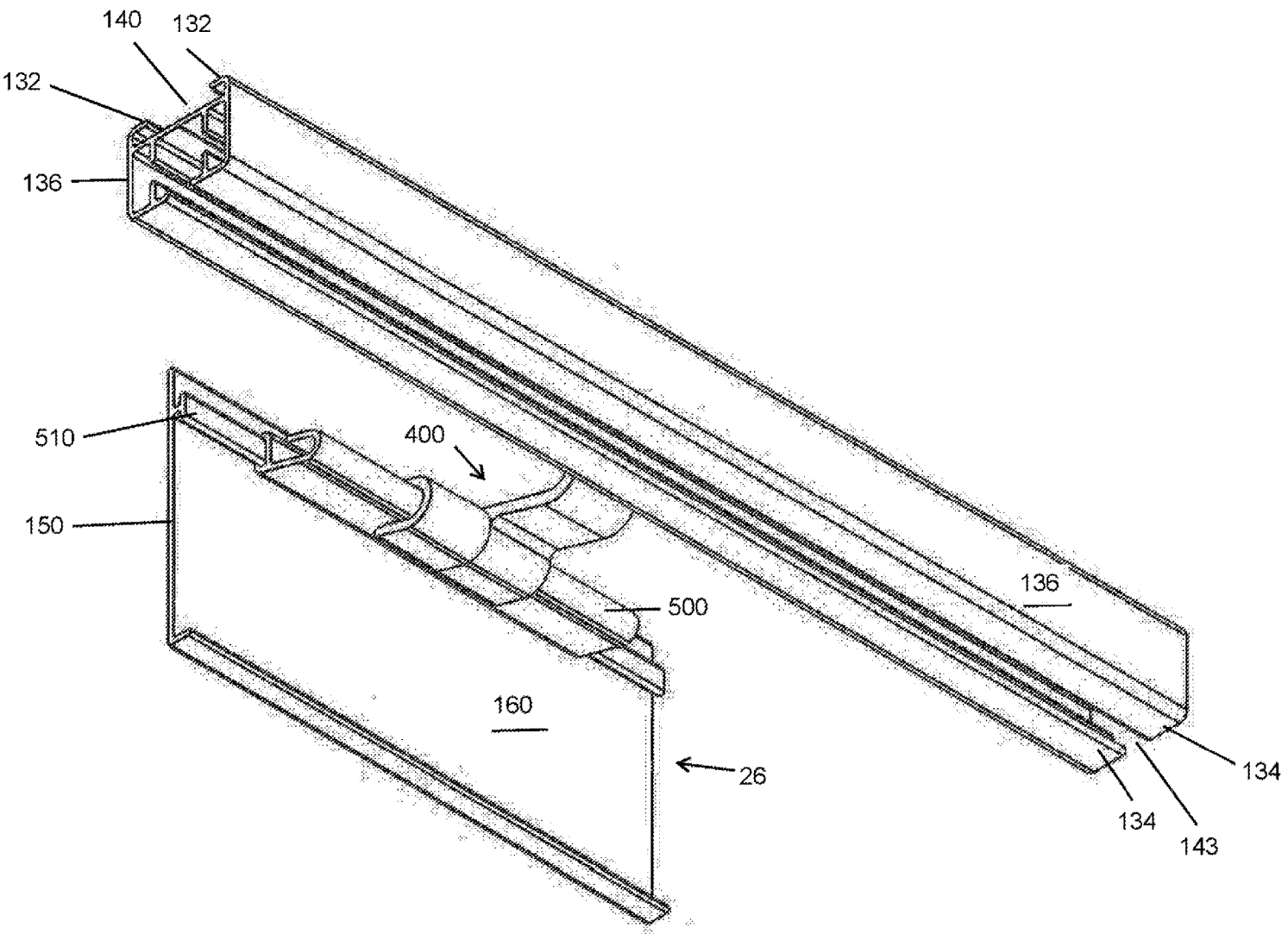
FIG. 82 is a perspective view of FIG. 80 from the rear-bottom side.
Figure 83:
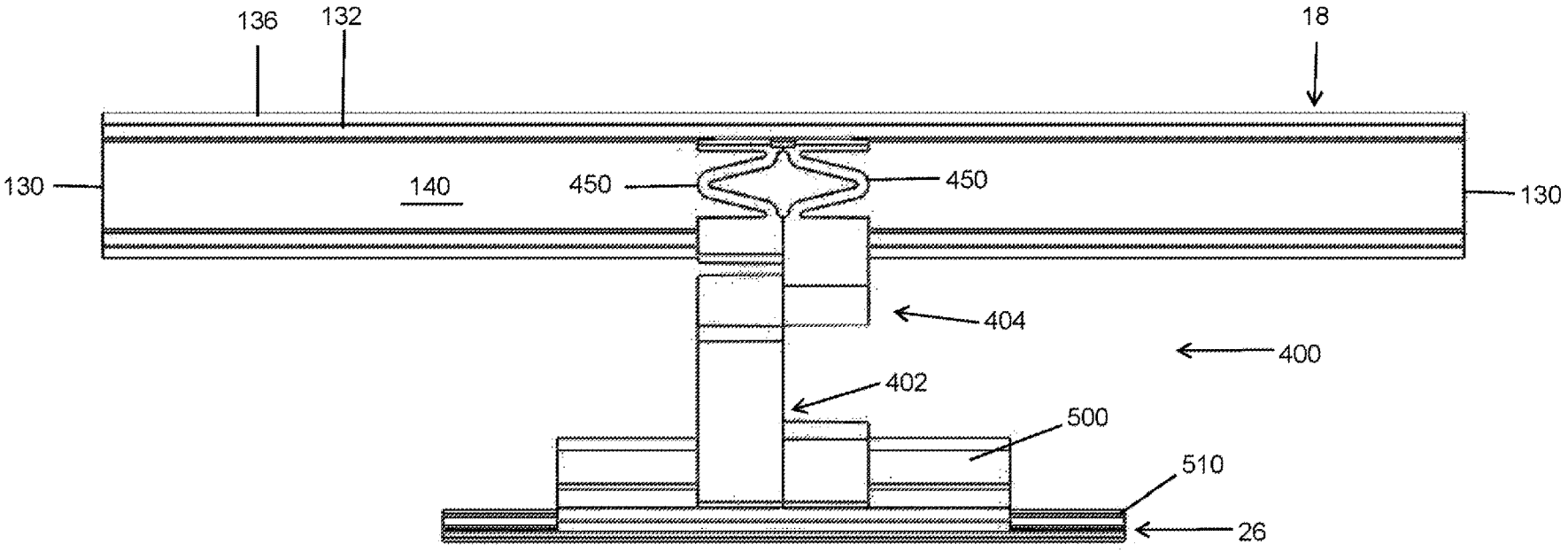
FIG. 83 is an elevation view of FIG. 80 from the top side.
Figure 84:
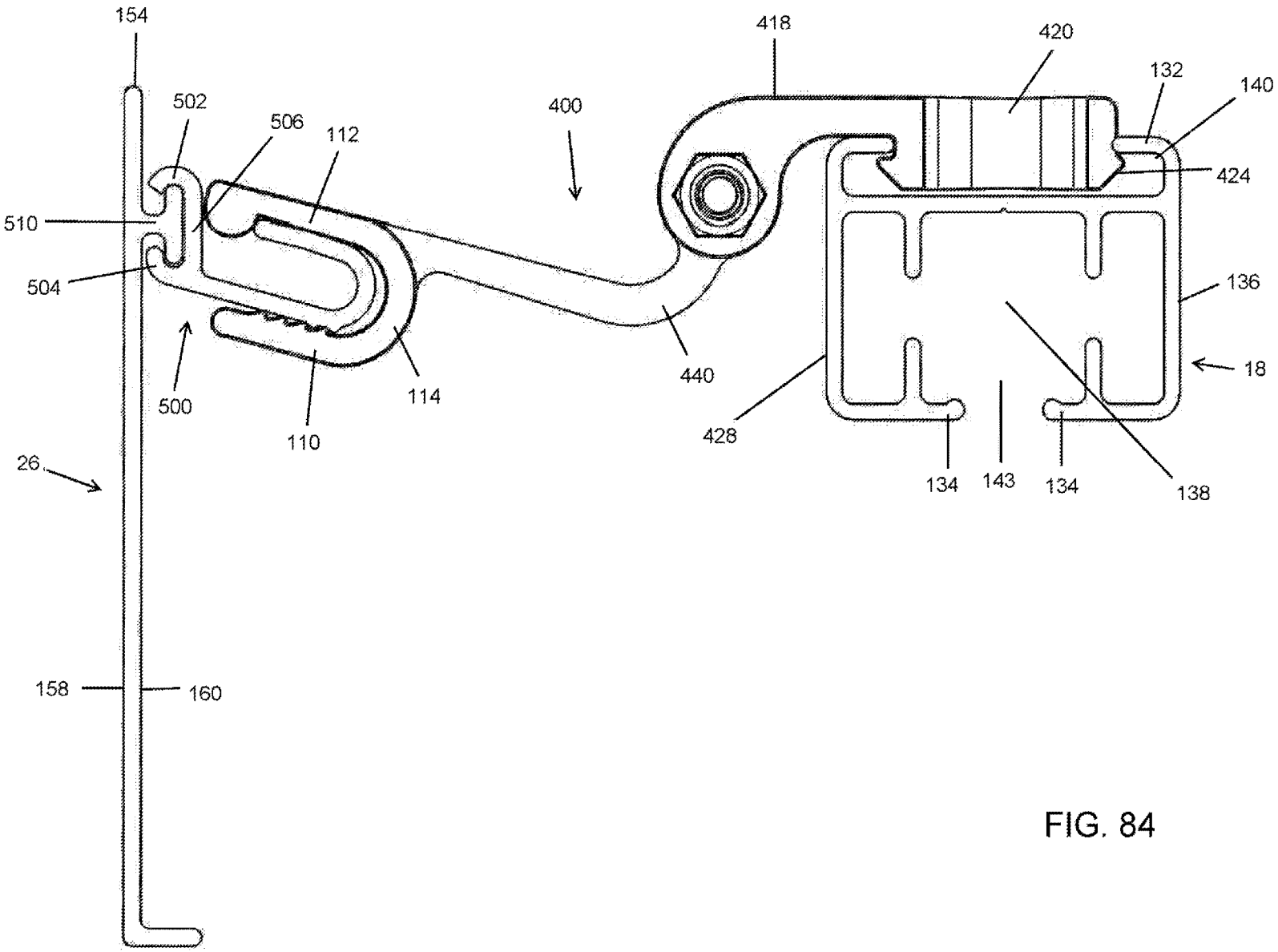
FIG. 84 is an elevation view of FIG. 80 from the side, the view showing the feature of the valance having an upper arm and a lower arm that are held within the hollow interior of the removable clip feature and engaged by the upper arm and lower arm and center wall of the removable clip feature.
Figure 85:
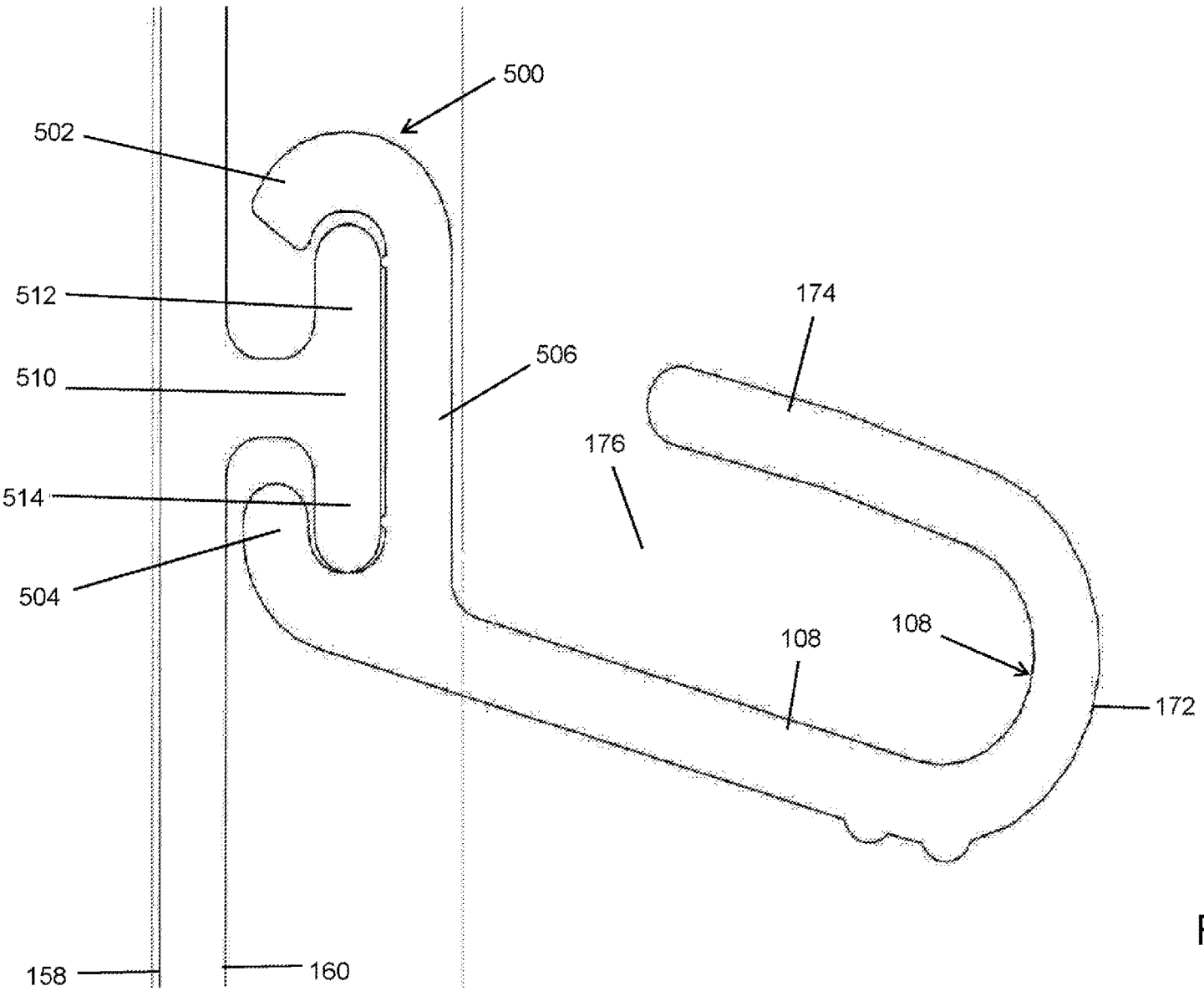
FIG. 85 is a close-up elevation view of the side of the removable clip feature which is attached to the feature in the rearward side of the valance.
Figure 86:
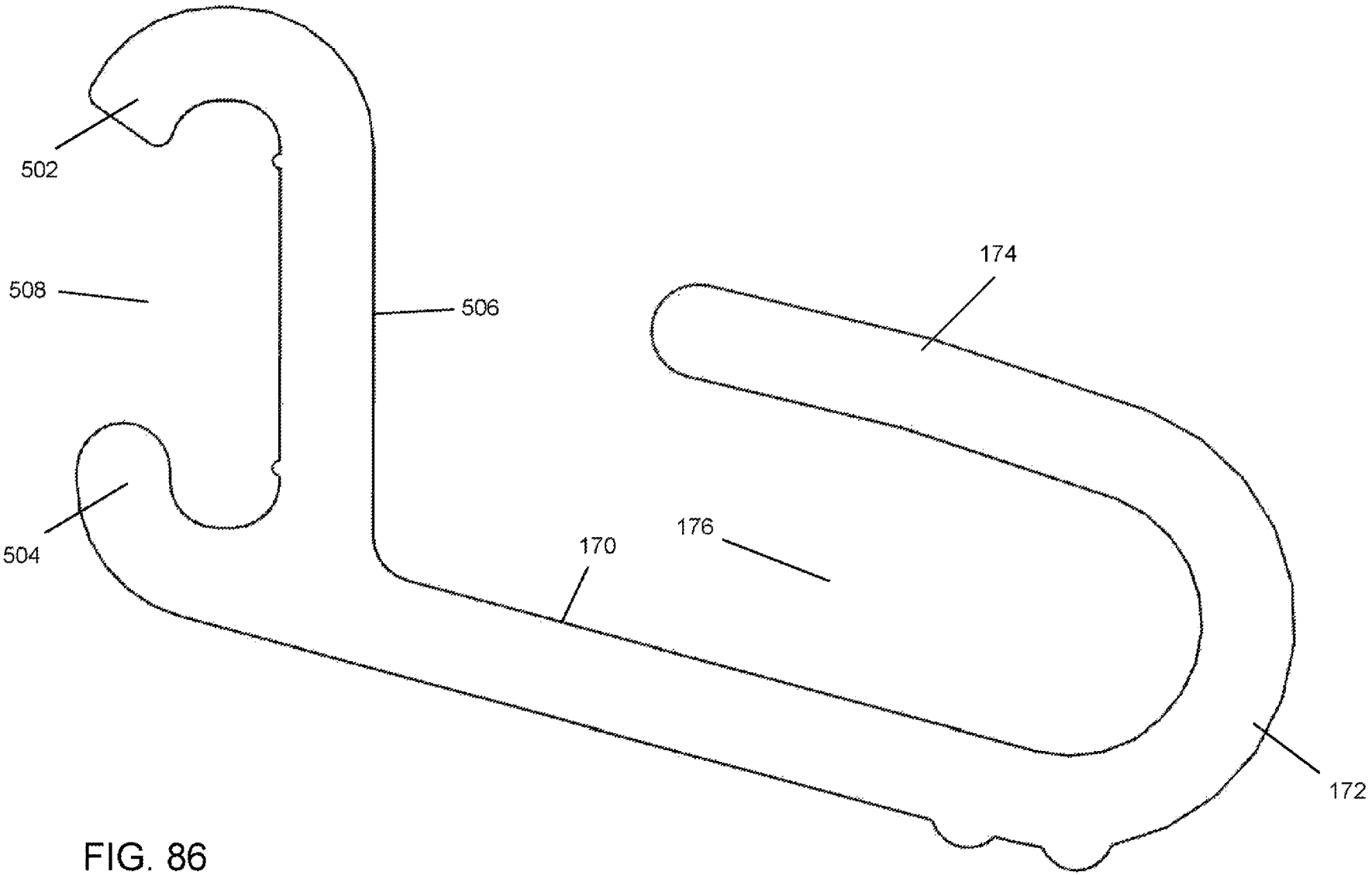
FIG. 86 is a close-up elevation view of the side of the removable clip feature.
Figure 87:
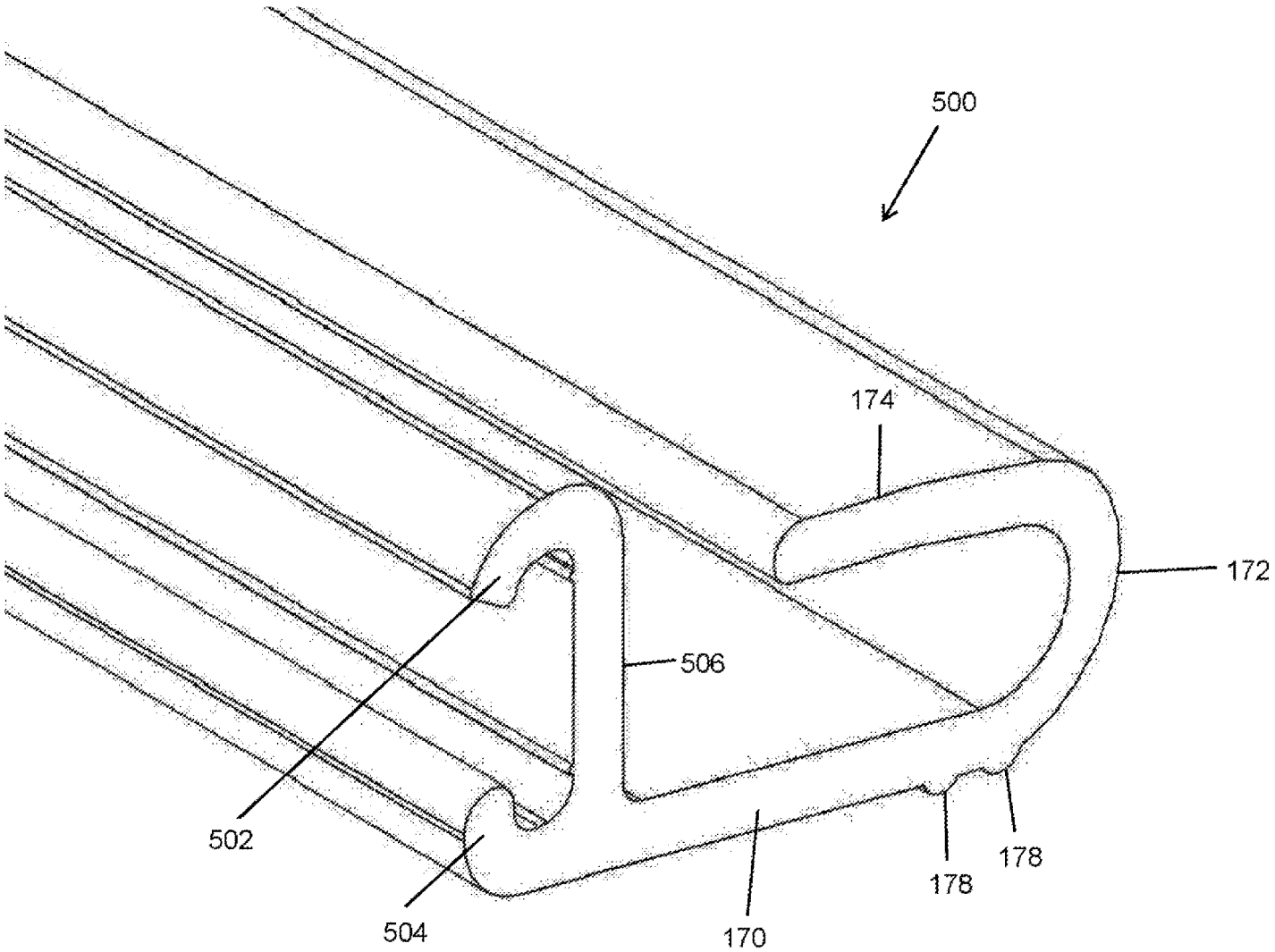
FIG. 87 is a close-up front elevation view of the removable clip feature.
Figure 88:
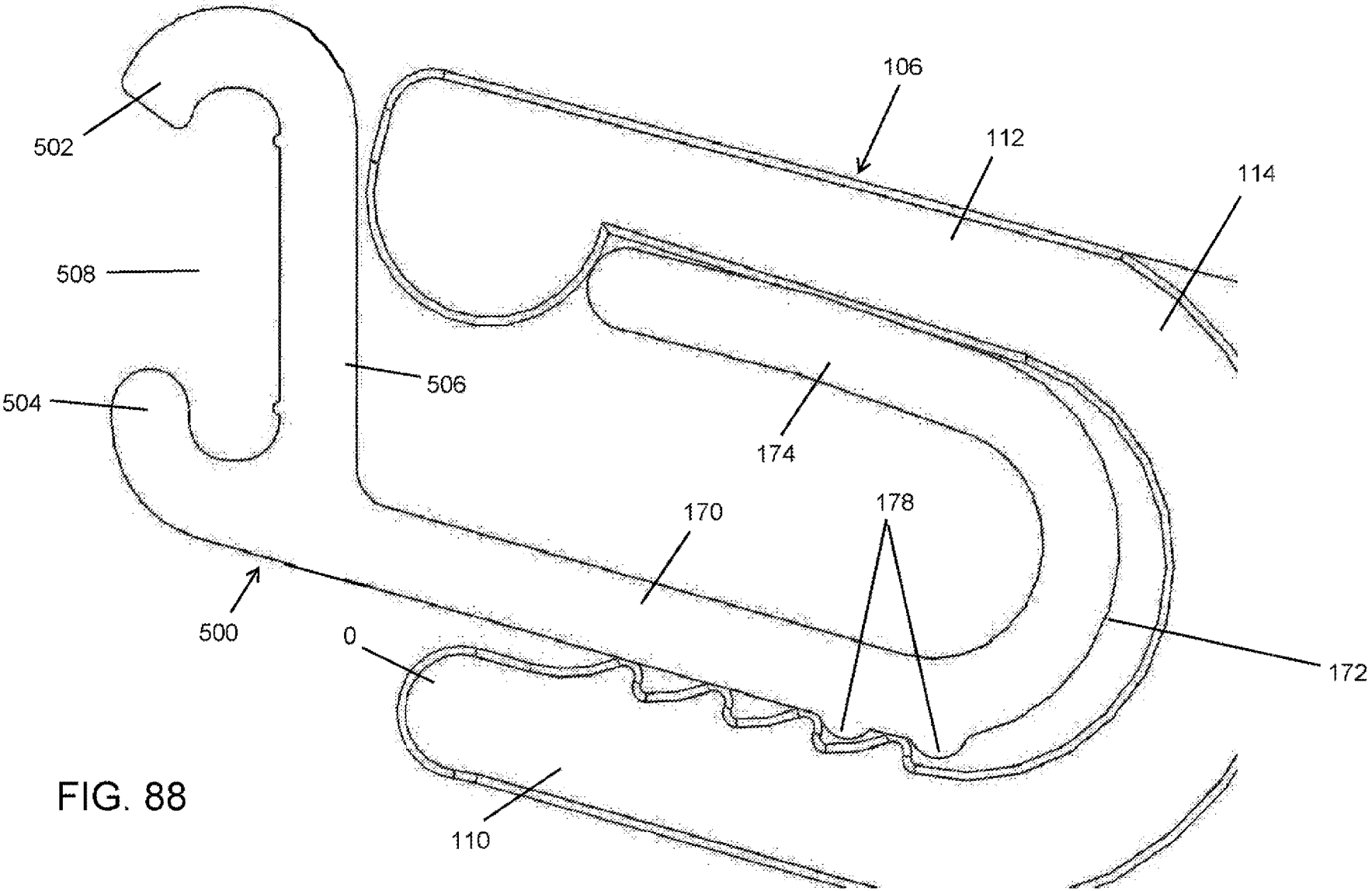
FIG. 88 is a close-up elevation view of the side of the removable clip feature unattached to the valance but inserted within the socket of the adjustable valance clip.
Figure 89:
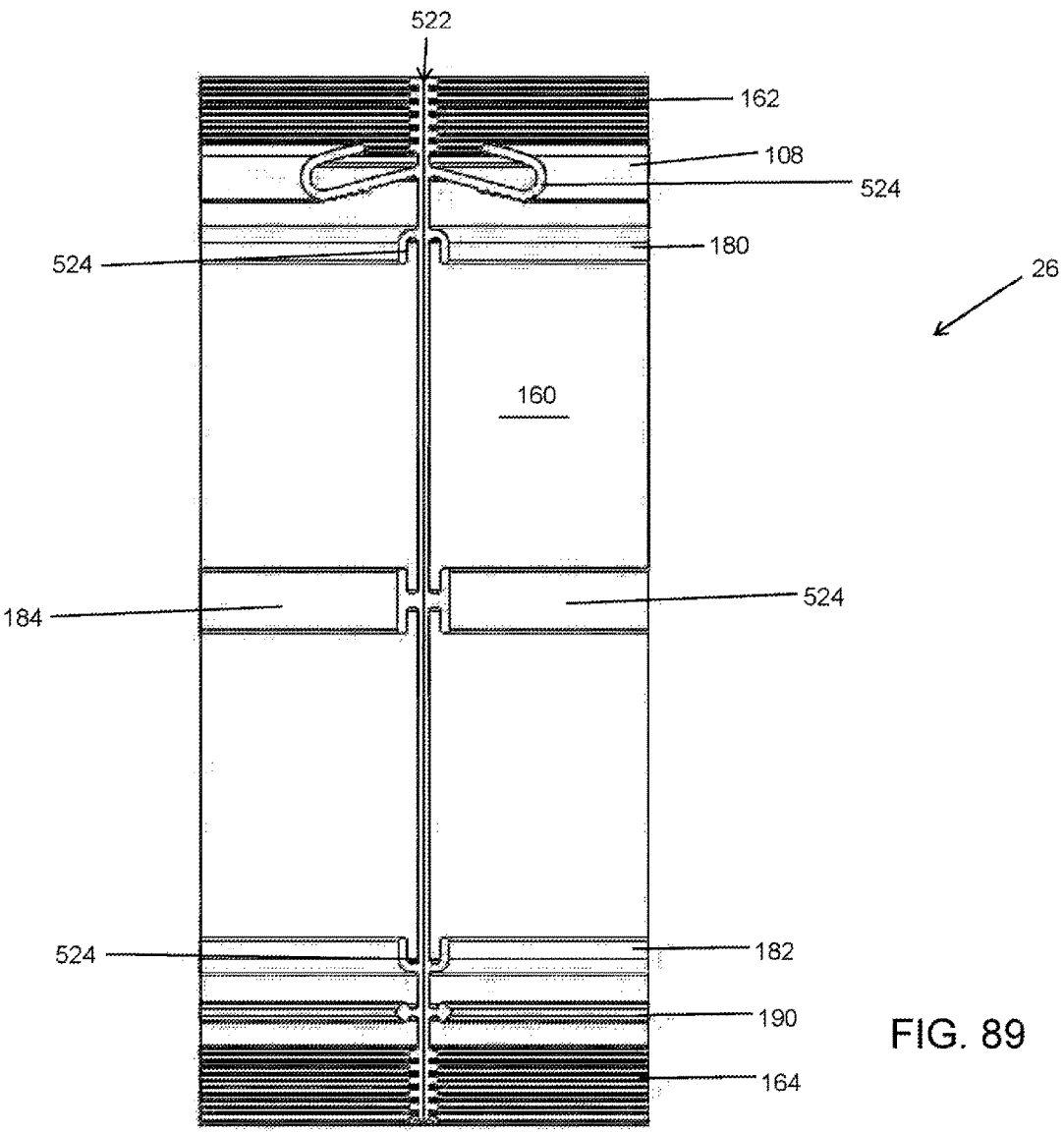
FIG. 89 is an elevation view of the rear side of a valance having a single ninety degree cut therein that forms a corner.
Figure 90:
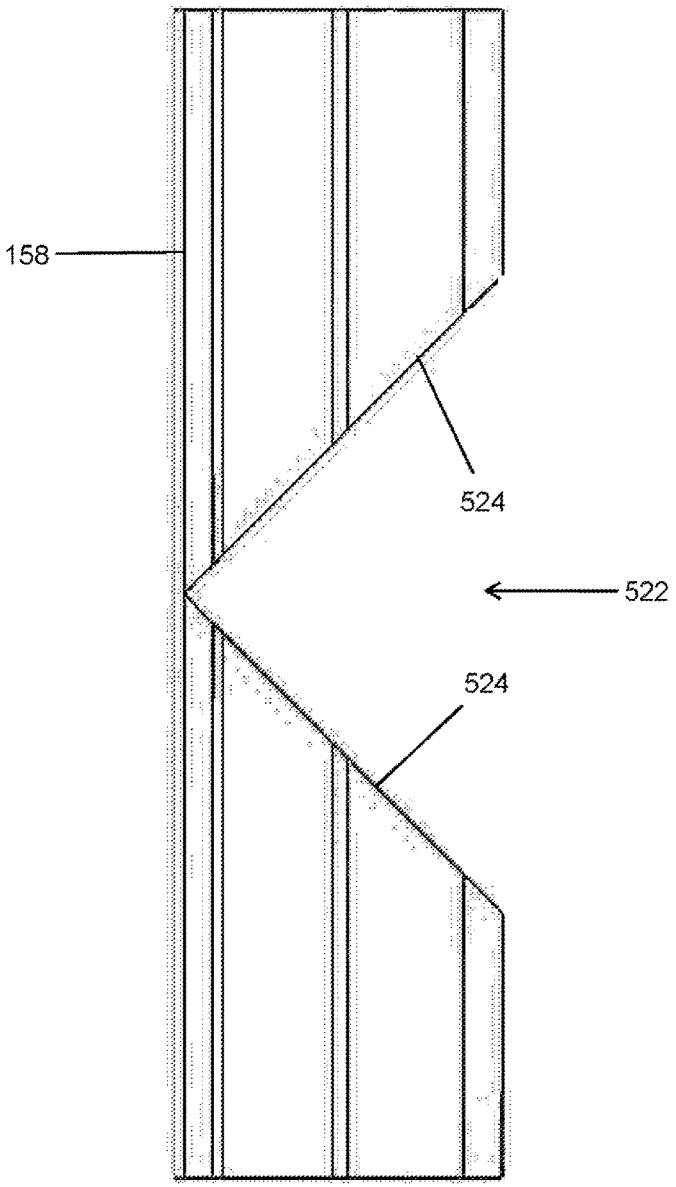
FIG. 90 is an elevation view of the top side of the valance shown in FIG. 89, the view showing the valance in a straight elongated manner prior to bending to form the corner.
Figure 91:
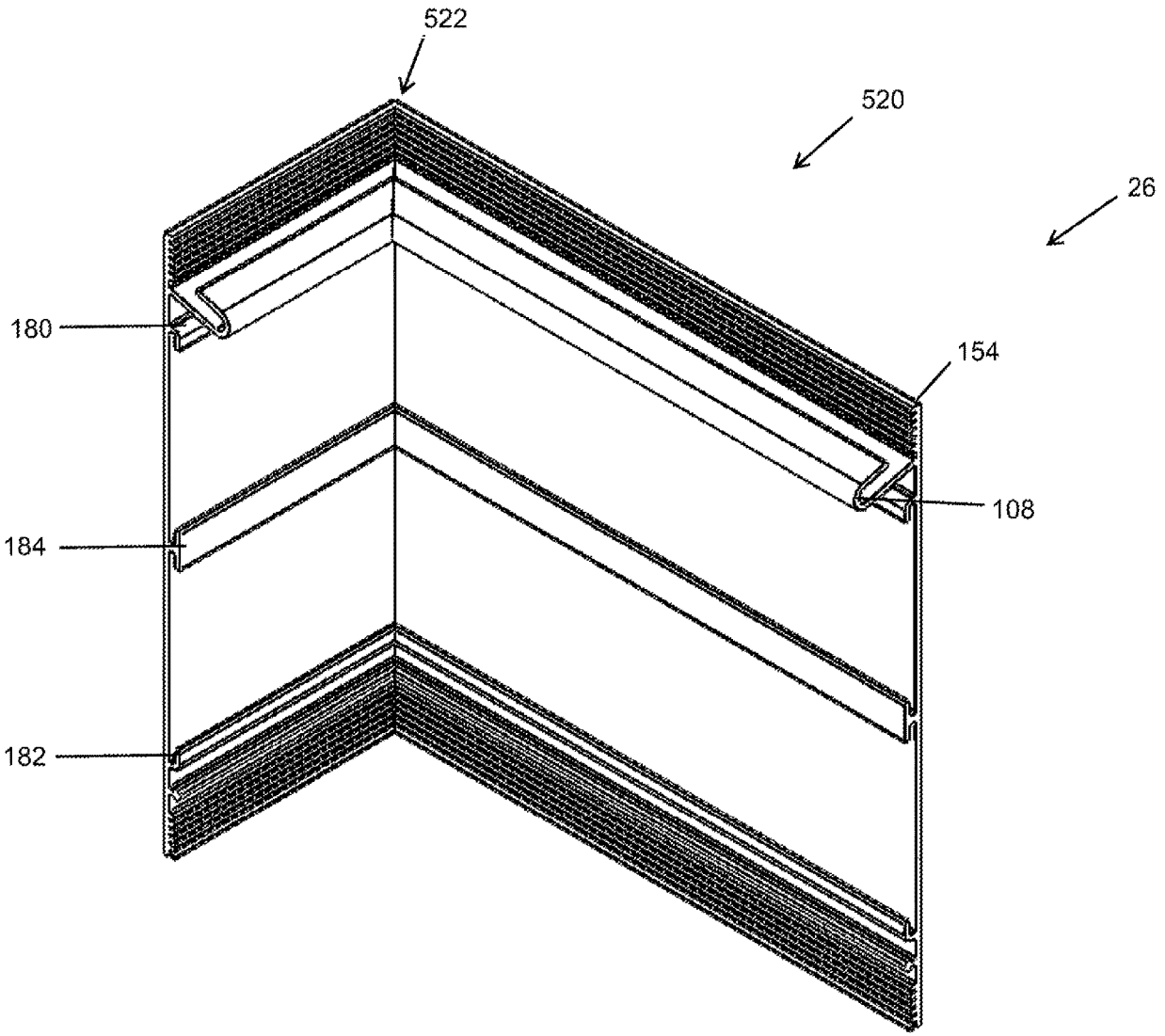
FIG. 91 is a perspective view of the rear side of the valance shown in FIG. 89, the view showing the valance bent to form a corner.
Figure 92:
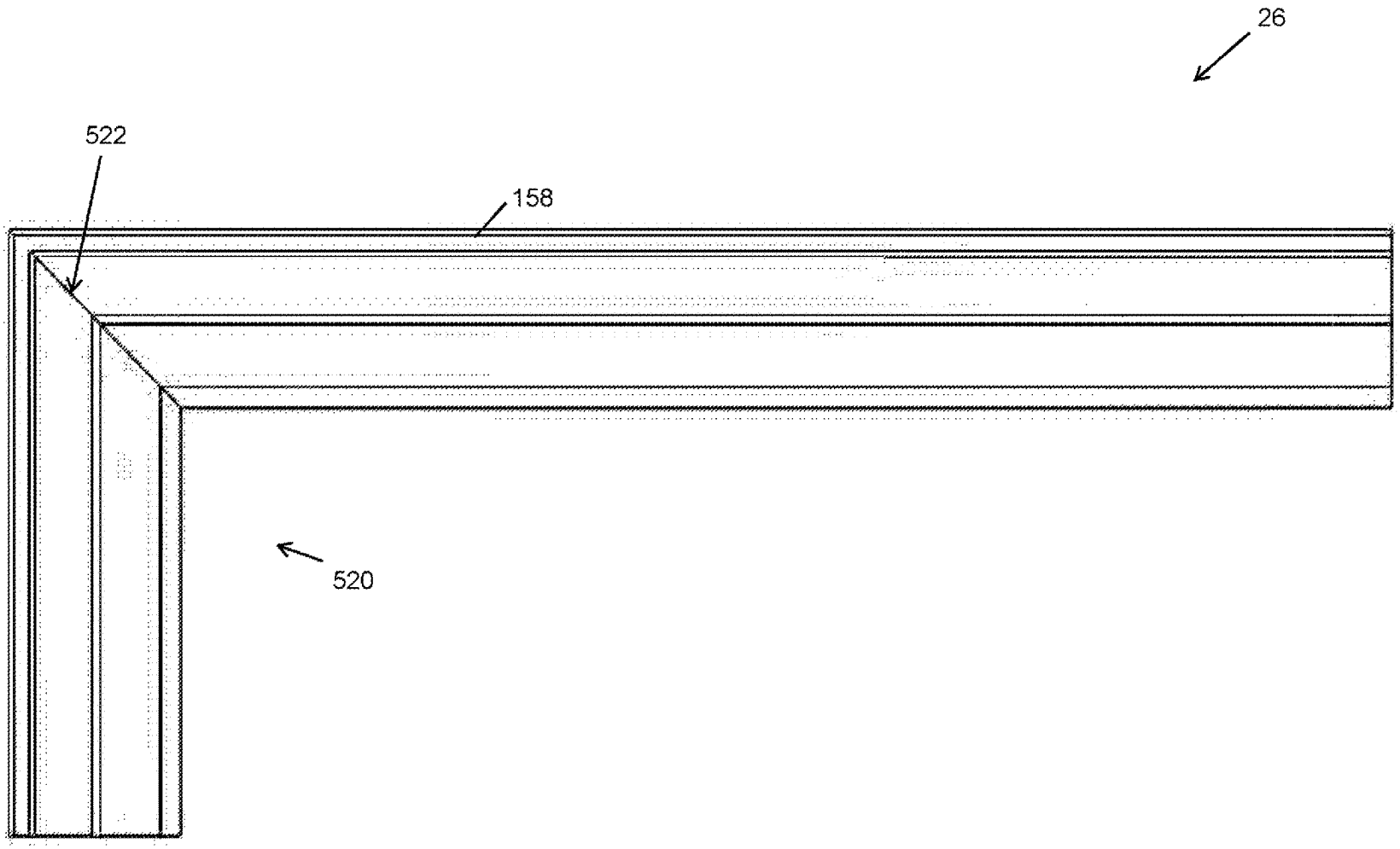
FIG. 92 is an elevation view of the top side of the valance shown in FIG. 89, the view showing the valance bent to form the corner
Figure 93:
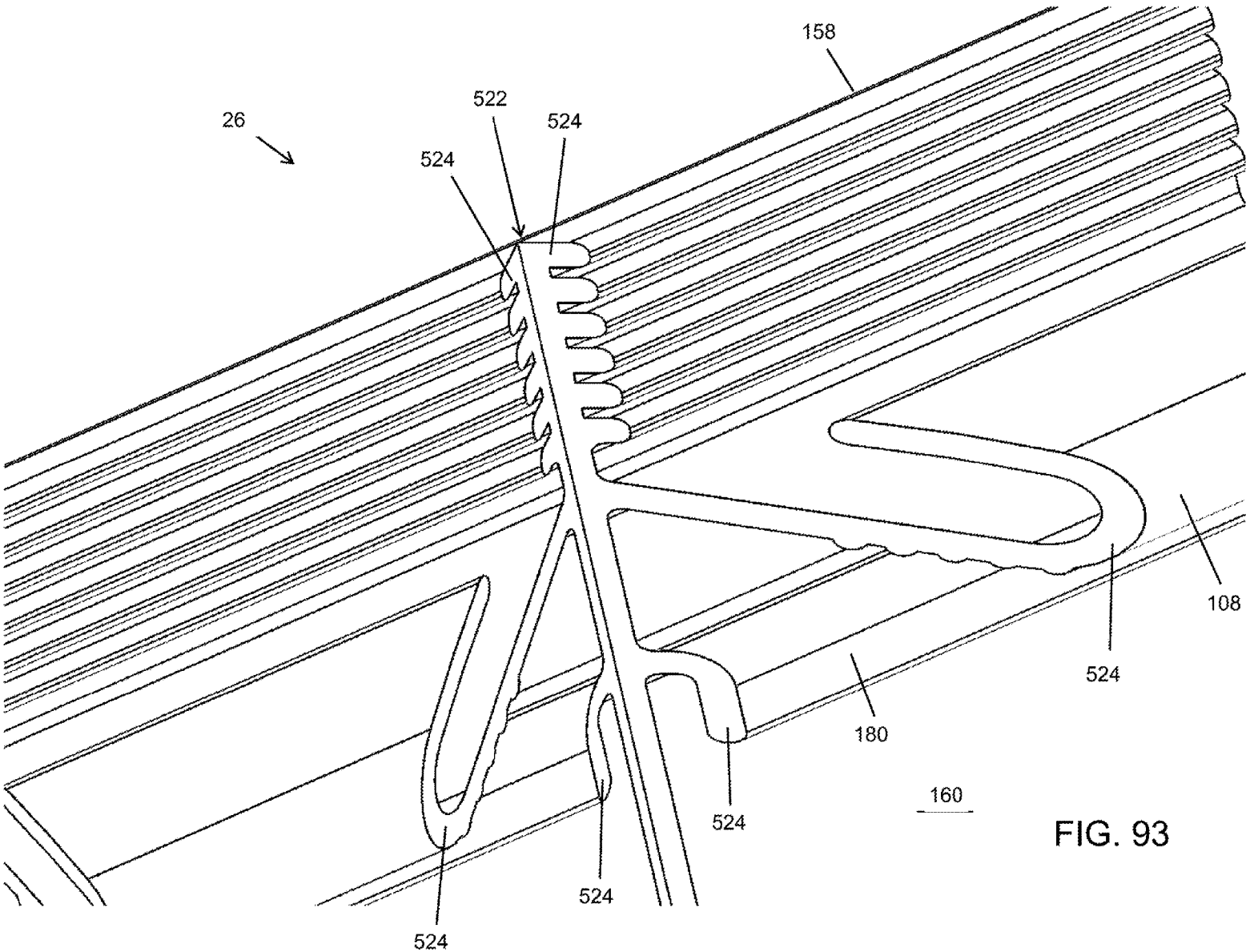
FIG. 93 is a close up perspective view of the rear-top side of the valance, the view showing the cut and the edges formed by the cut in the features in the valance.
Figure 94:
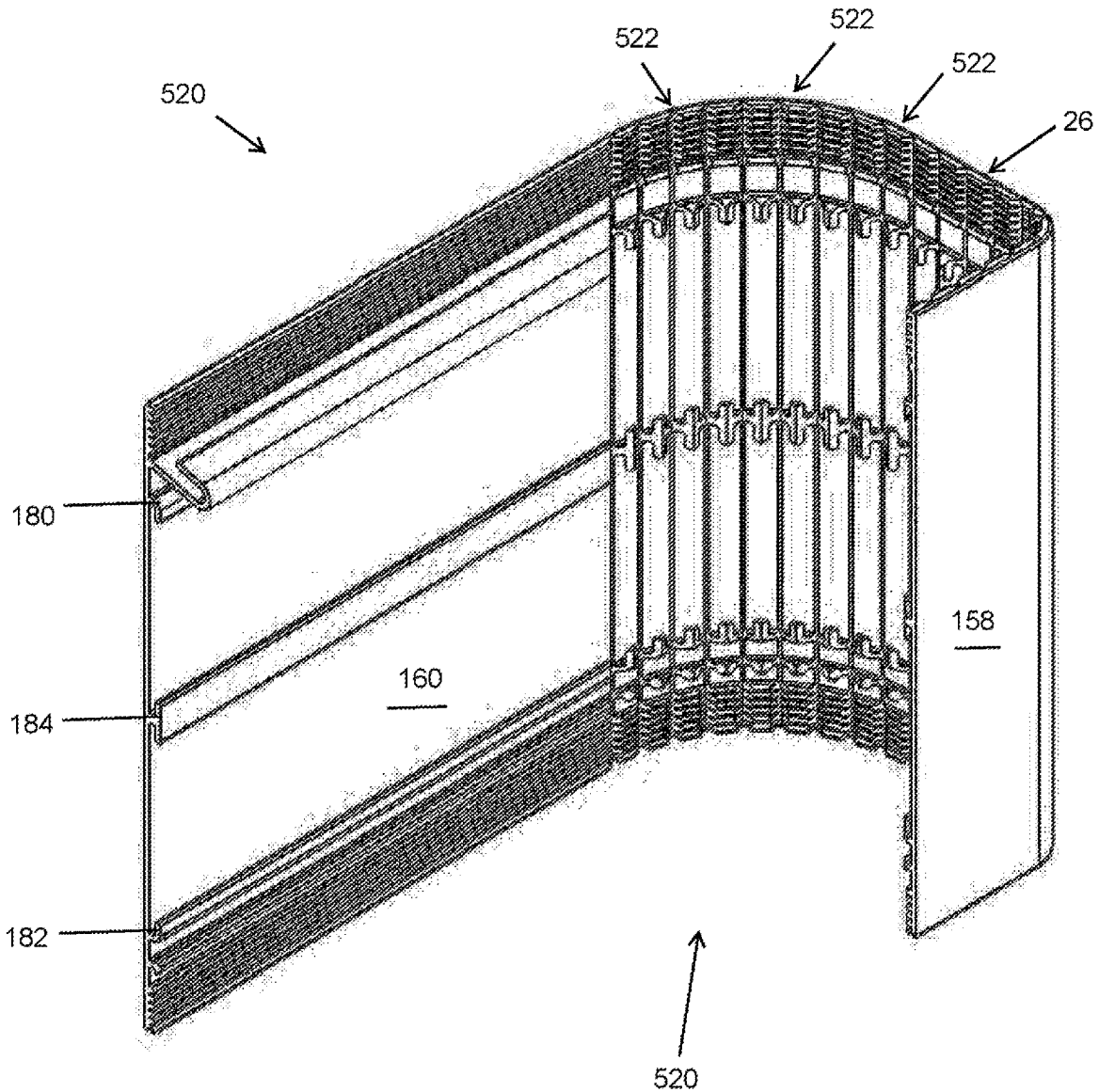
FIG. 94 is a perspective view of the rear-top side of a valance having a plurality of cuts that are bent to form a corner of the valance.
Figure 95:
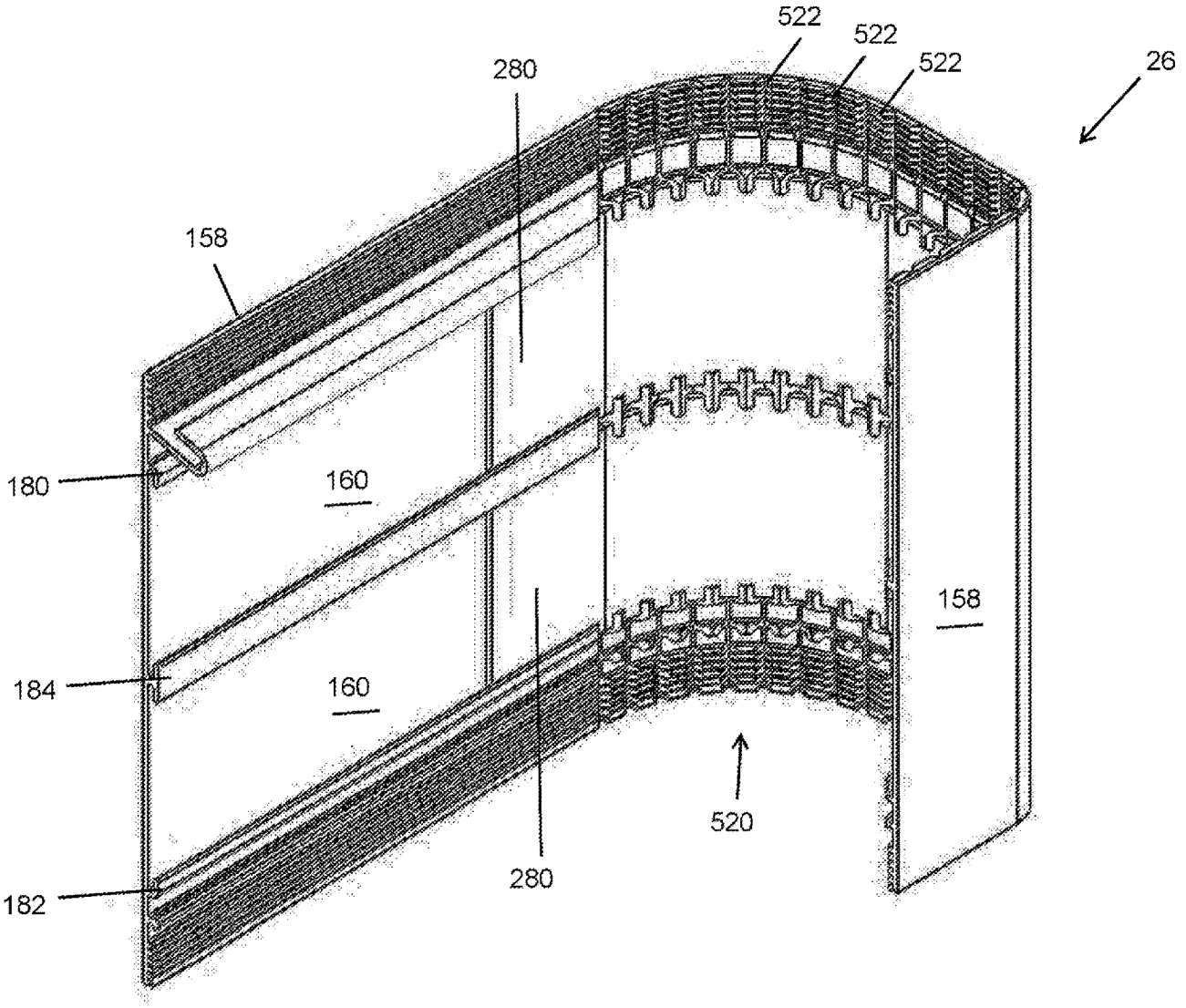
FIG. 95 is a perspective view of the rear-top side of the valance of FIG. 94 with a stiffener added to cover the cuts in the corner that serves to hold the shape of the corner.
Figure 96:
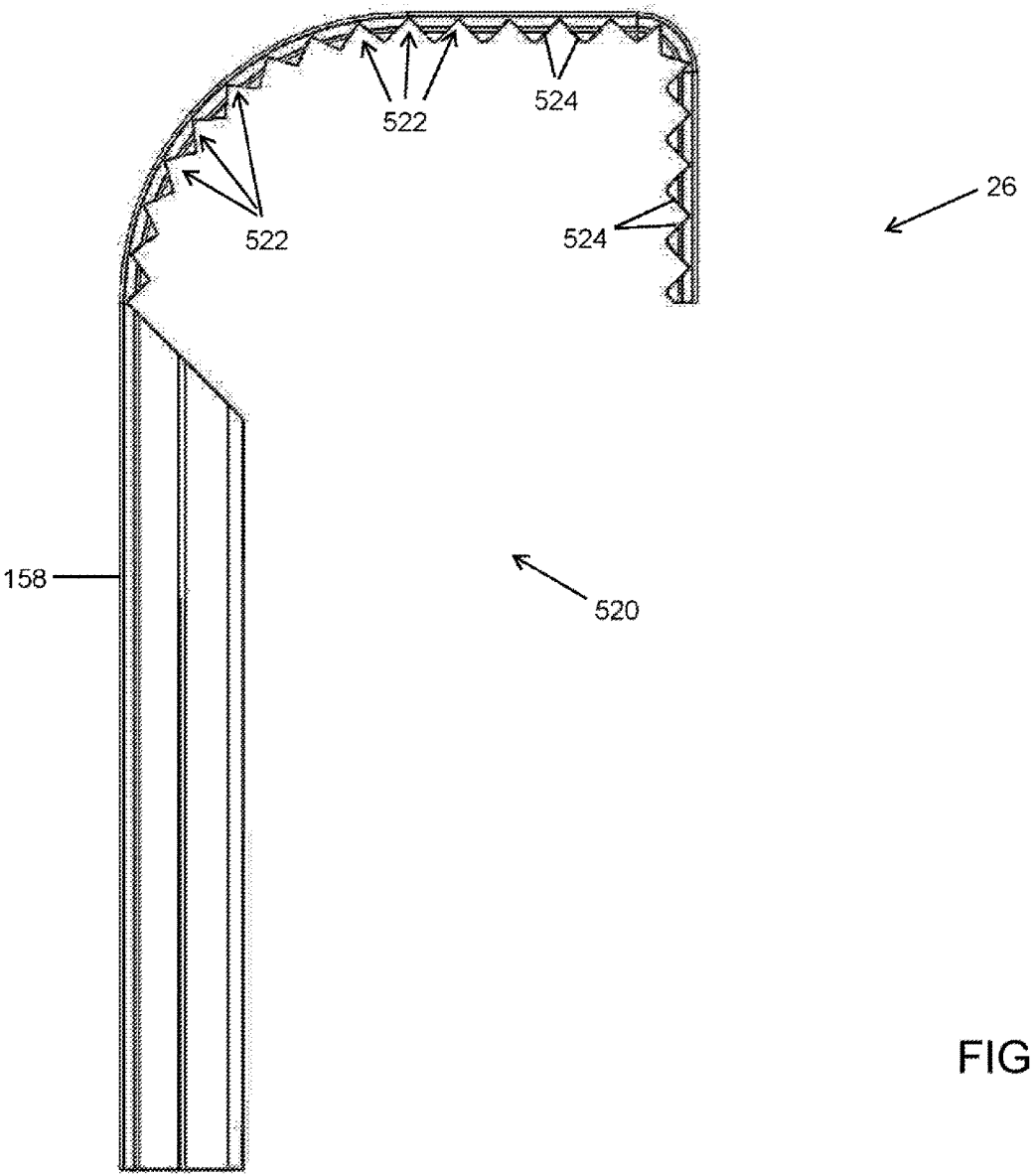
FIG. 96 is an elevation view of the top side of the valance shown in FIG. 94.
Figure 97:
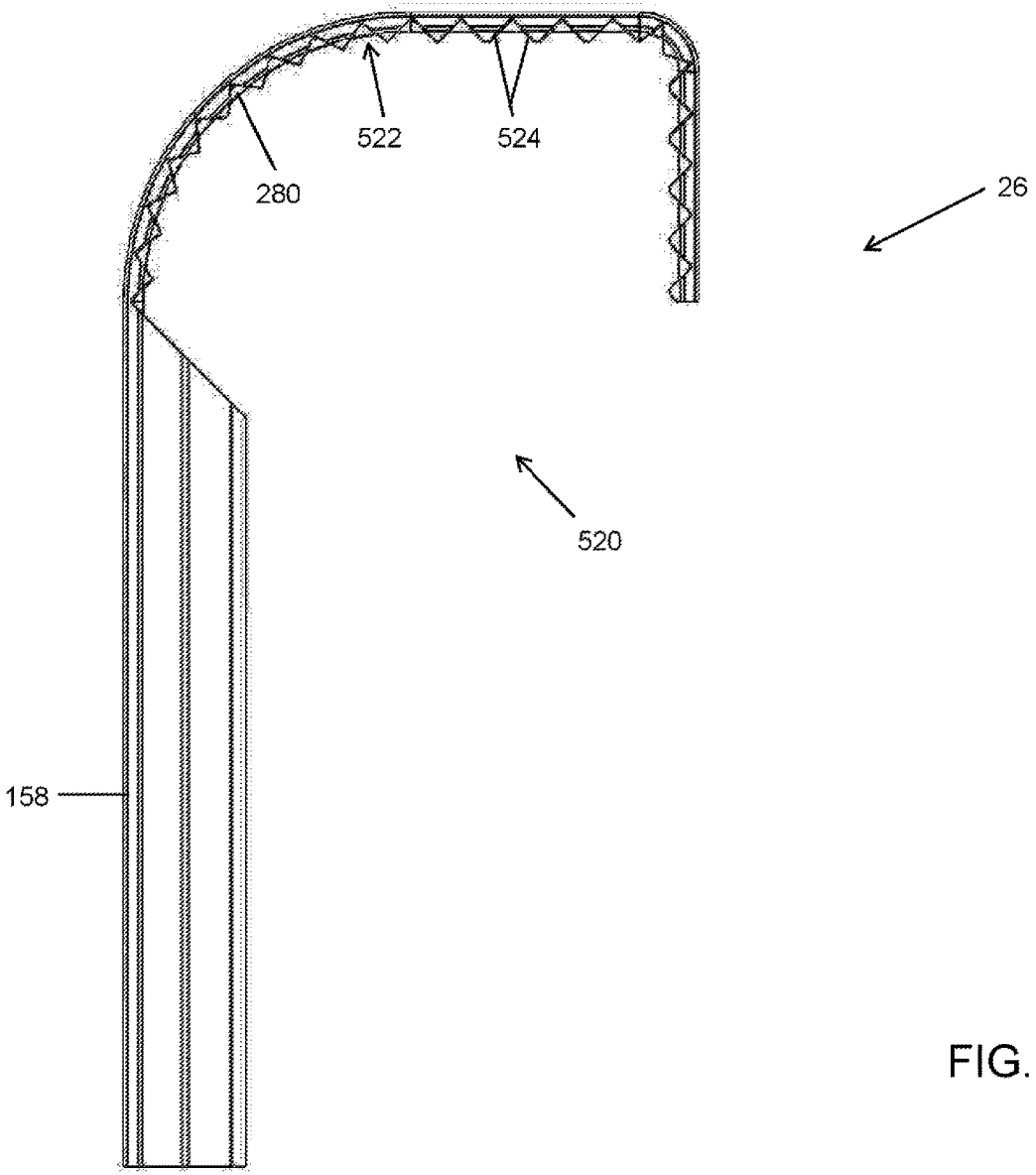
FIG. 97 is an elevation view of the top side of the valance shown in FIG. 95
Figure 98:
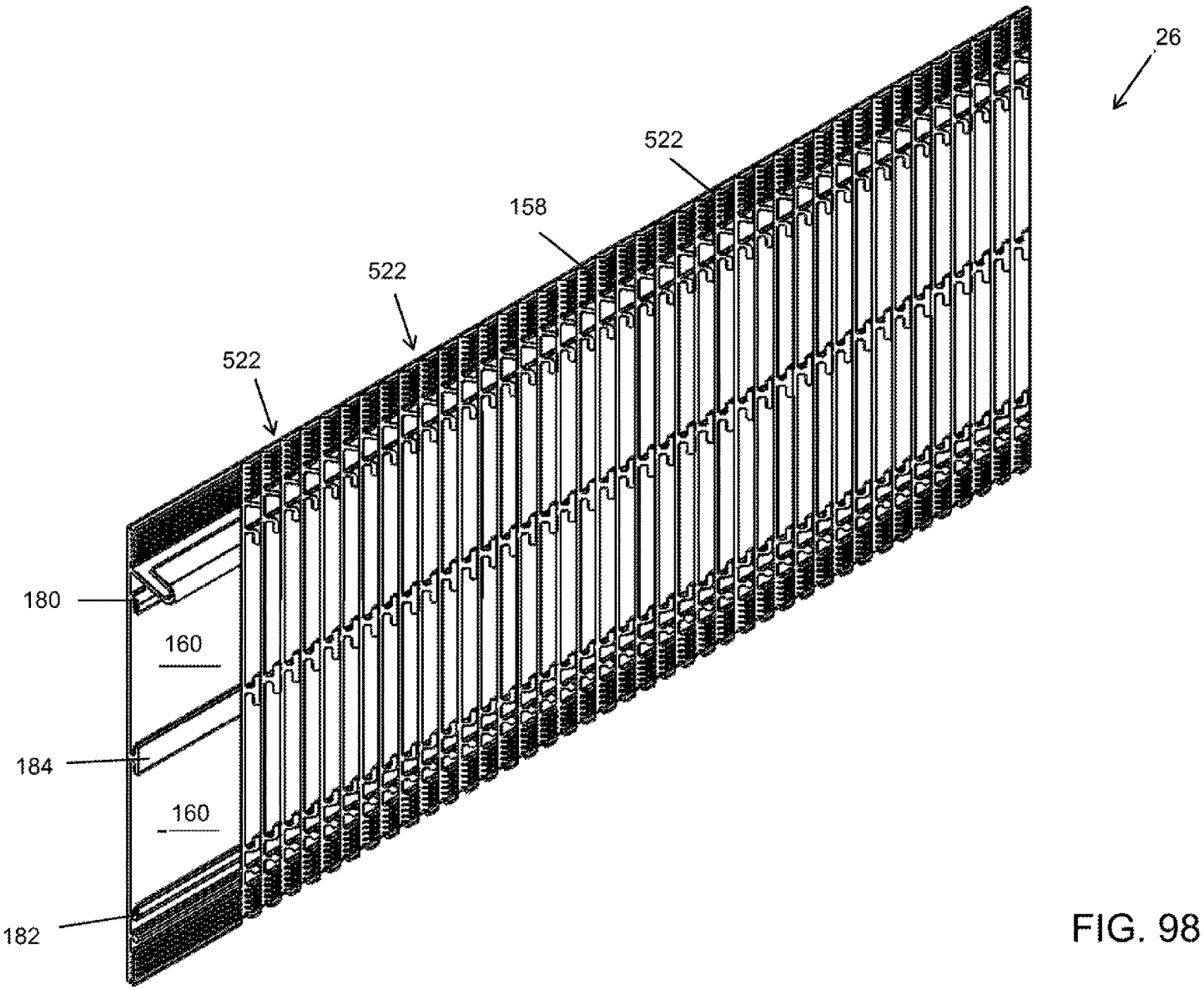
FIG. 98 is a perspective view of the rear-top side of a valance having a plurality of cuts therein that may be formed at the end of the valance to form a corner or at the middle of the valance to form a folding section.
Figure 99:
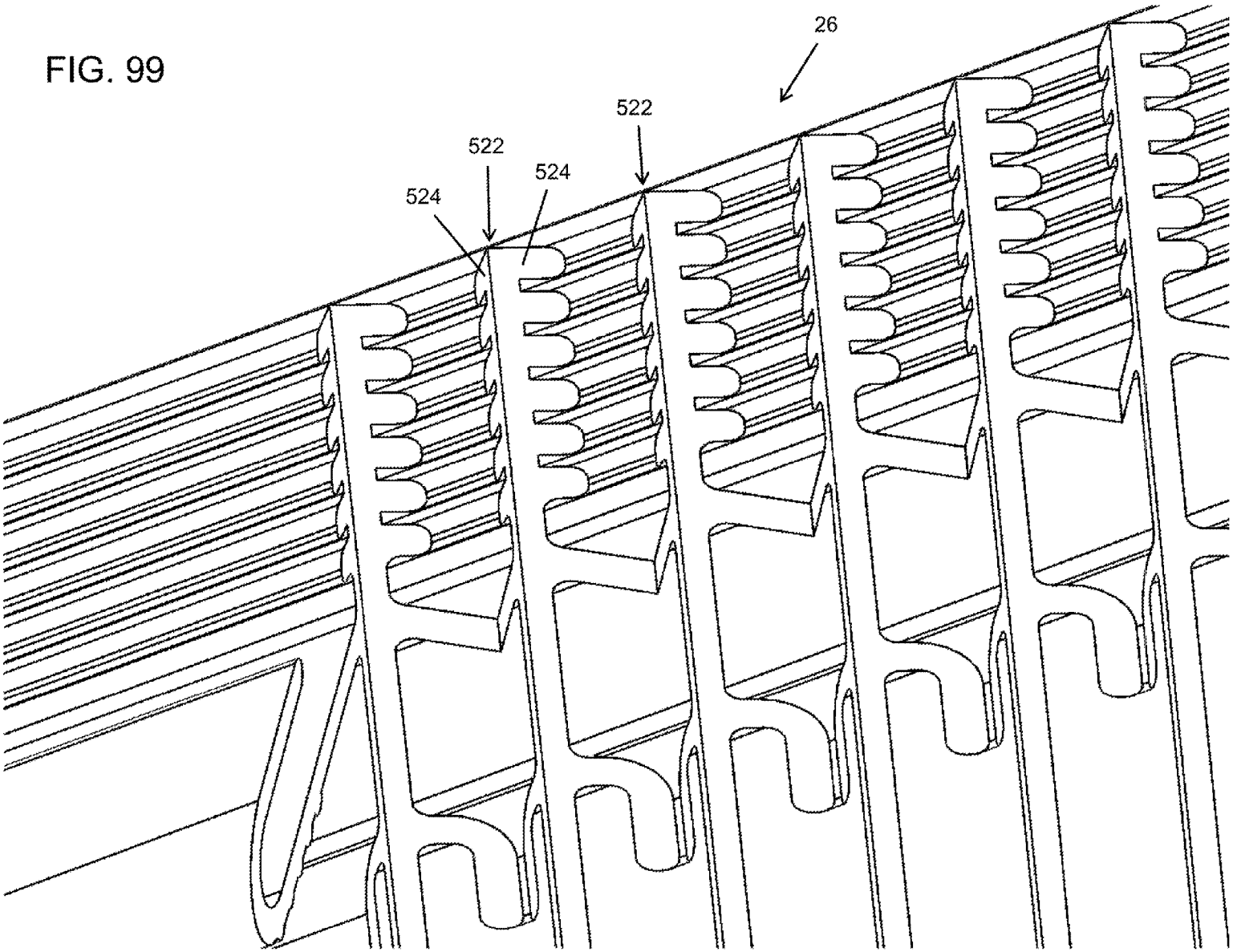
FIG. 99 is a close-up perspective view of the rear-top side of the cuts shown in FIG. 98.
Figure 100:
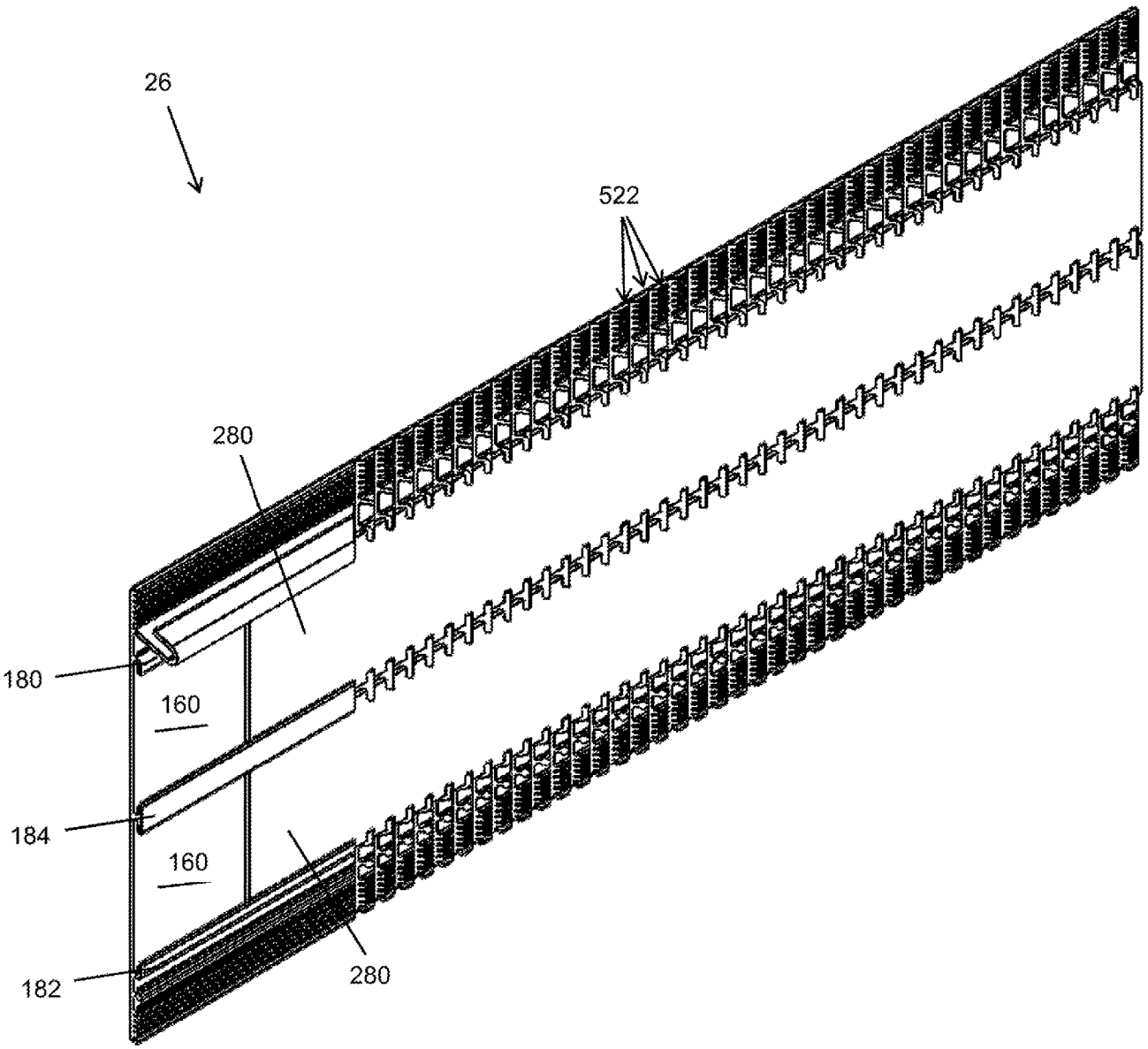
FIG. 100 is a perspective view of the rear-top side of the valance shown in FIG. 98 with the addition of a pair of stiffeners that cover the cuts in the valance.
Figure 101:
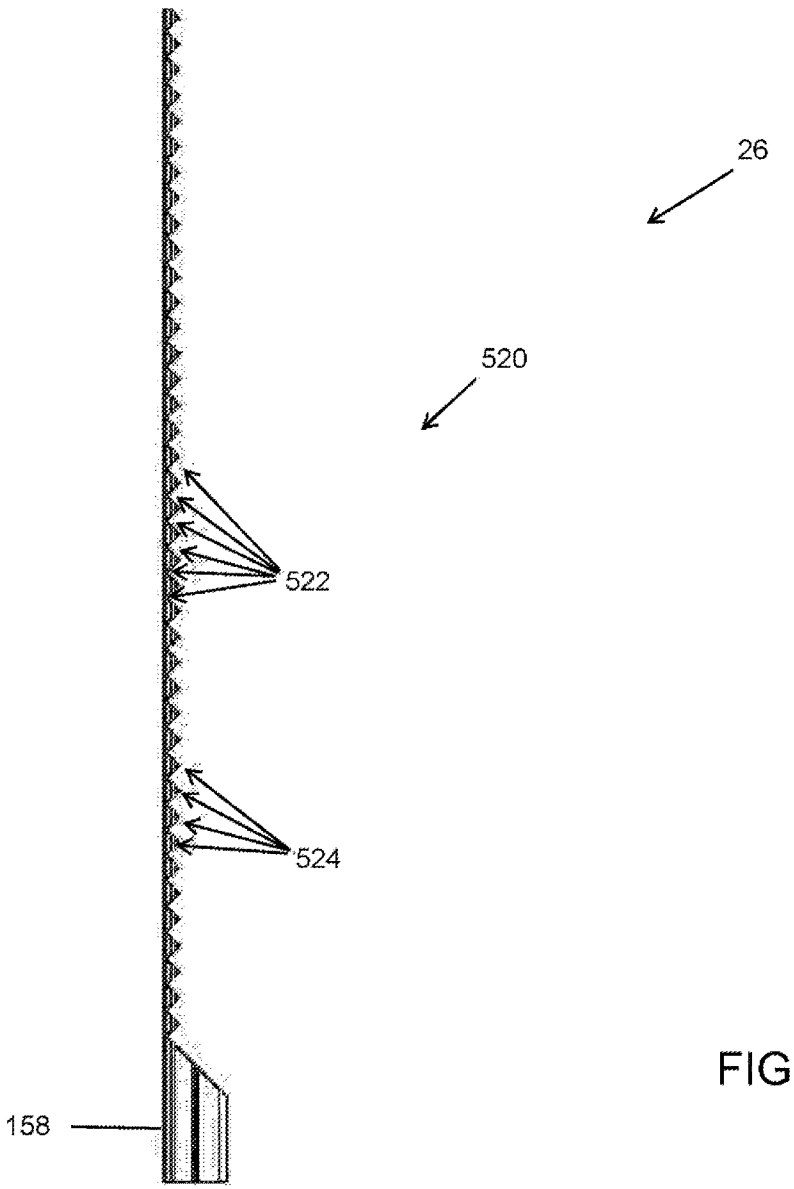
FIG. 101 is an elevation view of the top side of the valance shown in FIG. 98.

With reference to FIG. 70, when valance 26 is installed into socket 106 of adjustable valance clip 400 (which would be the same if it were installed into the socket 106 of bracket 14, 16 or clip 300) clip feature 108, which is covered by a layer of fabric of sock 460, is received within the receiving space 116 between lower wall 110, upper wall 112 and center wall 114. As the clip feature 108 is inserted within the socket 106, the fabric of sock 460, which is already slightly taught or under slight tension around valance 26, is pulled even tighter as the clip feature 108 is installed into the receiving space 116 of socket 106. By pulling sock 460 taught around valance 26, this provides an improved aesthetic appearance as the fabric of sock 460 is tightly stretched, smooth and wrinkle free across the face of valance 26.

As clip feature 108 is inserted into the receiving space 116 of socket 106, the somewhat compressible fabric of sock 460 compresses between socket 106 and clip feature 108. In one arrangement, this compression of the fabric of socket 460 helps to hold valance 26 in socket 106. In one arrangement, the presence of and engagement between friction members 118 of socket 106 and friction members 178 of clip feature 108 further help to secure and hold the engagement between socket 106 and clip feature 108, even when a layer of fabric of sock 406 is present between socket 106 and clip feature 108.

In the arrangement shown, as one example, to help increase the hold between clip feature 108 and socket 106, in one arrangement a feature 468 is placed at the forward end of the upper wall 112 of socket 106. In the arrangement shown, as one example, this feature 468, when viewed from the side, is a rounded protrusion that extends downward and inward into the receiving space 116 of socket 106 at the end of upper wall 112. When socket 106 is fully installed over clip feature 108, feature 468 is configured engage and extend just past the end of flange 174 of clip feature 108. As is seen in FIG. 70, when socket 106 is fully installed over clip feature 108, feature 468 helps to pull the fabric of sock 460 tighter as the fabric must extend around the protrusion of feature 468. As is also seen in FIG. 70, when socket 106 is fully installed over clip feature 108, feature 468 helps to lock socket 106 onto clip feature 108 as feature 468 extends past the flange 174 of clip feature 108 and protrudes downward into the open space of slot 176. In this way, feature 468 increases the friction and grip of socket 106 onto clip feature 108.

In the arrangement shown, as one example, the distance between the lower surface of feature 468 and the upper surface of the lower wall 110 of socket 106 is less than the distance between the lower surface of arm 170 and the upper surface of flange 174. As such, upon installation of socket 106 having feature 468 thereon over clip feature 108, the presence of feature 468 causes clip feature 108 to slightly deform and compress so as to allow installation of socket 106 over clip feature 108. Once feature 468 passes the end of flange 174, feature 468 extends into slot 176 thereby helping to lock socket 106 onto clip feature 108. In this way, the presence or feature 468 provides a more secure connection between socket 106 and clip feature 108.

The teaching presented herein with regard to feature 468 and sock 460 applies equally to whether socket 106 is part of bracket 14, 16, clip 300 and/or adjustable valance clip 400. Also, the teaching presented herein with regard to feature 468 and sock 460 applies equally to whether valance 26 is used alone or in-combination with valance extension 28.

With reference to FIGS. 71-76 an end cap 152 is shown connected to the end of valance 26. In this arrangement, as one example, end cap 152 lacks clip feature 108 in the rearward face 242 of end cap 152. The lack of clip feature 108 in the rearward face 242 of end cap 152 allows for end cap 152 to flex and curve at hinge area 238.

Hinge area 238 may be formed of any design that allows end cap 152 to curve or bend. In one arrangement, hinge area 238 is a living hinge member that allows end cap 152 to take on any desired shape from a sharp and straight ninety-degree curve to a smooth rounded curve. In one arrangement, stiffeners are connected to end cap 152 that help to hold the shape of end cap 152 once it is bent into the desired shape. In one arrangement, stiffeners are malleable metallic members that are connected to end cap 152 between center arm 184 and upper arm 180 and/or between center arm 184 and lower arm 182. In the arrangement shown, as one example, when sock 460 is placed over valance 26 and end cap 152 the outward end of sock 460 is secured to the outward end of end cap 152 (also known as the excess portion 254) by end clip 470.

End clip 470 is formed of any suitable size, shape and design and is configured to secure the end of sock 460 to end cap 152 as well as facilitate attachment of the outward end of end cap 152 to the wall or structure that valance system 10 is connected to. In the arrangement shown, as one example, end clip 470 includes a center wall 472 that connects to a forward wall 474 and a rearward wall 476 that extend continuously between upper and lower ends 478. In the arrangement shown, as one example, forward wall 474 and rearward wall 476 extend in approximate parallel spaced relation to one another and are spaced apart from one another by the distance of the interior surface of center wall 472. In the arrangement shown, as one example, forward wall 474 and rearward wall 476 extend in approximate perpendicular relation to center wall 472. In this way, center wall 472, forward wall 474 and rearward wall 476 form a slot 480 between the interior surfaces of center wall 472, forward wall 474 and rearward wall 476 that extends continuously from upper end 478 to lower end 478 of end clip 470. End clip 470 and more specifically slot 478 is sized and shaped to slide over the outward end of end cap 152 and sock 460 thereby securing the end of sock 460 to the end of end cap 152. End clip 470 also provides a finished and aesthetically pleasing look to the end of end cap 152 with sock 460 there over. End clip 470 also provides a mechanism to connect the end of end cap 152 to the wall or structure that valance system 10 is connected to.

In the arrangement shown, as one example, forward wall 474 of end clip 470 includes a feature 482 that extends into the slot 480 a distance. Feature 482 is formed of any suitable size, shape and design and is configured to secure sock 460 to end cap 152 by causing a pinch point or other point of higher pressure between end clip 470 and end cap 152 thereby securing sock 460 between end cap 152 and end clip 470. In the arrangement shown, as one example, when viewed from an end 478 feature 482 is a generally triangular and pointed member positioned near the outward end of forward wall 474, opposite center wall 472, that extends inward a distance into the slot 480 from the interior surface of forward wall 474. In this way, the interior end of feature 482 causes a pinch point that tightly secures end clip 470 to end cap 152 while securing sock 460 between end cap 152 and end clip 470. While a single feature 482 is shown extending into slot 480, any number of features 482 are hereby contemplated for use such as none, one, two, three, four, five, six, seven, eight, nine, ten or more. Also, while a single feature 482 is shown protruding into slot 480 from forward wall 474, it is hereby contemplated that one or more features 482 may extend into slot 480 from forward wall 474, rearward wall 476 or from any other portion of end clip 470.

In the arrangement shown, as one example, when sock 460 is installed over valance 26 and end cap 152, the end of sock 460 is cut about flush with the outward end of end cap 152. Next, the end clip 470 is installed over the end of end clip 152 over sock 460 by sliding the end of end cap 152 and sock 460 into the slot 480 of end clip 470. In doing so, the feature 482, which extends into the slot 480 pinches the material of sock 460 tight between end clip 470 and end cap 152 thereby securing the position of sock 460 with respect to end cap 152 and valance 26. In one arrangement, a pin, clip, lock screw or other locking device may be used that clips and/or extends through clip feature 470, sock 460 and/or end cap 152.

In the arrangement shown, to help facilitate connection of the outward end of valance 26 and end cap 152 and sock 460 to the wall or structure that valance system 10 is connected to, the rearward side of rearward wall 476 includes a recess 484 that is sized and shaped to receive and align and hold a connection member 486. Connection member 486 may be any device or system that helps to secure the outward end of valance 26 and/or end cap 152 to the wall or structure that valance system 10 is connected to and may include a piece of double sided tape that adheres to the wall of structure, a piece of double sided foam tape that adheres to the wall of structure, an adhesive gel strip that adheres to the wall of structure, a strip of hook-and-loop fastener (e.g. Velcro) that connects an opposing strip of hook-and-loop fastener connected to the wall or structure, or any other form of a connection member.

In operation, in the arrangement shown, to assemble and install the system shown in FIGS. 67-79 the user selects the type of material they want for sock 460. Next, the user installs sock 460 over valance 26 and end caps 152 which should be relatively tight fitting while also being easy to install over valance 26 and end caps 152. The user bends end caps 152 to their desired position, which is held once bent by the stiffeners received in the rearward side of the end caps 152. The user trims the length of sock 460 to end at the outward end of the end caps 152. Next, the user slides end clips 470 over the outward ends of end caps 152 which are covered by sock 460. By doing so, the end clips 470 tightly secure the sock 460 in place over the end of end caps 152. The user also installs the connection member 486 in the recess 484 in the rearward side of end clips 470.

Next, the user inserts the clip feature 108 that is covered by the material of sock 460 into the socket 106 of bracket 14, 16, clip 300 and/or adjustable valance clip 400. Upon insertion, the socket 106 pulls the material of sock 460 even tighter over the valance 26 and/or end caps 152. Upon full insertion of the clip feature 108 into socket 106, feature 468 passes the end of flange 174 thereby locking socket 106 tightly onto clip feature 108.

Next, the ends of end caps 152 are secured to the wall or structure by connecting the connection members 486 held within the recess 484 of end clips 470 to the surface of the wall or structure that valance system 10 is connected to. In this way, valance system 10 is quickly and easily installed without tools while providing a visually pleasing aesthetic appearance.

To remove valance 26 from the socket 106 of bracket 14, 16, clip 300 and/or adjustable valance clip 400, the connection members 486 that hold the ends of end caps 152 to the wall or structure that valance system 10 is connected to are removed (e.g. in the case of Velcro or another hook-and-loop fastener system one side of the Velcro or hook-and-loop fastener system is pulled apart from the other side of the Velcro or hook-and-loop fastener). Next, the clip feature 108 is pulled out of the socket 106 of bracket 14, 16, clip 300 and/or adjustable valance clip 400 by peeling one end of the clip feature 108 out of socket 106. This peeling focuses the forces at a narrow portion of the connection between socket 106 and clip feature 108 thereby allowing for easy separation. This peeling continues from one end of the valance 26 to the other. Once the clip feature 108 is fully removed from socket 106, the end clips 470 may be slid off of the end caps 152 and the sock 460 may be slid off of valance 26 and end caps 152 thereby fully disassembling valance 26.

Removable Clip Feature:

In an alternative arrangement, with reference to FIGS. 80-88 an alternative arrangement of valance system 10 is presented that includes a removable clip feature 500. Removable clip feature 500 is formed of any suitable size, shape and design and is configured to be attached to and removed from valance 26 so as to facilitate quick and easy attachment and detachment of valance 26 to and from socket 106 of a bracket 14, 16 in the same or similar ways valance 26 with an integrated clip feature 108 is attached to and removed from socket 106 of a bracket 14, 16 as is described herein.

In the arrangement shown, as one example, removable clip feature 500 includes a forward end having an upper arm 502 and an opposed lower arm 504 that are connected by a center wall 506 that extends between upper arm 502 and lower arm 504. A hollow interior 508 is positioned between the lower end of upper arm 502, the upper end of lower arm 504 and the forward surface of center wall 506.

In the arrangement shown, as one example, an arm 170 extends rearward from the intersection of the lower arm 504 and the center wall 506. Arm 170 extends rearward and forms rounded nose 172 and flange 174 similar to if not identical to the clip feature 108 described herein.

In the arrangement shown, as one example, removable clip feature 500 is configured to fit over a feature 510 in rearward face 160 of the valance 26. Feature 510 may be formed of any suitable size, shape and design and is configured to facilitate attachment of the removable clip feature 500 to the valance 26 as well as facilitate removal of the adjustable clip feature 500 from the valance 26. In the arrangement shown, as one example, feature 510 is formed of a protrusion that extends rearward from the rearward face 160 of valance 26 and includes an opposing upper arm 512 that extends upward and a lower arm 514 that extends downward.

In the arrangement shown, as one example, removable clip feature 500 may be installed at any position along valance 26 by either sliding the forward end of clip feature 500 over an end of the feature 510 or by snapping the forward end of clip feature 500 over feature 510. In either arrangement, once installed, the feature 510 is frictionally held with close and tight tolerances within the hollow interior 508 of removable clip feature 500 such that the upper arm 512 of feature 510 is held behind the upper arm 502 of removable clip feature 500, and the lower arm 514 of feature 510 is held behind the lower arm 504 of removable clip feature 500.

In the arrangement shown, as one example, removable clip feature 500 may be removed from the feature 500 of valance 26 by lifting upward on the rearward end of removable clip feature 500 which causes lower arm 504 to rotate out of the space between lower arm 514 and the rearward face 160 of valance 26 thereby freeing removable clip feature 500 from valance 26.

This arrangement, wherein removable clip feature 500 is installed onto valance 26 provides several advantages. One advantage is that the removable clip feature 500 may be installed at any position along the length of valance 26. Another substantial advantage is this arrangement allows for a removable clip feature 500 that is formed of plastic to be installed onto a valance 26. This allows the material properties of the plastic removable clip 500 to be harnessed for insertion and removal from socket 106, while providing the aesthetics of the aluminum valance 26. Also, by not having to extrude the clip feature 108 along the entire length of the valance 26, this saves material costs and eases the manufacturing process. In addition, this arrangement of adding a removable clip feature 500 to the rearward face 160 of valance 26 allows for use of many commercially available fascia configurations on the market today and facilitates attachment and use of these standard fascia configurations t in a manner never before possible.

Valance Corner:

In an alternative arrangement, with reference to FIGS. 89-93 an alternative arrangement of valance system 10 is presented that facilitates the formation of a corner 520 of valance 26. Corner 520 is formed of any suitable size, shape and design and is configured to facilitate the closure of the end of valance 26 in an aesthetically pleasing manner that is also quick, efficient and easy to implement.

In the arrangement shown, as one example, corner 520 is formed in valance 26 by placing a cut 522 in the rearward side 160 of valance 26. This cut 522 serves to remove all of the features of the rearward side 160 of valance 26 so as to allow valance 26 to be bent or folded at cut 522. In the arrangement shown, cut 522 is a ninety-degree cut in the rearward side 160 of valance 26 that removes all of the features in the rearward side 160 of valance 26 including: upper staple area 162, upper arm 180, center arm 184, lower arm 182, alignment feature 190, and lower staple feature 164. In the arrangement shown, as one example, cut 522 cuts into the material of valance 26 between the rearward face 160 and the forward face 158. In the arrangement shown, as one example, the tip or point or apex of cut 522 terminates just inward of the forward face 158. That is, in the arrangement shown, as one example, the cut 522 does not cut through the forward face 158 of valance 26, but instead leaves the forward face 158 completely intact so that the valance 26 maintains a unified, singular piece with some of its original rigidity. With that said, cut 522 forms a weak point in valance 26 by removing the structural features on the rearward side 160 of valance 26 as well as by leaving only a thin layer of material at the point of cut 522. The point or cut 522 facilitates a natural fold line for folding the valance 26 rearward at cut 522 to form corner 520.

In the arrangement shown, as one example, cut 522 forms edges 524 on each side of the cut 522, as well as on each side of the features in the rearward side 160 of valance. Corner 520 is formed when valance 26 is bent at the fold line formed by cut 522 until the opposing edges 524 engage one another. At this point a clip or other holding member may be placed over the adjoined features on each side of cut 522 so as to hold the corner 520 in place. However, in some arrangements, such as when using a metallic fascia 26, a clip or other holding member may not be necessary as once the fascia 26 is bent at cut 522 it will hold its shape.

In the arrangement shown, as one example, the v-cut 502 is formed of a 90-degree angle when viewed from above or below. This arrangement provides a crisp and clean and finished look at the ends of valance 26 and as such it is desirable. However, any other angle, as desired, is hereby contemplated for use from one degree to one hundred and eighty degrees and anywhere in-between, with each angle providing a different appearance at the end of valance. In addition, multiple cuts 522 are hereby contemplated for use such as two thirty degree cuts that form a two-fold-line corner 520, or three twenty two and a half degree cuts that form a three-fold-line corner 520. Any other angle or combination of angles are hereby contemplated as is any number of cuts 522 to form any configuration of a corner 500 at the end of fascia 26 that closes the end of the system 10.

Malleable Corner & Stiffener:

In an alternative arrangement, with reference to FIGS. 94-101 an alternative arrangement of corner 520 is presented. In this arrangement, corner 520 includes a plurality of cuts 522 in the rearward side 160 of valance 26. These cuts 520 are positioned laterally close to one another. The result is a section at the end of valance 26 that is relatively flexible and can be molded into practically any shape, from a clean ninety degree corner to a smooth curved corner, or any other shape.

In the arrangement shown, as one example, as the support features have been removed from the rearward side 160 of valance 26, the end of valance 26 easily flexes and moves. In the arrangement shown, as one example, to help corner 520 hold its shape a stiffener 280 is added.

In the arrangement shown, as one example, a user may desire valance 26 be bent or configured to facilitate common shapes such as a curve, an angle, or any other shape. In one arrangement, as is shown, valance 26 is a malleable valance 26. Malleable valance 26, as discussed herein, is a living member that is capable of taking on any desired shape from a sharp and straight ninety-degree corner, to any other angle, or to a smooth rounded curve. Subsequently, due to the flexibility of malleable valance 26, a user may desire a stiffener 280 to help malleable valance 26 maintain its shape long after installation.

To aid malleable valance 26 in maintaining a desired shape, or likewise to eliminate any angles or curvature of malleable valance 26, a stiffener 280 is added. Stiffener 280 is any object or device that can be added to malleable valance 26 that helps malleable valance 26 take or maintain a desired shape, which may be flat, angled, curved, or the like.

In one arrangement, as is shown, stiffener 280 is a generally elongated piece of metal, wood, plastic, composite or other generally stiff or rigid material, or alternatively a flexible material or a generally flexible material. As one example, a flexible aluminum material of requisite thickness has been used with success. In one arrangement, as is shown, stiffener 280 is generally rectangular in shape when viewed from the front or rear and is generally planar in shape. In the arrangement shown, stiffener 280, is generally sized and shaped to fit within and slide within the slots formed by center arm 184 and upper arm 180 and/or center arm 184 and lower arm 182, such that the stiffener 280 can be slid into malleable valance 26 adjacent corner 520 and covering the area where cuts 522 have been made. The addition of stiffener 280 adds strength to valance 26 as well as helps corner 520 of valance 26 hold its shape.

In the arrangement shown, as one example, valance 26 is curved at the corner 520. This semi-circular or curved shape is formed by bending the corner 520 thereby causing the cuts 522 to flex as well as causing stiffener 280, which itself is malleable, to flex however due to the material properties of stiffener 280 the stiffener 280 holds the shape it is bent into.

In an alternative arrangement, stiffener 280 is not slid into the slot of malleable valance 26, but instead may be installed by any other manner or means onto the malleable valance 26 such as gluing, welding, adhering, stapling, taping, or the like.

In an alternative arrangement, a plurality of cuts 522 are positioned at other portions of valance 26, such as at its middle, so as to facilitate bending of valance 26 for shipping purposes. In this arrangement, once valance 26 is taken out of its shipping container, valance 26 is bent back to a straight arrangement. Once this is accomplished, stiffeners 280 are slid over the cuts 522 thereby holding the previously bent portion of valance 26 into a straight configuration. In this way, a unique and easy to use configuration is provided that eases shipping.

Figure 102:
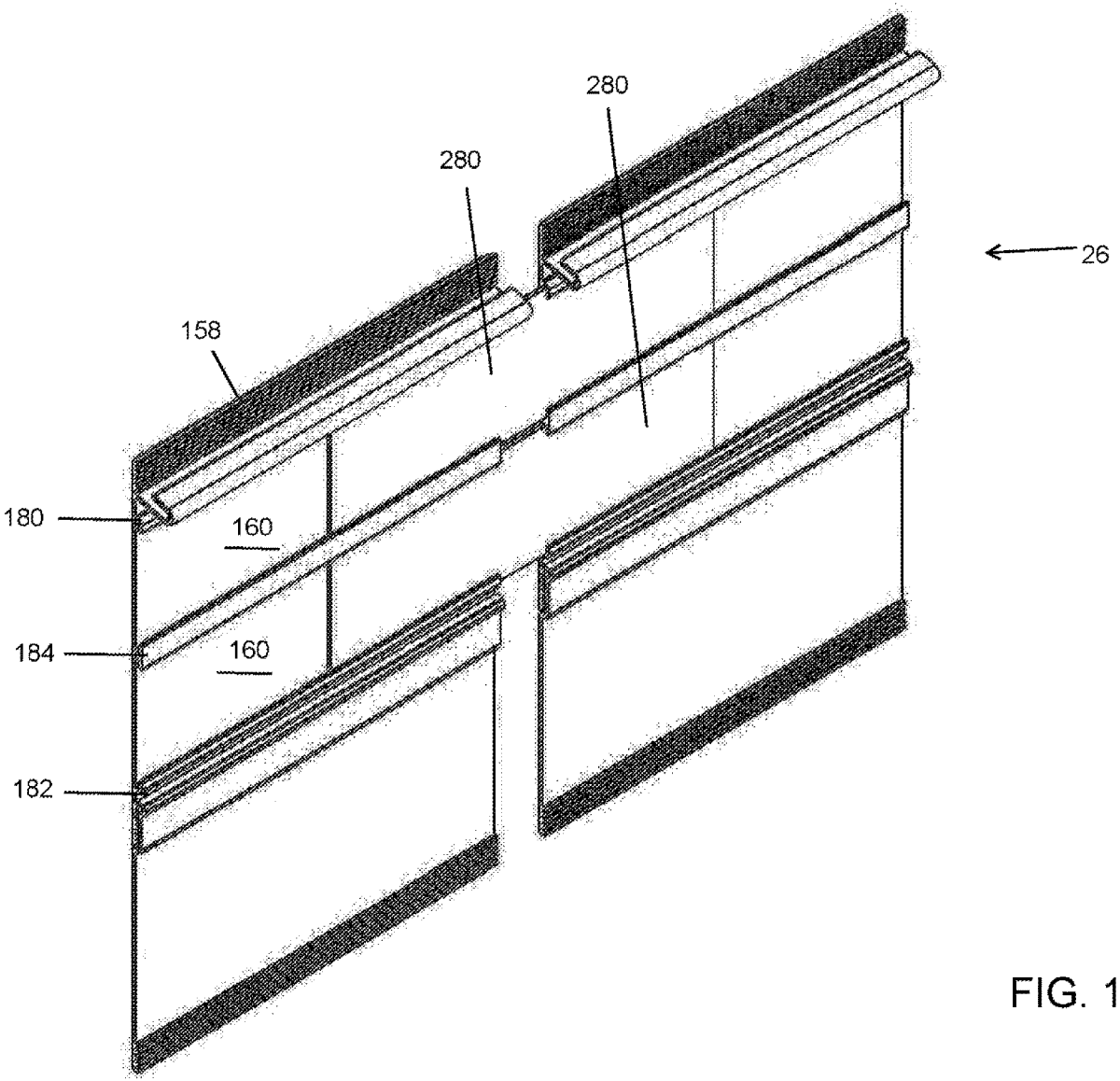
FIG. 102 is a perspective view of the rear-top side of adjacent valances that are positioned in end-to-end alignment with a pair of stiffeners covering the seam between the two valances, the view showing the two valances slightly separated.
Figure 103:
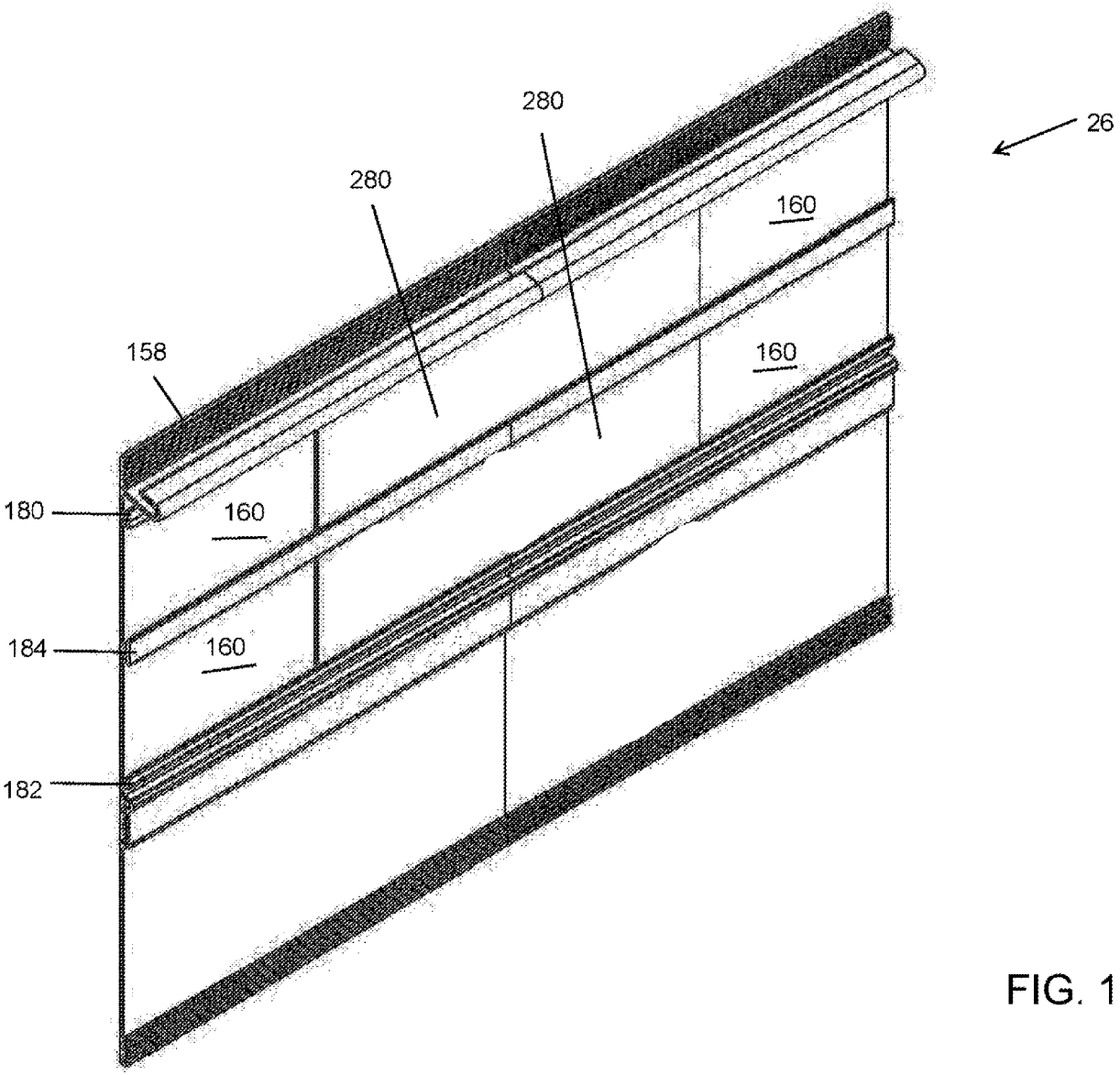
FIG. 103 is a perspective view of the rear-top side of the valance shown in FIG. 102, the view showing the valances engaged with one another as opposed to separated.

Center Seam & Stiffener:

In the arrangement shown, as one example, with reference to FIGS. 102-103 a center seam is presented in valance 26 that is bridged by the application of stiffeners 280. In this arrangement, two separate valances 26 are connected to one another in flush end-to-end alignment. To provide additional strength to this seam, as well as to ensure proper alignment of the adjacent valances 26, stiffeners 280 are inserted into the opposing valances 26. In this arrangement, stiffener 280 may be configured to maintain its shape so as to ensure proper alignment of valances 26.

From the above discussion and the accompanying drawings and claims it will be appreciated that the improved valance system for window coverings presented offers many advantages over the prior art. That is, the system presented: improves upon the state of the art; has a pleasing aesthetic appearance; is easy to install; is easy to remove; is easy to cover; is easy to ship; can be folded for shipping; can be shipped in the same shipping box as a broken down track system; does not require a shipping box that is longer than a broken down track system; can be installed quickly; can be replaced quickly; is easy to cover with material; is formed of a minimum number of parts; is relatively inexpensive; has a long useful life; is easily customized; can be easily cut to size; can be used in most applications; is standardized; allows for customized end caps; uses a minimum amount of material; is lightweight; is durable; has a long useful life; can be easily extended; utilizes and end cap that can be configured in a number of ways, among countless other improvements and advantages.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

What is claimed is:

1. A valance system, comprising:
an adjustable valance clip;
the adjustable valance clip having:
a forward section;
the forward section extending from a forward end to a rearward end;
a rear section;
the rear section extending from a forward end to a rearward end
the forward section and rear section connected to one another by a joint;
an adjustment member operably connected to the forward section and the rear section;
a socket adjacent the forward end of the forward section;
wherein the joint is positioned adjacent the forward end of the rear section and adjacent the rearward end of the forward section;
wherein the joint forms a pivot point of rotation for the forward section relative to the rear section,
wherein the adjustment member is positioned between the joint and the socket;
a valance;
the valance having a clip feature
wherein the valance is attached to the adjustable valance clip by inserting the clip feature of the valance into the socket of the adjustable valance clip;
wherein the angle of the valance is adjustable by adjusting the forward section relative to the rear section.

2. The system of claim 1, wherein the adjustable valance clip is connected to a drapery track.

3. The system of claim 1, wherein the adjustment member includes a screw having a head and a threaded shaft.

4. The system of claim 1, wherein the adjustment member includes a screw having a head and a threaded shaft, wherein the screw extends vertically through at least a portion of the forward section and the rearward section.

5. The system of claim 1, wherein the adjustment member includes a screw and a spring.

6. The system of claim 1, wherein the adjustment member includes a screw having a head and a threaded shaft, wherein the threaded shaft extends through one of the forward section and the rearward section and into the other of the forward section and the rearward section.

7. The system of claim 1, wherein the adjustment member includes a spring positioned between the forward section and the rear section.

8. The system of claim 1, wherein the joint includes an axle that is received in a socket thereby facilitating angular adjustment of the forward section relative to the rear section.

9. The system of claim 1, wherein the forward section and the rear section angularly adjust with respect to one another.

10. A valance system, comprising:
an adjustable valance clip;
the adjustable valance clip having:
a forward section;
the forward section extending from a forward end to a rearward end;
a rear section;
the rear section extending from a forward end to a rearward end;
the forward section and rear section connected to one another by a joint;
wherein the joint facilitates angular adjustment of the forward section relative to the rear section;
an adjustment member operably connected to the forward section and the rear section;
a socket connected to the forward end of the forward section;
wherein the adjustment member is offset from the joint;
wherein the joint is positioned adjacent the forward end of the rear section and adjacent the rearward end of the forward section;
wherein the joint forms a pivot point of rotation for the forward section relative to the rear section;
wherein the adjustment member is positioned between the joint and the socket;
a valance;
the valance having a clip feature;
wherein the valance is attached to the adjustable valance clip by inserting the clip feature of the valance into the socket of the adjustable valance clip;
wherein the angle of the valance is adjustable by adjusting the forward section relative to the rear section.

11. A valance system, comprising:
an adjustable valance clip;
the adjustable valance clip extending from a rearward end to a forward end;
the adjustable valance clip having a socket positioned adjacent the forward end;
the adjustable valance clip having an adjustment member that is configured to facilitate angular adjustment of the socket about a pivot point;
wherein the adjustment member is offset from the pivot point;
wherein the adjustment member is positioned between the pivot point and the socket;
a valance;
the valance having a clip feature extending outward from a rearward side of the valance;
wherein the clip feature is sized and shaped to frictionally fit within the socket of the adjustable valance clip;
wherein the valance is installed onto the adjustable valance clip by pressing the clip feature of the valance into the socket of the adjustable valance clip; and
wherein the angle of the valance is adjusted by adjusting the forward end relative to the rearward end.

12. The system of claim 11, wherein the valance is removed from the socket of the adjustable valance clip by pulling the clip feature of the valance out of the socket of the adjustable valance clip.

13. The system of claim 11, wherein the valance is formed of a single continuous uninterrupted piece.

14. The system of claim 11, wherein the clip feature includes at least one friction member, and the socket includes at least one friction member, wherein when the clip feature is inserted within the socket, the at least one friction member of the clip feature engages the at least one friction member of the socket.

15. The system of claim 11, wherein the clip feature is C-shaped or U-shaped when viewed from the side.

16. The system of claim 11, wherein the adjustment member includes a screw having a head and a threaded shaft.

17. The system of claim 11, wherein the adjustment member includes a screw having a head and a threaded shaft, wherein the screw extends vertically through at least a portion of the forward section and the rearward section.

18. A valance system, comprising:

a valance clip;

the valance clip extending from a rearward end to a forward end;

the valance clip having a socket positioned adjacent the forward end;

the valance clip having an adjustment member configured to facilitate adjustment of the forward end relative the rearward end about a pivot point;

wherein the adjustment member is positioned between the pivot point and the socket;

a valance;

the valance extending a length between opposing ends;

the valance having a forward side and a rearward side;

the valance having a clip feature extending outward from the rearward side of the valance;

wherein the clip feature is sized and shaped to frictionally fit within the socket of the valance clip;

a sock;

the sock extending a length between opposing ends and having a hollow interior;

an end cap connected to opposing ends of the valance;

wherein the sock is installed over the valance and end caps;

wherein the valance is installed onto the adjustable valance clip by pressing the clip feature of the valance into the socket of the adjustable valance clip; and wherein the angle of the valance is adjusted by adjusting the forward relative to the rearward end.

19. The system of claim 18, further comprising end clips connected over the ends of the sock and end caps.

20. The system of claim 18, wherein the valance clip includes an adjustment member that is configured to facilitate angular adjustment of the socket.

* * * * *